US006308018B1

(12) United States Patent
Yoshida et al.

(10) Patent No.: US 6,308,018 B1
(45) Date of Patent: Oct. 23, 2001

(54) IMAGE FORMING APPARATUS

(75) Inventors: Hiroaki Yoshida, Nara; Jitsuo Masuda, Yamatotakada; Junji Morimoto, Nara; Eiichi Kido, Yamatokoriyama; Masahiro Sakai, Osaka; Atsushi Inoue, Nara; Takayuki Yamanaka, Tenri, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/640,705

(22) Filed: Aug. 18, 2000

(30) Foreign Application Priority Data

Aug. 18, 1999 (JP) ..... 11-231983
Sep. 24, 1999 (JP) ..... 11-270891
May 31, 2000 (JP) ..... 12-163210

(51) Int. Cl.[7] ..... G03G 15/08

(52) U.S. Cl. ..... 399/53; 399/50; 399/51; 399/55; 399/66; 399/67

(58) Field of Search ..... 399/38, 40, 46, 399/47, 48, 49, 50, 51, 53, 54, 55, 66, 67, 69, 299, 300

(56) References Cited

U.S. PATENT DOCUMENTS 5,568,234 * 10/1996 Shiba ..... 399/59
5,581,331 * 12/1996 Teshigawara et al. ..... 399/300 X
5,724,633 * 3/1998 Amemiya ..... 399/299
5,953,554 * 9/1999 Ohnishi ..... 399/49

FOREIGN PATENT DOCUMENTS 6258910 9/1994 (JP) .

* cited by examiner

*Primary Examiner*—Arthur T. Grimley
*Assistant Examiner*—Hoan Tran

(57) ABSTRACT

The image forming portion of this image forming apparatus includes a LSU, a photosensitive drum, a developing unit holder, a multiple number of developing units, an intermediate transfer element, a transfer element and a fixing unit. All the developing units are of an identical configuration. Therefore, for replacement of developing units, the operator may and should remove any color of developing unit in the same fashion and attach a fresh developing unit of the color in the same fashion. The image forming portion sets up the image forming conditions for individual colors in the developing order.

22 Claims, 88 Drawing Sheets

Difference depending upon printing order
(the range of hues with the fixing temperature set to be higher )

FIG.58

| | Numeral in Fig.1 | Developer unit location No. | Color No. |
|---|---|---|---|
| 1 | 14a | DUP(1) | Color(1) |
| | 14b | DUP(2) | Color(2) |
| | 14c | DUP(3) | Color(3) |
| | 14d | DUP(4) | Color(4) |
| 2 | 14a | DUP(1) | Color(1) |
| | 14b | DUP(2) | Color(2) |
| | 14c | DUP(3) | Color(4) |
| | 14d | DUP(4) | Color(3) |
| 3 | 14a | DUP(1) | Color(1) |
| | 14b | DUP(2) | Color(3) |
| | 14c | DUP(3) | Color(2) |
| | 14d | DUP(4) | Color(4) |
| 4 | 14a | DUP(1) | Color(1) |
| | 14b | DUP(2) | Color(3) |
| | 14c | DUP(3) | Color(4) |
| | 14d | DUP(4) | Color(2) |
| 5 | 14a | DUP(1) | Color(1) |
| | 14b | DUP(2) | Color(4) |
| | 14c | DUP(3) | Color(2) |
| | 14d | DUP(4) | Color(3) |
| 6 | 14a | DUP(1) | Color(1) |
| | 14b | DUP(2) | Color(4) |
| | 14c | DUP(3) | Color(3) |
| | 14d | DUP(4) | Color(2) |

FIG.59

| | Numeral in Fig.1 | Developer unit location No. | Color No. |
|---|---|---|---|
| 7 | 14a | DUP(1) | Color(2) |
| | 14b | DUP(2) | Color(1) |
| | 14c | DUP(3) | Color(3) |
| | 14d | DUP(4) | Color(4) |
| 8 | 14a | DUP(1) | Color(2) |
| | 14b | DUP(2) | Color(1) |
| | 14c | DUP(3) | Color(4) |
| | 14d | DUP(4) | Color(3) |
| 9 | 14a | DUP(1) | Color(2) |
| | 14b | DUP(2) | Color(3) |
| | 14c | DUP(3) | Color(1) |
| | 14d | DUP(4) | Color(4) |
| 10 | 14a | DUP(1) | Color(2) |
| | 14b | DUP(2) | Color(3) |
| | 14c | DUP(3) | Color(4) |
| | 14d | DUP(4) | Color(1) |
| 11 | 14a | DUP(1) | Color(2) |
| | 14b | DUP(2) | Color(4) |
| | 14c | DUP(3) | Color(1) |
| | 14d | DUP(4) | Color(3) |
| 12 | 14a | DUP(1) | Color(2) |
| | 14b | DUP(2) | Color(4) |
| | 14c | DUP(3) | Color(3) |
| | 14d | DUP(4) | Color(1) |

| | Numeral in Fig.1 | Developer unit location No. | Color No. |
|---|---|---|---|
| 13 | 14a | DUP(1) | Color(3) |
| | 14b | DUP(2) | Color(2) |
| | 14c | DUP(3) | Color(1) |
| | 14d | DUP(4) | Color(4) |
| 14 | 14a | DUP(1) | Color(3) |
| | 14b | DUP(2) | Color(2) |
| | 14c | DUP(3) | Color(4) |
| | 14d | DUP(4) | Color(1) |
| 15 | 14a | DUP(1) | Color(3) |
| | 14b | DUP(2) | Color(1) |
| | 14c | DUP(3) | Color(2) |
| | 14d | DUP(4) | Color(4) |
| 16 | 14a | DUP(1) | Color(3) |
| | 14b | DUP(2) | Color(1) |
| | 14c | DUP(3) | Color(4) |
| | 14d | DUP(4) | Color(2) |
| 17 | 14a | DUP(1) | Color(3) |
| | 14b | DUP(2) | Color(4) |
| | 14c | DUP(3) | Color(2) |
| | 14d | DUP(4) | Color(1) |
| 18 | 14a | DUP(1) | Color(3) |
| | 14b | DUP(2) | Color(4) |
| | 14c | DUP(3) | Color(1) |
| | 14d | DUP(4) | Color(2) |

FIG.61

| | Numeral in Fig.1 | Developer unit location No. | Color No. |
|---|---|---|---|
| 19 | 14a | DUP(1) | Color(4) |
| | 14b | DUP(2) | Color(2) |
| | 14c | DUP(3) | Color(3) |
| | 14d | DUP(4) | Color(1) |
| 20 | 14a | DUP(1) | Color(4) |
| | 14b | DUP(2) | Color(2) |
| | 14c | DUP(3) | Color(1) |
| | 14d | DUP(4) | Color(3) |
| 21 | 14a | DUP(1) | Color(4) |
| | 14b | DUP(2) | Color(3) |
| | 14c | DUP(3) | Color(2) |
| | 14d | DUP(4) | Color(1) |
| 22 | 14a | DUP(1) | Color(4) |
| | 14b | DUP(2) | Color(3) |
| | 14c | DUP(3) | Color(1) |
| | 14d | DUP(4) | Color(2) |
| 23 | 14a | DUP(1) | Color(4) |
| | 14b | DUP(2) | Color(1) |
| | 14c | DUP(3) | Color(2) |
| | 14d | DUP(4) | Color(3) |
| 24 | 14a | DUP(1) | Color(4) |
| | 14b | DUP(2) | Color(1) |
| | 14c | DUP(3) | Color(3) |
| | 14d | DUP(4) | Color(2) |

FIG.84

| | Developing unit insert order | Cyan | Magenta | Yellow | Black |
|---|---|---|---|---|---|
| P1 | Down stream Up stream K C M Y | No.2 | No.2 | No.1 | No.1 |
| P2 | Down stream Up stream K M C Y | No.2 | No.3 | No.1 | No.1 |
| P3 | Down stream Up stream K C Y M | No.2 | No.1 | No.1 | No.1 |
| P4 | Down stream Up stream K Y C M | No.1 | No.1 | No.1 | No.1 |
| P5 | Down stream Up stream K Y M C | No.1 | No.2 | No.1 | No.1 |
| P6 | Down stream Up stream K M Y C | No.1 | No.2 | No.1 | No.1 |

FIG.88

| | Developing unit insert order | Fixing temperature setting (Hi/Lo) |
|---|---|---|
| P1 | Down stream Up stream K C M Y | Hi |
| P2 | Down stream Up stream K M C Y | Hi |
| P3 | Down stream Up stream K C Y M | Hi |
| P4 | Down stream Up stream K Y C M | Lo |
| P5 | Down stream Up stream K Y M C | Hi |
| P6 | Down stream Up stream K M Y C | Hi |

IMAGE FORMING APPARATUS

BACKGROUND OF THE INVENTION (1) Field of the Invention

The present invention relates to an image forming apparatus for multi-color printing using the electrophotography and particularly relates to an image forming apparatus capable of image forming in appropriate conditions even if a plurality of developing units are arranged in an arbitrary order.

(2) Description of the Prior Art

Recently, there has been a tendency toward colorization in the field of image forming apparatus such as copiers and the like, and color copiers have widely been put on the market. In such color copiers, four color, namely black, cyan, magenta and yellow developers are used and the multiple number of developing units storing the different color developers are arranged in a certain relationship.

Conventionally, upon the replacement of the developing units for such an image forming apparatus having multiple developing units, the operator should confirm the developer's color being stored in a developing unit and attach the unit to the predetermined developing unit mounting space on the apparatus body. This configuration not only provides the operator with a burden, but also has frequently induced deficiencies and accidents due to erroneous insert or damages to the parts.

In a color image forming apparatus wherein a multiple number of color image developing units each having a different color of toner are arranged in series in the paper conveyance direction, color components of an image are formed by associated color image developing units and superimposed on a sheet of paper as the paper is conveyed. The paper with the toner image formed thereon in a superimposed manner after the passage of the all the color image developing units is made to pass through the heated, heat roller in the fixing unit so that the toner becomes fused by heat from the roller surface, to thereby complete image formation.

The order or position in which the color image developing units are inserted and set in the main body determines the order of transfer and superimposition. That is, the color toner of the color developing unit laid out on the most downstream side in the transfer and superimposition stage will adhere to the topmost layer of the print paper so that it will be most affected by the heat from the heated surface of the heat roller of the fixing unit. Resultantly, the conventional configuration has the following problem. That is, if the order of insertion of the developing units or the order in which the color toners are superimposed is changed, color or hue in the printed image will vary depending upon the order of superimposition of the color toners.

SUMMARY OF THE INVENTION

In order to solve the above problems, it is therefore an object of the present invention to provide a color image forming apparatus which enables image forming under proper conditions even if a multiple number of developing units are set at arbitrary positions upon replacement of the developing units so as to reduce the operator's burden of replacement and improve the operativity, handling performance and safety, enables quick start of the image forming operation to thereby improve the operating efficiency of the whole apparatus, can promote reasonable design by reducing the number of parts of the developing units and image forming apparatus and by common use of identical parts and still can provide stable image quality.

It is another object of the present invention to provide a color image developing device which can minimize deviation of hues in the final multi-color printed image, regardless of the order of arrangement of the developing units.

It is a further object of the present invention to provide a color image developing device which can provide better color image quality even if the color developing units present insufficient developing functions and if it is difficult to make up for the deficiency by regulating the developing bias voltages to control the amounts of adherence of the color toners appropriately.

In order to achieve the above objects, the present invention is configured as follows:

In accordance with the first feature of the present invention, an image forming apparatus includes a static latent image support, a charging device for charging the surface of the static latent image support, an exposing device for forming a static latent image on the static latent image support, and a plurality of developing units, each developing the formed static latent image with a developer held therein to produce a visual image, wherein the developed images are transferred and superimposed one over another to a recording medium and fixed thereto, and the image forming apparatus further includes:

a developing unit holding portion having as many holders for accommodating the developing units and allowing the developing units to be detachably attached and set in an arbitrary order; and a controller for regulating the image forming conditions of each developer under which image is formed, depending on the order of development determined by the arrangement in which the developing units are set in the developing unit holding portion and depending on the colors of the developers held in the developing units.

In accordance with the second feature of the present invention, the image forming apparatus having the above first feature is characterized in that the controller arbitrarily sets up the order of development of the plurality of developing units, when the colors of developers are designated.

In accordance with the third feature of the present invention, the image forming apparatus having the above first or second feature is characterized in that, upon the control of the image forming conditions by the controller, the developing bias voltage for each color of developer is set to be higher in the order in which the developers are to be located closer to the top surface, so that the amount of each developer per unit area to be transferred to the recording medium will be equal to the others.

In accordance with the fourth feature of the present invention, the image forming apparatus having the above first or second feature is characterized in that, upon the control of the image forming conditions by the controller, the exposure power of the exposing device for each color of developer is set to be higher in the order in which the developers are to be located closer to the top surface, so that the amount of each developer per unit area to be transferred to the recording medium will be equal to the others.

In accordance with the fifth feature of the present invention, the image forming apparatus having the above first or second feature is characterized in that, upon the control of the image forming conditions by the controller, the exposure time of the exposing device for each color of developer is set to be longer in the order in which the developers are to be located closer to the top surface, so that the amount of each developer per unit area to be transferred to the recording medium will be equal to the others.

In accordance with the sixth feature of the present invention, the image forming apparatus having the above first or second feature is characterized in that the controller controls the image forming conditions in such a manner that, when the developed images are transferred from the static latent image support, the transfer output voltage for the black developer is set to be lower than that for the chromatic color developers.

In accordance with the seventh feature of the present invention, the image forming apparatus having the above first or second feature is characterized in that the controller controls the image forming conditions in such a manner that, when, upon fixing, any low chromatic color developer is located in a layer higher than a high chromatic color developer on the recording medium, the fixing temperature is set to be higher.

In accordance with the eighth feature of the present invention, the image forming apparatus having the above first or second feature is characterized in that the controller controls the image forming conditions in such a manner that, when, upon fixing, any low chromatic color developer is located in a layer higher than a high chromatic color developer on the recording medium, the speed of fixing is set to be lower.

In accordance with the ninth feature of the present invention, the image forming apparatus having the above first or second feature is characterized in that the developing units are arranged at fixed positions around the static latent image support, and upon the control of the image forming conditions by the controller, the voltage applied to the charger is varied dependent on each developing unit so that the static latent image support will have a constant surface potential at the developing position of the associated developing unit.

In accordance with the tenth feature of the present invention, the image forming apparatus having the above first or second feature is characterized in that the developing units are arranged at fixed positions around the static latent image support, and upon the control of the image forming conditions by the controller, the exposure power of the exposing device is varied dependent on the position of each developing unit so that the static latent image support will have a constant surface potential after exposure at the developing position of the associated developing unit.

In accordance with the eleventh feature of the present invention, the image forming apparatus having the above first or second feature is characterized in that the developing units are arranged at fixed positions around the static latent image support, and upon the control of the image forming conditions by the controller, the exposure time of the exposing device is varied dependent on the position of each developing unit so that the static latent image support will have a constant surface potential after exposure at the developing position of the associated developing unit.

In accordance with the twelfth feature of the present invention, the image forming apparatus having the above first or second feature is characterized in that the controller controls the image forming conditions so that the amount of developer per unit area to be supplied for development by each developing unit is controlled to modify dependent upon a predetermined developer amount of the developing unit or a developer amount based on the predetermined rule.

In accordance with the thirteenth feature of the present invention, the image forming apparatus having the above twelfth feature is characterized in that the modification control is carried out by controlling the developing bias voltage of each developing unit.

In accordance with the fourteenth feature of the present invention, the image forming apparatus having the above twelfth feature, further includes a fixing unit for fixing the multi-color image formed on the recording medium to the recording medium by heating, wherein the fixing temperature of the fixing unit is controlled to modify based on the order of development.

In accordance with the fifteenth feature of the present invention, the image forming apparatus having the above first or second feature is characterized in that all the developing units are of an identical configuration.

In accordance with the sixteenth feature of the present invention, the image forming apparatus having the above first or second feature is characterized in that all the developing units are accommodated in, and engaged with, the developer holder, and of all the developing units the developing unit from which a greatest amount of developer is used is designed to be larger in size than the developing units of other developers, but the larger one also has the same engaging structure as that of the others.

In accordance with the seventeenth feature of the present invention, the image forming apparatus having the above first or second feature, further includes color information detecting portion for detecting color information of the developer colors, wherein the controller determines the colors of the developers held in developing units based on the detected result from the color detecting portion.

In accordance with the eighteenth feature of the present invention, the image forming apparatus having the above seventeenth feature is characterized in that a patch image is formed on the static latent image support using the developer held in each developing unit and the color information detecting portion detects the amount of light reflected on the patch image so as to recognize the color of the developer held in each developing unit.

In accordance with the nineteenth feature of the present invention, the image forming apparatus having the above first or second feature is characterized in that each developing units has a color information indicator presenting the color information of the developer held therein; the apparatus main body includes color information detectors for detecting the color information presented by the color information indicators; and the controller determines the colors of the developers held in developing units based on the detected result from the color information detectors.

In the image forming apparatus according to the above features of the present invention, suitable image forming conditions can be set up in conformity with the developing order of the developing units and the colors of the developers held in the developing units. Therefore, for replacement of the developer units, the operator can set each developing unit without checking the color of the developer held therein. Resultantly, it is possible to provide an image forming apparatus which can reduce the operator's burden during replacement of the developing units and leads to improvement in operativity, handling performance, safety and other performances. Further, since the image forming operation can be started as soon as the replacement is completed, the operating efficiency of the whole apparatus can also be improved.

In accordance with the twentieth feature of the present invention, an image forming apparatus includes:

a plurality of image forming portions provided for different colors, each having a static latent image support, an exposing portion for forming a static latent image on the static latent image support and a developing unit for developing the formed static latent image into a visual image with a developer held therein;

a developing unit holder which permits the plurality of developing units in the image forming portions to be attached and removed with respect to the apparatus main body and also permits each developing unit to be accommodated and arranged into any holding position;

a developing unit arrangement detecting portion for detecting the order of arrangement of the developing units set in the holding positions; and a developer amount controller which controls the amount of developer per unit area to be supplied for development by each developing unit so as to adjust it to the predetermined amount of developer for the associated developing unit or based on the predetermined rule.

In accordance with the twenty-first feature of the present invention, the image forming apparatus having the above twentieth feature is characterized in that the developer amount controller comprises a developing bias controller for controlling the developing bias voltage of each developing unit.

In accordance with the twenty-second feature of the present invention, the image forming apparatus having the above twentieth or twenty-first feature, further includes a fixing unit for fixing the developer image formed on the recording medium to the recording medium by heating, and is characterized in that the fixing temperature of the fixing unit is modified based on the order of arrangement of the developing units detected by the developer unit arrangement detecting portion.

In the image forming apparatus according to the above first through nineteenth features of the present invention, suitable image forming conditions can be set up in conformity with the developing order of the developing units and the colors of the developers held in the developing units. Therefore, for replacement of the developer units, the operator can set each developing unit without checking the color of the developer held therein. Resultantly, it is possible to provide an image forming apparatus which can reduce the operator's burden during replacement of the developing units and leads to improvement in operativity, handling performance, safety and other performances. Further, since the image forming operation can be started as soon as the replacement is completed, the operating efficiency of the whole apparatus can also be improved.

According the image forming apparatus having any of the twelfth to fourteenth and twentieth to twenty-second features, when the images of color developers are transferred and superimposed one another, the amounts of the developers are adjusted, for example, the amount of the adherence of the color developer on the topmost surface is made low. Accordingly, the fusibility of the color developer during fixing can be promoted, thus making it possible to improve the color reproducibility by reducing the burden of the fixing unit.

Further, when deficiencies such as reduction in development density occur in each developing unit due to environmental variation or when operator's delay in supplying the color developer, there is a limit to achieve the aimed color reproduction by controlling only the amounts of adherence of the color developers based on the regulation of the developing bias voltages.

In such a case, changing the fixing temperature of the fixing unit can improve the color printing while keeping the color reproducibility of the control of the amounts of adherence of the color developers by development quantity controller, for example, based on the regulation of the developing bias voltages.

BRIEF DESCRIPTION OF THE DRAWINGS

FIG. 46 is a flowchart showing the control steps of the controller of the fourth embodiment;

FIG. 58 is a timing chart for effecting development with developing units in the designated, developing color order;

FIG. 59 is a timing chart for effecting development with developing units in the designated, developing color order;

FIG. 61 is a timing chart for effecting development with developing units in the designated, developing color order;

FIG. 84 is an illustrative view showing the amounts of superimposed color toners classed into three grades when the individual colors of developing containers 75*a* according to seventh embodiment are set in different orders P1 to P6;

FIG. 88 is an illustrative chart showing the fixing temperature setup of fixing roller 78 when the individual colors of developing containers 75*a* according to seventh embodiment are set in different orders P1 to P6.

DESCRIPTION OF THE PREFERRED EMBODIMENTS

The embodiment of the present invention will hereinafter be described with reference to the accompanying drawings.

(The First Embodiment)

Figure 1:
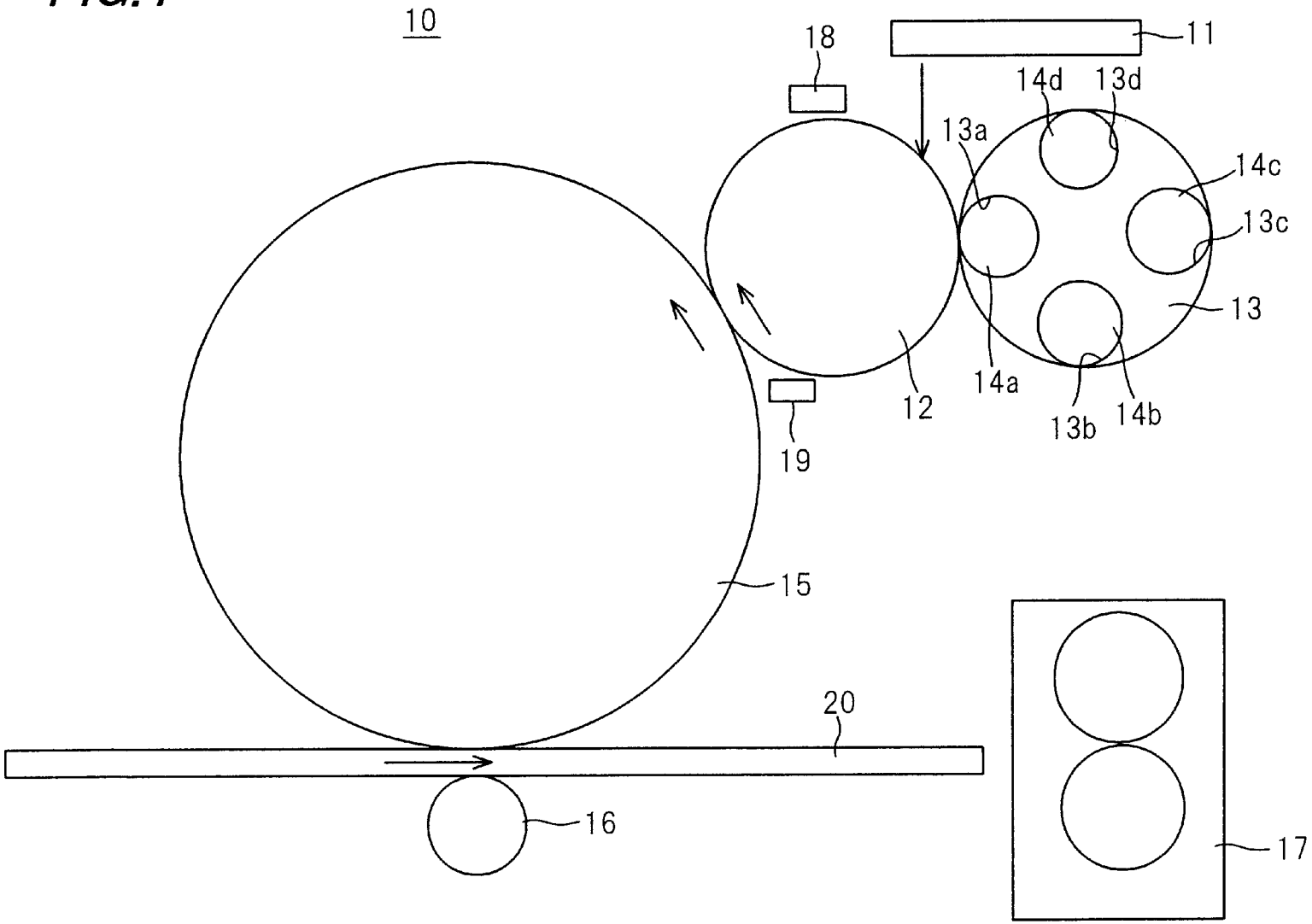
FIG. 1 is an overall schematic view showing the first embodiment of the image forming portion in an image forming apparatus according to the present invention.

FIG. 1 is an overall schematic view showing the first embodiment of the image forming portion in an image forming apparatus according to the present invention. The image forming portion, designated at 10, of this image forming apparatus includes: a LSU (laser scanner unit) 11 as a light exposure means; a photosensitive drum 12 as a static latent image support; a developing unit holder 13; developing units 14*a* to 14*d*; an intermediate transfer element 15; a transfer element 16; and a fixing unit 17. Arranged above and near photosensitive drum 12 is a charger 18 for uniformly charging the photosensitive drum 12 surface. A process control sensor 19 is provided below and in proximity to photosensitive drum 12 and right before the position where the image is transferred to intermediate transfer element 15.

Further, cylindrical, developing unit holder 13 is formed along its periphery with accommodation sockets (holders) 13*a*, 13*b*, 13*c* and 13*d* for accommodating four, cylindrical developing units 14*a*, 14*b*, 14*c* and 14*d* storing yellow, magenta, cyan and black developers. Here, developing unit holder 13 holds developer units 14*a* to 14*d* so that their supply ports are located on the outer peripheral surface. All the developing units 14*a* to 14*d* are of an identical configuration. Therefore, when replacing developing units 14*a* to 14*d*, the operator can remove any color of developing units 14*a* to 14*d* in the same fashion and can attach any of developing units 14*a* to 14*d* to an arbitrary position in the same fashion. Developing unit holder 13 rotates about its cylindrical axis and has a rotary configuration so as to move and set developing unit 14*a* to 14*d* for a color to be developed to the predetermined position of photosensitive drum 12.

Each of developing units 14*a* to 14*d* having different colors is provided with a color information indicating means for presenting color information corresponding to the color of the developer held therein. This color information indicating means may be a transparent window for allowing the developer in the developing unit to be seen, a bar code of color information, or a mark directly representing a color. A color information detecting means for detecting this color information indicating means is also provided. The color information detecting means may be a photosensor for identifying the color by the amount of light reflection when the color information indicating means is of a transparent window for allowing the developer in the developing unit to be seen or a color mark, while it is a bar code reader for reading bar code information when the color information indicator is of a bar code.

Now, the operation of this image forming portion 10 will be described briefly.

Though not shown FIG. 1, an image signal picked up by the document reader or an image signal sent out from a personal computer is supplied to image forming portion 10. Based on this image signal, LSU 11 arranged above photosensitive drum 12 exposes the photosensitive drum 12 surface in a scan-wise manner, forming a static latent image.

The static latent image on photosensitive drum 12 is developed by causing the toners from developing units 14*a* to 14*d* to adhere thereto. The image thus formed is checked as to its developed state by process control sensor 19 so as to set up optical development conditions. Then the development is performed under the optimal development conditions and the developed image is transferred to intermediate transfer element 15. In this way, the color component images thus developed by developing units 14*a* to 14*d* are transferred to and superimposed one over another onto intermediate transfer element 15.

When the last component color image has been formed on intermediate transfer element 15, a sheet of print paper 20 is pressed against intermediate transfer element 15 by means of a transfer member 16 so the image is transferred to print paper 20. Then the paper is heated by fixing unit 17 so as to fix the image onto print paper 20.

When developing units 14*a* to 14*d* are set arbitrarily to developing unit holder 13, image forming portion 10 sets up image forming conditions, based on the color development order of developing units 14*a* to 14*d*. This control will be described next.

Figure 2:
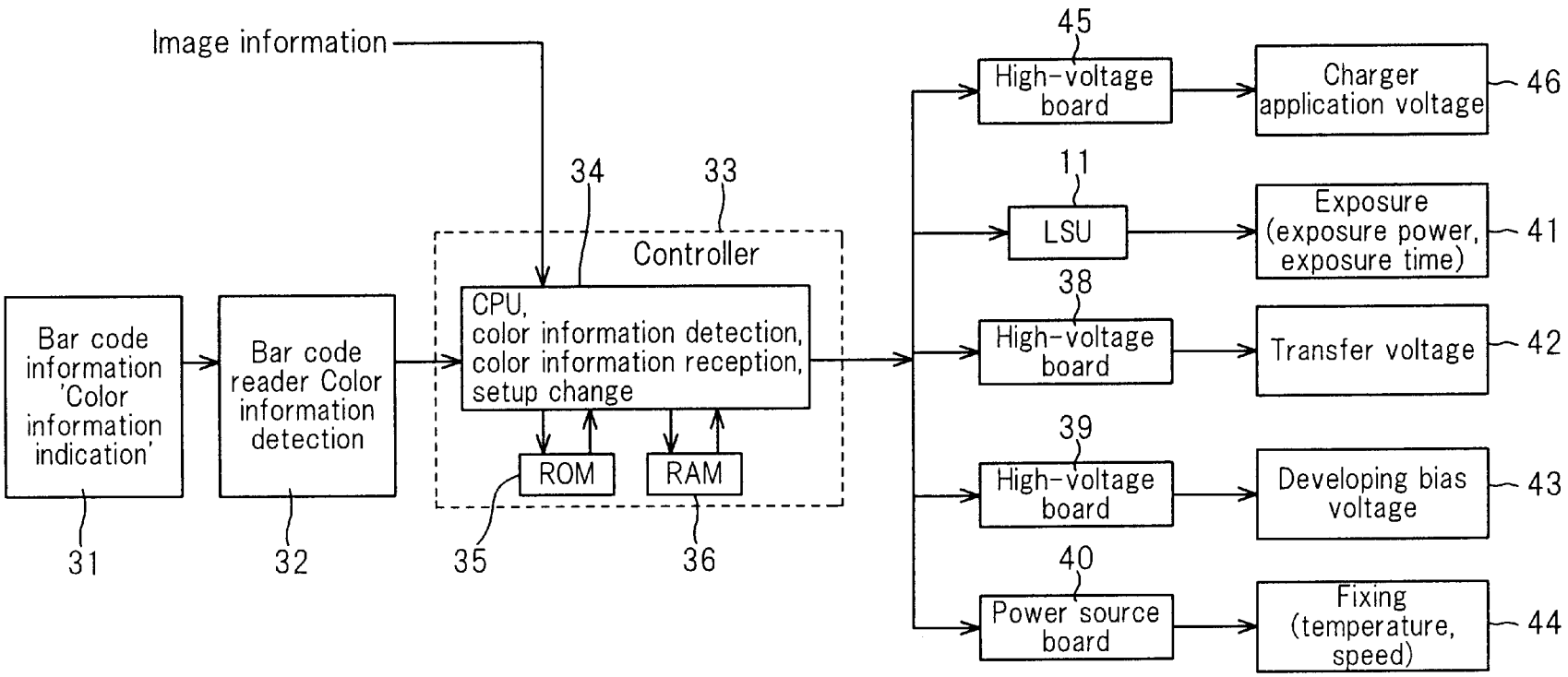
FIG. 2 is a block diagram showing the controller of the first embodiment.

FIG. 2 is a block diagram showing the condition controller of image forming of image forming portion 10. FIGS. 3 through 11 are the flowcharts showing the control steps. This condition controller of image forming unit 10 comprises: color information indicating means 31 (bar code information in FIG. 2) attached to developing units 14*a* to 14*d*; a color information detecting means 32 (bar code reader in FIG. 2); a controller 33 for controlling process conditions based on the color information; a high-voltage board 45 for setting up a charger application voltage 46; a LSU 11 for setting up exposure conditions 41 under which photosensitive drum 12 is exposed; a high-voltage board 38 for setting up a transfer voltage 42 applied to print paper 20; a high-voltage board 39 for setting up a developing bias voltage 43; and a power source board 40 for setting up fixing conditions 44 of fixing unit 17. Controller 33 comprises: a CPU 34 for control, a ROM 35 storing the control algorithms and a RAM 36 for storing color information, condition setup values and the like.

Figure 3:
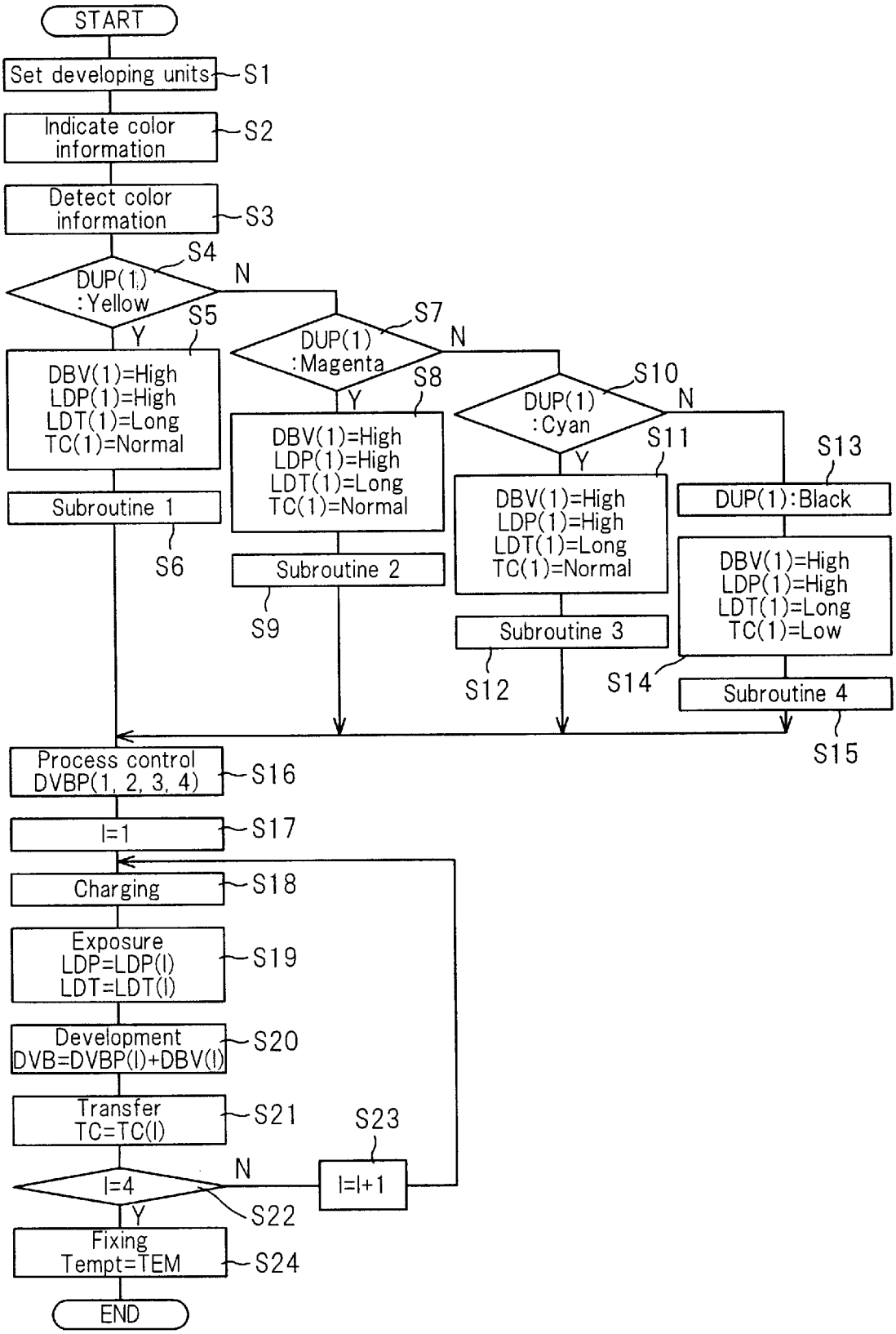
FIG. 3 is a flowchart showing the control steps of the controller of the first embodiment.

Referring next to FIGS. 1 to 3, the specific control scheme will be described.

When all developing units 14*a* to 14*d* are set to accommodation sockets (holders) 13*a* to 13*d* of developing unit holder 13 (S1), each color information indicating means 31 presents color information (S2). This color information is detected by color information detecting means 32 located at the associated positions (S3) and the obtained information is output to CPU 34. CPU 34 temporarily stores the color information into RAM 36. CPU 34, based on the color information, recognizes the colors of developing units 14*a* to 14*d* having been mounted in developing unit sockets (holders) 13*a* to 13*d* of image forming portion 10. The color information stored includes the process control target values, etc.(target densities of the standard toner image formed on the photosensitive member) of developing units 14*a* to 14*d*, based on which conditions for the various elements during image forming are set up (S4 to S15), to form images of a good quality.

As understood from Table 1 below, for transferring the color toners from photosensitive drum 12, there are, in total, twenty-four permutations of the development colors (the number of ordered arrangements of color superimpositions). That is, the control during image forming differs depending on the ordered arrangement of colors.

TABLE 1

| The order of development | 1st | 2nd | 3rd | 4th | No. |
|---|---|---|---|---|---|
| Subroutine 1 | Y | M | C | B | T1 |
| | Y | M | B | C | T2 |
| | Y | C | M | B | T3 |
| | Y | C | B | M | T4 |
| | Y | B | M | C | T5 |
| | Y | B | C | M | T6 |
| Subroutine 2 | M | Y | C | B | T7 |
| | M | Y | B | C | T8 |
| | M | C | Y | B | T9 |
| | M | C | B | Y | T10 |
| | M | B | Y | C | T11 |
| | M | B | C | Y | T12 |
| Subroutine 3 | C | M | Y | B | T13 |
| | C | M | B | Y | T14 |
| | C | Y | M | B | T15 |
| | C | Y | B | M | T16 |
| | C | B | M | Y | T17 |
| | C | B | Y | M | T18 |
| Subroutine 4 | B | M | C | Y | T19 |
| | B | M | Y | C | T20 |
| | B | C | M | Y | T21 |
| | B | C | Y | M | T22 |
| | B | Y | M | C | T23 |
| | B | Y | C | M | T24 |

Y = yellow, M = magenta, C = cyan, B = black

CPU 34 recognizes which color developing unit among 14*a* to 14*d* is used first for development. There are four developing unit locations DUP(1) to DUP(4) set up beforehand for developing units 14*a* to 14*d*. Development is performed in the order of the developing unit locations DUP. It is checked at steps S4, S7, S10 and S13 which color of toner, yellow, magenta, cyan or black, the developing unit set at DUP(1) holds. At steps S5, S8, S11 and S14, image forming conditions, i.e., developing bias voltage DBV, exposure power LDP, exposure time LDT, transfer voltage TC from photosensitive member 12 to intermediate transfer element 15 and fixing temperature TEM and the fixing speed are set up based on the first color. Here, only the fixing temperature is written in the flowchart.

If the first development color is yellow (S4), or when the color of the toner in the developing unit set at DUP(1) is yellow, the image forming conditions for each of the second to fourth development colors are set up through subroutine 1 (S6). In a similar manner, the image forming conditions for each of the second to fourth development colors are set up through subroutine 2 (S9) if the first development is of magenta (S7), subroutine 3 (S12) if it is of cyan (S10) and subroutine 4 (S15) if it is of black (S13).

Next, subroutines 1 to 4 will be described.

Figure 4:
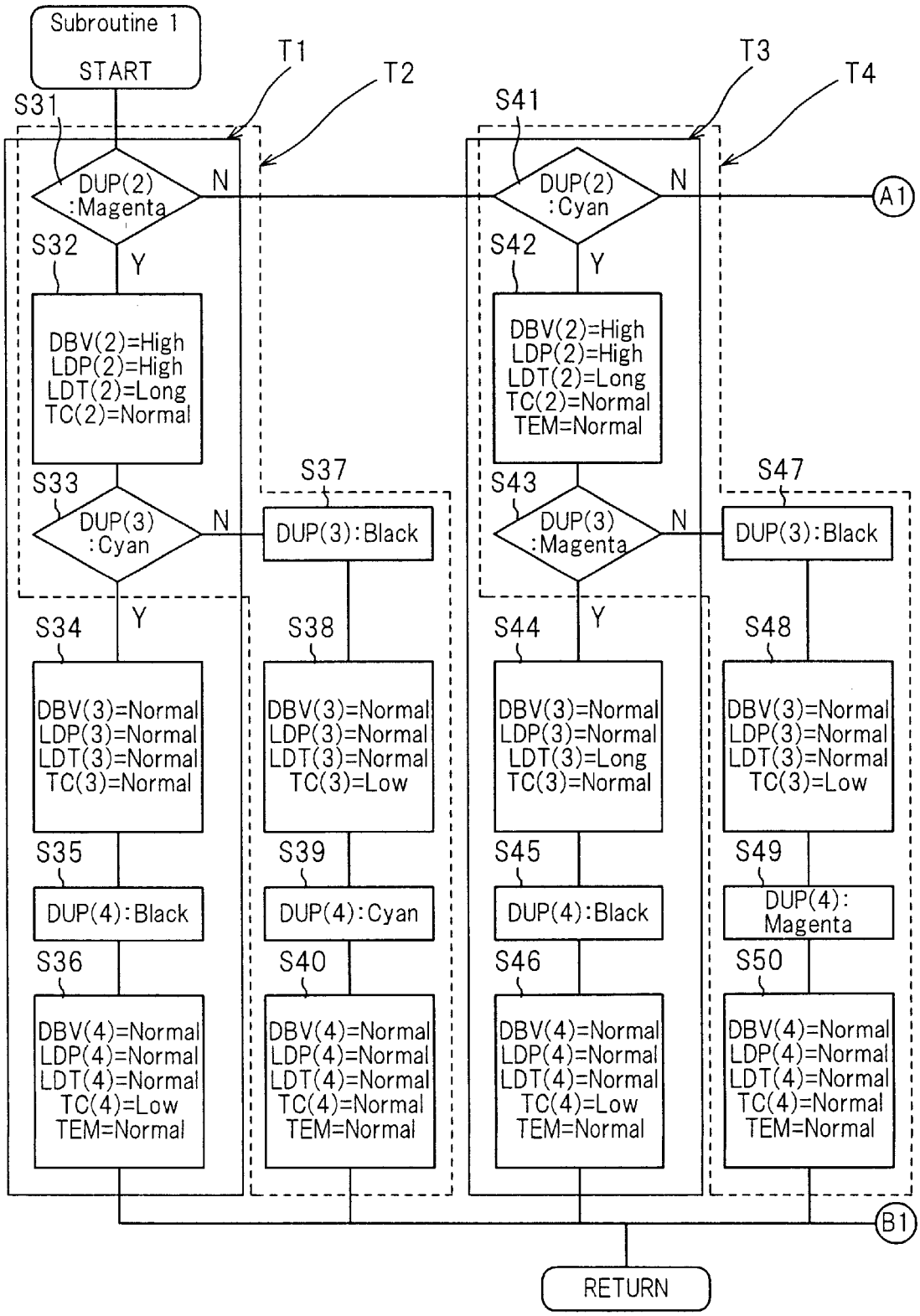
FIG. 4 is a flowchart showing subroutine 1.
Figure 5:
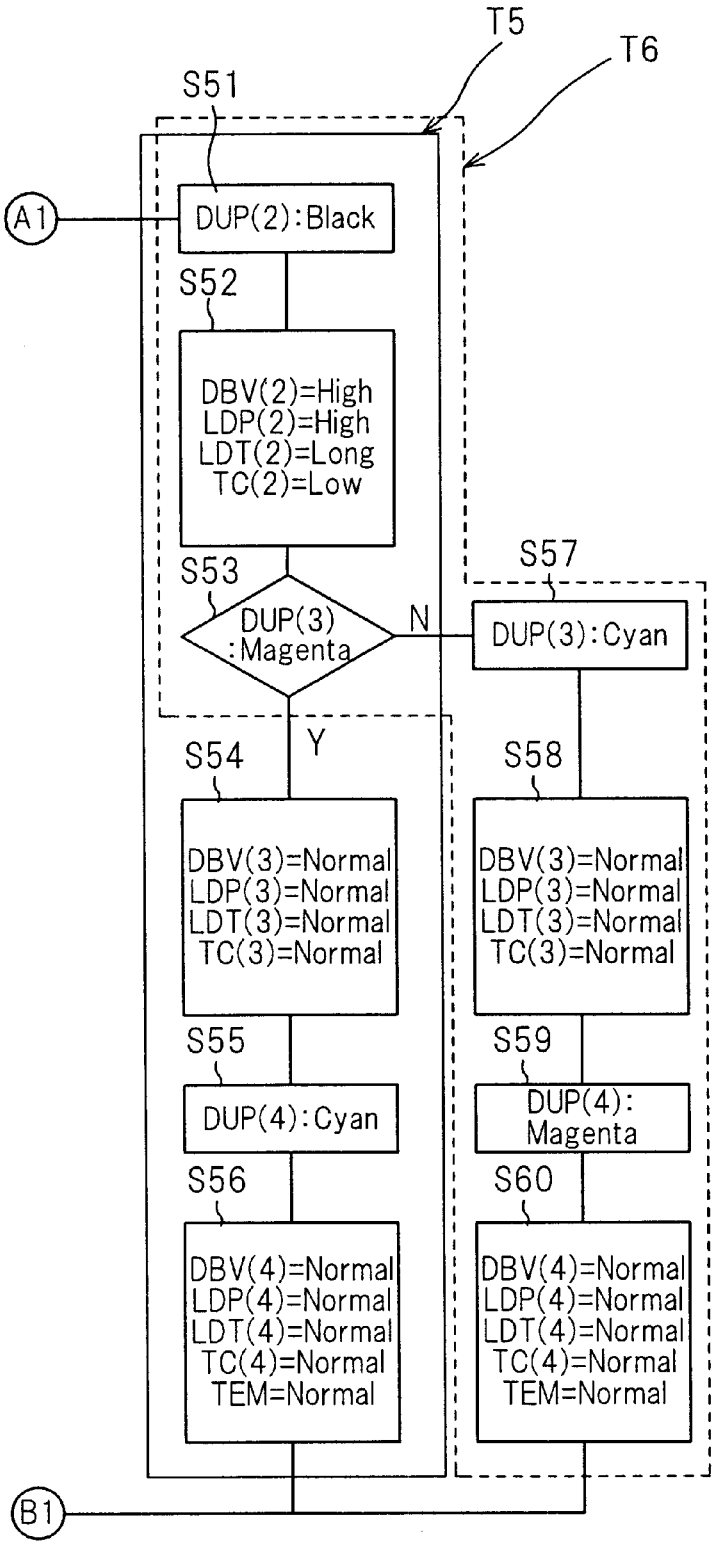
FIG. 5 is a flowchart showing the continuation of subroutine 1 following FIG. 4.

As shown in FIGS. 4 and 5, in subroutine 1 for the toner color of the developing unit set at DUP(1) being yellow, the toner color of the developing unit at DUP(2) (S31, S41, S51), the toner color of the developing unit at DUP(3) (S33, S37, S43, S47, S53, S57), and the toner color of the developing unit at DUP(4) (S35, S39, S45, S49, S55, S59) are successively checked and confirmed. In FIGS. 4 and 5, each color confirmation flow is indicated by corresponding number (No. T1 to No. T6) in Table 1. When the color at each developing unit position DUP is confirmed, the image forming conditions corresponding to the development color are set up (S32, S34, S36, S38, S40, S42, S44, S46, S48, S50, S52, S54, S56, S58, S60). When the development color of the developing unit set at DUP (4) is confirmed, the fixing temperature TEM and fixing speed as the forming conditions are set (S36, S40, S46, S50, S56, S60). Here, only the fixing temperature is mentioned in the flowchart.

Figure 6:
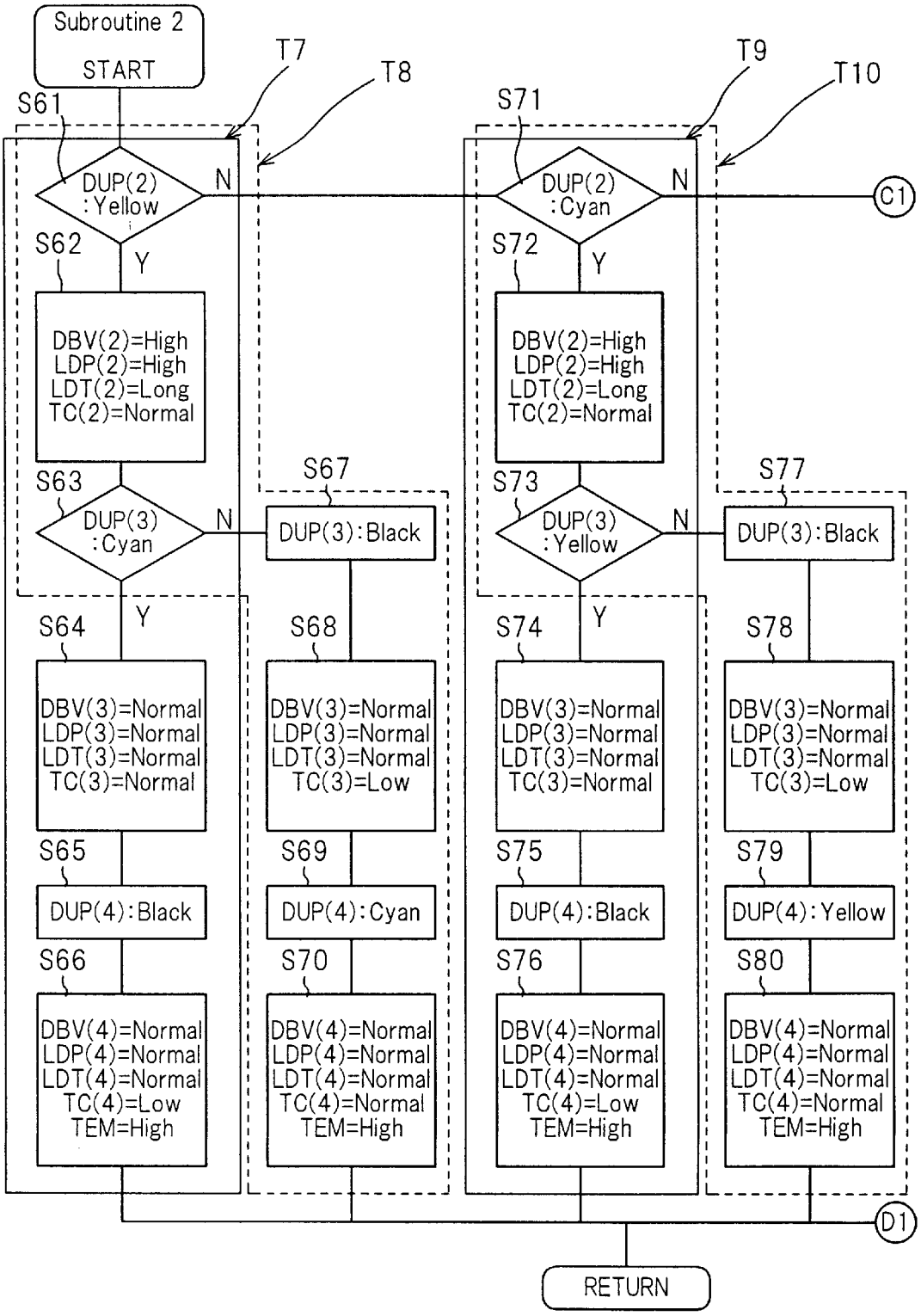
FIG. 6 is a flowchart showing subroutine 2.
Figure 7:
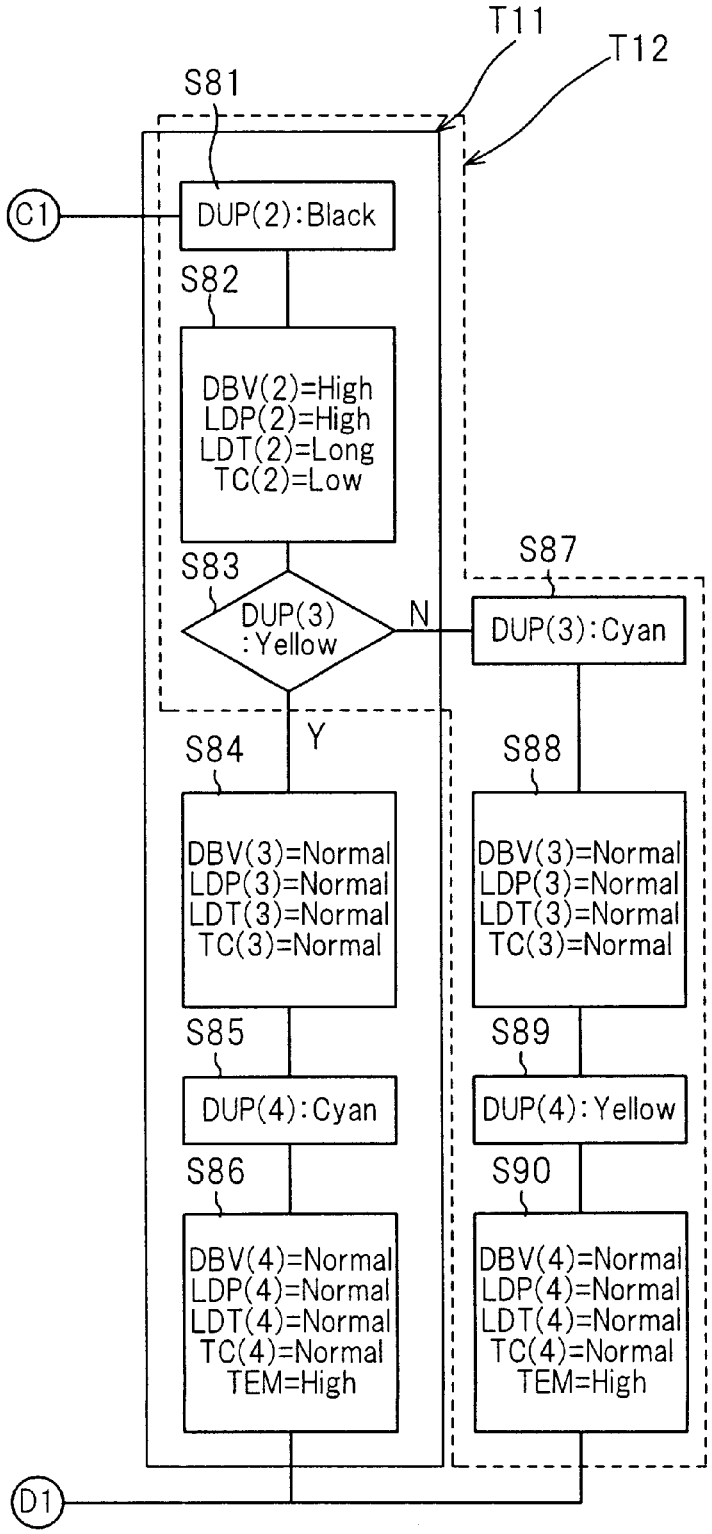
FIG. 7 is a flowchart showing the continuation of subroutine 2 following FIG. 6.

As shown in FIGS. 6 and 7, in subroutine 2 for the toner color of the developing unit set at DUP(1) being magenta, the toner color of the developing unit at DUP(2) (S61, S71, S81), the toner color of the developing unit at DUP(3) (S63, S67, S73, S77, S83, S87) , and the toner color of the developing unit at DUP(4) (S65, S69, S75, S79, S85, S89) are successively checked and confirmed. In FIGS. 6 and 7, each color confirmation flow is indicated by corresponding number (No. T7 to No. T12) in Table 1. When the color at each developing unit position DUP is confirmed, the image forming conditions corresponding to the development color are set up (S62, S64, S66, S68, S70, S72, S74, S76, S78, S80, S82, S84, S86, S88, S90). When the development color of the developing unit set at DUP(4) is confirmed, the fixing temperature TEM and fixing speed as the forming conditions are set (S66, S70, S76, S80, S86,S90). Here, only the fixing temperature is mentioned in the flowchart.

Figure 8:
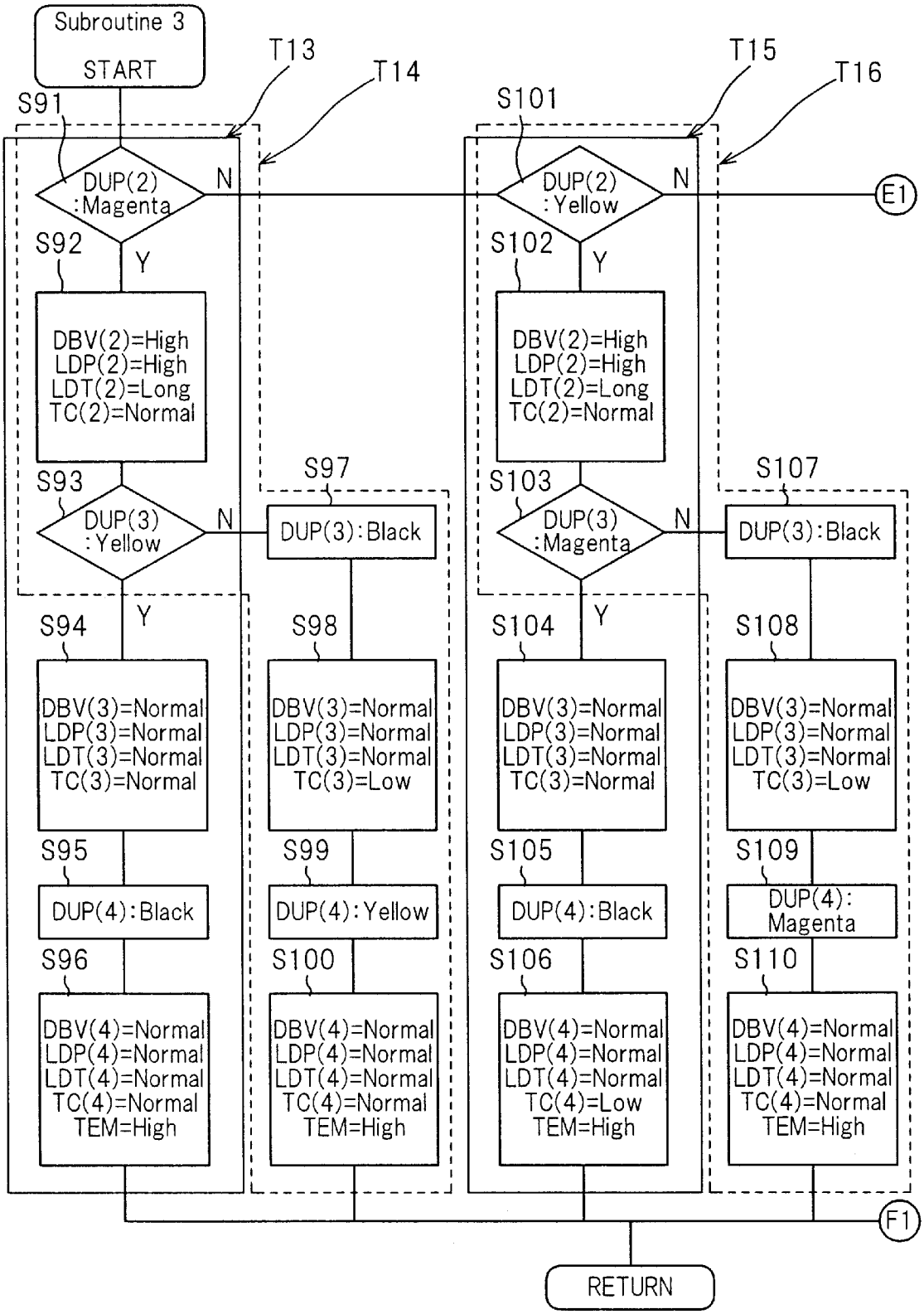
FIG. 8 is a flowchart showing subroutine 3.
Figure 9:
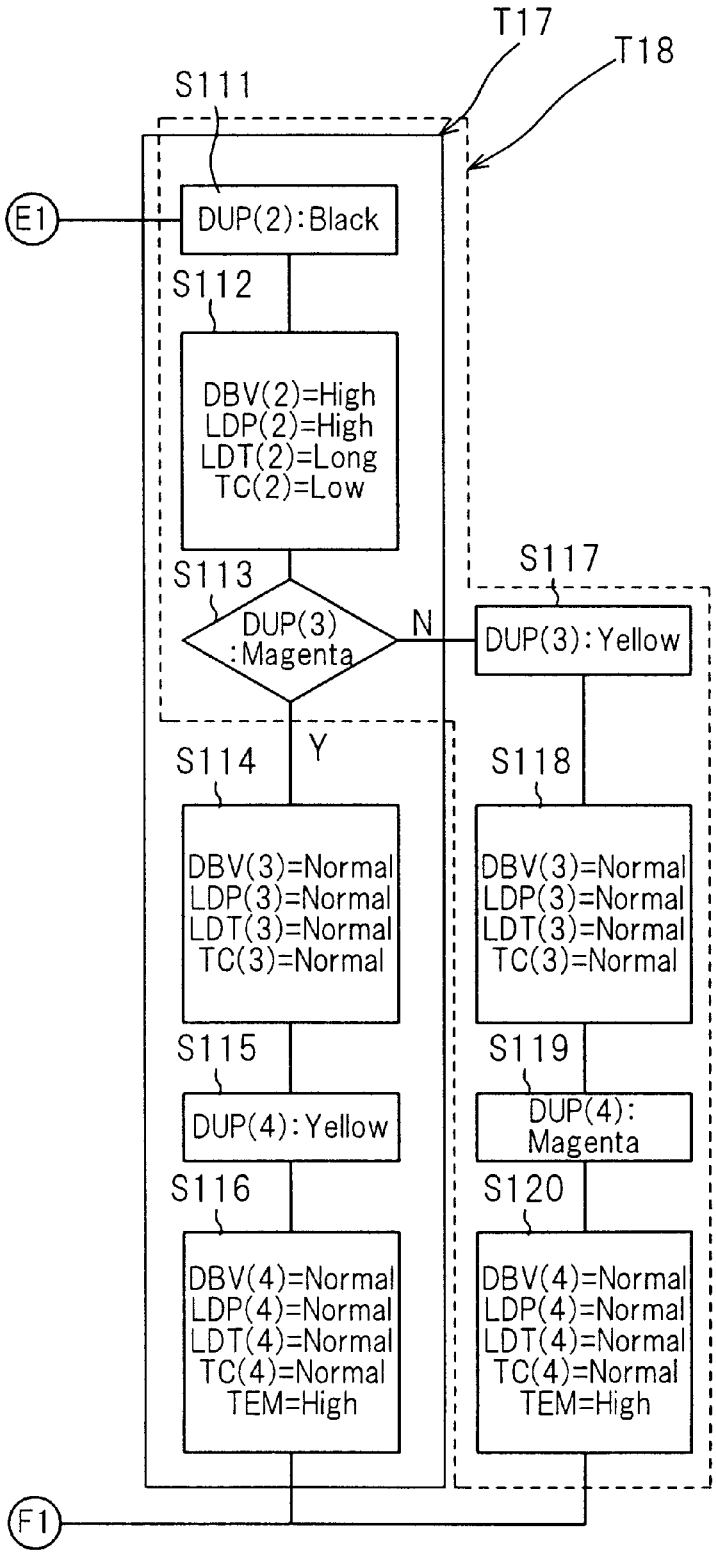
FIG. 9 is a flowchart showing the continuation of subroutine 3 following FIG. 8.

As shown in FIGS. 8 and 9, in subroutine 3 for the toner color of the developing unit set at DUP(1) being cyan, the toner color of the developing unit at DUP(2) (S91, S101, S111), the toner color of the developing unit at DUP(3) (S93, S97, S103, S107, S113, S117), and the toner color of the developing unit at DUP(4) (S95, S99, S105, S109, S115, S119) are successively checked and confirmed. In FIGS. 8 and 9, each color confirmation flow is indicated by corresponding number (No. T13 to No. T18) in Table 1. When the color at each developing unit position DUP is confirmed, the image forming conditions corresponding to the development color are set up (S92, S94, S96, S98, S100, S102, S104, S106, S108, S110, S112, S114, S116, S118, S120). When the development color of the developing unit set at DUP(4) is confirmed, the fixing temperature TEM and fixing speed as the forming conditions are set (S96, S100, S106, S110, S116, S120). Here, only the fixing temperature is mentioned in the flowchart.

Figure 10:
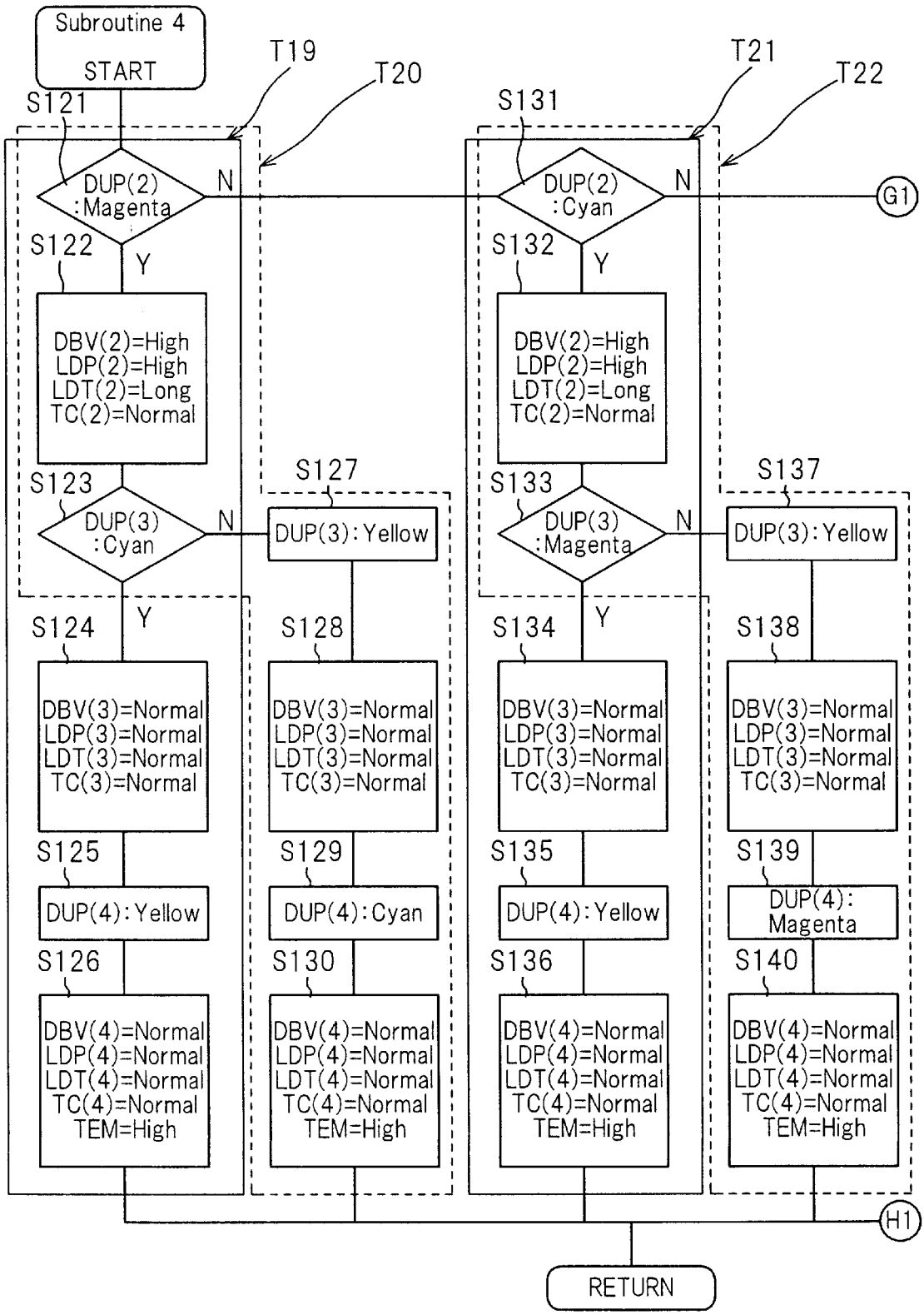
FIG. 10 is a flowchart showing subroutine 4.
Figure 11:
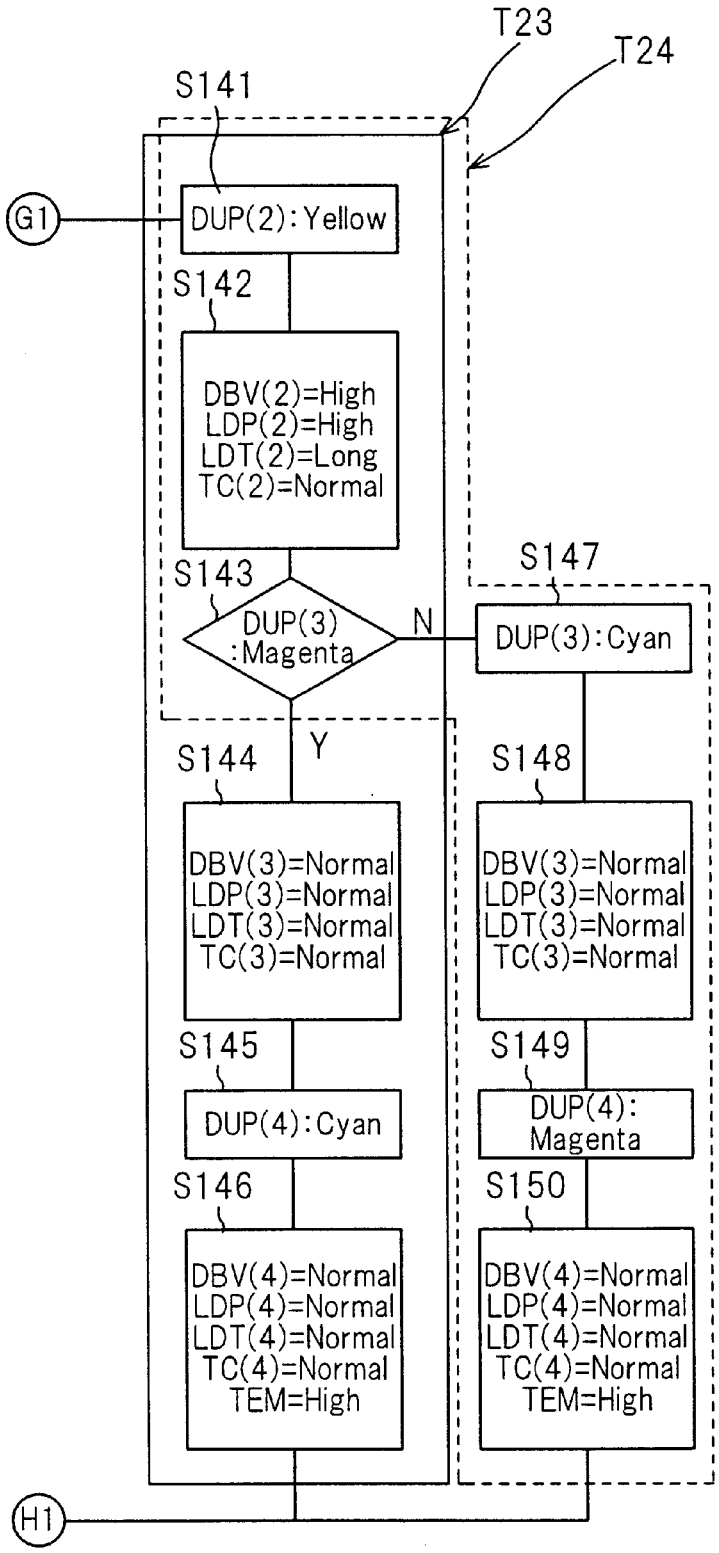
FIG. 11 is a flowchart showing the continuation of subroutine 4 following FIG. 10.

As shown in FIGS. 10 and 11, in subroutine 4 for the toner color of the developing unit set at DUP(1) being black, the toner color of the developing unit at DUP(2) (S121, S131, S141), the toner color of the developing unit at DUP(3) (S123, S127, S133, S137, S143, S147), and the toner color of the developing unit at DUP(4) (S125, S129, S135, S139, S145, S149) are successively checked and confirmed. In FIGS. 10 and 11, each color confirmation flow is indicated by corresponding number (No. T19 to No. T24) in Table 1.

When the color at each developing unit position DUP is confirmed, the image forming conditions corresponding to the development color are set up (S122, S124, S126, S128, S130, S132, S134, S136, S138, S140, S142, S144, S146, S148, S150). When the development color of the developing unit set at DUP(4) is confirmed, the fixing temperature TEM and fixing speed as the forming conditions are set (S126, S130, S136, S140, S146, S150). Here, only the fixing temperature is mentioned in the flowchart.

Next, description will be made returning to FIG. 3.

In the above way, CPU 34 sets up the image forming conditions for all the colors in accordance with the order of development and temporarily stores them into RAM 36. Then, process control is performed by developing images on photosensitive drum 12 with developing units 14*a* to 14*d*, under the determined image forming conditions (S16). That is, the state of the image formed on photosensitive drum 12 is checked by process control sensor 19, so as to set up modified developing bias values DVBP for developing units 14*a* to 14*d*.

Next, CPU 34, based on the image forming conditions, carries out the image forming operation described below. First, I is assumed as the number indicating the sequential order of development, and I is set equal to 1 (I=1). Then, the first image forming is carried out under the image forming conditions stored in RAM 36. This image forming begins with uniform charging of photosensitive drum 12 by charger 18 (S18). LSU 11 exposes photosensitive drum 12 at exposure power LDP (1) for a period of exposure time LDT (1), which are the exposure conditions, to thereby form a static latent image (S19). Next, development is carried out with the optimal developing bias DVB which is the modified developing bias DVBP (1) plus developing bias DBV (1) characterized by the color order, using the developing unit located at DUP(1) (S20). Then, the image is transferred to intermediate transfer element 15 with the transfer voltage set at TC(1) (S21).

When the first color component image has been formed, it is checked if I=4 (S22), then I=I+1 at S23 and the operation returns to S18. This sequence from S18 to S21 is repeated until I=4. Thus, multiple layers of color toners are formed on intermediate transfer element 15, from the top to the bottom in the order opposite to the developing order. When the developed image of the fourth color is completely laid on intermediate transfer element 15, all the layers of toners are transferred at one time to print paper 20 and then the toner is fixed at fixing temperature TEM (S24). The multiple layers of color toners are formed on print paper 20, from the top to the bottom, in the developing order.

Now, setup of the aforementioned image forming conditions will be described in detail.

Figure 12:
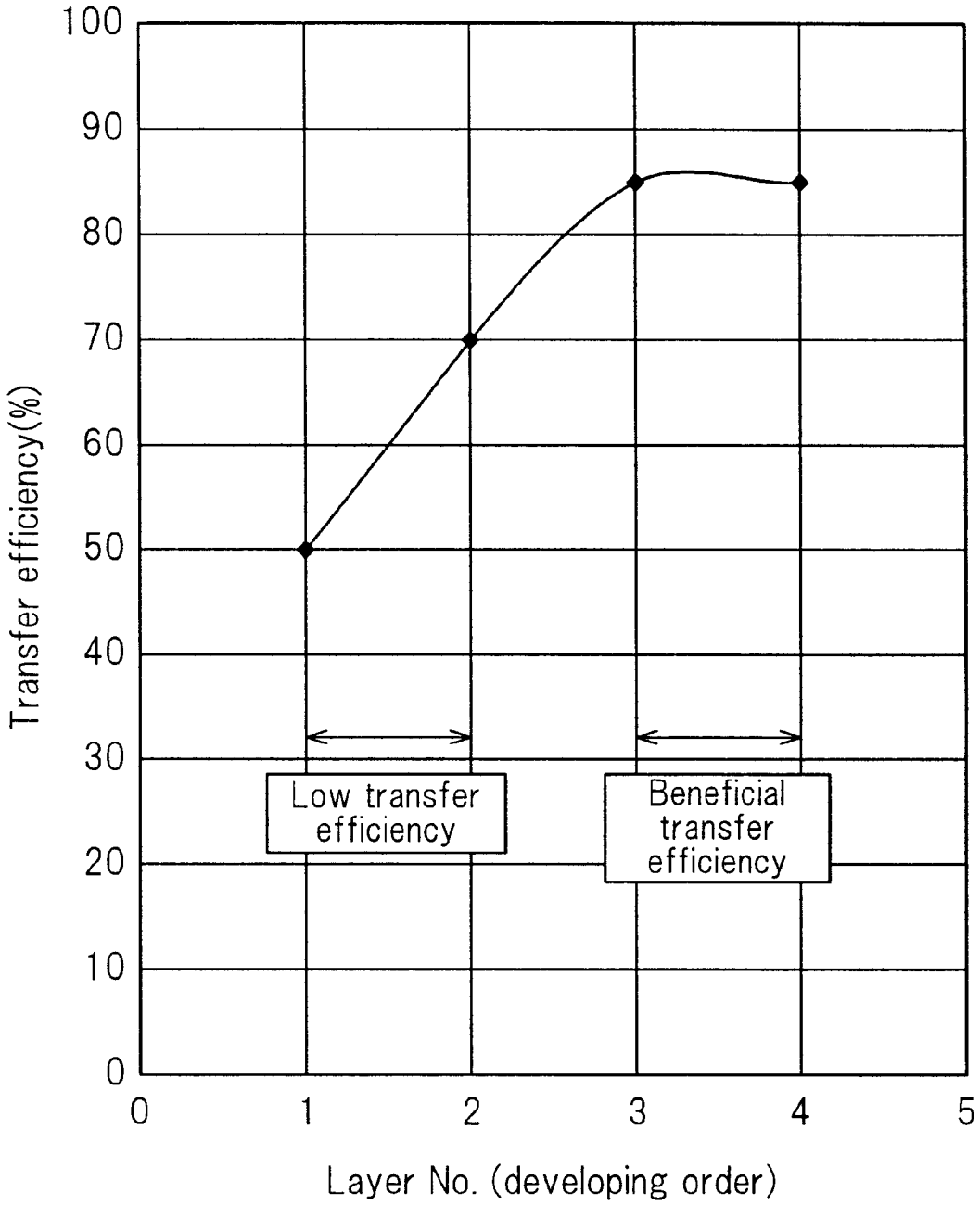
FIG. 12 is a chart of characteristics showing the relationship between the order of development and the transfer efficiency in the first embodiment.
Figure 13:
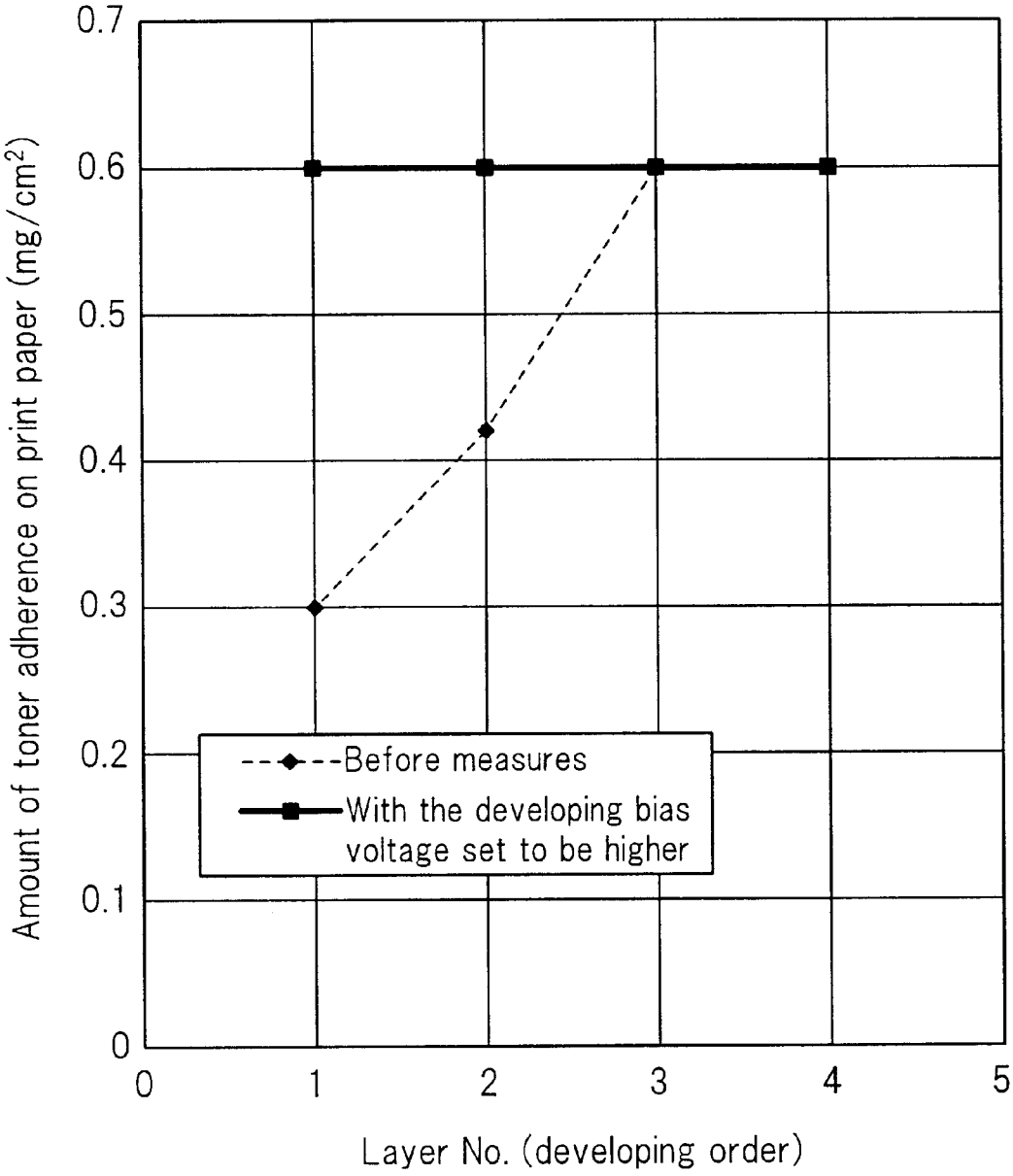
FIG. 13 is a chart of characteristics showing the relationship between the order of development and the amount of toner adherence on the print paper when the developing bias is varied in the first embodiment.

When multiple colors of toners are transferred to print paper 20, the colors in the lower layers on intermediate transfer element 15, or the colors in the upper layers on the print paper, or more specifically, the first and second colors in the developing order have their transfer efficiency lowered, posing a problem of lowering the color reproducibility (causing hue deviation). FIG. 12 shows the relation between the developing order of colors and the transfer efficiencies. FIG. 13 shows the amount of toner adherence per unit area when the developing bias is set to be higher. As seen in FIG. 12, the first and second colors present poor transfer efficiencies with respect to print paper 20 whereas the third and fourth colors present sufficient transfer efficiencies. This fact is also confirmed from FIG. 13, from which the amounts of the first and second toner adherence per unit area to print paper 20 are lower while the third and fourth layers have sufficient amounts of the toner adherence per unit area. To deal with this situation, when the light exposed photosensitive drum 12 is developed, developing bias DBV is set and controlled so that the developing bias voltages for the first color (the color developed first, for example, will be called the first color) and second color will be higher than that of the third and fourth colors (S4 to S15 in FIG. 3). As seen in FIG. 13, all the layers have uniform amounts of toner adherence, 0.6 mg/cm$^2$, so that it is understood that the above control is effective in stabilizing the amount of adherence and hence color reproducibility. Thus, even if the order of developing units 14*a* to 14*d* is changed, the suitable image forming conditions can be set up automatically, thus eliminating density failure, low reproducibility in hue, low reproducibility in fine lines and other deficiencies, as well as providing stable, multi-color images having uniform image quality.

Figure 14:
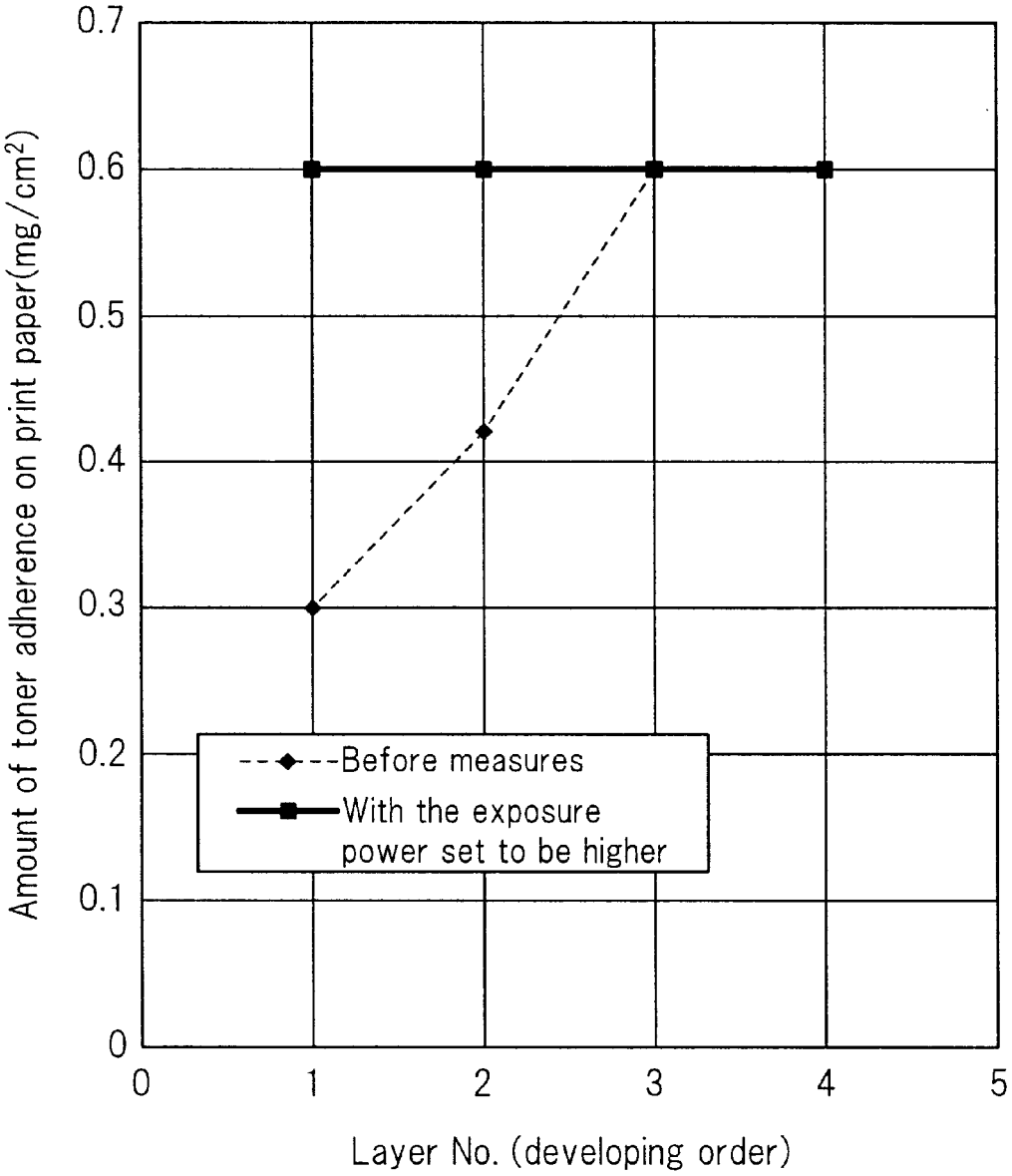
FIG. 14 is a chart of characteristics showing the relationship between the order of development and the amount of toner adherence on the print paper when the exposure power is varied the first embodiment.

The signal output from the document reading portion such as CCD etc., is subjected to the predetermined image processing and shaped into image data through an unillustrated image processing portion. When start of an image forming operation is instructed, CPU 34 outputs the generated, image data of color components to LSU 11 in association with colors. LSU 11 forms each static latent image on photosensitive member 12 with the predetermined exposure power LDP. Also in this case, as shown in FIG. 12, the transfer efficiency lowers towards the final color (the color in the topmost layer) on the print paper 20 (the transfer efficiency of the first and second colors in the developing order lowers). Therefore, upon exposure during an image forming operation, if the exposure power is set constant for all the colors, the amounts of toner adherence on print paper 20 for the first and second colors lower, as shown in FIG. 14. To deal with this situation, the exposure power LDP of LSU 11 for the first and second colors is set to be higher than that for the third and fourth colors (S4 to S15 in FIG. 3). This enables provision of uniform and stable images, and even if the order of developing units 14*a* to 14*d* is changed, the suitable image forming conditions can be set up automatically, thus eliminating density failure, low reproducibility in hue and low reproducibility in fine lines, as well as providing stable, images having uniform image quality. As seen in FIG. 14, all the layers have a uniform toner adherence amount of 0.6 mg/cm$^2$ after this measure, so that it is understood that the above control is effective in stabilizing the amount of adherence and hence color reproducibility.

Figure 15:
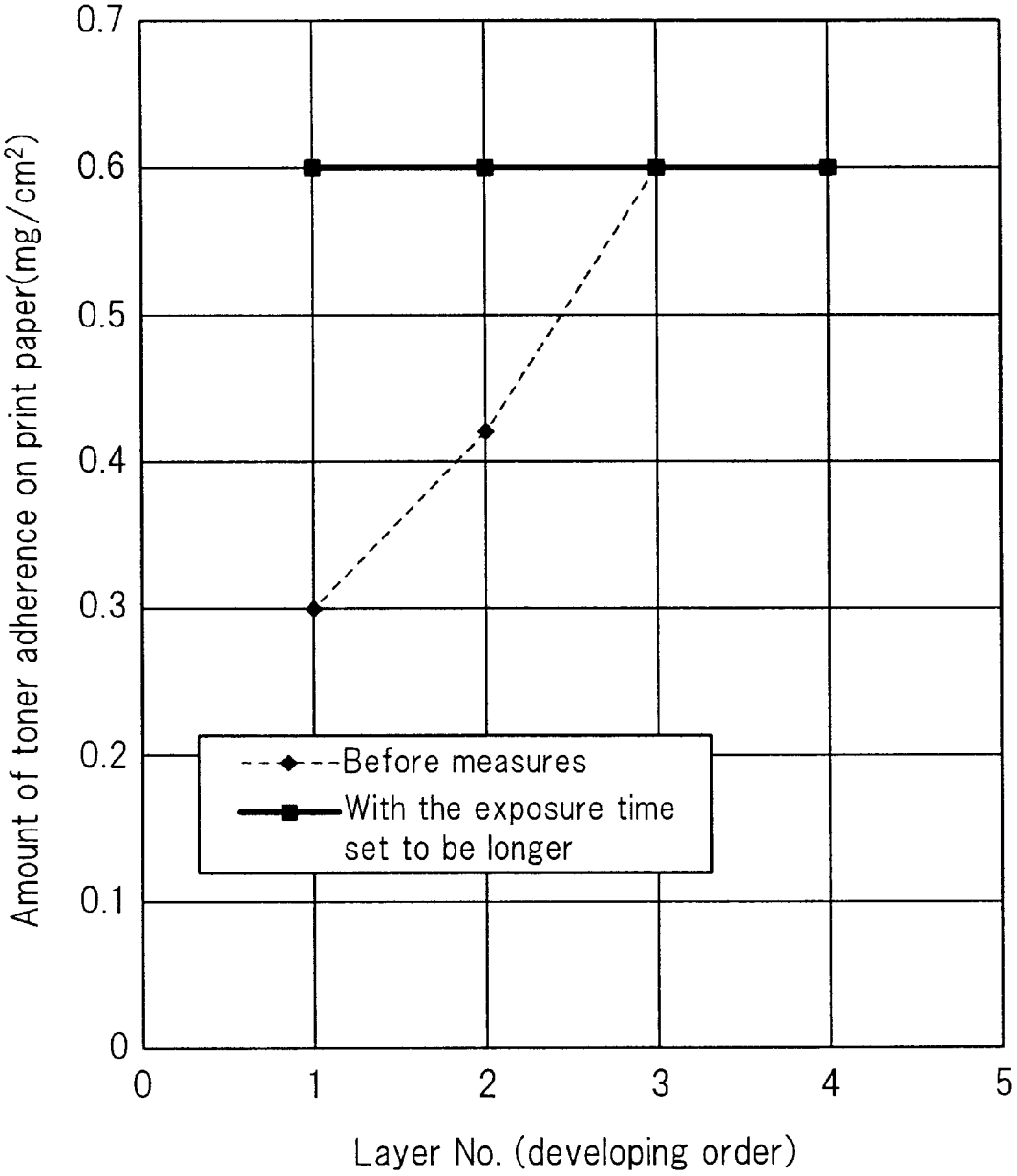
FIG. 15 is a chart of characteristics showing the relationship between the order of development and the amount of toner adherence on the print paper when the exposure time is varied in the first embodiment.

Upon exposure during an image forming operation, if the exposure time LDT of LSU 11 is set constant for all the colors, the amounts of toner adherence on print paper 20 for the first and second colors lower, as shown in FIG. 15. To deal with this situation, the exposure time LDT of LSU 11 for the first and second colors is set to be longer than that for the third and fourth colors (S4 to S15 in FIG. 3). This enables provision of uniform and stable images, and even if the order of developing units 14*a* to 14*d* is changed, the suitable image forming conditions can be set up automatically, thus eliminating density failure, low reproducibility in hue and low reproducibility in fine lines, as well as providing stable, images having uniform image quality. As seen in FIG. 15, all the layers have a uniform toner adherence amount of 0.6 mg/cm$^2$ after this measure, so that it is understood that the above control is effective in stabilizing the amount of adherence and hence color reproducibility.

Figure 16:
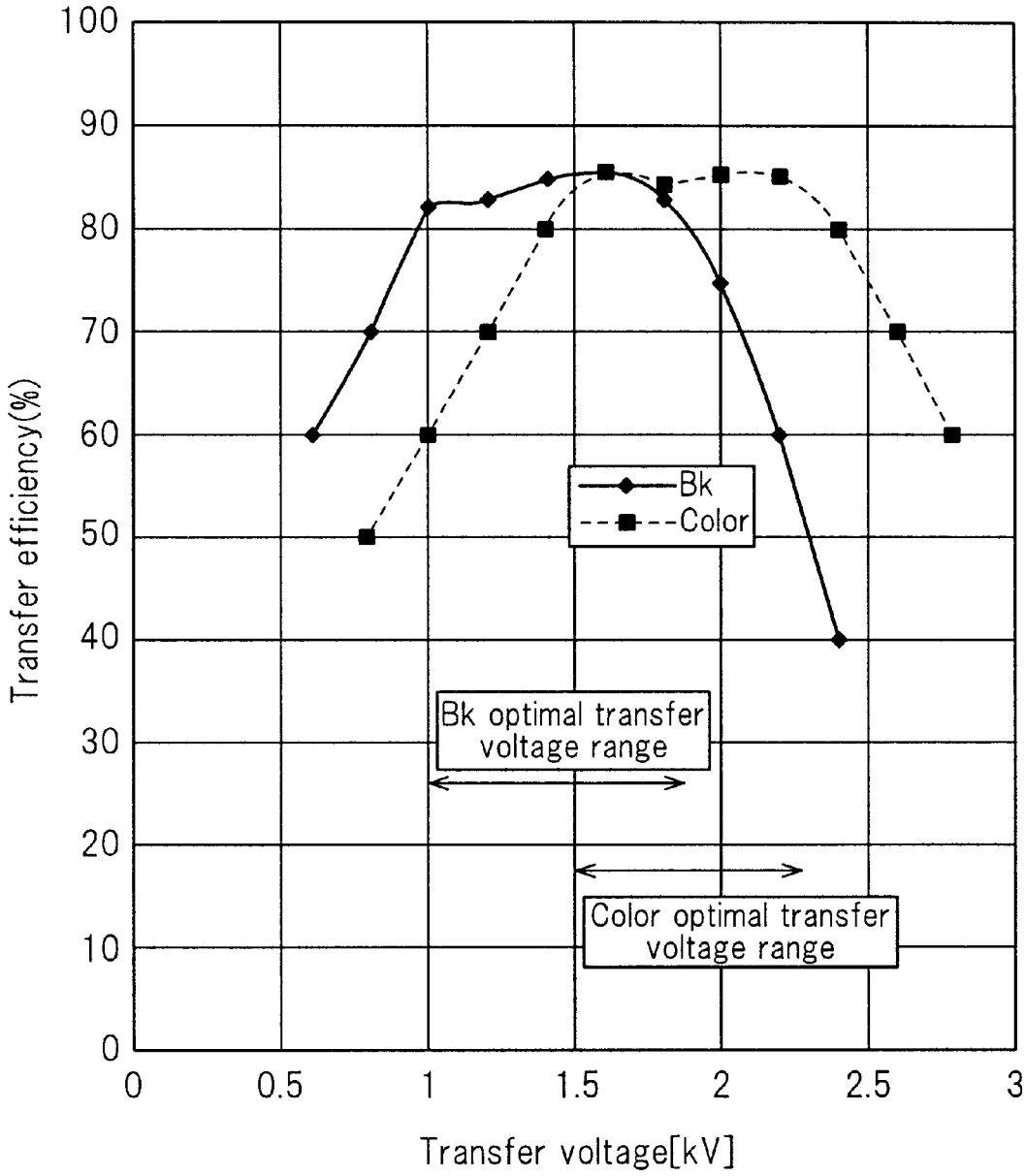
FIG. 16 is a chart of characteristics showing the relationship between the transfer voltage and the transfer efficiency for black and color toners, especially showing their optimal transfer voltage ranges.

Further, as shown in FIG. 16, the optimal transfer voltage TC for black printing is lower than that for color printing (magenta, cyan, yellow). Therefore, a good transfer efficiency of black toner transfer to intermediate transfer element 15 can obtained by setting up a lower transfer voltage TC. So, for transfer of the toner images formed on photosensitive drum 12 to intermediate transfer element 15, the transfer voltage TC for black printing is controlled to be lower than that for color printing (S4 to S15 in FIG. 3). This control enables black printing, which has a lower optimal transfer voltage TC than the others, to present uniform and stable images, and even if the order of developing units is changed, image forming conditions can be set up automatically, thus eliminating density failure, low reproducibility in hue and low reproducibility in fine lines and other deficiencies.

Figure 17:
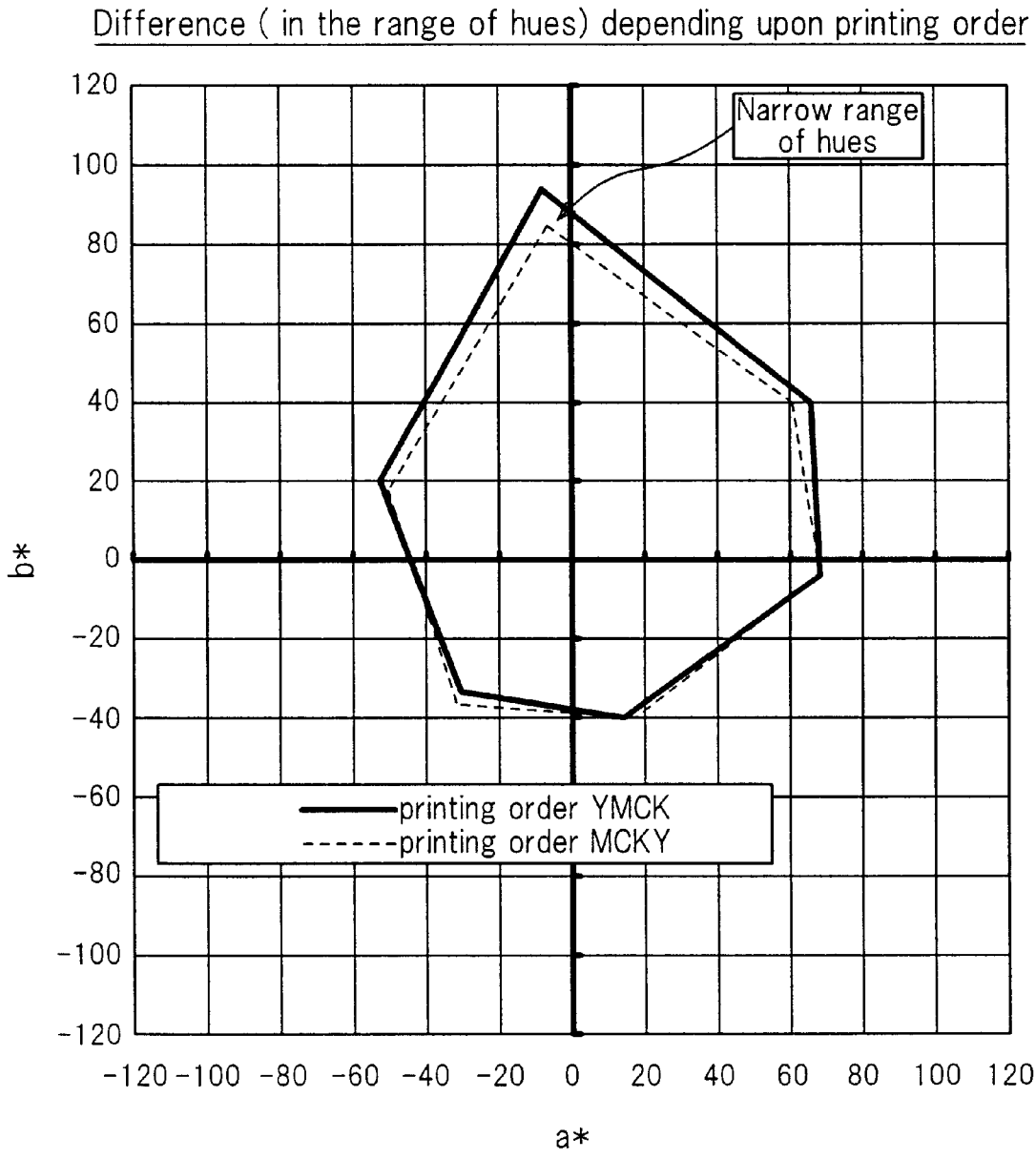
FIG. 17 is a chart of characteristics showing the relationship between the chroma and the order of printing to the print paper in the first embodiment.
Figure 18:
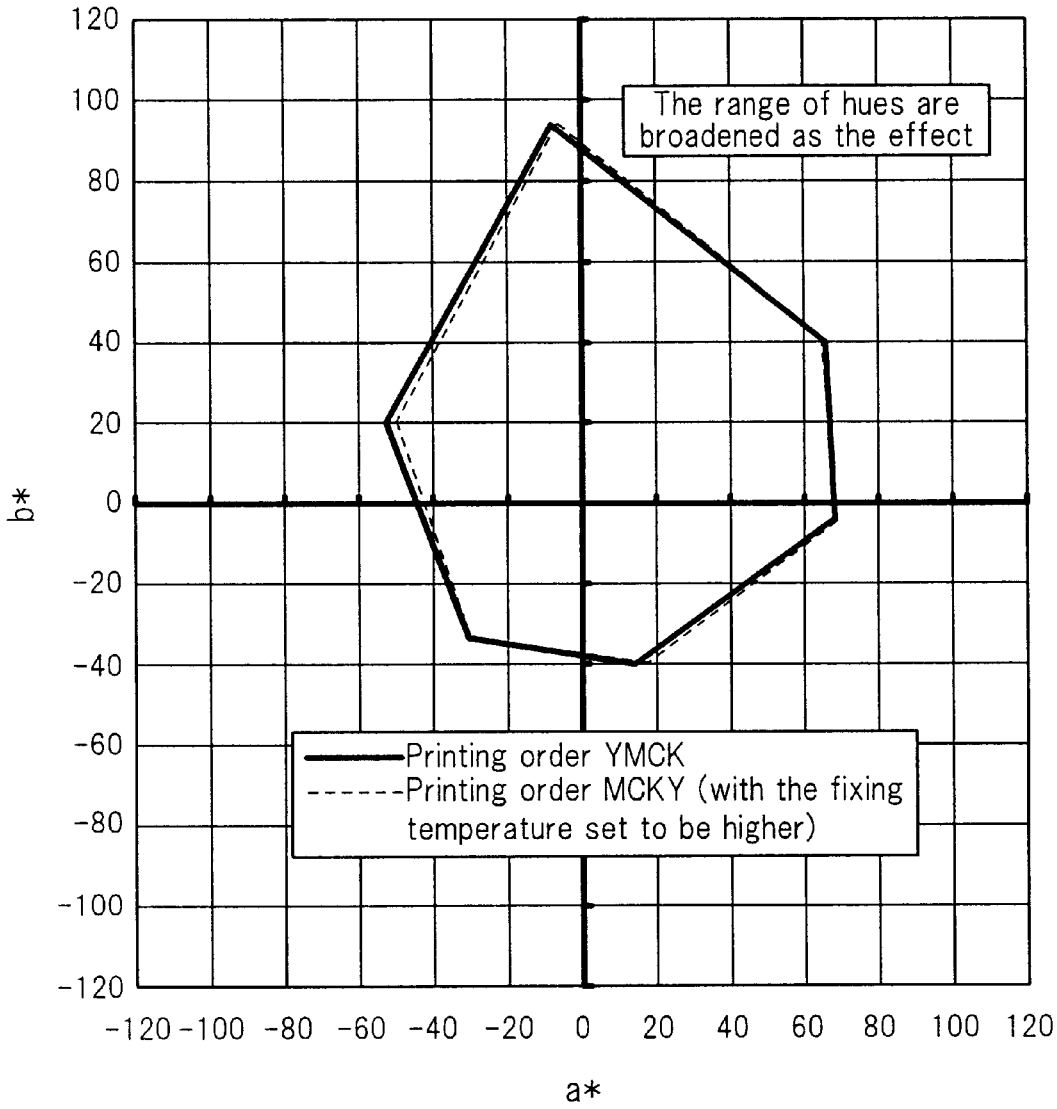
FIG. 18 is a chart of characteristics showing the relationship between the chroma and the order of printing to the print paper when the fixing temperature is varied in the first embodiment.

FIG. 17 shows the dependence of chroma upon the order of printing in the CIELAB color space coordinates. Upon fixing the toner image transferred to print paper 20, if low chromatic colors such as black, cyan, magenta exist in the upper layer, the chroma becomes narrow. To deal with this situation, the fixing temperature TEM is set to be higher when the low chromatic colors exist in the upper layer than when high chromatic colors such as yellow exist in the upper layer (S4 to S15 in FIG. 3). This control enhances the chroma and broadens the range of hues in the former case to be as wide as the case where high chromatic colors exist in the upper layer. FIG. 18 shows the dependence of chroma upon the fixing temperature in the same space coordinates. As seen from this chart, increase in fixing temperature enables provision of high chromatic images, regardless of the printing order.

Figure 19:
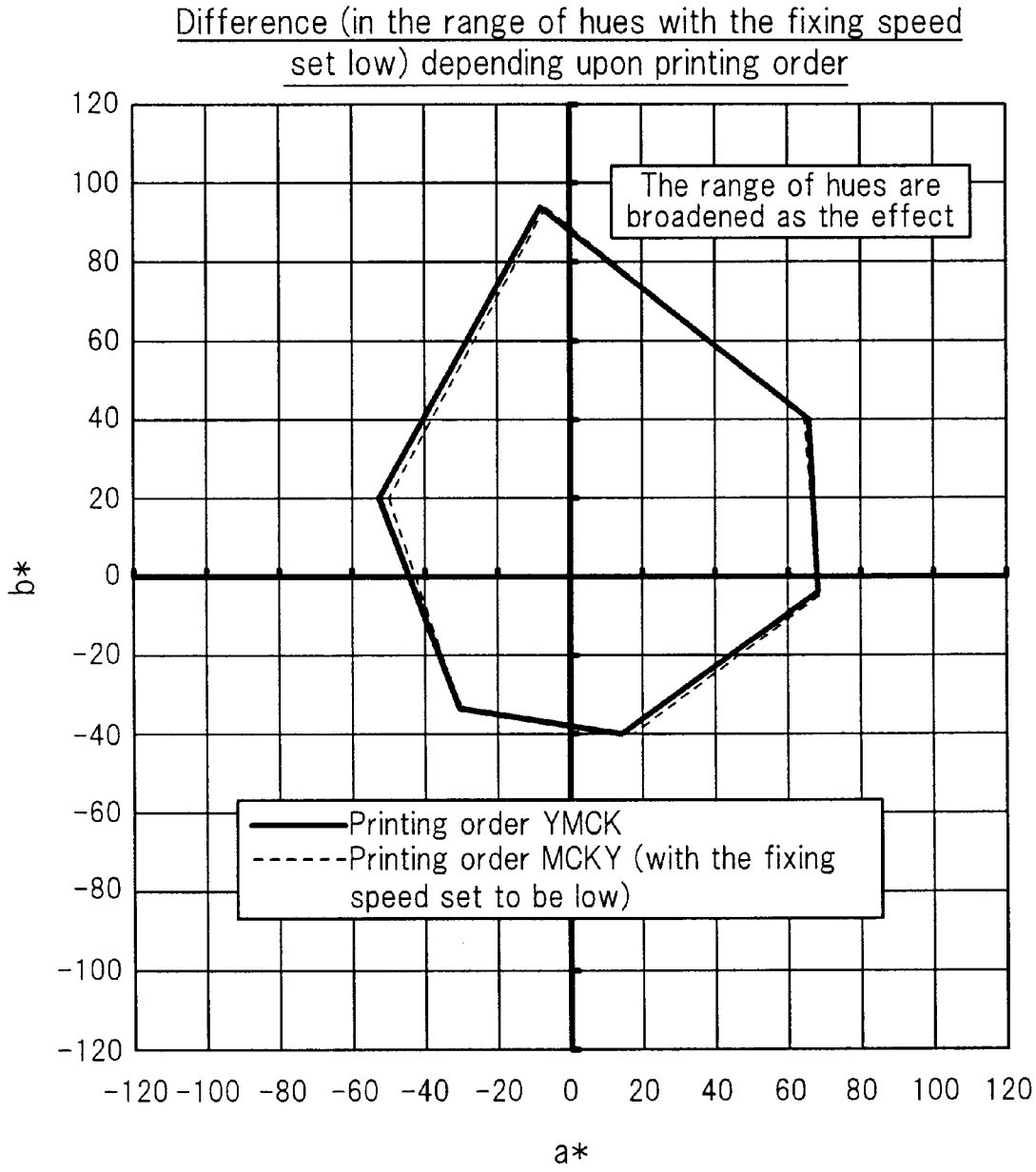
FIG. 19 is a chart of characteristics showing the relationship between the chroma and the order of printing to the print paper when the fixing speed is varied in the first embodiment.

Though not shown in the flowchart, it is also possible to change the fixing speed. Upon fixing the toner image transferred to print paper 20, the fixing speed is set to be lower when the low chromatic colors such as black, cyan, magenta exist in the upper layer than when high chromatic colors such as yellow exist in the upper layer. This control enhances the chroma and broadens the range of hues. FIG. 19 shows the dependence of chroma upon the fixing speed in the same space coordinates. As seen from this chart, reduction in fixing speed enables provision of high chromatic images, regardless of the printing order.

(The Second Embodiment)

Figure 20:
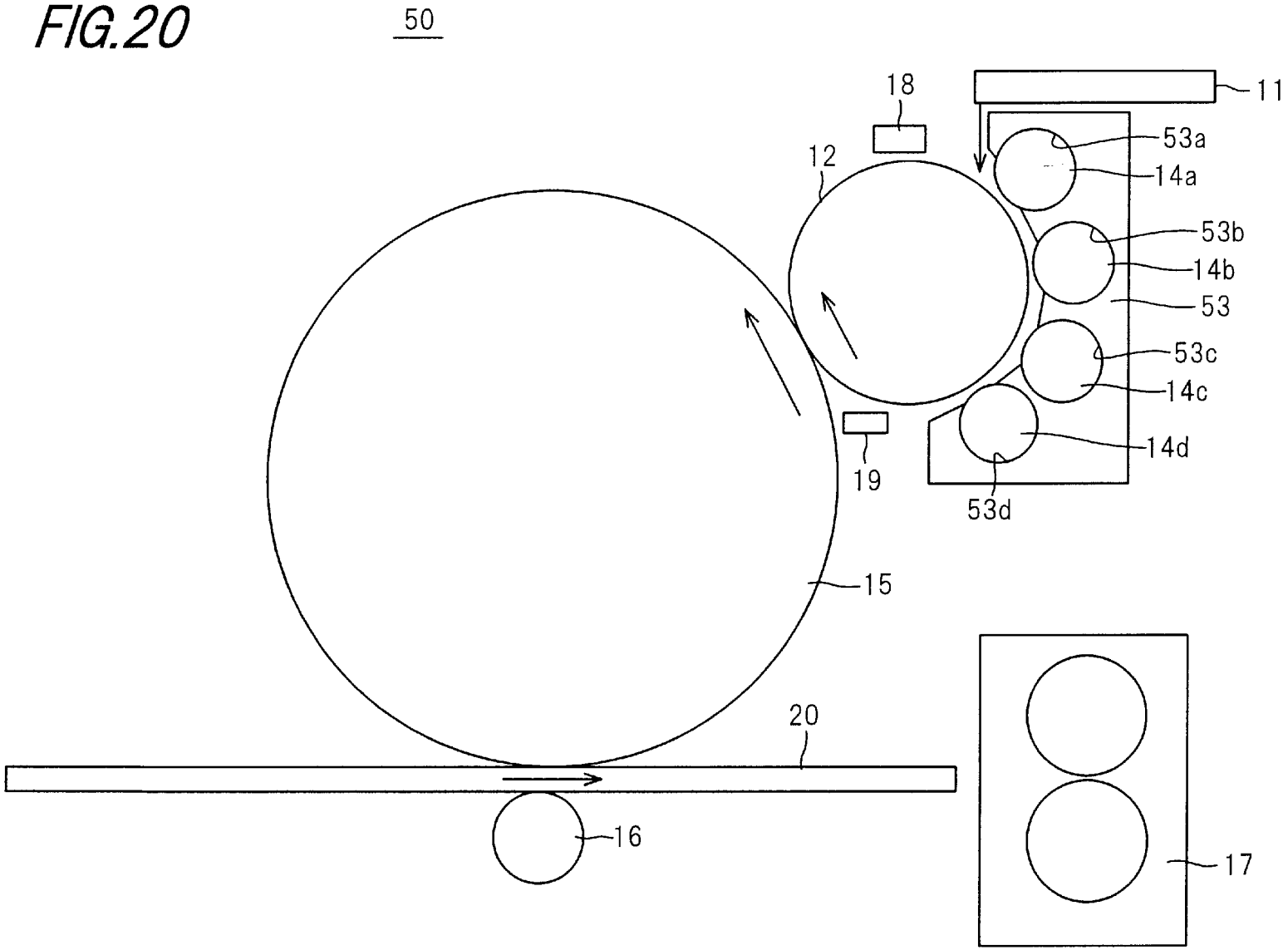
FIG. 20 is an overall schematic view showing the second embodiment of the image forming portion in an image forming apparatus according to the present invention.

FIG. 20 is an overall view showing the second embodiment of the image forming portion in an image forming apparatus according to the present invention. The image forming portion, designated at 50, has almost the same configuration as in the first embodiment, so that the same parts are allotted with the same reference numerals without detailed description. The difference from the first embodiment resides in a developing unit holder 53.

Figure 21:
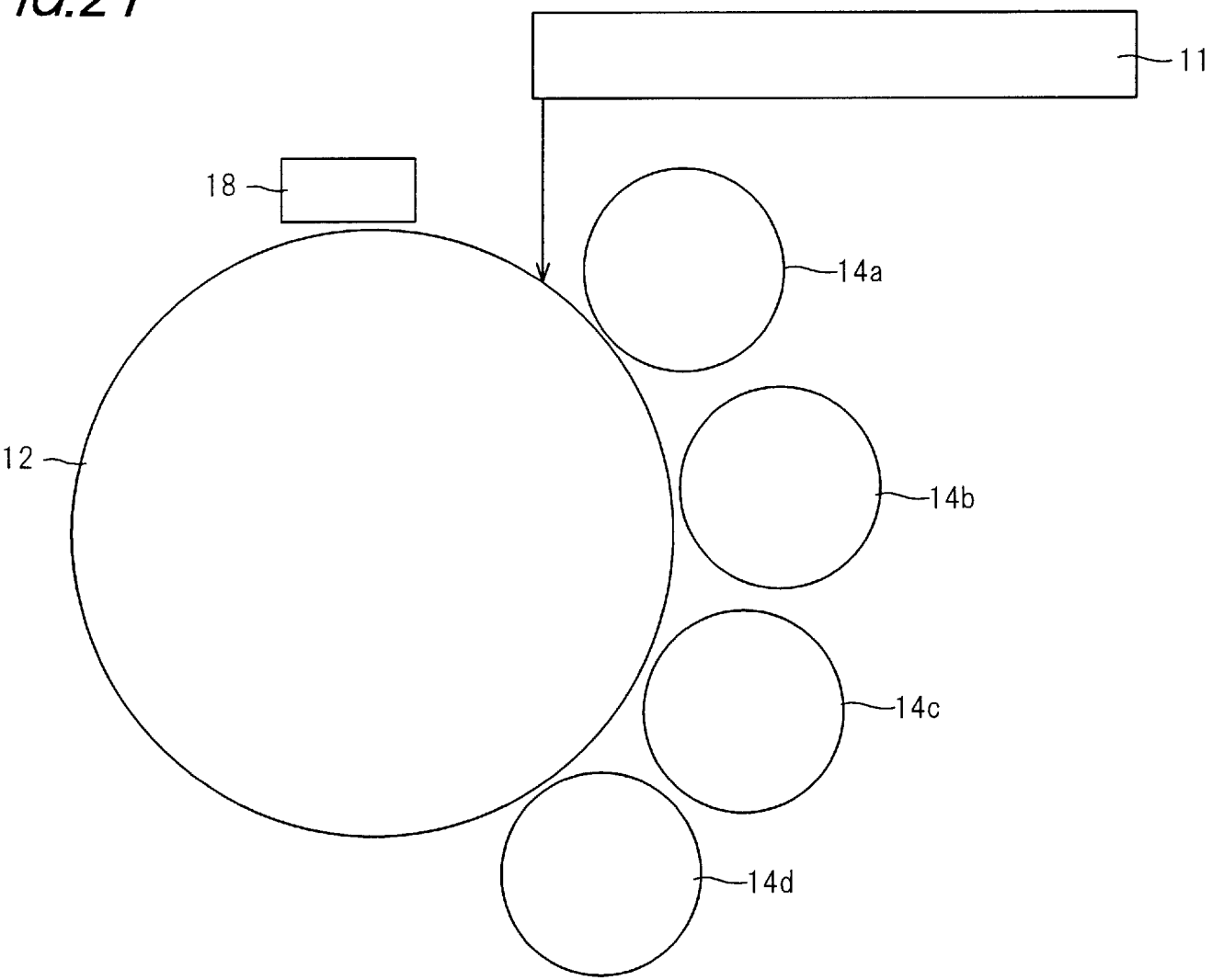
FIG. 21 is a partially enlarged view showing developing units and a photosensitive drum in the second embodiment.

FIG. 21 is a partially enlarged view showing a photo sensitive drum with developing units. Developing units 14*a* to 14*d* are arranged along the photosensitive drum 12 surface. This means that accommodation sockets (holders) 53*a* to 53*d* of developing unit holder 53 are arranged around photosensitive drum 12. Naturally, differing from the first embodiment, developing units 14*a* to 14*d* are fixed and will not move. As in the first embodiment, all the developing units 14*a* to 14*d* have the same configuration.

As in the first embodiment, development is carried out in the order from developing units 14*a* to 14*d* and the developed, multiple color images are transferred and superimposed one over another to intermediate transfer element 15. Then, the superimposed images are finally transferred and fixed to print paper 20 all at once. The control portion for image forming conditions is the same as that shown in FIG. 2.

Figure 22:
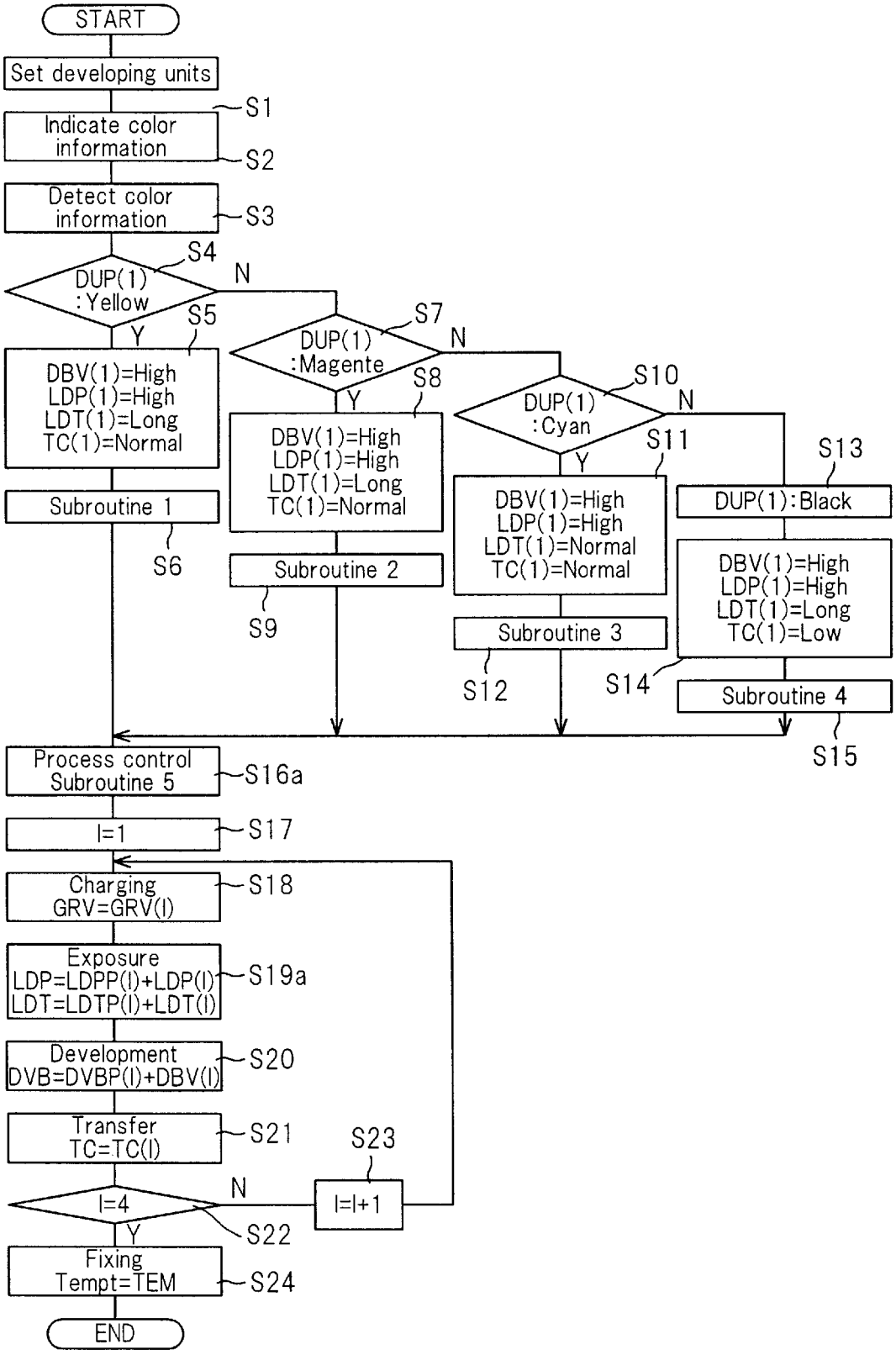
FIG. 22 is a flowchart showing the control steps of the controller of the second embodiment.

FIG. 22 is a flowchart showing the control steps in this image formation. Since this flowchart is basically the same as that of the first embodiment shown in FIG. 3, the same parts are allotted with the same numerals without description. The difference from the first embodiment resides in subroutine 5 in the process control at step S16*a* and setup of the exposure conditions at step S19*a* shown in FIG. 22.

Figure 23:
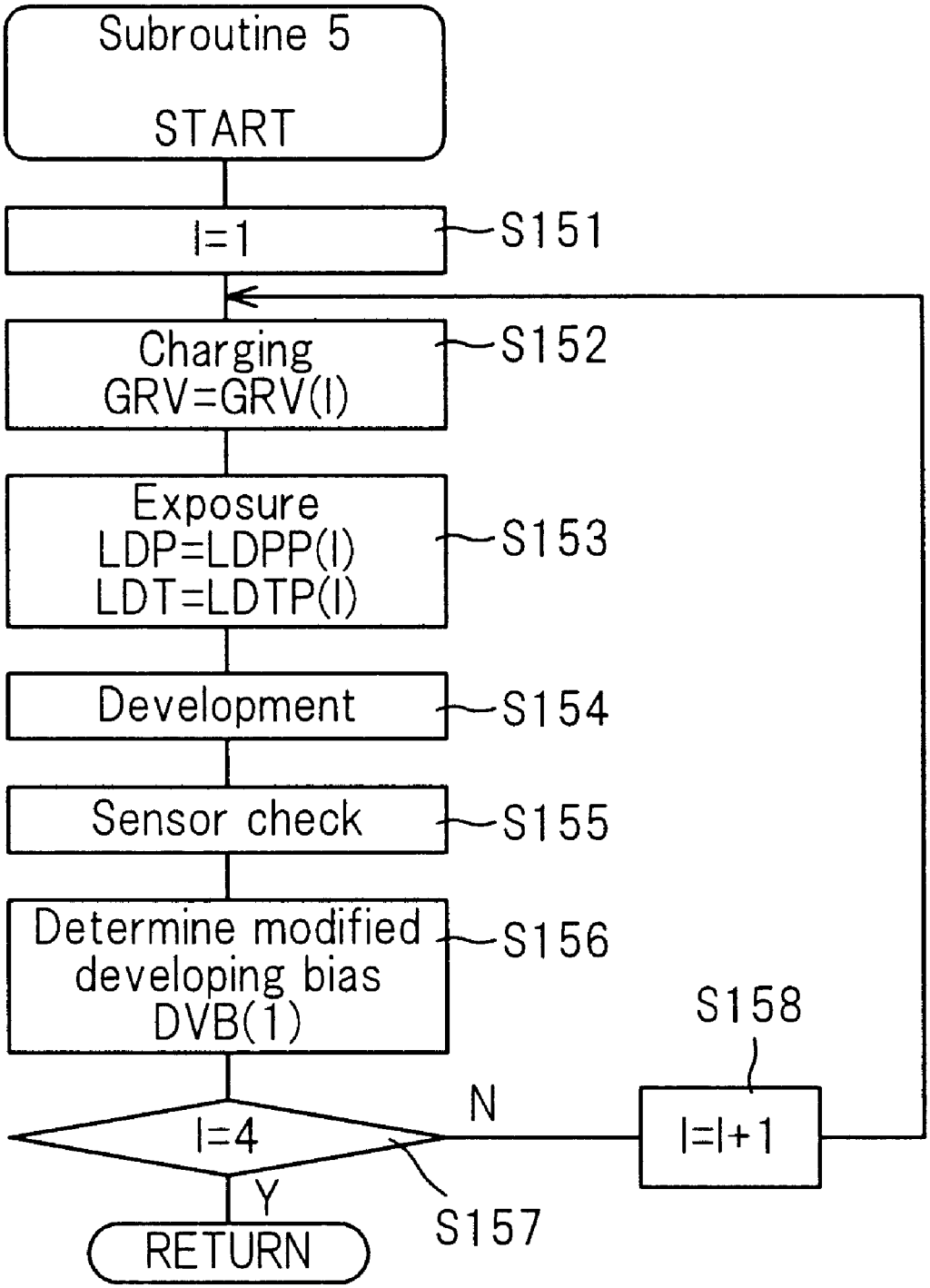
FIG. 23 is a flowchart showing subroutine 5.

Since developing units 14*a* to 14*d* are arranged along photosensitive drum 12, the distance (the angle of arrangement) from the charging station to each developing station differs from one to the others, so that subroutine 5 sets up modified image forming conditions, taking it into account, as shown in FIG. 23.

First, the sequential order is set equal to 1 (I=1) at S151, then the image forming conditions of developing unit 14*a* located at DUP(1) are set up. The grid voltage GRV(1) of charger 18 is determined so as to charge photosensitive drum 12 uniformly (S152). Next, modified exposure power LDPP (L) and modified exposure time LDTP(1) of LSU 11 are set again (S153). Development is effected by developing unit 14*a* under these conditions (S154), then the resulting developed state is checked by process control sensor 19 (S155). Based on the detection result of sensor 19, CPU 34 determines modified developing bias DVBP(I) (S156). At S157, it is checked whether I=4. If not, then I=I+1, and the operation returns to S152. In this way, the processing steps S152 to S156 are repeated until I=4, thus completing determination of modified developing bias voltages DVBP(2) to DVBP(4) of developing units 14*b* to 14*d*.

Secondary, CPU 34 performs image forming from S17 to S22, based on the image forming conditions. This operation is almost the same as that described in the first embodiment, so only the difference will be described. At S19*a*, photosensitive drum 12 is exposed by LSU 11 under the exposure conditions, i.e., with the optimal exposure power LDP for a period of the optimal exposure time LDT, to form a static latent image. Here, this optimal exposure power LDP is the modified exposure power LDPP plus exposure power LDP (I) dependent on the color order. The optimal exposure time LDT is the modified exposure time LDTP plus exposure time LDT(I) dependent on the color order. Thus, multiple layers of color toners are formed on intermediate transfer element 15, from the top to the bottom in the order opposite to the developing order. When the developed image of the fourth color is completely laid on intermediate transfer element 15, all the layers of toners are transferred at one time to print paper 20 and then the toner is fixed at fixing temperature TEM (S24). The multiple layers of color toners are formed on print paper 20, from the top to the bottom, in the developing order.

Next, setup of the aforementioned image forming conditions dependent upon the arrangement of the developing units will be described in detail.

Figure 24:
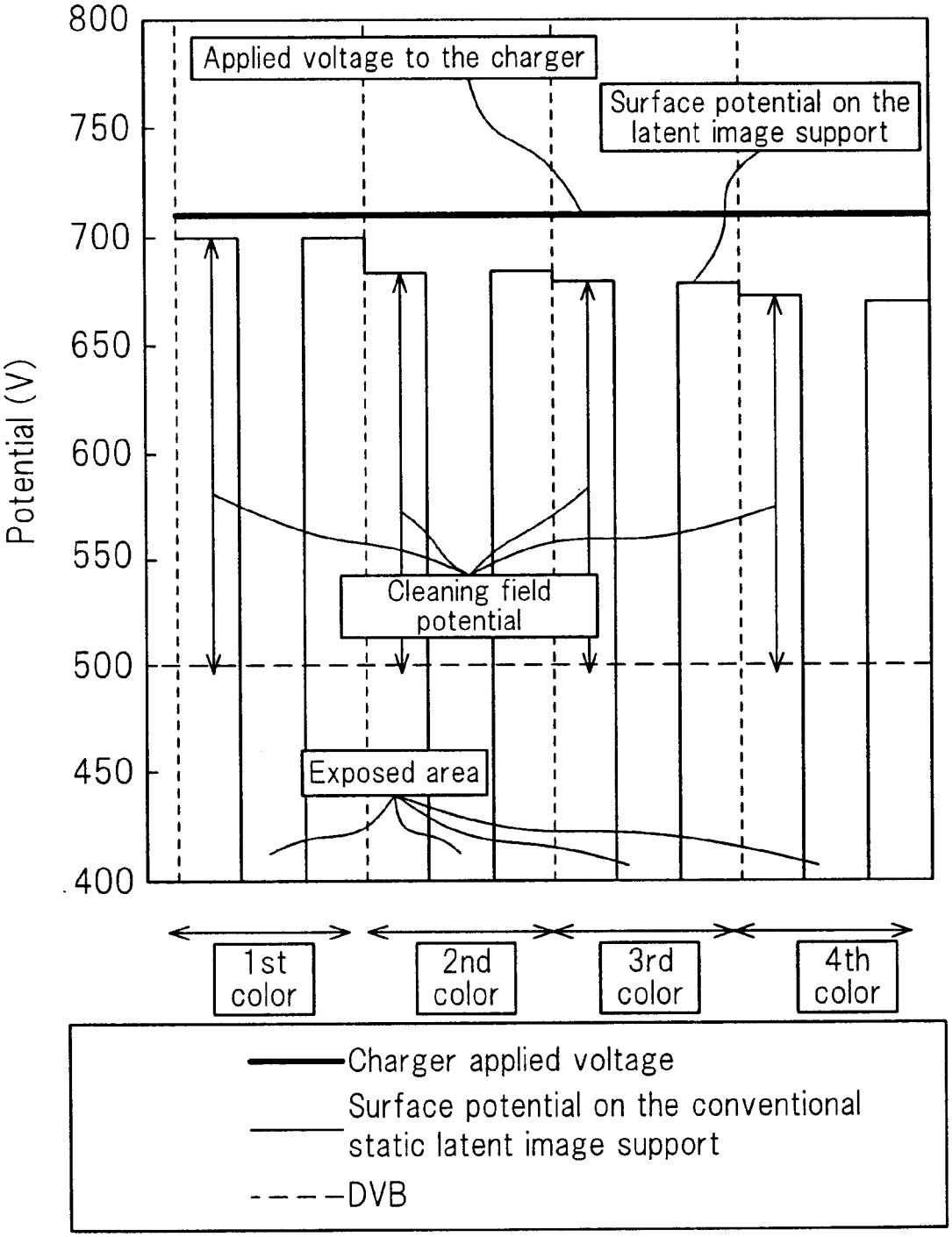
FIG. 24 is a chart of characteristics showing the variations of the surface potential on the photosensitive drum when the same charger voltage is applied.

The surface potential on photosensitive drum 12, charged by charger 18 tends to lower with passage of time because of discharge. FIG. 24 shows the variations in the surface potential of photosensitive drum 12 dependent the distance from the charging station to each developing station when the same charger voltage is applied. Since developing units 14*a* to 14*d* (the first to fourth colors) are located so as to be more distant from charger 18 in this order, the time from charging to the execution of development is different from one of developing units 14*a* to 14*d* to others. Therefore, as shown in FIG. 24, the surface potential on photosensitive drum 12 at the position opposing each of developing units 14*a* to 14*d* lowers in this order (the first to fourth colors). Further, since the cleaning field potential of photosensitive drum 12 at the developing position of each of developing units 14*a* to 14*d* differs from the others, this may cause insufficient cleaning. Here, the cleaning field potential is the potential required for the toner adhering on photosensitive drum 12 to be cleared after image formation, and defined as the difference from the surface potential to developing bias DVB.

The variation in surface potential induces the edge effect or increases toner adherence at edges, degrading the stability of image quality. Also, insufficient cleaning causes rear end voids, fogging and other problems. As a countermeasure, the voltage GRV applied to charger 18 is shifted for each rotation of photosensitive drum 12 depending on the position of each of developing units 14*a* to 14*d* (S152 in FIG. 23).

Figure 25:
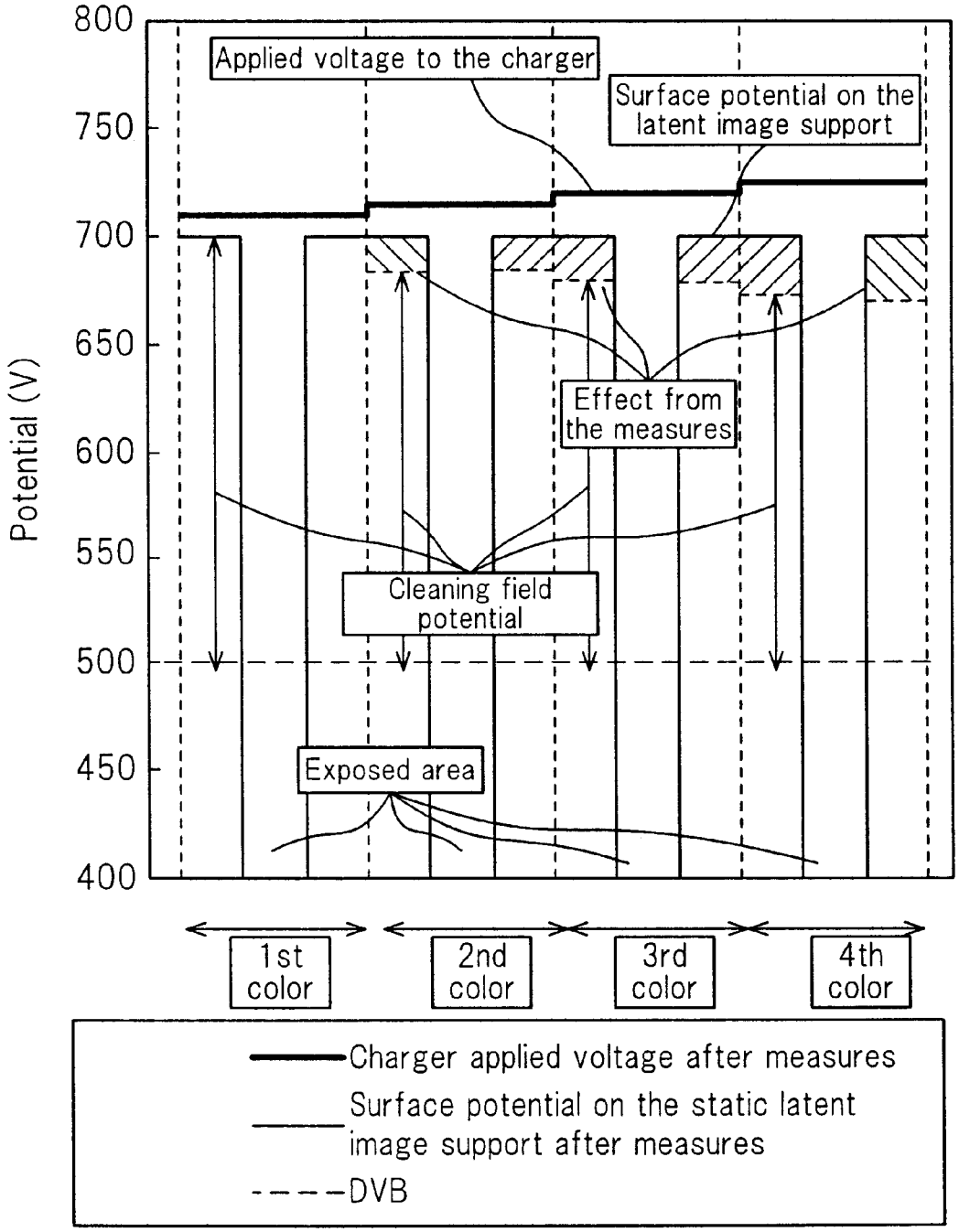
FIG. 25 is a chart of characteristics showing the variations of the surface potential on the photosensitive drum when a different charging voltage is set for each developing unit.

FIG. 25 shows the surface potential on photosensitive drum 12 when the voltage applied to charger 18 is shifted for each of developing units 14*a* to 14*d*. Here, it is assumed that photosensitive drum 12 has a linear speed of 90 mm/s with a diameter of 60 mm. The voltage applied to charger 18 is controlled so that the surface potentials of photosensitive drum 12 at the positions of developing units 14*a* to 14*d* will be equal to each other, taking into account the discharge phenomenon. That is, the voltage applied to charger 18 is increased as the position of the developing unit becomes more distant from charger 18. By this measure, the surface potentials of photosensitive drum 12 at positions of developing units 14*a* to 14*d* become constant, so that it is possible to eliminate adverse effects upon color reproducibility and image quality, edge effects, rear end voids, fogging and other deficiencies due to difference in position between developing units 14*a* through 14*d*.

Figure 26:
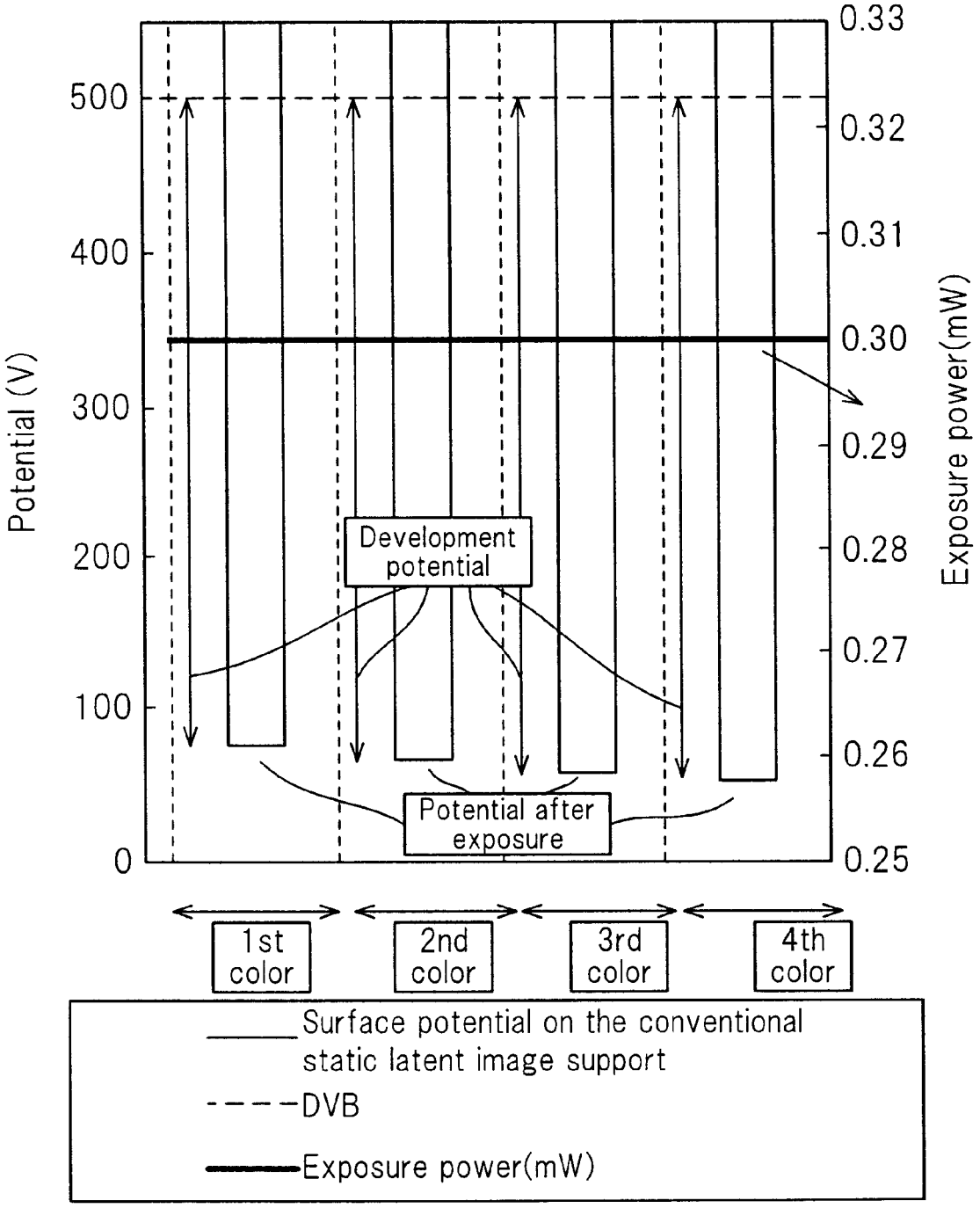
FIG. 26 is a chart of characteristics showing the variations of the surface potential on the photosensitive drum when the exposure power is set at the same level.

Developing units 14*a* to 14*d* are arranged along photosensitive drum 12 so that they become distant from LSU 11 in the order of developing unit 14*a* to 14*d* (see FIG. 21). FIG. 26 shows the surface potentials after exposure on photosensitive drum 12 at positions corresponding to respective developing units when the exposure power is set equal. The surface potential after exposure on photosensitive drum 12 tends to lower with passage of time because of influence of the charge-transfer speed in photosensitive drum 12. Therefore, the surface potential after exposure on photosensitive drum 12 differs from each of developing units 14*a* to 14*d* to others, lowering from the first to fourth colors. Therefore, the development potential at each of developing units 14*a* to 14*d* differs from the others. Here, the development potential is that required for development and is defined as the difference between developing bias DVB and the surface potential after exposure.

The variation in the potential after exposure causes change in the amount of toner adherence, inducing adverse effects such as density failure, low reproducibility in hue and low reproducibility in fine lines. As a countermeasure, the exposure power is shifted for each rotation of photosensitive drum 12 depending on the position of each of developing units 14*a* to 14*d* (S153 in FIG. 23).

Figure 27:
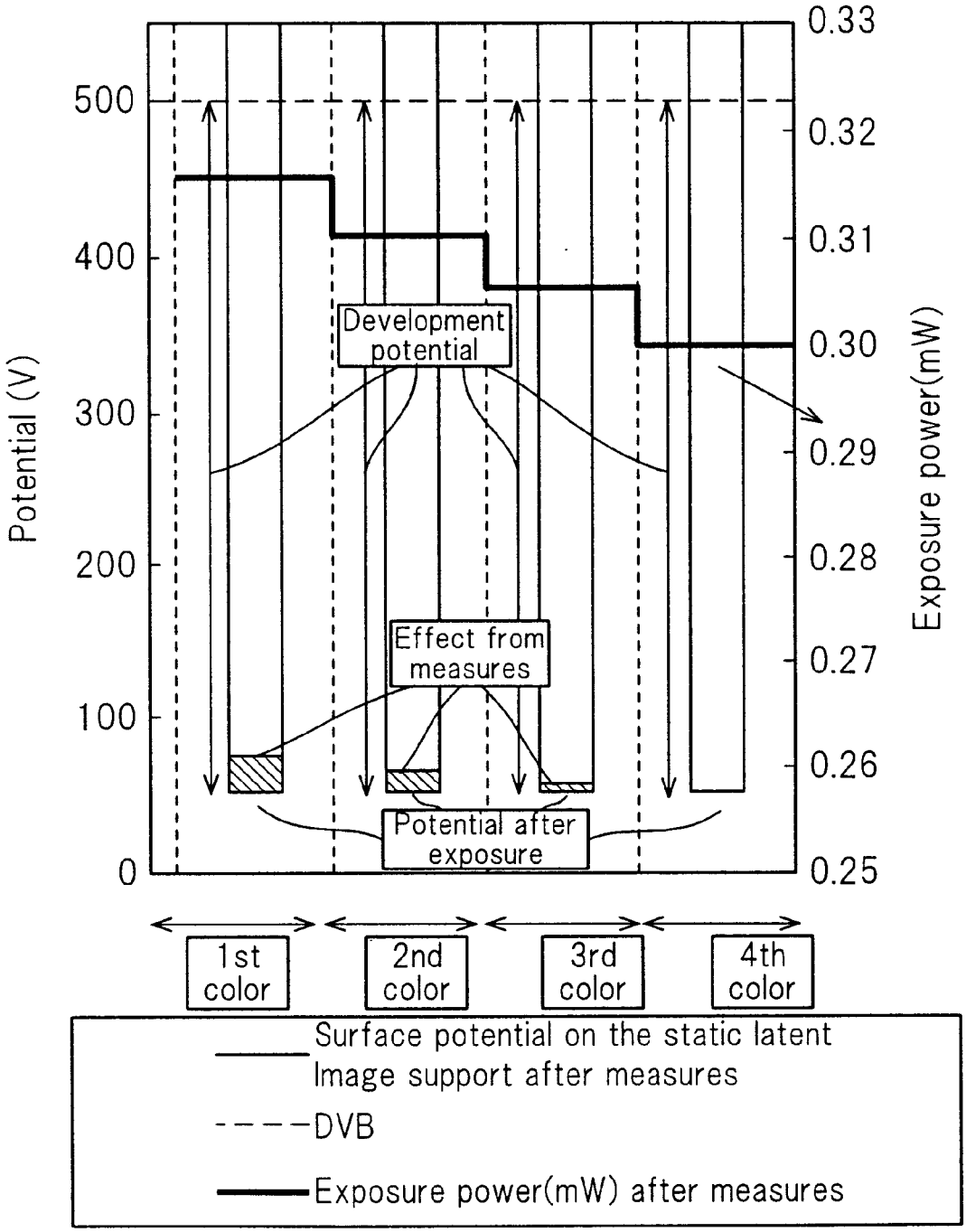
FIG. 27 is a chart of characteristics showing the variations of the surface potential on the photosensitive drum when exposure power is set depending on each developing unit.

FIG. 27 shows the surface potential on photosensitive drum 12 when the exposure power of exposure device 11 is adjusted for each of developing units 14*a* to 14*d*. Here, it is assumed that photosensitive drum 12 has a linear speed of 90 mm/s with a diameter of 60 mm. The exposure power of LSU 11 is set so that the surface potentials of photosensitive drum 12 at the positions of developing units 14*a* to 14*c* will be equal to that of developing unit 14*d*, taking into account the influence of the charge-transfer speed in photosensitive drum 12. That is, for developing units 14*a* to 14*d*, the closer to the exposure position of LSU 11 is the developing unit, the higher is the exposure power (laser power) with which the suitable position of the photosensitive drum is illuminated. This control makes equal the surface potentials after exposure on photosensitive drum 12 at the positions of developing units 14*a* to 14*d*, hence the development potentials at developing units 14*a* to 14*d* become equal to each other. Therefore, it is possible to eliminate adverse effects upon color reproducibility and image quality, density failure, low reproducibility in hue and low reproducibility in fine lines and other deficiencies due to difference in position between developing units 14*a* through 14*d*.

Figure 28:
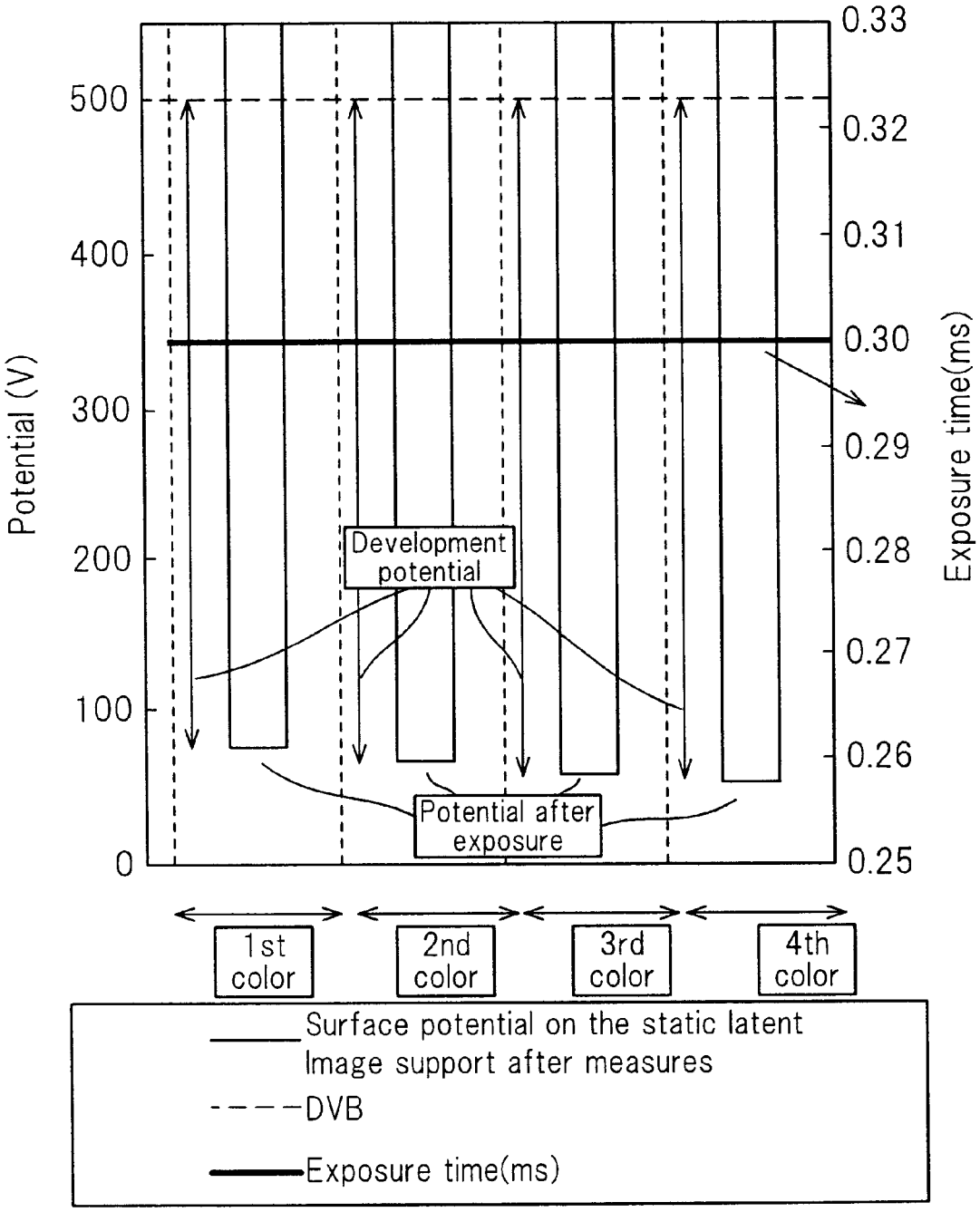
FIG. 28 is a chart of characteristics showing the variations of the surface potential on the photosensitive drum when exposure is done for the same period of time.

Next, FIG. 28 shows the surface potentials after exposure depending upon the positions of developing units 14*a* to 14*d* with respect to the position of exposure when the exposure time is constant. As already stated, the surface potential after exposure on photosensitive drum 12 tends to lower with passage of time because of influence of the charge-transfer speed in photosensitive drum 12. Therefore, the surface potential after exposure on photosensitive drum 12 differs from each of developing units 14*a* to 14*d*, lowering from the first to fourth colors. Therefore, the development potential at each of developing units 14*a* to 14*d* differs from the others. Here, the development potential is that required for development and is defined as the difference between developing bias DVB and the surface potential after exposure.

The variation in the potential after exposure causes change in the amount of toner adherence, inducing adverse effects such as density failure, low reproducibility in hue and low reproducibility in fine lines. As a countermeasure, the exposure time is shifted for each rotation of photosensitive drum 12 depending on the position of each of developing units 14*a* to 14*d* (S153 in FIG. 23).

Figure 29:
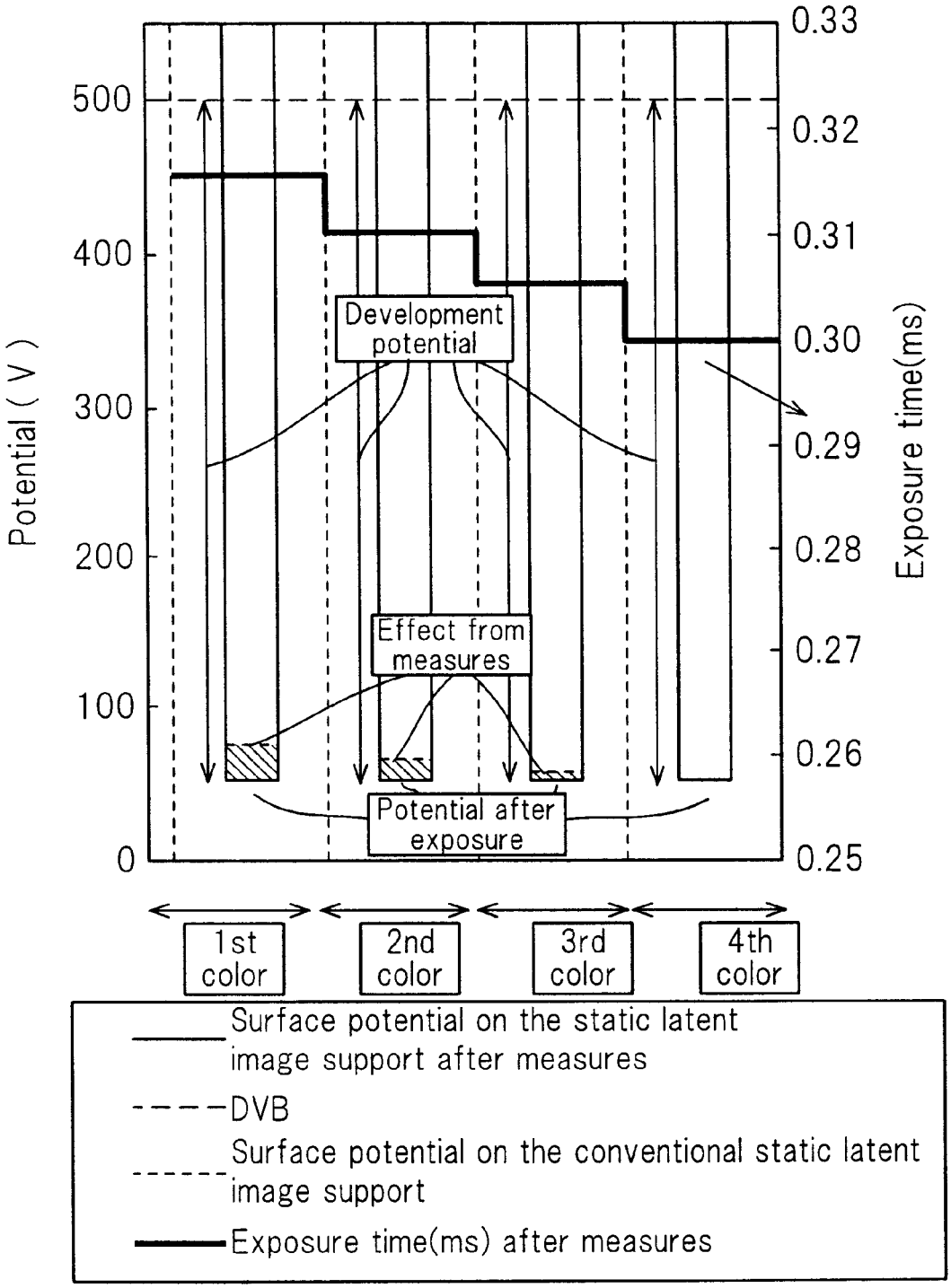
FIG. 29 is a chart of characteristics showing the variations of the surface potential on the photosensitive drum when the exposure is done for a period of time dependent on each developing unit.

FIG. 29 shows the surface potential on photosensitive drum 12 when the exposure time of exposure device 11 is adjusted for each of developing units 14*a* to 14*d*. Here, it is assumed that photosensitive drum 12 has a linear speed of 90 mm/s with a diameter of 60 mm. The exposure time of LSU 11 is set so that the surface potentials of photosensitive drum 12 at the positions of developing units 14*a* to 14*d* will be equal to each other, taking into account the influence of the charge-transfer speed of photosensitive drum 12. That is, for developing units 14*a* to 14*d*, the closer to the exposure position of LSU 11 is the developing unit, the corresponding position of the photosensitive drum is illuminated for a longer exposure time. This control makes equal the surface potentials after exposure on photosensitive drum 12 at the positions of developing units 14*a* to 14*d*, hence the development potentials at developing units 14*a* to 14*d* become equal to each other. Therefore, it is possible to eliminate adverse effects upon color reproducibility and image quality, density failure, low reproducibility in hue, reproducibility in fine lines and other deficiencies due to difference in position between developing units 14*a* through 14*d*.

Since the image forming conditions set through S4 to S15 depending upon the order of the development colors are the same as that described in the first embodiment, description is omitted.

(The Third Embodiment)

Figure 30:
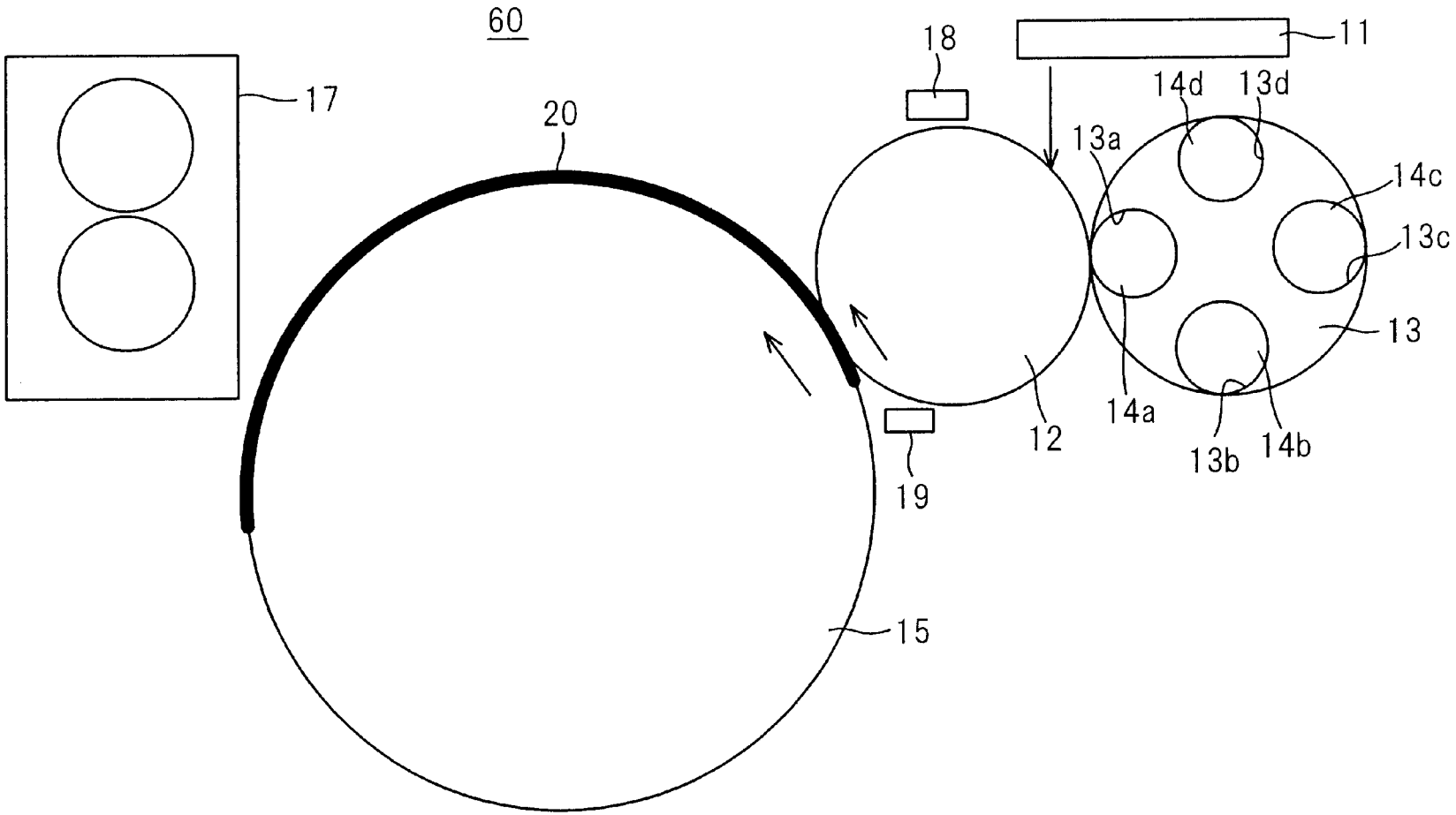
FIG. 30 is an overall schematic view showing the third embodiment of the image forming portion in an image forming apparatus according to the present invention.

FIG. 30 is an overall view showing the third embodiment of the image forming portion in an image forming apparatus according to the present invention. The image forming portion, designated at 60, has almost the same configuration as that in the first embodiment, so that the same parts are allotted with the same reference numerals without detailed description. The difference from the first embodiment resides in that print paper 20 is made to pass through between photosensitive drum 12 and intermediate transfer element 15 so that the image is directly transferred from photosensitive drum 12 to print paper 20. Accordingly there is no transfer member 16 as in the first embodiment. As in the first embodiment, developing unit holder 13 rotates about its cylindrical axis and has a rotary configuration so as to move and set developing unit 14*a* to 14*d* for a color to be developed to the predetermined position of photosensitive drum 12.

The overall operation of this image forming apparatus 60 will be described.

Though not shown FIG. 30, an image signal picked up by the document reader or an image signal sent out from a personal computer is supplied to image forming portion 60. Based on this image signal, LSU 11 arranged above photosensitive drum 12 exposes the photosensitive drum surface in a scan-wise manner, forming a static latent image.

The static latent image on photosensitive drum 12 is developed by causing the toners from developing units 14*a* to 14*d* to adhere thereto. The image thus formed is checked as to its developed state by process control sensor 19 and is transferred to print paper 20 wound on intermediate transfer element 15. In this way, the color component images thus developed by developing units 14*a* to 14*d* are transferred from photosensitive drum 12 to and superimposed one over another onto print paper 20, forming a multi-color image.

When the last component color image has been formed on print paper 20, the paper is heated by fixing unit 17 so as to fix the image onto print paper 20.

When developing units 14*a* to 14*d* are set arbitrarily to developing unit holder 13, image forming portion 60 sets up image forming conditions based on the color arrangement of developing units 14*a* to 14*d*. This control will be described next.

The block diagram showing the condition controller of image forming of image forming portion 60 is the same as FIG. 2. FIGS. 31 through 39 are flowcharts showing the control steps.

Figure 31:
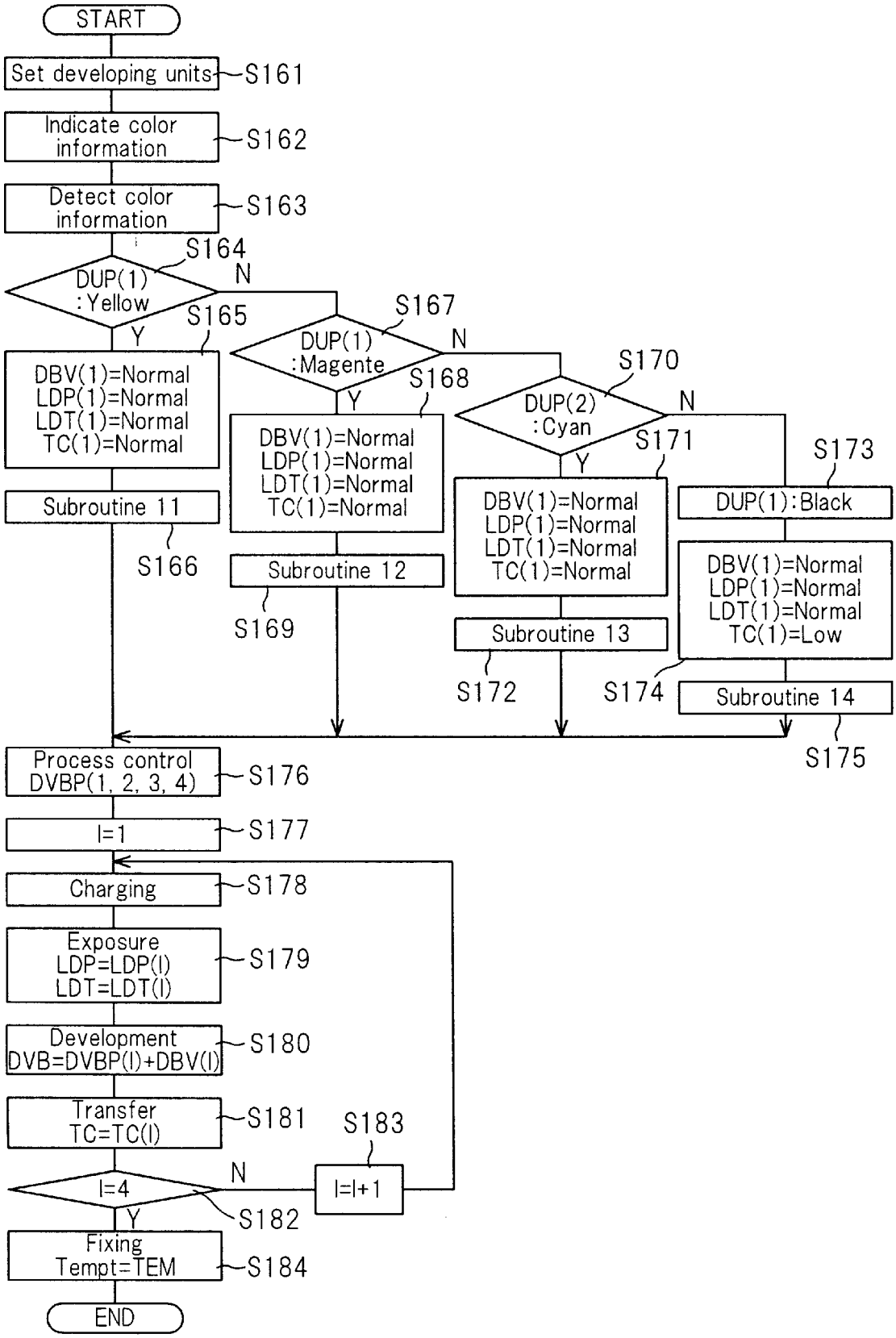
FIG. 31 is a flowchart showing the control steps of the controller of the third embodiment.

Referring next to FIG. 31, the specific control scheme will be described.

When all developing units 14*a* to 14*d* are set to accommodation sockets (holders) 13*a* to 13*d* of developing unit holder 13 (S161), each color information indicating means 31 presents color information (S162). This color information is detected by color information detecting means 32 located at the associated position (S163) and the obtained information is output to CPU 34. CPU 34 temporarily stores the color information into RAM 36. CPU 34, based on the color information, recognizes the colors of developing units 14*a* to 14*d* having been mounted in developing unit sockets (holders) 13*a* to 13*d* of image forming portion 10. The color information stored includes the process control target values, etc. of developing units 14*a* to 14*d*, based on which conditions for the various elements during image forming are set up (S164 to S175), to form images of a good quality.

As understood from Table 1 below, for transferring the color toners from photosensitive drum 12 to intermediate transfer element 15, there are, in total, twenty-four permutations of the development colors (the number of ordered arrangements of color superimposition's). That is, the control during image forming differs depending on the ordered arrangement of colors.

CPU 34 recognizes which color developing unit among 14*a* to 14*d* is used first for development. There are four developing unit locations DUP(1) to DUP(4) set up beforehand for developing units 14*a* to 14*d*. Development is performed in the order of the developing unit locations DUP. It is checked at steps S164, S167, S170 and S173 which color of toner, yellow, magenta, cyan or black, the developing unit set at DUP(1) holds. At steps S165, S168, S171 and S174, developing bias voltage DBV, exposure power LDP, exposure time LDT, transfer voltage TC from photosensitive drum 12 to print paper 20 and fixing temperature TEM and the fixing speed are set up based on the first color.

When the developing unit set at DUP (1) has a yellow color toner (S164, S165), the image forming conditions for the developing units at DUP(2) to (4) are set up through subroutine 11 (S166). In a similar manner, the image forming conditions are set up through subroutine 12 (S169) when the developing unit set at DUP(1) has a magenta color toner (S167, S168), the image forming conditions are set up through subroutine 13 (S172) when the developing unit set at DUP(1) has a cyan color toner (S170, S171), and the image forming conditions are set up through subroutine 14 (S175) when the developing unit set at DUP(1) has a black color toner (S173, S174).

Next, subroutines 11 to 14 will be described.

Figure 32:
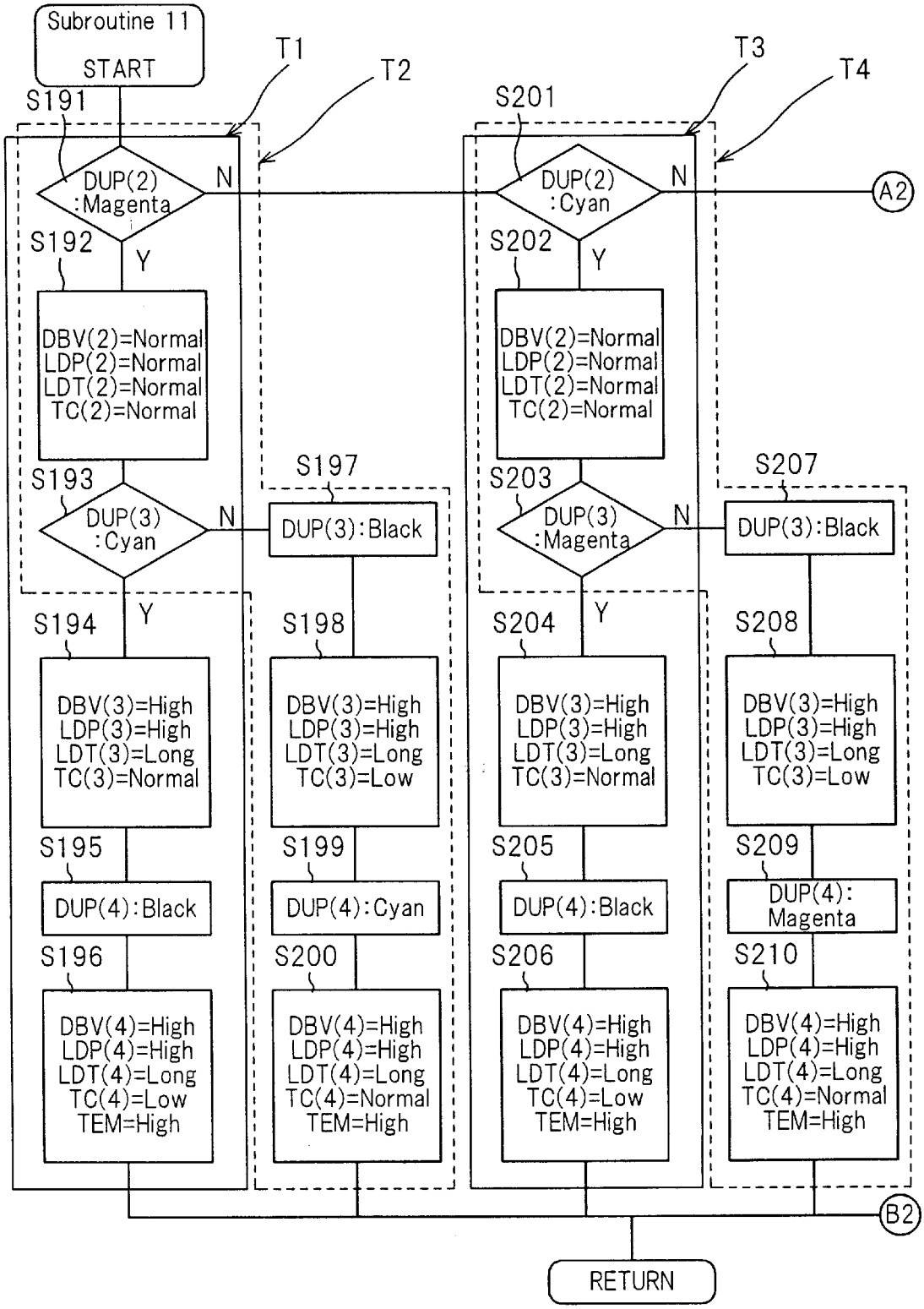
FIG. 32 is a flowchart showing subroutine 11.
Figure 33:
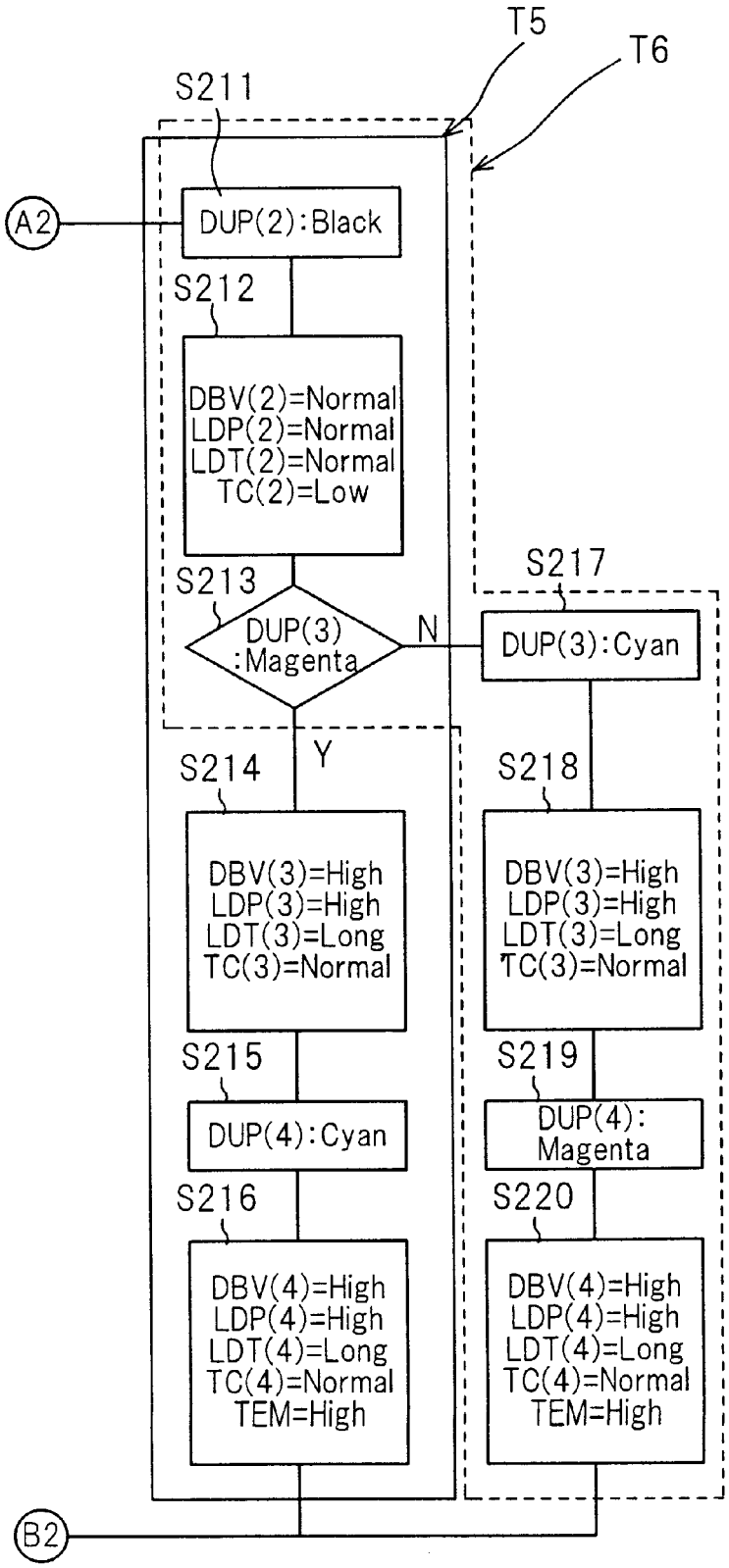
FIG. 33 is a flowchart showing the continuation of subroutine 11 following FIG. 32.

As shown in FIGS. 32 and 33, in subroutine 11 for the toner color of the developing unit set at DUP(1) being yellow, the toner color of the developing unit at DUP(2) (S191, S201, S211), the toner color of the developing unit at DUP(3) (S193, S197, S203, S207, S213, S217), and the toner color of the developing unit at DUP(4) (S195, S199, S205, S209, S215, S219) are successively checked and confirmed. In FIGS. 32 and 33, each color confirmation flow is indicated by corresponding number (No. T1 to No. T6) in Table 1. When each color is confirmed, the image forming conditions corresponding to the color are set up (S192, S194, S196, S198, S200, S202, S204, S206, S208, S210, S212, S214, S216, S218, S220). When the development color of the developing unit set at DUP(4) is confirmed, the fixing temperature TEM and fixing speed as the forming conditions are set (S196, S200, S206, S210, S216, S220). Here, only the fixing temperature is mentioned in the flowchart.

Figure 34:
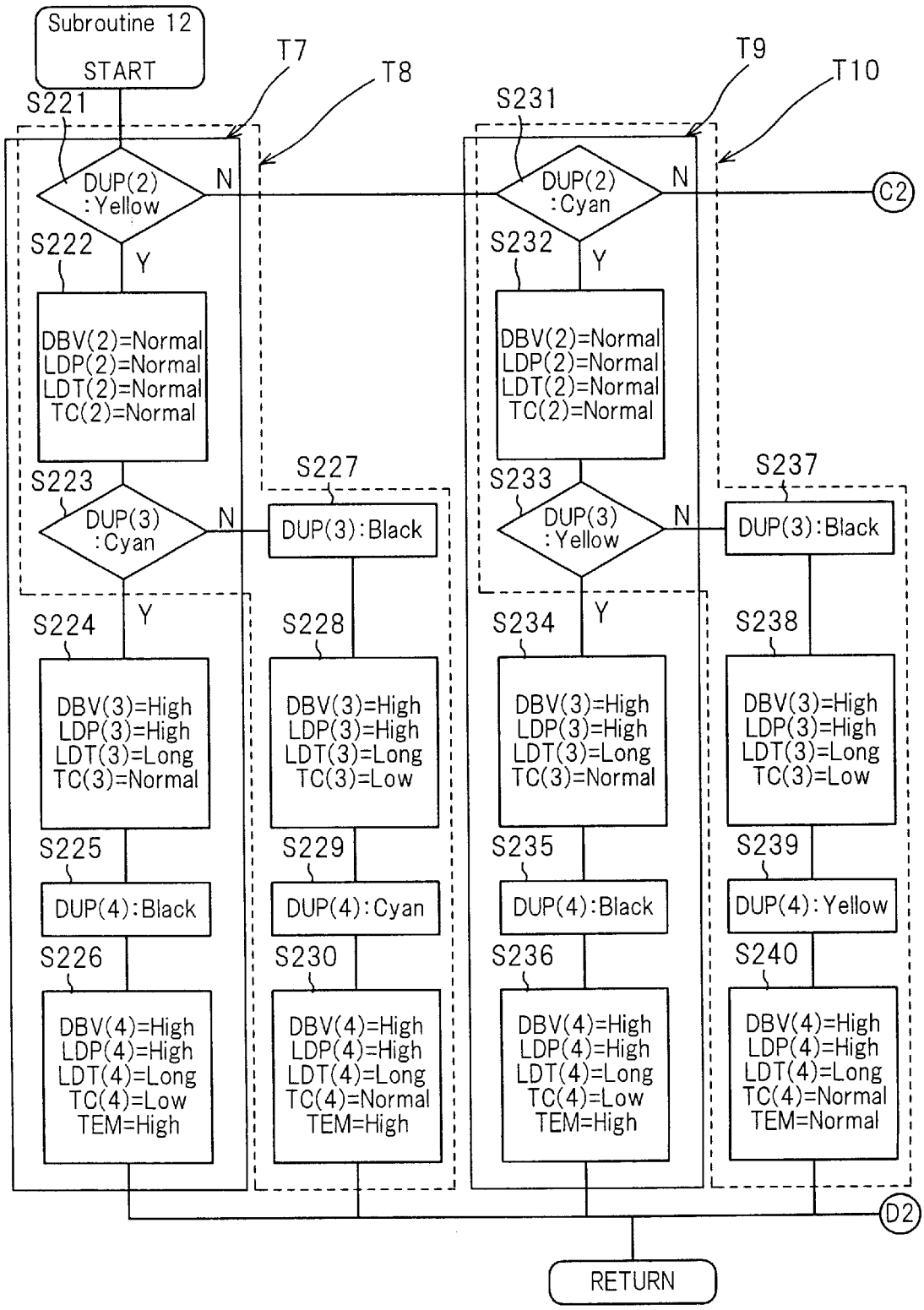
FIG. 34 is a flowchart showing subroutine 12.
Figure 35:
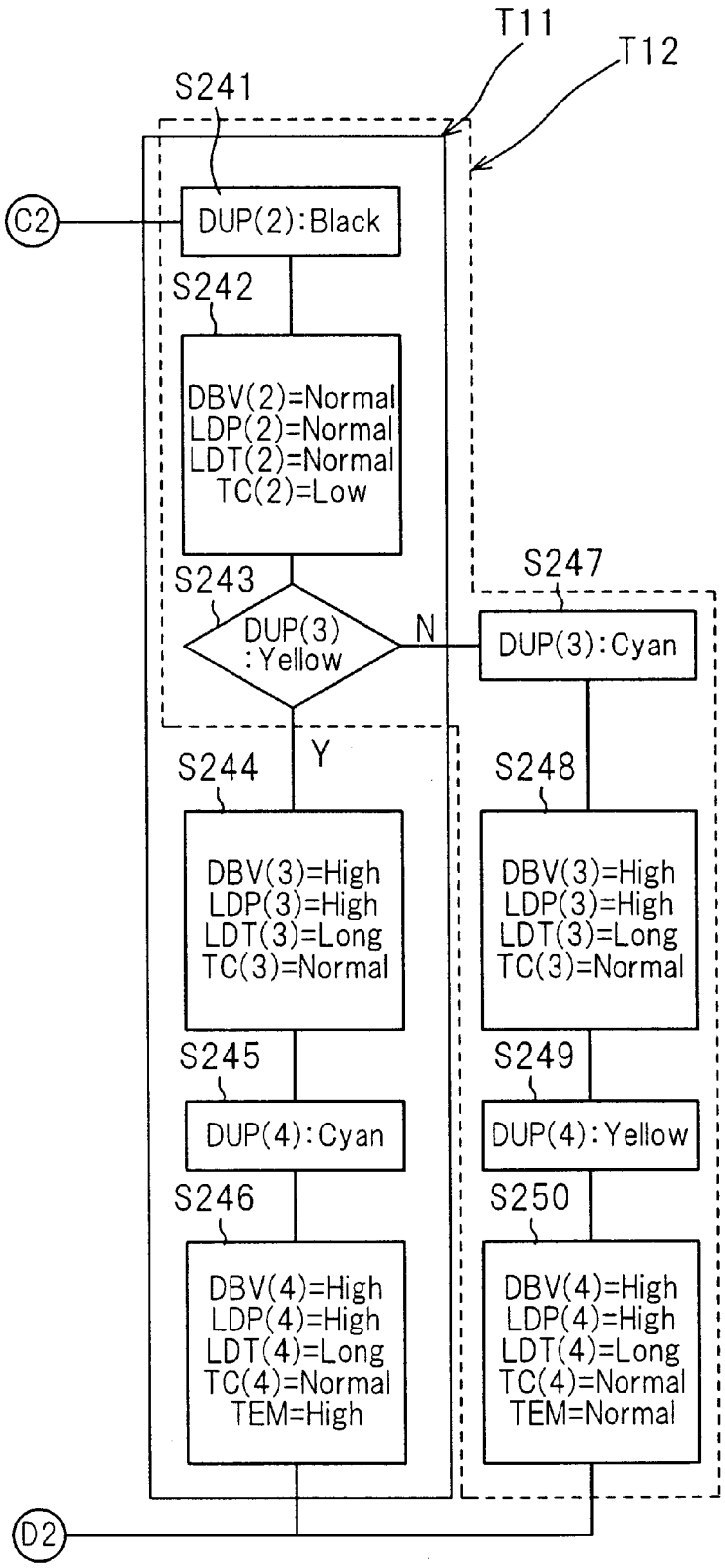
FIG. 35 is a flowchart showing the continuation of subroutine 12 following FIG. 34.

As shown in FIGS. 34 and 35, in subroutine 12 for the toner color of the developing unit set at DUP(1) being magenta, the toner color of the developing unit at DUP(2) (S221, S231, S241), the toner color of the developing unit at DUP(3) (S223, S227, S233, S237, S243, S247), and the toner color of the developing unit at DUP(4) (S225, S229, S235, S239, S245, S249) are successively checked and confirmed. In FIGS. 34 and 35, each color confirmation flow is indicated by corresponding number (No. T7 to No. T12) in Table 1. When each color is confirmed, the image forming conditions corresponding to the color are set up (S222, S224, S226, S228, S230, S232, S234, S236, S238, S240, S242, S244, S246, S248, S250). When the development color of the developing unit set at DUP(4) is confirmed, the fixing temperature TEM and fixing speed as the forming conditions are set (S226, S230, S236, S240, S246, S250). Here, only the fixing temperature is mentioned in the flowchart.

Figure 36:
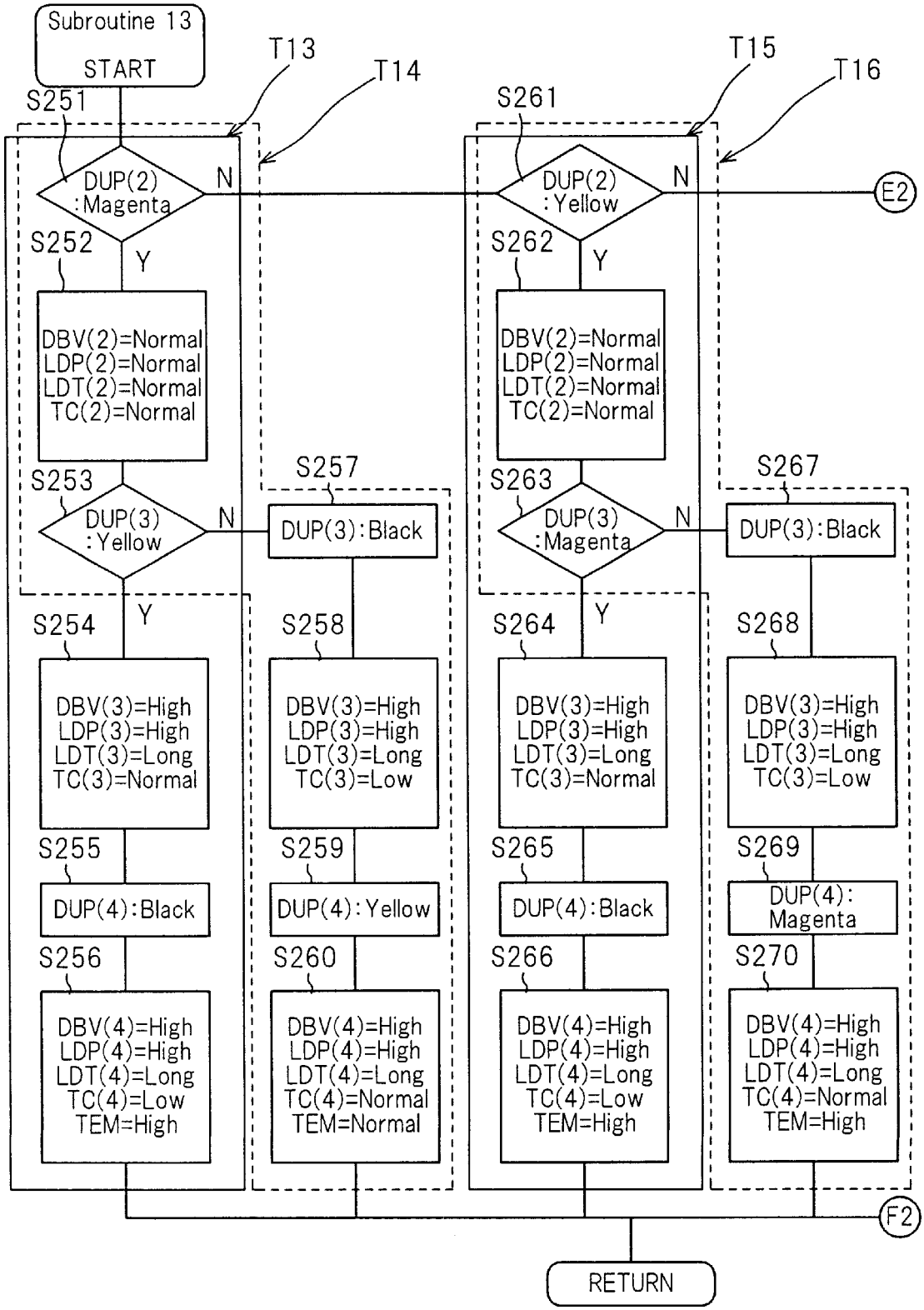
FIG. 36 is a flowchart showing subroutine 13.
Figure 37:
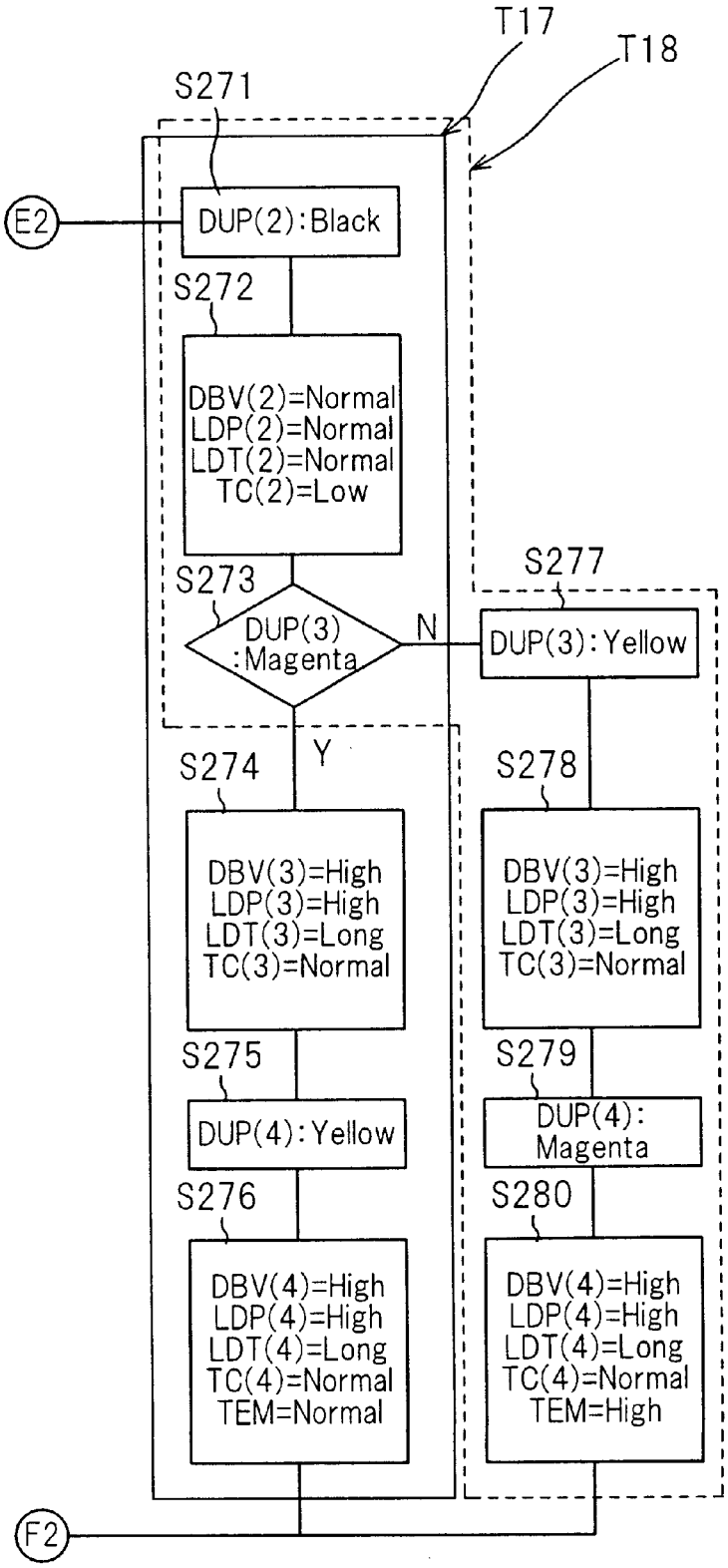
FIG. 37 is a flowchart showing the continuation of subroutine 13 following FIG. 36.

As shown in FIGS. 36 and 37, in subroutine 13 for the toner color of the developing unit set at DUP(1) being cyan, the toner color of the developing unit at DUP(2) (S251, S261, S271), the toner color of the developing unit at DUP(3) (S253, S257, S263, S267, S273, S277), and the toner color of the developing unit at DUP(4) (S255, S259, S265, S269, S275, S279) are successively checked and confirmed. In FIGS. 36 and 37, each color confirmation flow is indicated by corresponding number (No. T13 to No. T18) in Table 1. When each color is confirmed, the image forming conditions for the color are set up (S252, S254, S256, S258, S260, S262, S264, S266, S268, S270, S272, S274, S276, S278, S280). When the development color of the developing unit set at DUP(4) is confirmed, the fixing temperature TEM and fixing speed as the forming conditions are set (S256, S260, S266, S270, S276, S280). Here, only the fixing temperature is mentioned in the flowchart.

Figure 38:
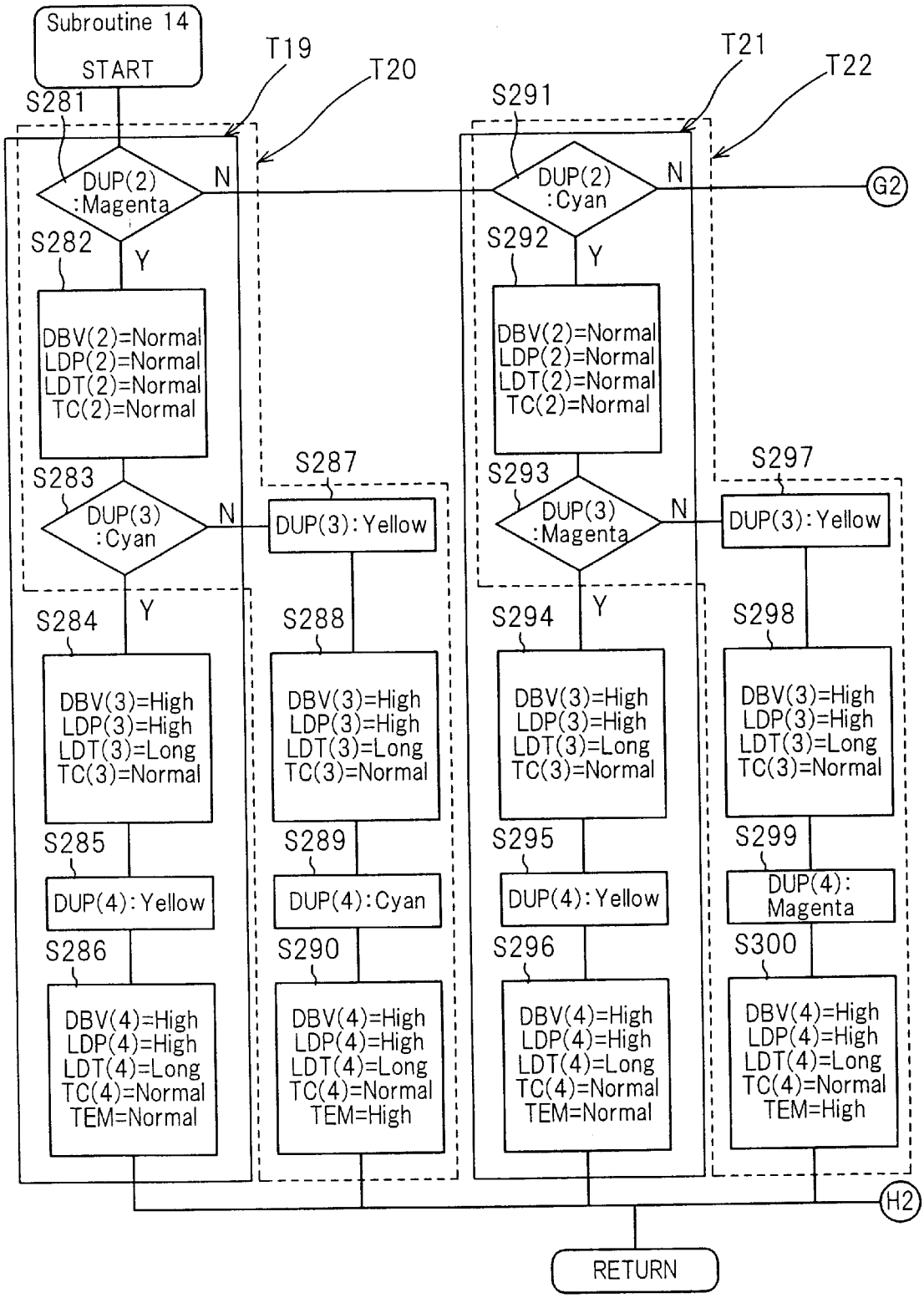
FIG. 38 is a flowchart showing subroutine 14.
Figure 39:
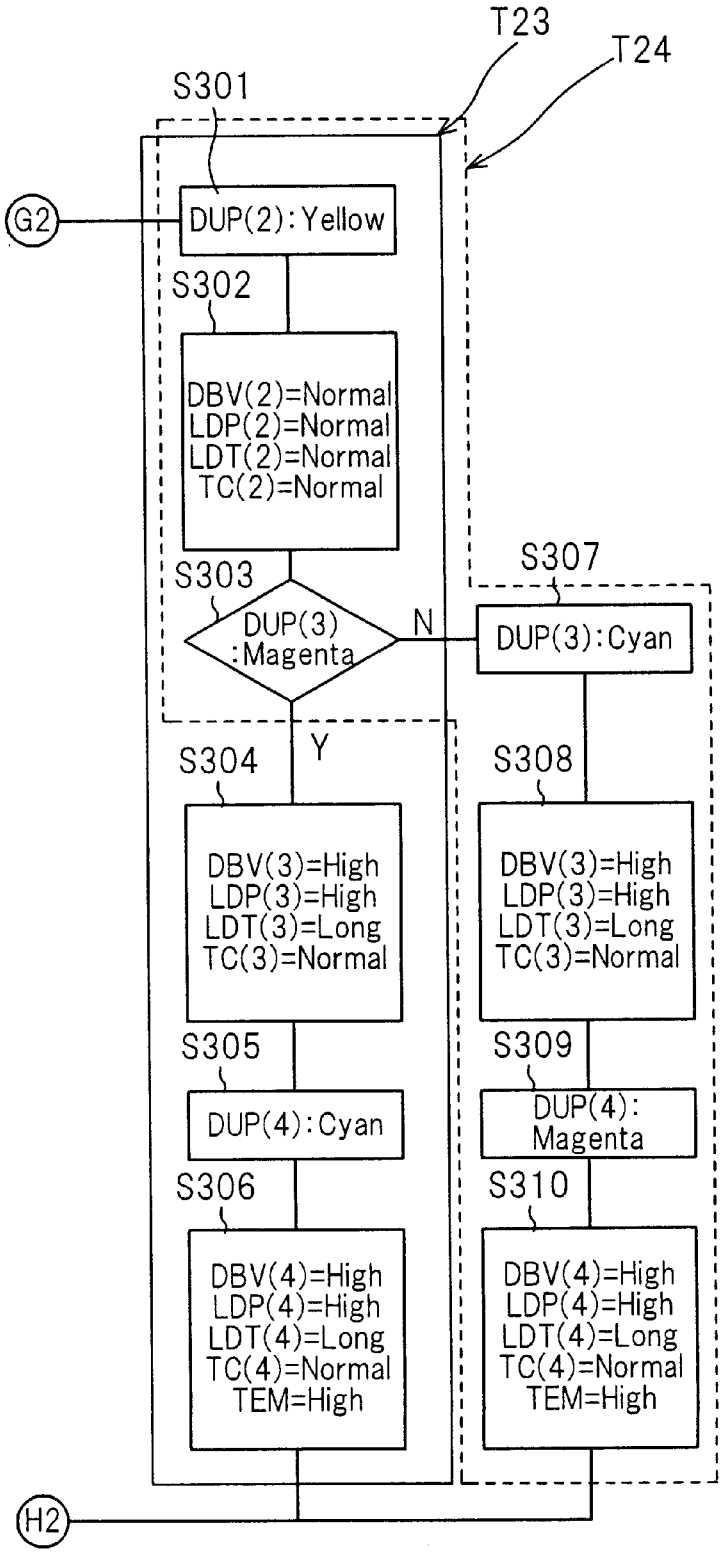
FIG. 39 is a flowchart showing the continuation of subroutine 14 following FIG. 38.

As shown in FIGS. 38 and 39, in subroutine 14 for the toner color of the developing unit set at DUP(1) being black, the toner color of the developing unit at DUP(2) (S281, S291, S301), the toner color of the developing unit at DUP(3) (S283, S287, S293, S297, S303, S307), and the toner color of the developing unit at DUP(4) (S285, S289, S295, S299, S305, S309) are successively checked and confirmed. In FIGS. 38 and 39, each color confirmation flow is indicated by corresponding number (No. T19 to No. T24) in Table 1. When each color is confirmed, the image forming conditions for the color are set up (S282, S284, S286, S288, S290, S292, S294, S296, S298, S300, S302, S304, S306, S308, S310). When the development color of the developing unit set at DUP(4) is confirmed, the fixing temperature TEM and fixing speed as the forming conditions are set (S286, S290, S296, S300, S306, S310). Here, only the fixing temperature is mentioned in the flowchart.

Next, description will be made returning to FIG. 31.

In the above way, CPU 34 sets up the image forming conditions for all the colors in accordance with the order of development and temporarily stores them into RAM 36. Then, process control is performed by developing images on photosensitive drum 12 with developing units 14*a* to 14*d*, under the determined image forming conditions (S176). That is, the state of the image formed on photosensitive drum 12 is checked by process control sensor 19, so as to set up modified developing bias values DVBP for developing units 14*a* to 14*d* each forming associated layers.

Next, CPU 34, based on the image forming conditions, carries out the image forming operation described below. First, I is assumed as the number indicating the sequential order of development, and I is set equal to 1 (I=1) at S177. Then, the first image forming is carried out under the image forming conditions stored in RAM 36. This image forming begins with uniform charging of photosensitive drum 12 by charger 18 (S178). LSU 11 exposes photosensitive drum 12 at exposure power LDP (1) for a period of exposure time LDT (1), which are the exposure conditions, to thereby form a static latent image (S179). Next, development is carried out with a voltage which is the modified developing bias DVBP (1) plus developing bias DBV (1), using the developing unit located at DUP(1) (S180). Then, the image is transferred to print paper 20 with the transfer voltage set at TC(1) (S181).

When the first color component image has been formed, it is checked if I=4 (S182), then I=I+1 at S183 and the operation returns to S178. This sequence from S178 to S181 is repeated up to the fourth color. When the developed image of the fourth color is completely laid on print paper 20, the toner is fixed to print paper 20 at fixing temperature TEM (S184). Thus, the multiple layers of color toners are formed on print paper 20, in the order opposite to the developing order.

Now, setup of the image forming conditions will be described in detail.

Figure 40:
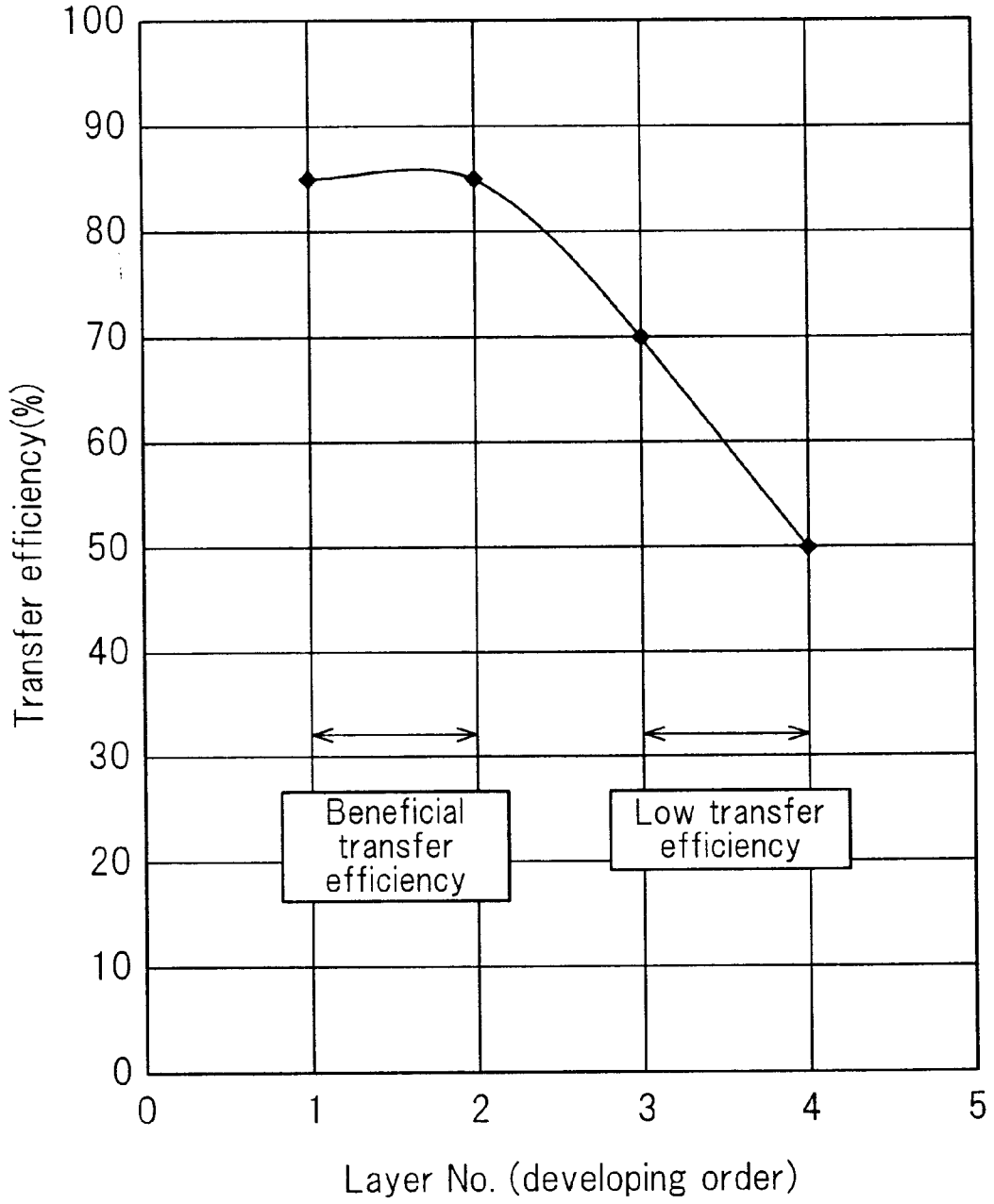
FIG. 40 is a chart of characteristics showing the relation between the developing order and the transfer efficiency in the third embodiment.
Figure 41:
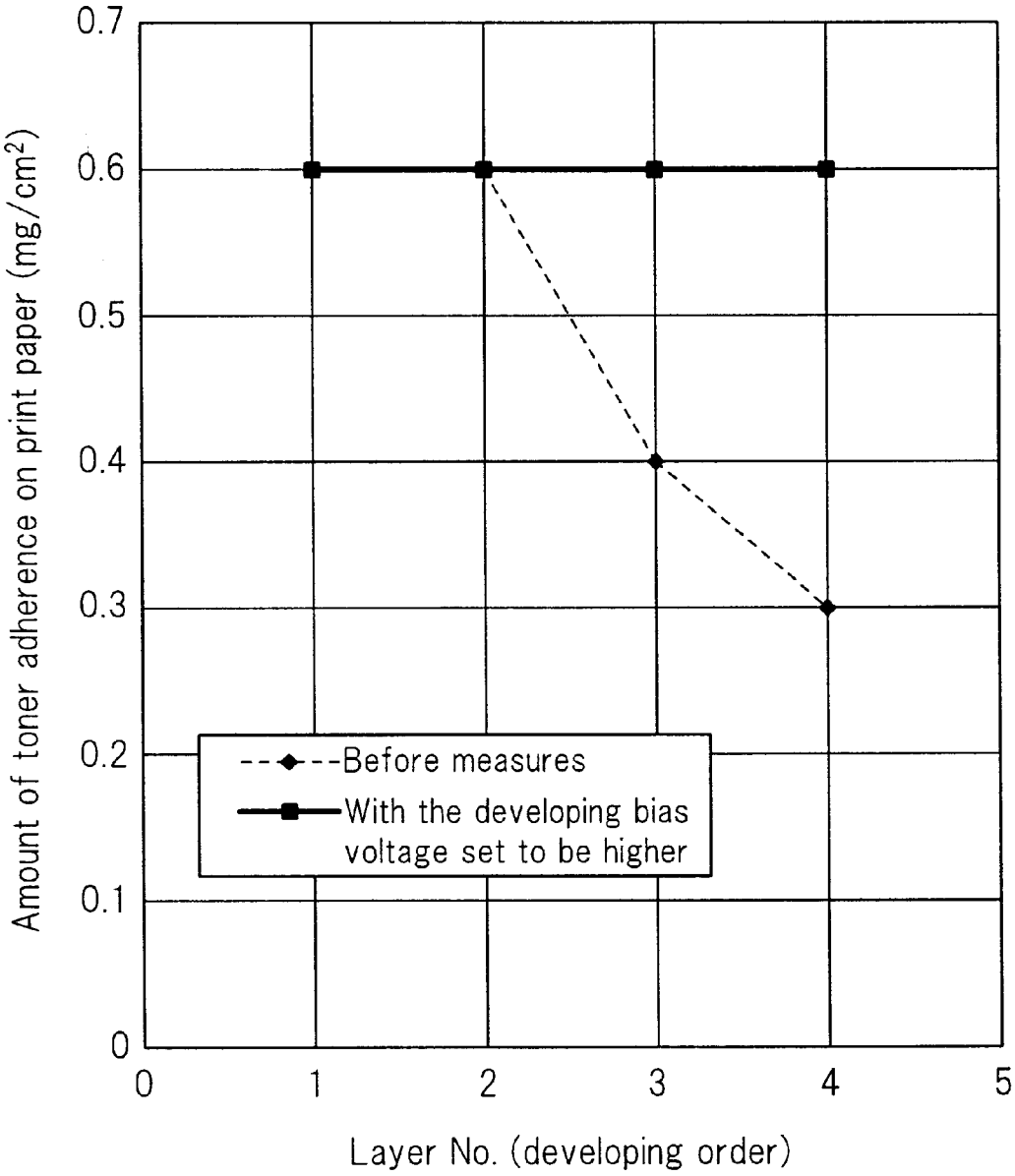
FIG. 41 is a chart of characteristics showing the relation between the amount of toner adherence on the print paper and the developing order when the developing bias is varied in the third embodiment.

When multiple colors of toners are transferred to print paper 20, the colors in the upper layers on print paper 20, or more specifically, the third and fourth colors in the developing order have their transfer efficiency lowered, posing a problem of lowering the color reproducibility (causing hue deviation). FIG. 40 shows the relation between the developing order of colors and the transfer efficiencies. FIG. 41 shows the amount of toner adherence when the developing bias is set to be higher. As seen in FIG. 40, the third and fourth colors present poor transfer efficiencies with respect to print paper 20 whereas the first and second colors present good transfer efficiencies. This fact is also confirmed from FIG. 41, from which the amounts of toner adherence of the third and fourth colors to print paper 20 are lower while the first and second layers have sufficient amounts of toner adherence. To deal with this situation, when the light exposed photosensitive drum 12 is developed, the developing bias is set and controlled so that the developing bias voltages for the third and fourth colors will be higher than that of the first and second colors (S164 to S175 in FIG. 31). As seen in FIG. 41, all the layers have uniform amounts of toner adherence, 0.6 mg/cm$^2$, so that it is understood that the above control is effective in stabilizing the amount of adherence and hence color reproducibility. Thus, even if the order of developing units 14*a* to 14*d* is changed, the suitable image forming conditions can be set up automatically thus eliminating density failure, low reproducibility in hue, low reproducibility in fine lines and other deficiencies as well as providing stable, multi-color images having uniform image quality.

Figure 42:
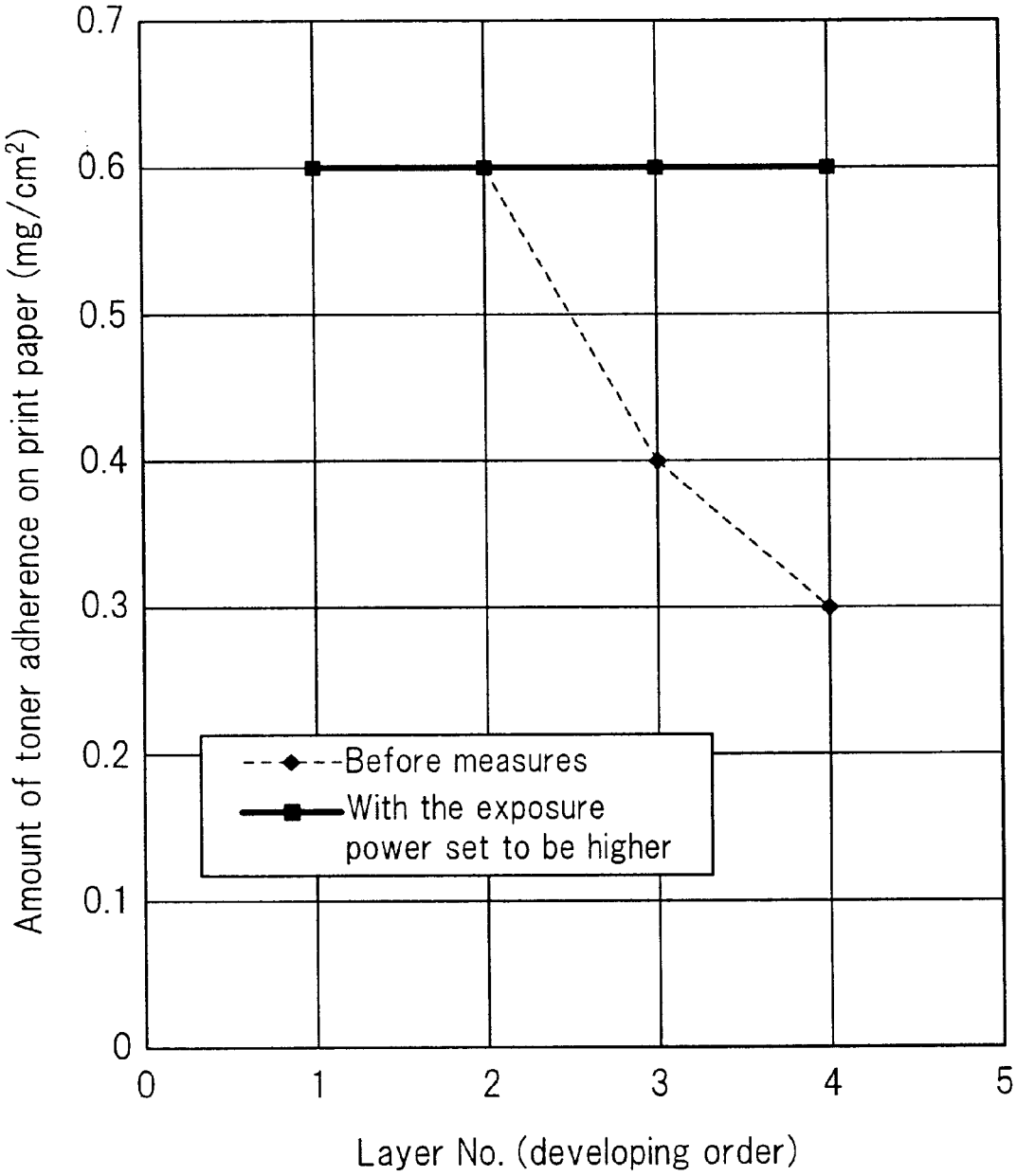
FIG. 42 is a chart of characteristics showing the relation between the amount of toner adherence on the print paper and the developing order when the exposure power is varied in the third embodiment.

With a command of an image forming operation, the signal output from the document reading portion such as CCD etc., is subjected to the predetermined image processing and shaped into color separations of image data through an unillustrated image processing portion, and CPU 34 outputs the generated color components of image data to LSU 11 in association with colors. LSU 11 forms each static latent image on photosensitive member 12 with the predetermined exposure power LDP. Also in this case, as shown in FIG. 42, since the transfer efficiency lowers towards the final color (the color in the topmost layer) of the multi-layered transfer with respect to print paper 20, upon exposure during an image forming operation, if the exposure power is set constant for all the colors, the amounts of toner adherence on print paper 20 for the third and fourth colors lower, as shown in FIG. 42. To deal with this situation, the exposure power of LSU 11 for the third and fourth colors is set to be higher than that for the first and second colors. This enables provision of uniform and stable images, and even if the order of developing units 14*a* to 14*d* is changed, the suitable image forming conditions can be set up automatically, thus eliminating density failure, low reproducibility in hue and low reproducibility in fine lines, as well as providing stable, images having uniform image quality. As seen in FIG. 42, all the layers have a uniform toner adherence amount of 0.6 mg/cm$^2$ after this measure, so that it is understood that the above control is effective in stabilizing the amount of adherence and hence color reproducibility.

Figure 43:
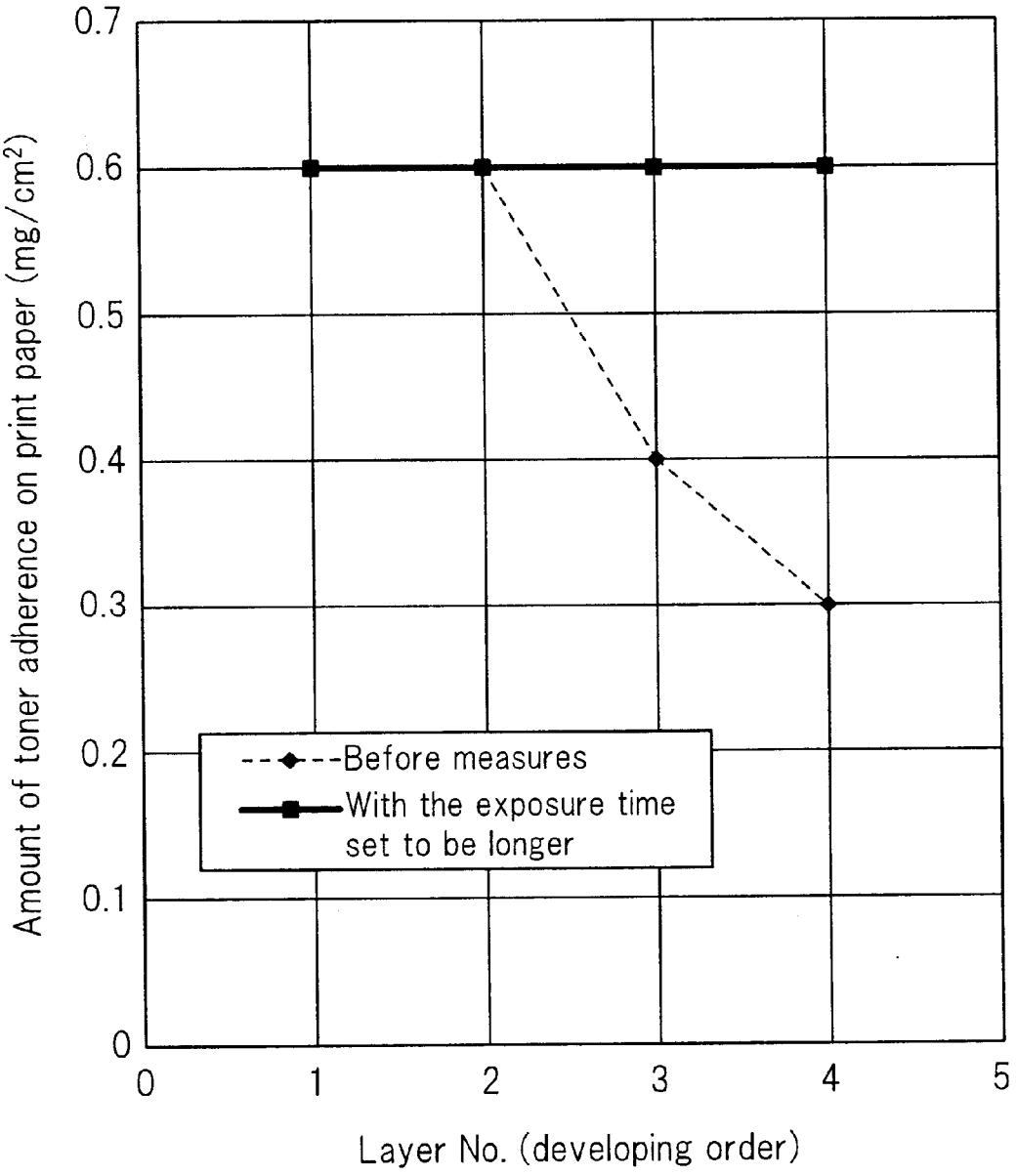
FIG. 43 is a chart of characteristics showing the relation between the amount of toner adherence on the print paper and the developing order when the exposure time is varied in the third embodiment.

Upon exposure during an image forming operation, if the exposure time LDT of LSU 11 is set constant for all the colors, the amounts of toner adherence of the third and fourth colors (the upper colors in print paper 20) lower, as shown in FIG. 43. To deal with this situation, the exposure time LDT of LSU 11 is set to be longer for the third and fourth colors than for the first and second colors. This enables provision of uniform and stable images, by means of developing units 14*a* to 14*d*. In FIG. 43, all the layers have a uniform toner adherence amount of 0.6 mg/cm$^2$ after this measure, so that it is understood that the above control is effective in stabilizing the amount of adherence and hence color reproducibility.

Further, if the transfer voltage for black printing is controlled so as to be lower than that for color printing, or if the fixing temperature is set to be higher when the low chromatic colors exist in the upper layer than when high chromatic colors such as yellow exist in the upper layer, or if the fixing speed is set to be lower when the low chromatic colors exist in the upper layer than when high chromatic colors such as yellow exist in the upper layer, the same effect as in the first embodiment can be obtained. Here, the detailed description is omitted because of similarity to the first embodiment.

(The Fourth Embodiment)

Figure 44:
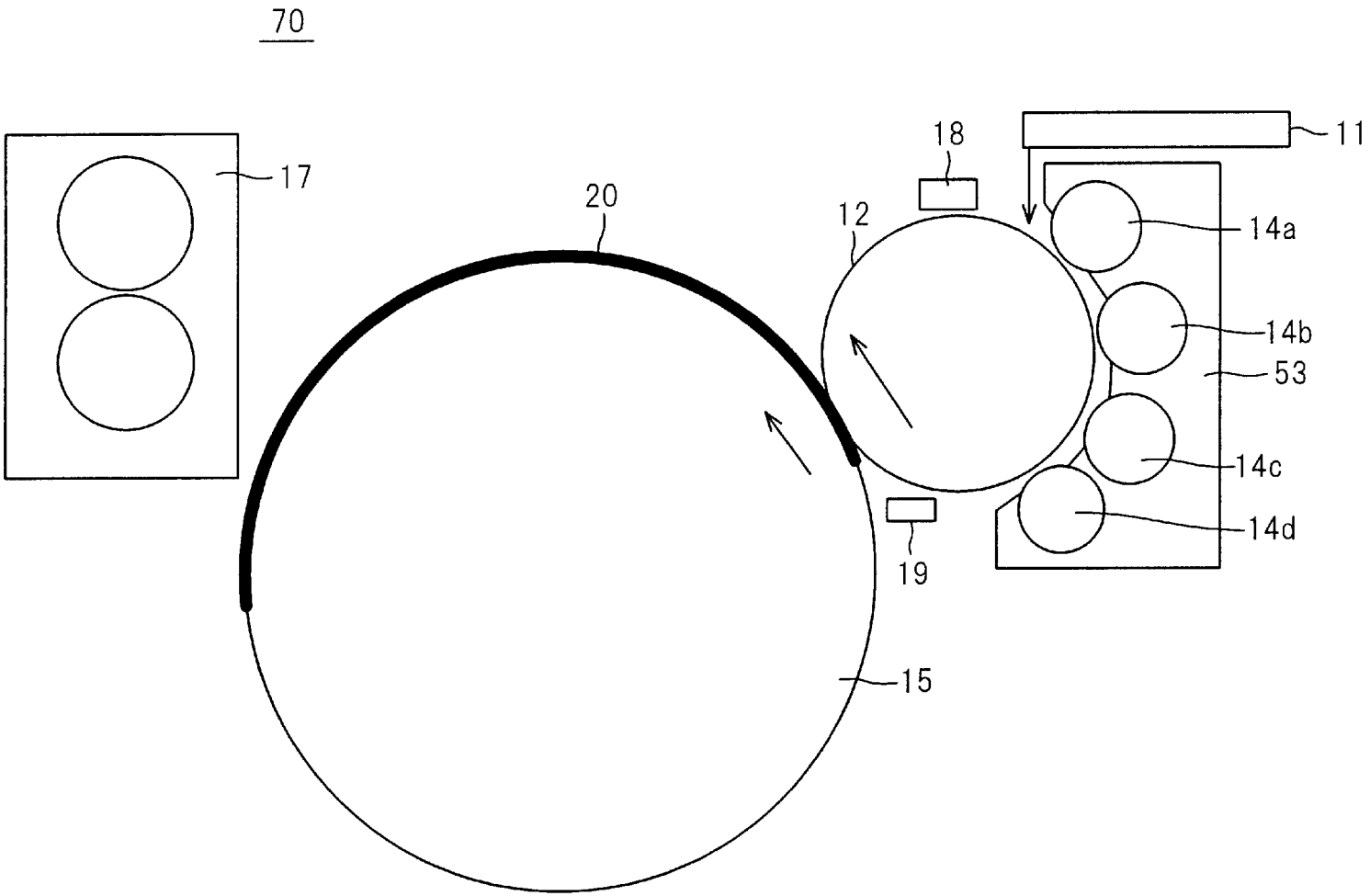
FIG. 44 is an overall schematic view showing the fourth embodiment of the image forming portion in an image forming apparatus according to the present invention.
Figure 45:
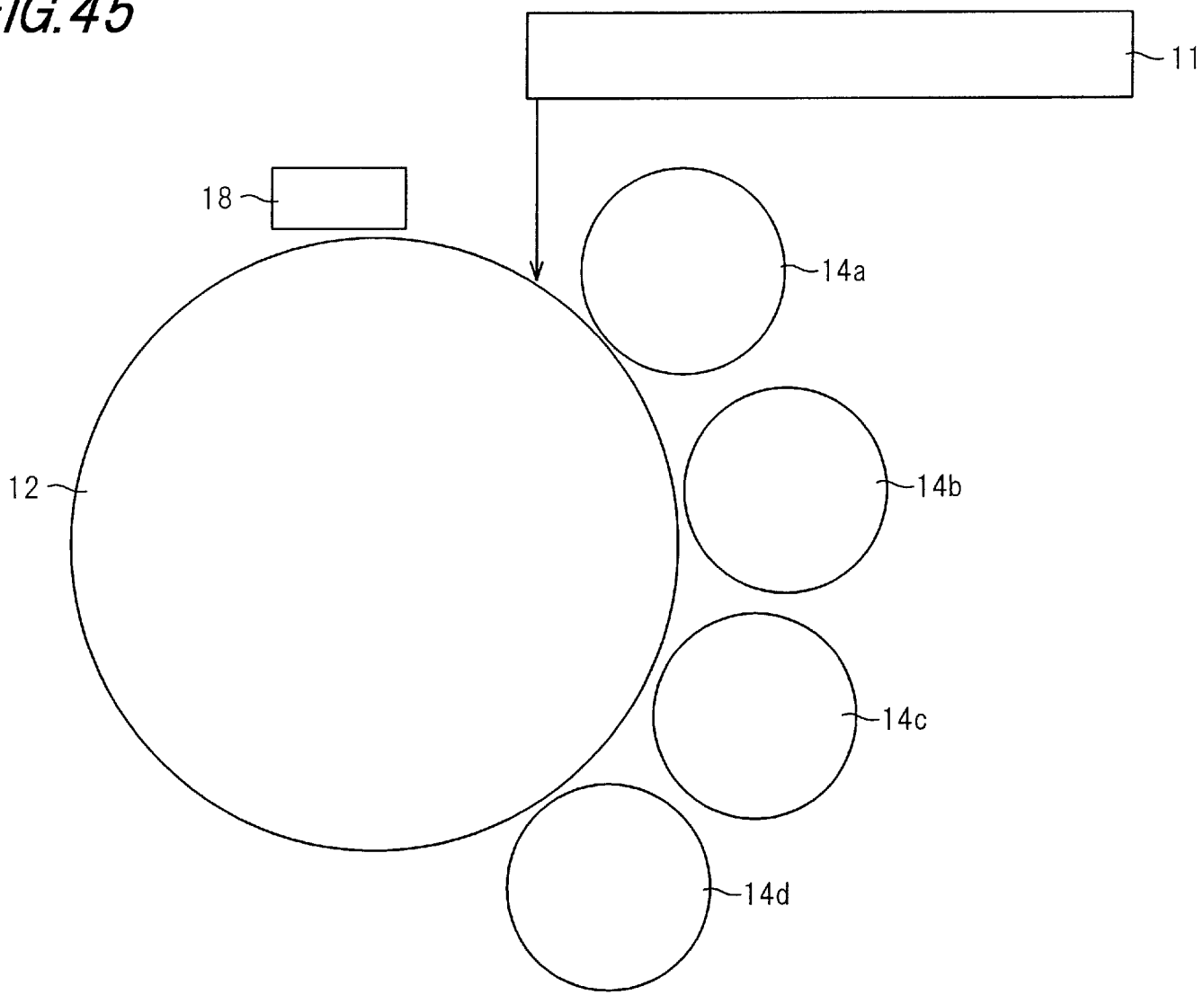

FIG. 44 is an overall view showing the fourth embodiment of the image forming portion in an image forming apparatus according to the present invention. The image forming portion, designated at 70, has almost the same configuration as in the second embodiment, so that the same parts are allotted with the same reference numerals without detailed description. FIG. 45 is a partially enlarged view showing a photosensitive drum with developing units. As in the second embodiment, developing units 14*a* to 14*d* are arranged along the photosensitive drum 12 surface. This means that accommodation sockets (holders) 53*a* to 53*d* of developing unit holder 53 are arranged around photosensitive drum 12, and developing units 14*a* to 14*d* are fixed and will not move. As in the second embodiment, all the developing units 14*a* to 14*d* have the same configuration. The difference from the second embodiment resides in that print paper 20 is made to pass through and between photosensitive drum 12 and intermediate transfer element 15 so that the image is directly transferred from photosensitive drum 12 to print paper 20. Accordingly there is no transfer member 16 as in the second embodiment.

Figure 46:
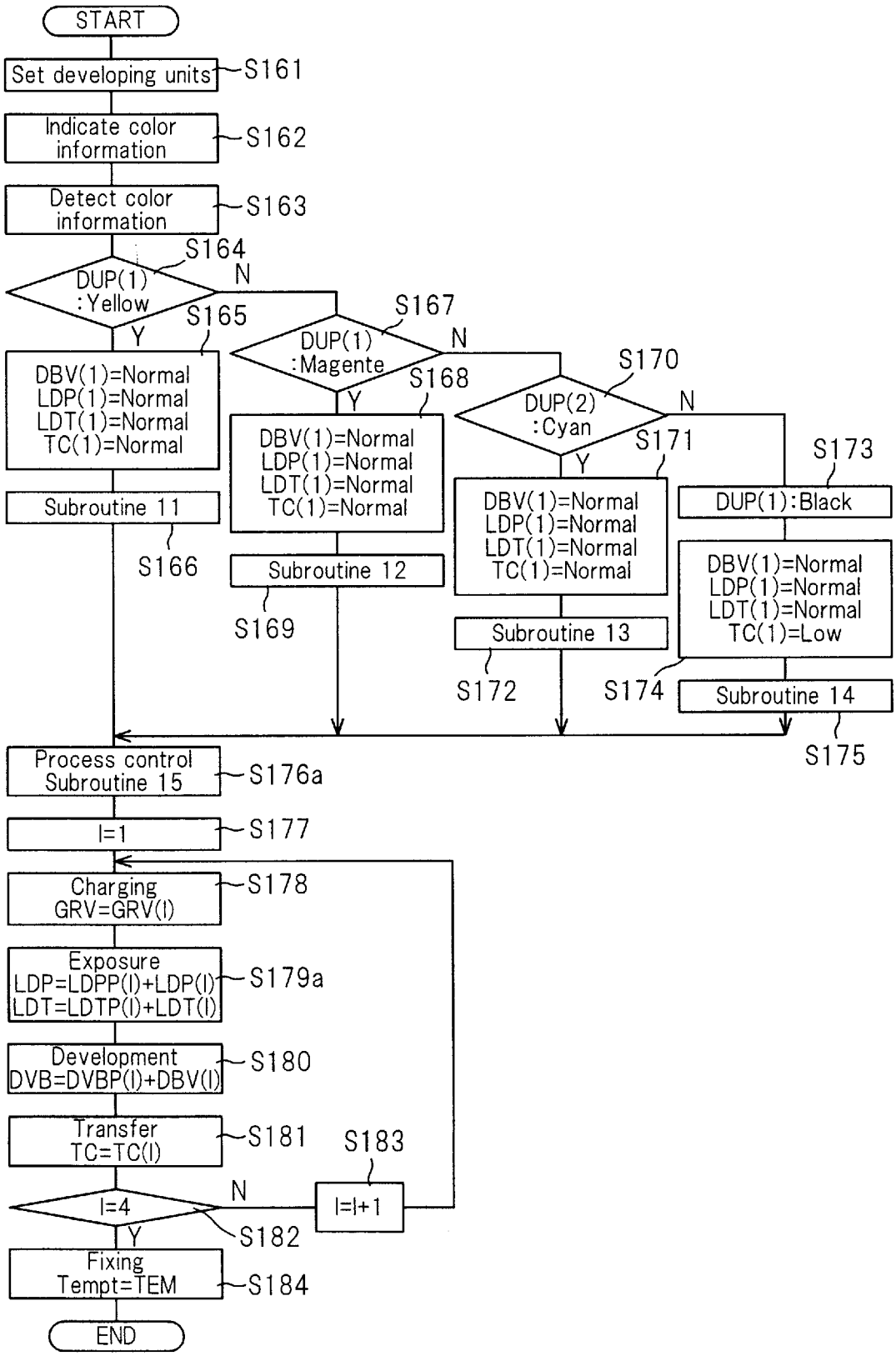
FIG. 46 is a partially enlarged view showing developing units and a photosensitive drum in the fourth embodiment.
Figure 47:
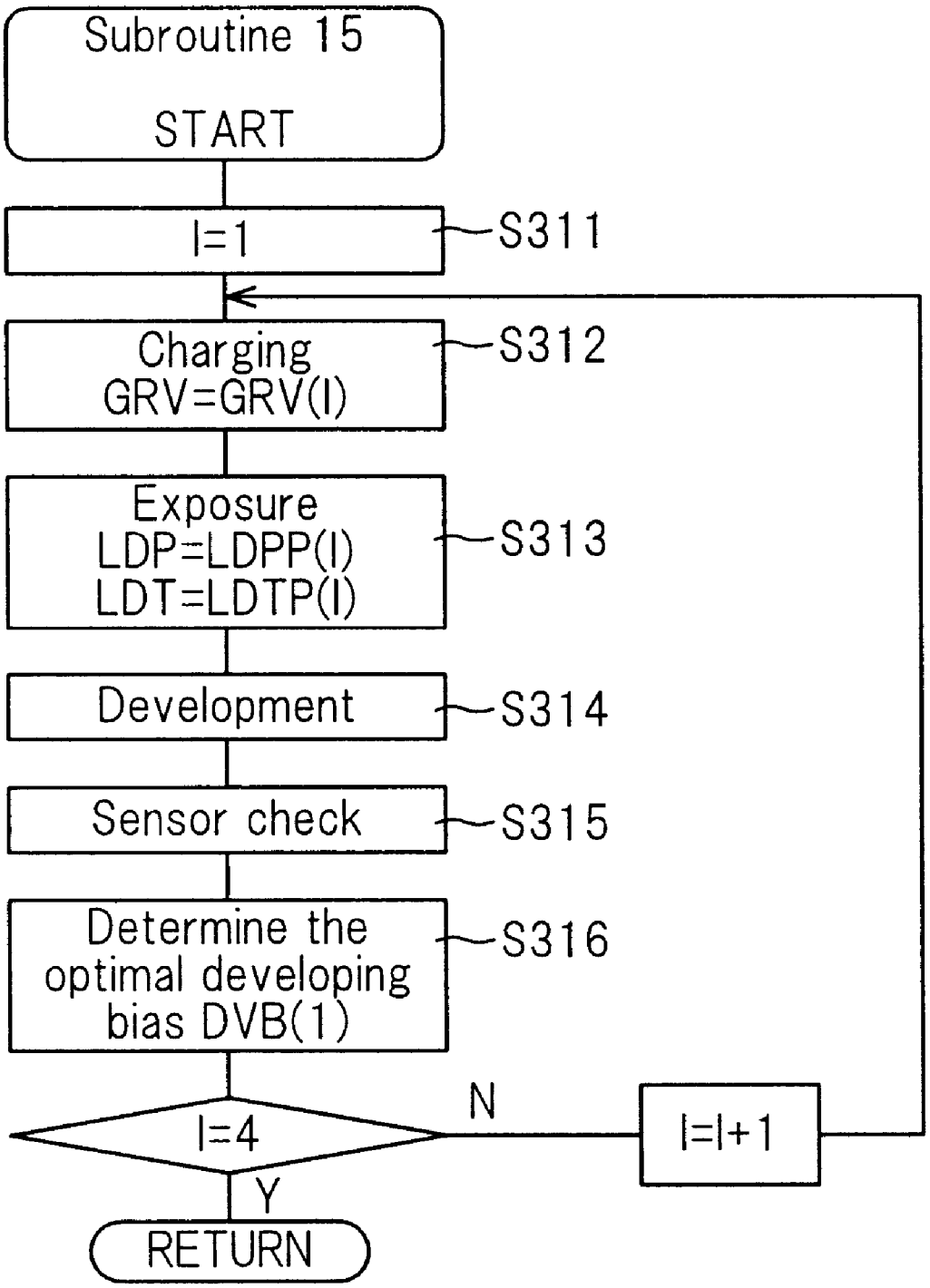
FIG. 47 is a flowchart showing subroutine 15.

FIG. 46 is a flowchart showing the control steps in this image formation. Since this flowchart is basically the same as that of the third embodiment shown in FIG. 31, the same parts are allotted with the same numerals without description. The difference from the third embodiment resides in subroutine 15 in the process control at step S176*a* and setup of the exposure conditions at step S179*a* shown in FIG. 46. Since developing units 14*a* to 14*d* are arranged along photosensitive drum 12, the distance (the angle of arrangement) from the charging station to each developing station differs from one to the others, so that subroutine 15 sets up modified image forming conditions, taking it into account, as shown in FIG. 47.

First, the sequential order is set equal to 1 (I=1) at S311, then the image forming conditions of developing unit 14*a* located at DUP(1) are set up. The grid voltage GRV(1) of charger 18 is determined so as to charge photosensitive drum 12 uniformly (S312). Next, modified exposure power LDPP (1) and modified exposure time LDTP(1) of LSU 11 are set again (S313). Development is effected by developing unit 14*a* under these conditions(S314), then the resulting developed state is checked by process control sensor 19 (S315). Based on the detection result of sensor 19, CPU 34 determines modified developing bias DVBP(1). At S317, it is checked whether I=4. If not, then I=I+1, and the operation returns to S312. In this way, the processing steps S312 to S316 are repeated until I=4, thus completing determination of modified developing bias voltages DVBP(2) to DVBP(4) of developing units 14*b* to 14*d*.

Secondary, CPU 34 performs image forming from S177 to S182, based on the image forming conditions. This operation is almost the same as that described in the third embodiment, so only the difference will be described. At S179*a*, photosensitive drum 12 is exposed by LSU 11 under the exposure conditions, i.e., with the optimal exposure power LDP for a period of the optimal exposure time LDT, to form a static latent image. Here, this optimal exposure power LDP is the modified exposure power LDPP plus exposure power LDP(I) dependent on the color order. The optimal exposure time LDT is the modified exposure time LDTP plus exposure time LDT(I) dependent on the color order. Thus, multiple layers of color toners are formed on intermediate transfer element 15, from the top to the bottom in the order opposite to the developing order. When the developed image of the fourth color is completely laid on intermediate transfer element 15, all the layers of toners are transferred at one time to print paper 20 and then the toner is fixed at fixing temperature TEM (S184). The multiple layers of color toners are formed on print paper 20, from the top to the bottom, in the developing order.

When the applied voltage to charger 18 is increased as the position of developing unit (14*a* to 14*d*) becomes distant for charger 18, or when the exposure power (laser power) is increased as the position of developing unit (14*a* to 14*d*) becomes closer to the exposure position of LSU 11, or the exposure time is set to be longer as the position of developing unit (14*a* to 14*d*) becomes closer to the exposure position of LSU 11, the same effect as in the second embodiment can be obtained. Here, the detailed description is omitted because of similarity to the second embodiment.

For development of light-exposed photosensitive drum 12, when the developing bias voltages for the third and fourth colors are set to be higher than that for the first and second colors, or when the exposure power of LDU 11 for the third and fourth colors are set to be higher than that for the first and second colors, or when the exposure time of LSU 11 for the third and fourth colors are set to be longer than that for the first and second colors, the same effect as in the third embodiment can be obtained. Here, the detailed description is omitted because of similarity to the third embodiment.

Further, if the transfer voltage for black printing is controlled so as to be lower than that for color printing, or if the fixing temperature is set to be higher when the low chromatic colors exist in the upper layer than when high chromatic colors such as yellow exist in the upper layer, or if the fixing speed is set to be lower when the low chromatic colors exist in the upper layer than when high chromatic colors such as yellow exist in the upper layer, the same effect as in the first embodiment can be obtained. Here, the detailed description is omitted because of similarity to the first embodiment.

(The Fifth Embodiment)

Since the image forming portion of the fifth embodiment has almost the same configuration as in the first embodiment (see FIG. 1), the detailed description is omitted. In this embodiment, as in the first embodiment, developing unit holder 13 rotates about its cylindrical axis and has a rotary configuration so as to move and set each developing unit for a color to be developed to the predetermined position of photosensitive drum 12. Each image of a different color is transferred from photosensitive drum 12 to intermediate transfer element 15, forming a multi-color image thereon, which is finally transferred to print paper 20 at one time. The difference from the first embodiment resides in that the user can freely select the order of colors to be developed.

Figure 48:
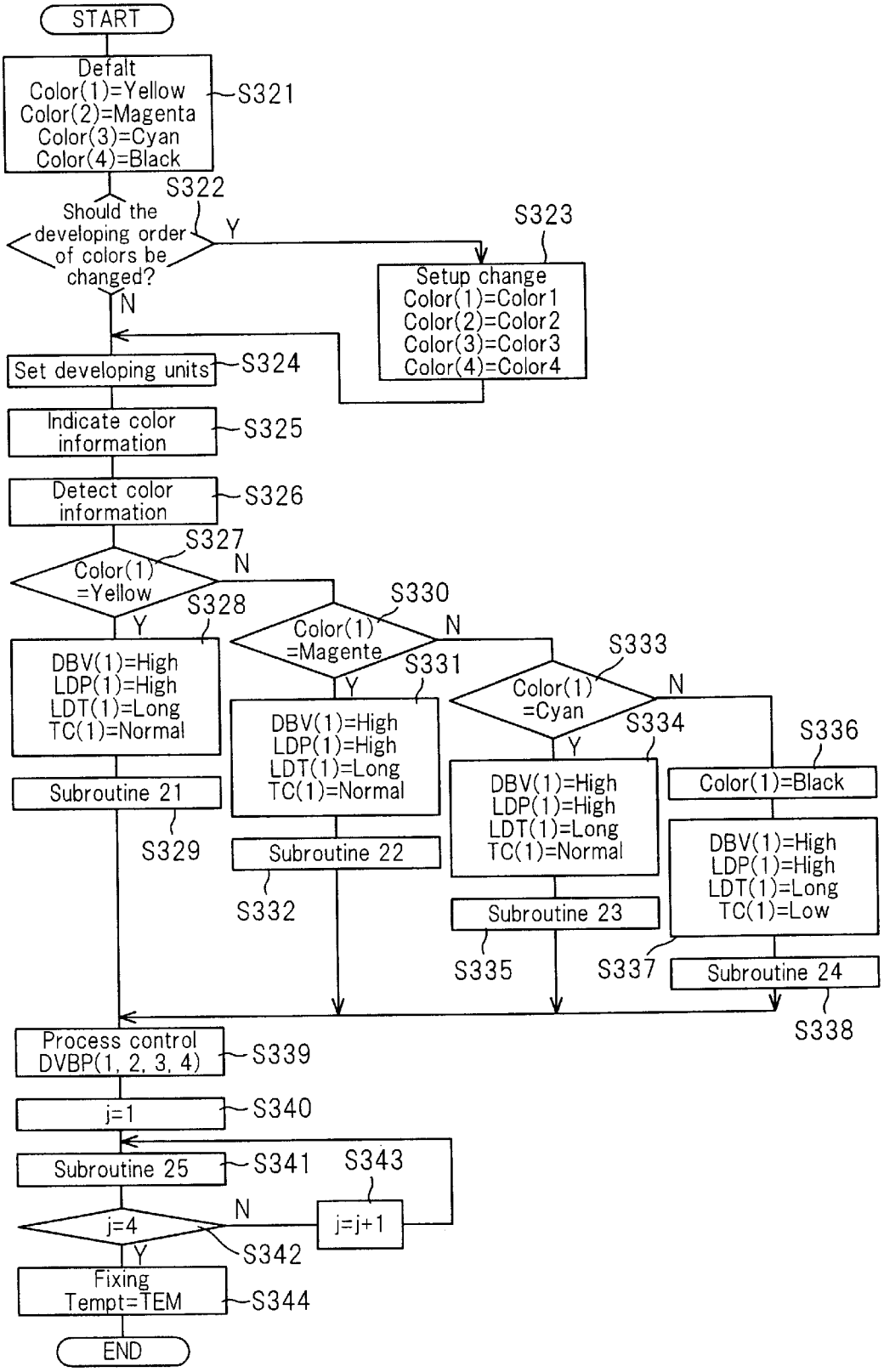
FIG. 48 is a flowchart showing the control steps of the controller the fifth embodiment.

FIG. 48 is a flowchart showing the control steps during image forming. When all developing units 14*a* to 14*d* are set to accommodation sockets (holders) 13*a* to 13*d*, the color information of each color information indicating means 31 is detected by color information detecting means 32 located at the associated position and the obtained information is output to CPU 34. CPU 34, based on the color information, recognizes the colors of developing units 14*a* to 14*d* having been mounted in developing unit sockets (holders) 13 of image forming portion 70 and stores color information such as process control target values, etc. of developing units 14*a* to 14*d* into RAM.

First, as the initial setup, Color (1)=yellow, Color (2)=magenta, Color (3)=cyan and Color (4)=black (S321). Here, the numerals (1) through (4) of Color indicate the order of development of colors. Since the user is allowed to set the order of colors to be developed, CPU 34 asks whether the order of colors to be developed should be changed (S322). If the setup needs to be changed, the user performs a setup change process as shown in S323. Colors 1 through 4 indicate any of yellow, magenta, cyan and black, and these can be set arbitrarily. CPU 34 stores the designation of the color order of development into RAM 36.

After the order of development has been designated, developing units 14*a* to 14*d* are set to developing unit holder 13 (S324). The color information indicating means 31 attached to each of developing units 14*a* to 14*d* presents color information (S325). This color information is detected by color information detecting means 32 located at the associated position (S326) and the obtained information is output to CPU 34. CPU 34 temporarily stores the color information into RAM 36. CPU 34, based on the color information, recognizes the colors of developing units 14*a* to 14*d* having been mounted in developing unit sockets (holders) 13*a* to 13*d* of image forming portion 10. The mount positions of developing unit sockets (holders) 13*a* to 13*d* are called DUP(1) to DUP(4). The color information stored includes the process control target values, etc. of developing units 14*a* to 14*d*, based on which conditions for the various elements during image forming are set up, to form images of a good quality.

CPU 34 checks at steps S327, S330, S333, S336, which color is set as Color (1), the first color, based on the information of the developing order stored in RAM 36. At steps S328, S331, S334 and S337, developing bias voltage DBV, exposure power LDP, exposure time LDT, transfer voltage TC from photosensitive member 12 to intermediate transfer element 15 and fixing temperature TEM and the fixing speed are set up based on the first color.

If the first color, namely Color (1) is yellow (S327), the image forming conditions for each of the second to fourth colors are determined through subroutine 21 (S329). In a similar manner, the image forming conditions for each of the second to fourth colors are set up through subroutine 22 (S332) if the first color, Color (1) is magenta (S330), subroutine 23 (S335) if the first color, Color (1) is cyan (S333) and subroutine 24 (S338) if the first color, Color (1) is black (S336).

Figure 49:
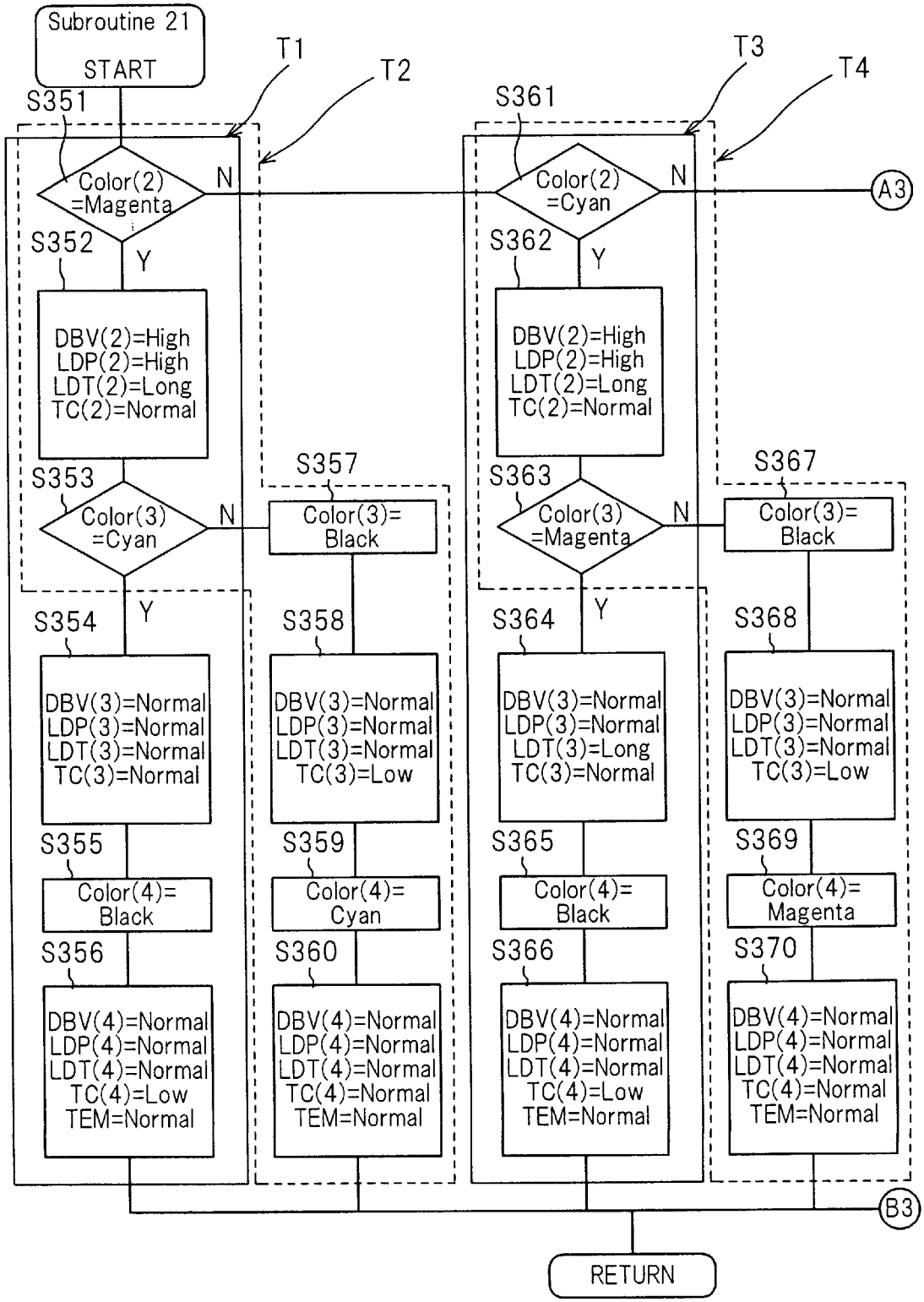
FIG. 49 is a flowchart showing subroutine 21.
Figure 50:
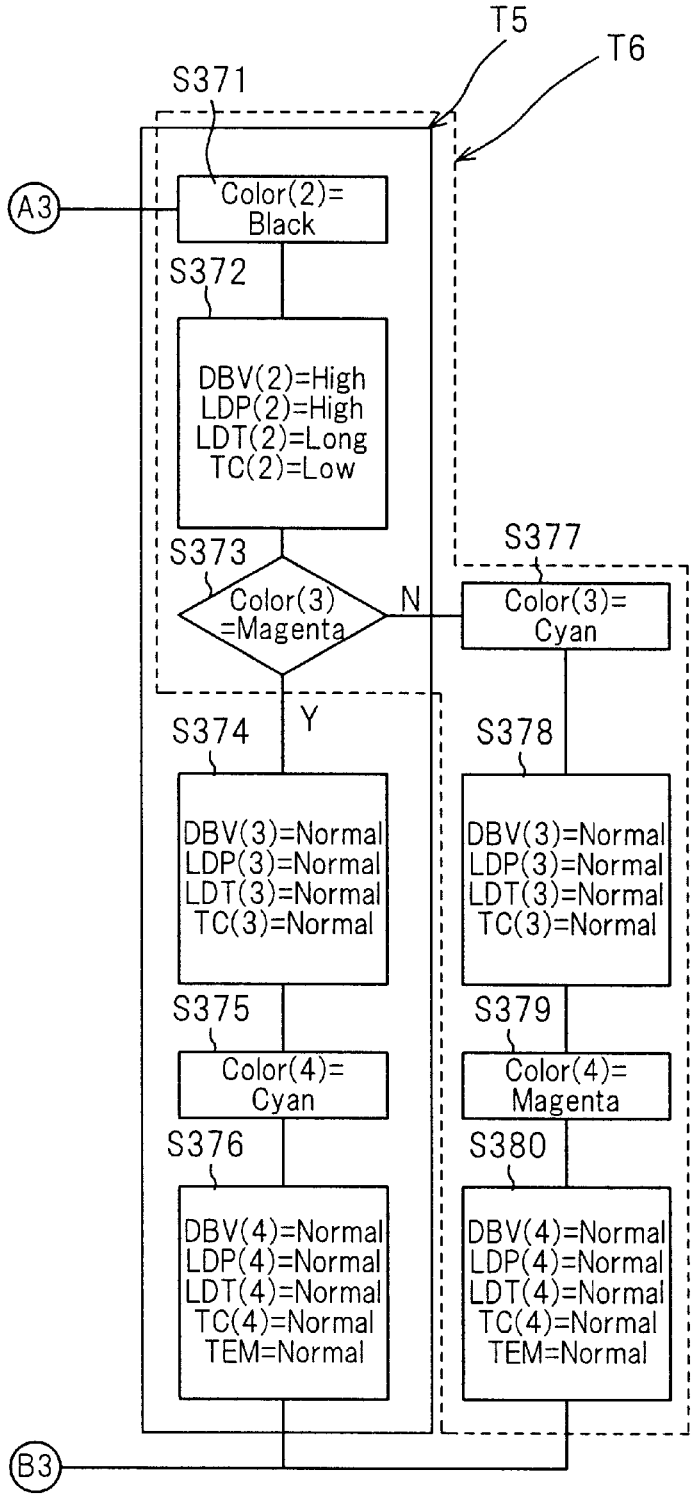
FIG. 50 is a flowchart showing the continuation of subroutine 21 following FIG. 49.

As shown in FIGS. 49 and 50, in subroutine 21 where the first color, Color (1) is yellow, the second color, Color (2) (S351, S361, S371), the third color, Color (3) (S353, S357, S363, S367, S373, S377), and the fourth color, Color (4) (S355, S359, S365, S369, S375, S379) are successively checked and confirmed. In FIGS. 49 and 50, each color confirmation flow is indicated by corresponding number (No. T1 to No. T6) in Table 1. For each color, the image forming conditions are set up (S352, S354, S356, S358, S360, S362, S364, S366, S368, S370, S372, S374, S376, S378, S380). When the development color of Color (4) is confirmed, the fixing temperature TEM and fixing speed as the forming conditions are set (S356, S360, S366, S370, S376, S380). Here, only the fixing temperature is mentioned in the flowchart.

Figure 51:
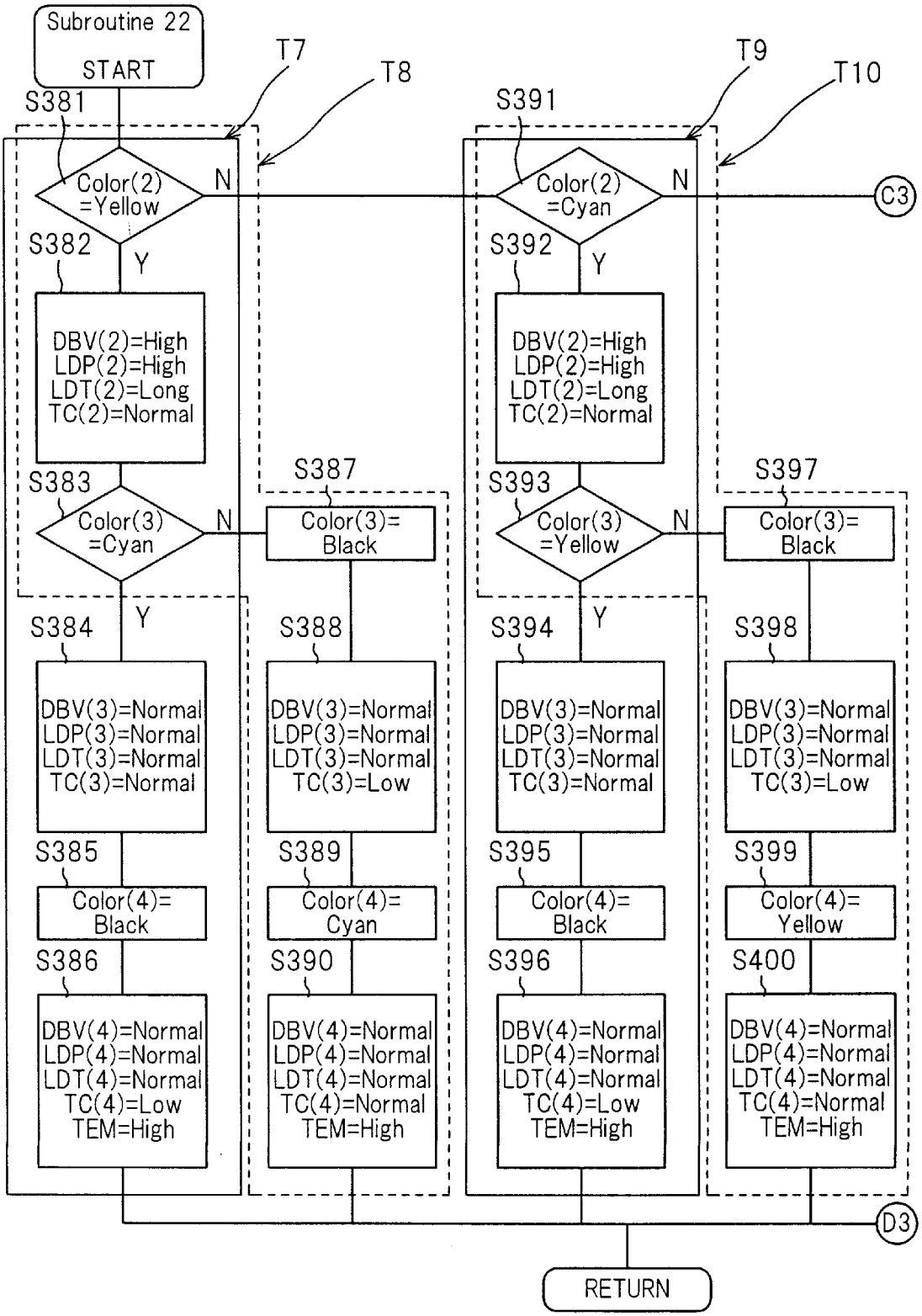
FIG. 51 is a flowchart showing subroutine 22.
Figure 52:
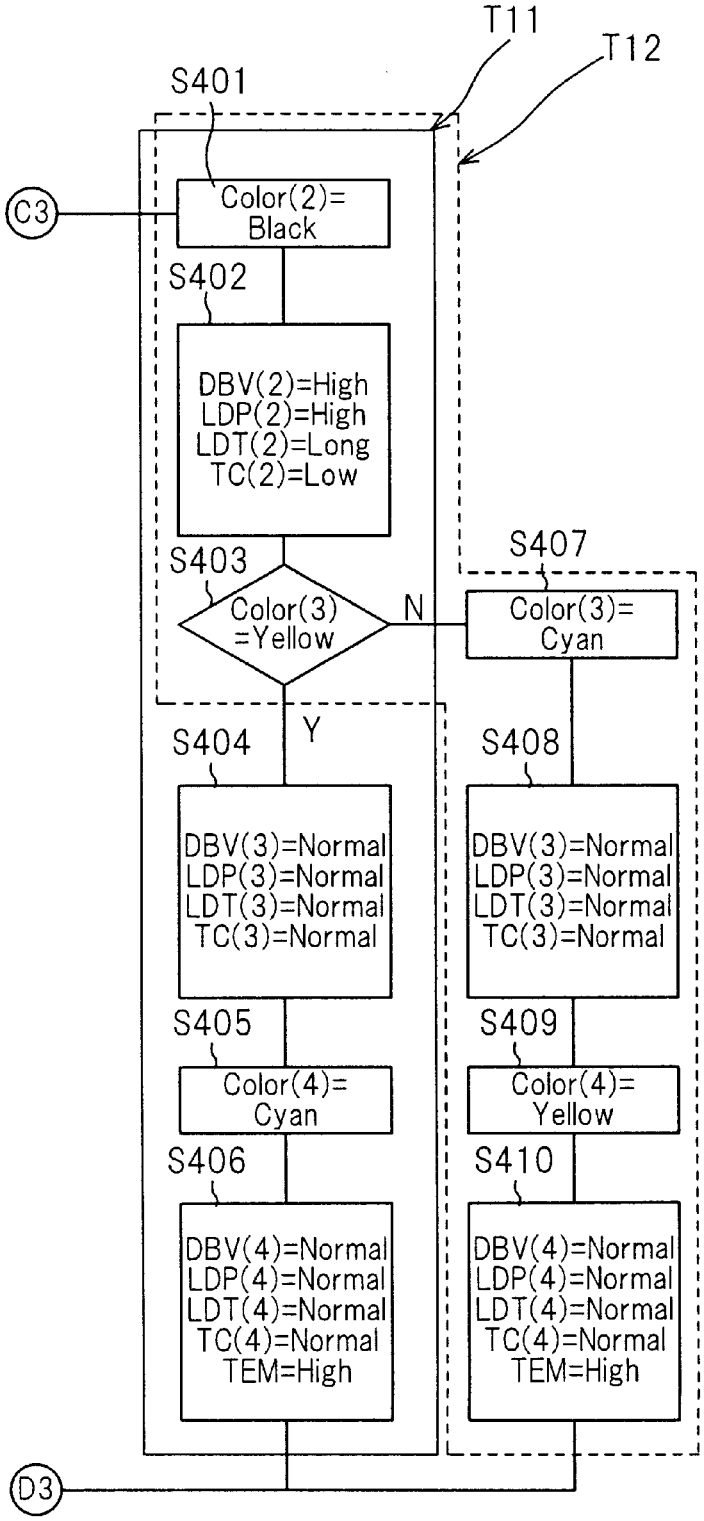
FIG. 52 is a flowchart showing the continuation of subroutine 22 following FIG. 51.

As shown in FIGS. 51 and 52, in subroutine 22 where the first color, Color (1) is magenta, the second color, Color (2) (S381, S391, S401), the third color, Color (3) (S383, S387, S393, S397, S403, S407), and the fourth color, Color (4) (S385, S389, S395, S399, S405, S409) are successively checked and confirmed. In FIGS. 51 and 52, each color confirmation flow is indicated by corresponding number (No. T7 to No. T12) in Table 1. For each color, the image forming conditions are set up (S382, S384, S386, S388, S390, S392, S394, S396, S398, S400, S402, S404, S406, S408, S410). When the development color of Color (4) is confirmed, the fixing temperature TEM and fixing speed as the forming conditions are set (S386, S390, S396, S400, S406, S410). Here, only the fixing temperature is mentioned in the flowchart.

Figure 53:
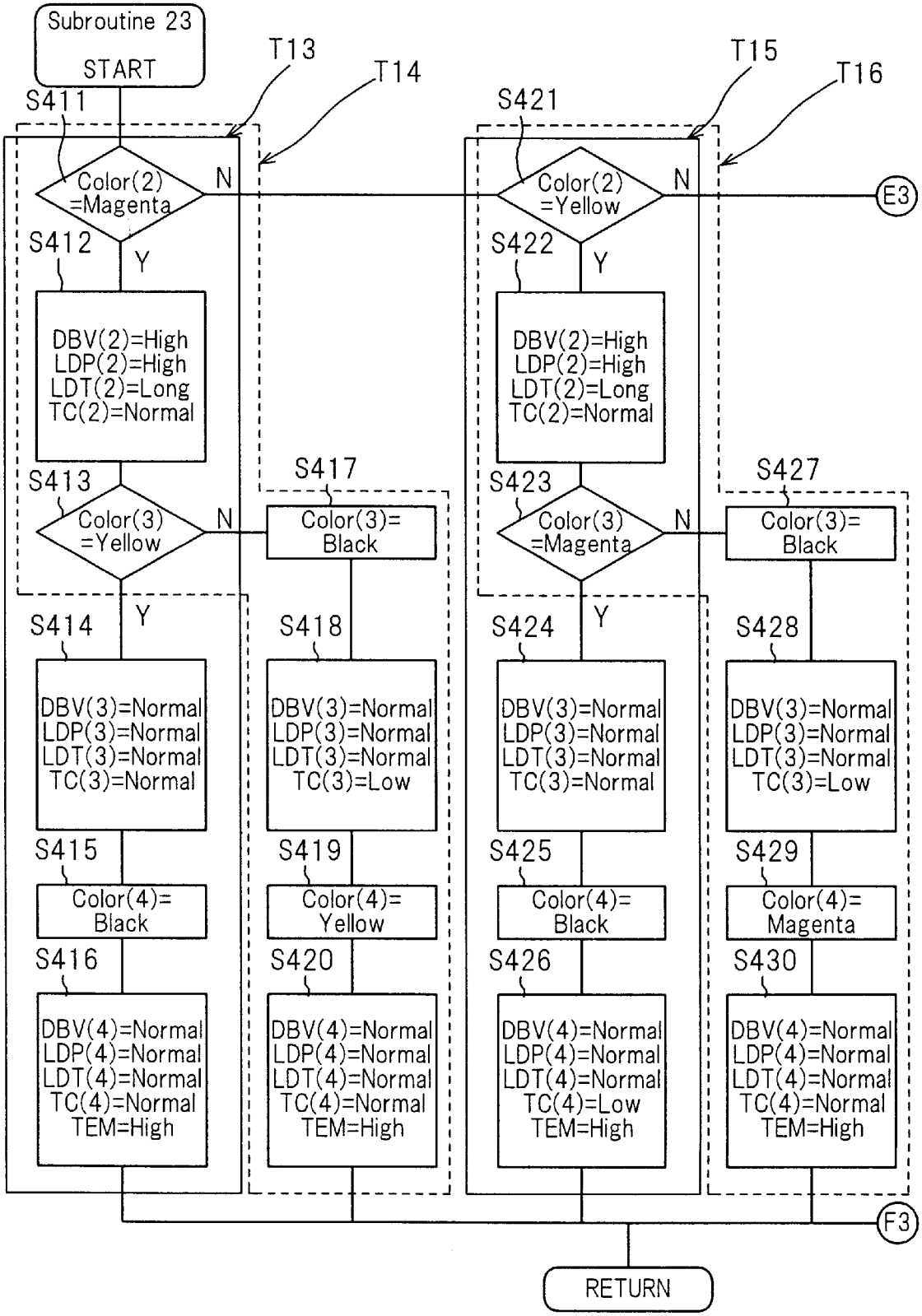
FIG. 53 is a flowchart showing subroutine 23.
Figure 54:
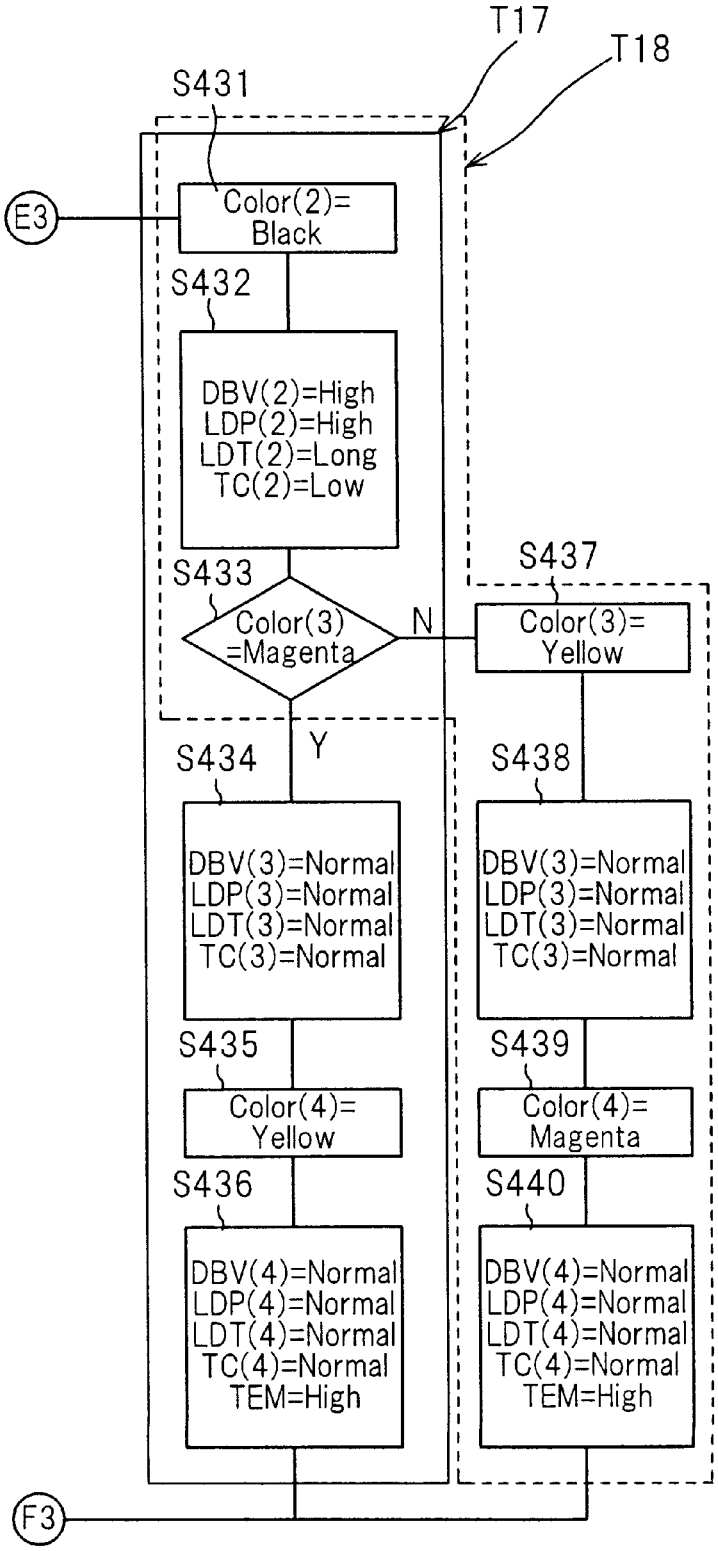
FIG. 54 is a flowchart showing the continuation of subroutine 23 following FIG. 53.

As shown in FIGS. 53 and 54, in subroutine 23 where the first color, Color (1) is cyan, the second color, Color (2) (S411, S421, S431), the third color, Color (3) (S413, S417, S423, S427, S433, S437), and the fourth color, Color(4) (S415, S419, S425, S429, S435, S439) are successively checked and confirmed. In FIGS. 53 and 54, each color confirmation flow is indicated by corresponding number (No. T13 to No. T18) in Table 1. For each color, the image forming conditions are set up (S412, S414, S416, S418, S420, S422, S424, S426, S428, S430, S432, S434, S436, S438, S440). When the development color of Color (4) is confirmed, the fixing temperature TEM and fixing speed as the forming conditions are set (S416, S420, S426, S430, S436, S440). Here, only the fixing temperature is mentioned in the flowchart.

Figure 55:
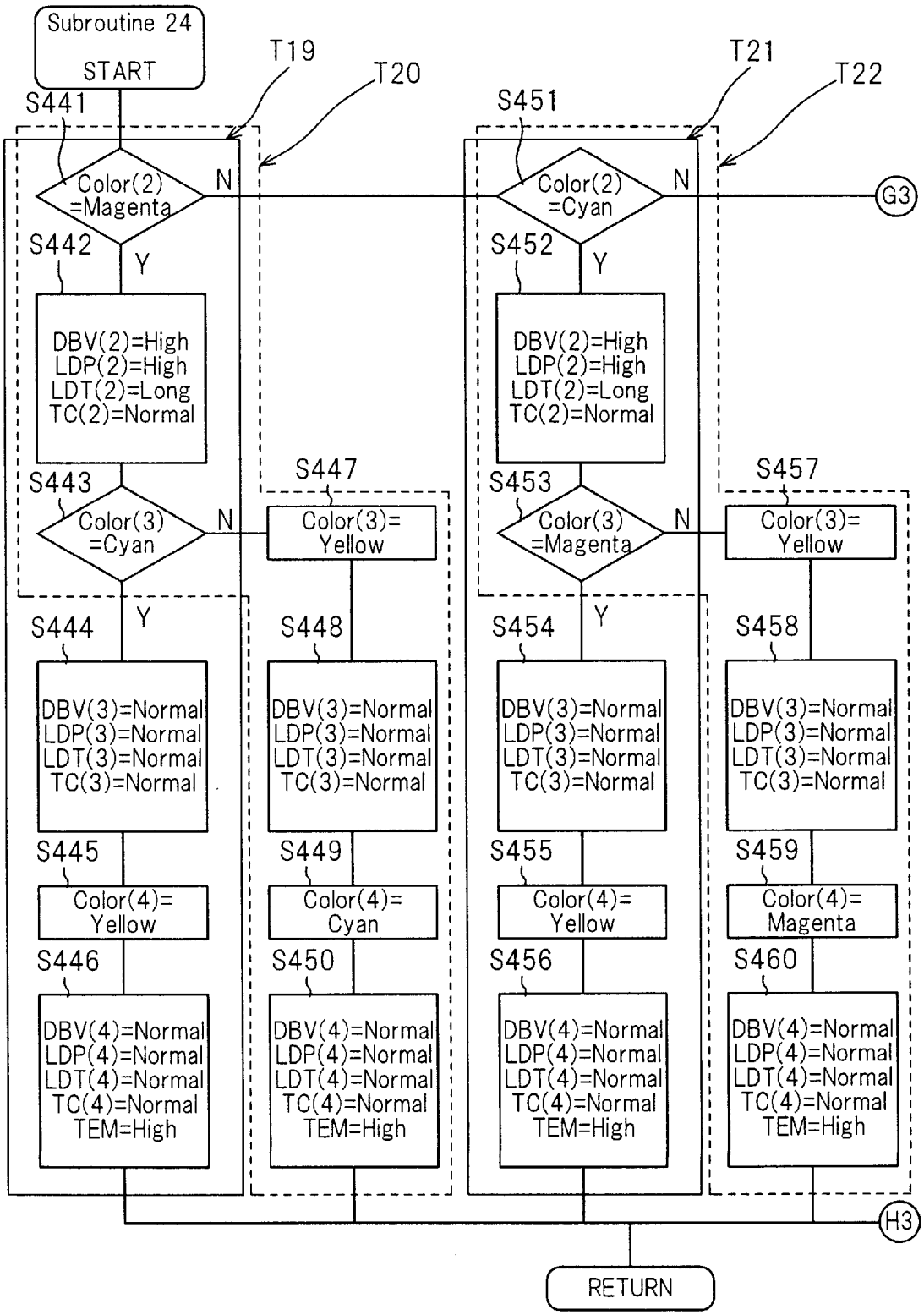
FIG. 55 is a flowchart showing subroutine 24.
Figure 56:
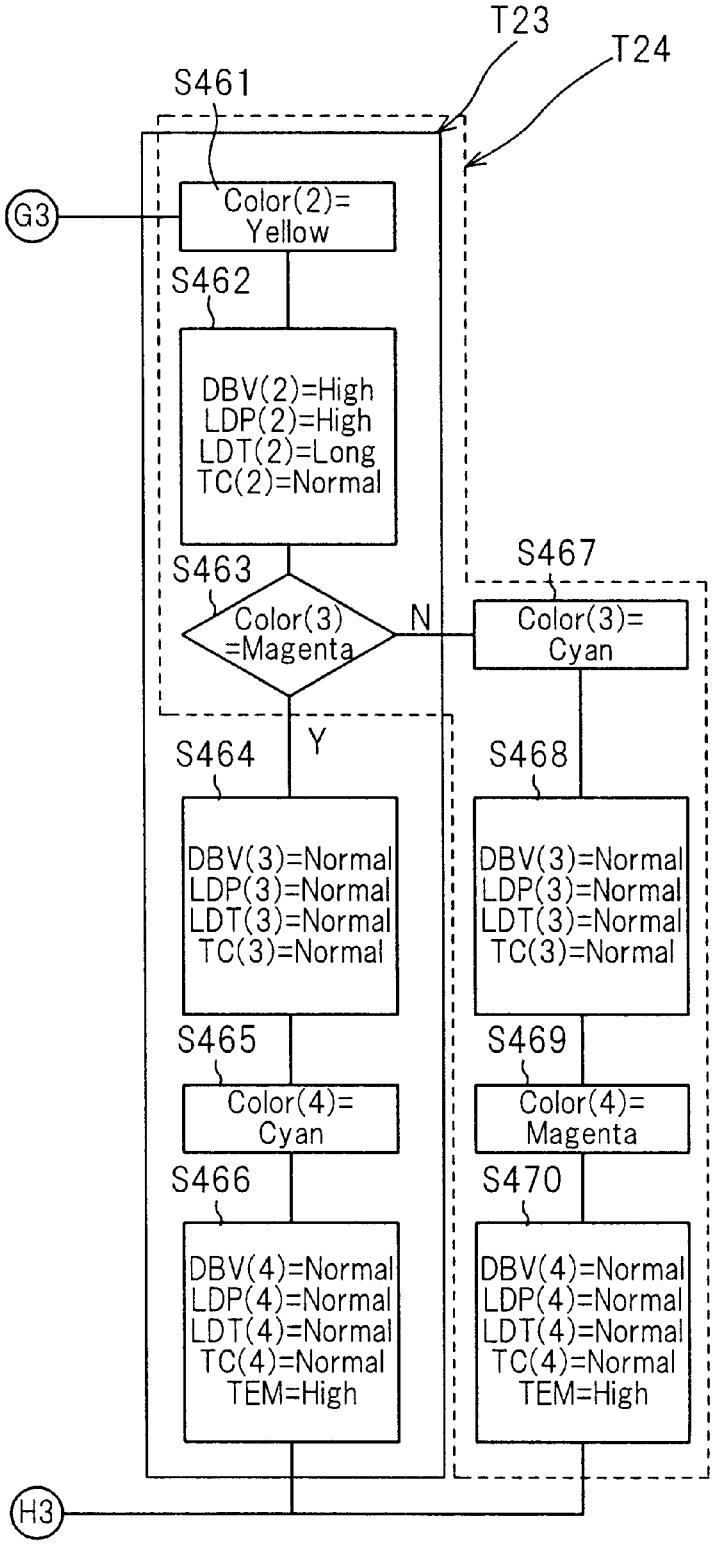
FIG. 56 is a flowchart showing the continuation of subroutine 24 following FIG. 55.

As shown in FIGS. 55 and 56, in subroutine 24 where the first color, Color (1) is black, the second color, Color (2) (S441, S451, S461), the third color, Color (3) (S443, S447, S453, S457, S463, S467), and the fourth color, Color (4) (S445, S449, S455, S459, S465, S469) are successively checked and confirmed. In FIGS. 55 and 56, each color confirmation flow is indicated by corresponding number (No. T19 to No. T24) in Table 1. For each color, the image forming conditions are set up (S442, S444, S446, S448, S450, S452, S454, S456, S458, S460, S462, S464, S466, S468, S470). When the development color of Color (4) is confirmed, the fixing temperature TEM and fixing speed as the forming conditions are set (S446, S450, S456, S460, S466, S470). Here, only the fixing temperature is mentioned in the flowchart.

There are twenty-four types of development timing for performing development following the thus setup image forming conditions. FIGS. 58 to 61 show the timing charts. CPU 34 selects one of the timing charts shown in FIGS. 58 to 61, based on the color order, Color (1) to Color (4) with respect to the locations DUP(1) to DUP(4) of developing units 14*a* to 14*d*. CPU 34 sets up image forming conditions based on the toner colors of developing units 14*a* to 14*d* and the color order, Color (1) to Color (4) in which image forming is performed and temporarily stores the conditions into RAM 36. Then CPU 34 performs the image formation described below, based on the thus setup image forming conditions.

Figure 57:
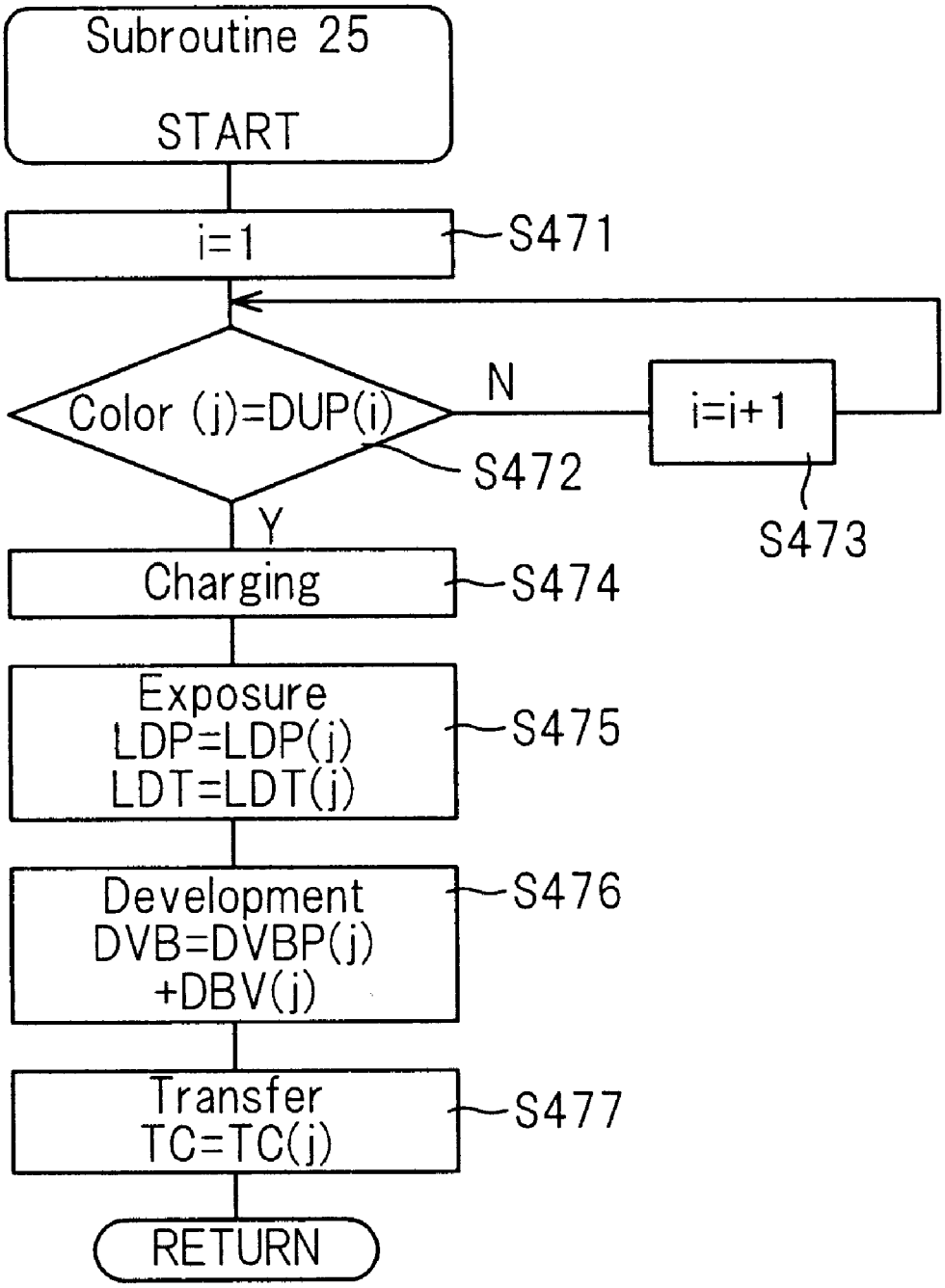
FIG. 57 is a flowchart showing subroutine 25.
Figure 60:
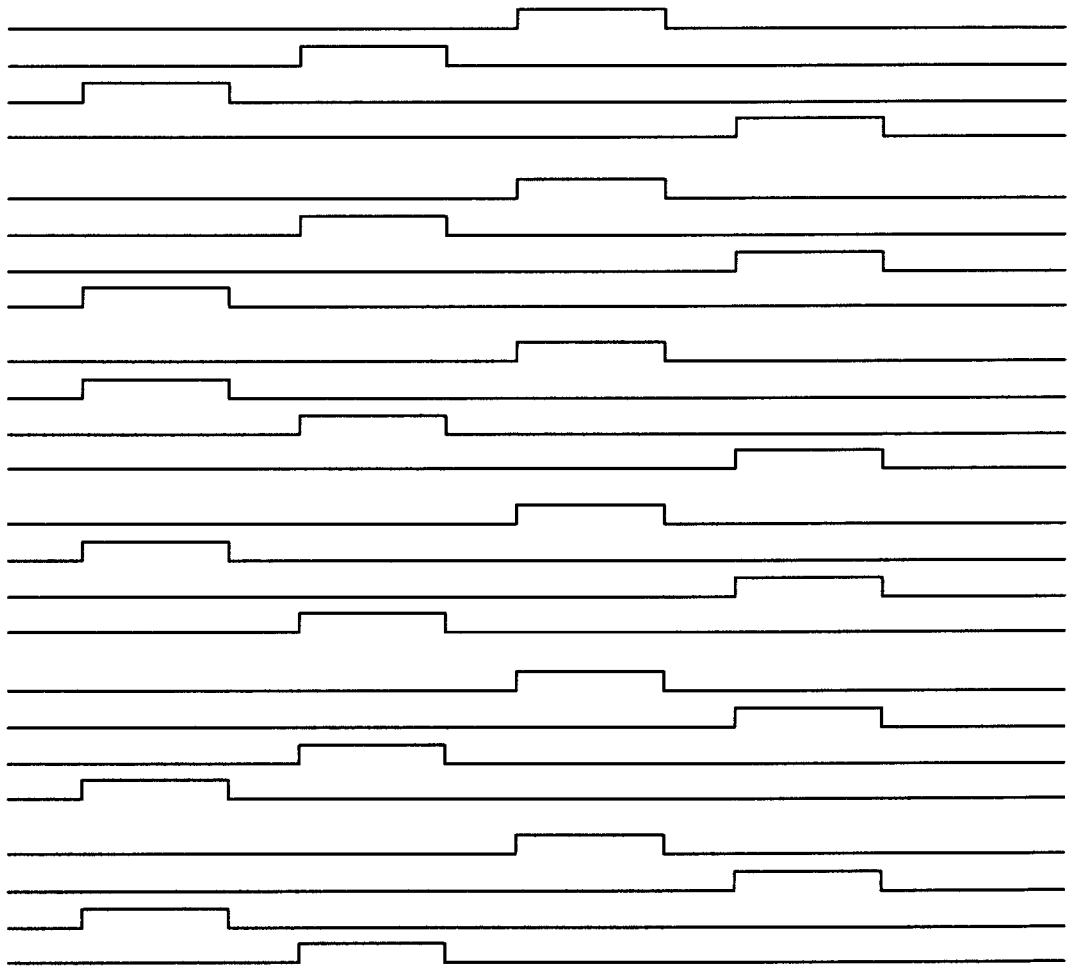
FIG. 60 is a timing chart for effecting development with developing units in the designated, developing color order.

After the completion of process control, developing bias DVBP for each layer is set (S339). Then, j is assumed as the number indicating the sequential order of development, and j is set equal to 1 (j=1) at S340 (FIG. 48). Then, the image forming of the first color is carried out through subroutine 25 under the image forming conditions stored in RAM 36 (FIG. 57).

CPU 34 sets i equal to 1 in subroutine 25 (FIGS. 48 and 57) at S471. Here, i is the number allotted for each of developing unit locations DUP(1) to (4). Then, CPU 34 searches for a DUP which allows the image formation of Color (1), based on the stored information in RAM 36 (S472). If DUP (1) is the wanted one, the operation goes to S474. If DUP (1) is not the one, the CPU increments i(i=i+1) at S473 and repeats the check at S472. In this way, CPU 34 locates the position DUP of the developing unit having Color (1).

Then, the image forming begins with uniform charging of photosensitive drum 12 by charger 18 (S474). LSU 11 exposes photosensitive drum 12 at exposure power LDP (1) for a period of exposure time LDT (1), which are the exposure conditions, to thereby form a static latent image (S475). Next, development is carried out with the optimal developing bias DVB which is the modified developing bias DVBP (1) plus developing bias DBV (1), using the developing unit located at the DUP corresponding to Color (1) (S476). Then, the image is transferred to intermediate transfer element 15 with the transfer voltage set at TC(1) (S477).

When the first color component image has been formed, it is checked if j=4 (S342), then j=j+1 at S343 and the operation returns to S341. This sequence, i.e., S341 or subroutine 25 is repeated up to the fourth color, Color (4). In this way, development is carried out based on the thus determined image forming conditions. There are twenty-four types of development timing for performing development. FIGS. 58 to 61 show the timing charts. When the developed image of the fourth color is completely laid on intermediate transfer element 15, all the layers of toners are transferred at one time to print paper 20 and then the toner is fixed at fixing temperature TEM (S344). The multiple layers of color toners are formed on print paper 20, from the top to the bottom, in the developing order.

Since specific setup of the image forming conditions in accordance with the locations of developing units 14*a* to 14*d* and the developing color order is the same as that in the first embodiment, the description is omitted.

(The Sixth Embodiment)

The image forming portion of the sixth embodiment has the same configuration as in the second embodiment (see FIGS. 20 and 21), so that the detailed description is omitted. In this embodiment, as in the second embodiment, developing units 14*a* to 14*d* are arranged along the photosensitive drum 12 surface, and developing units 14*a* to 14*d* are fixed and will not move. The difference from the second embodiment resides in that the user can freely select the order of colors to be developed.

Figure 62:
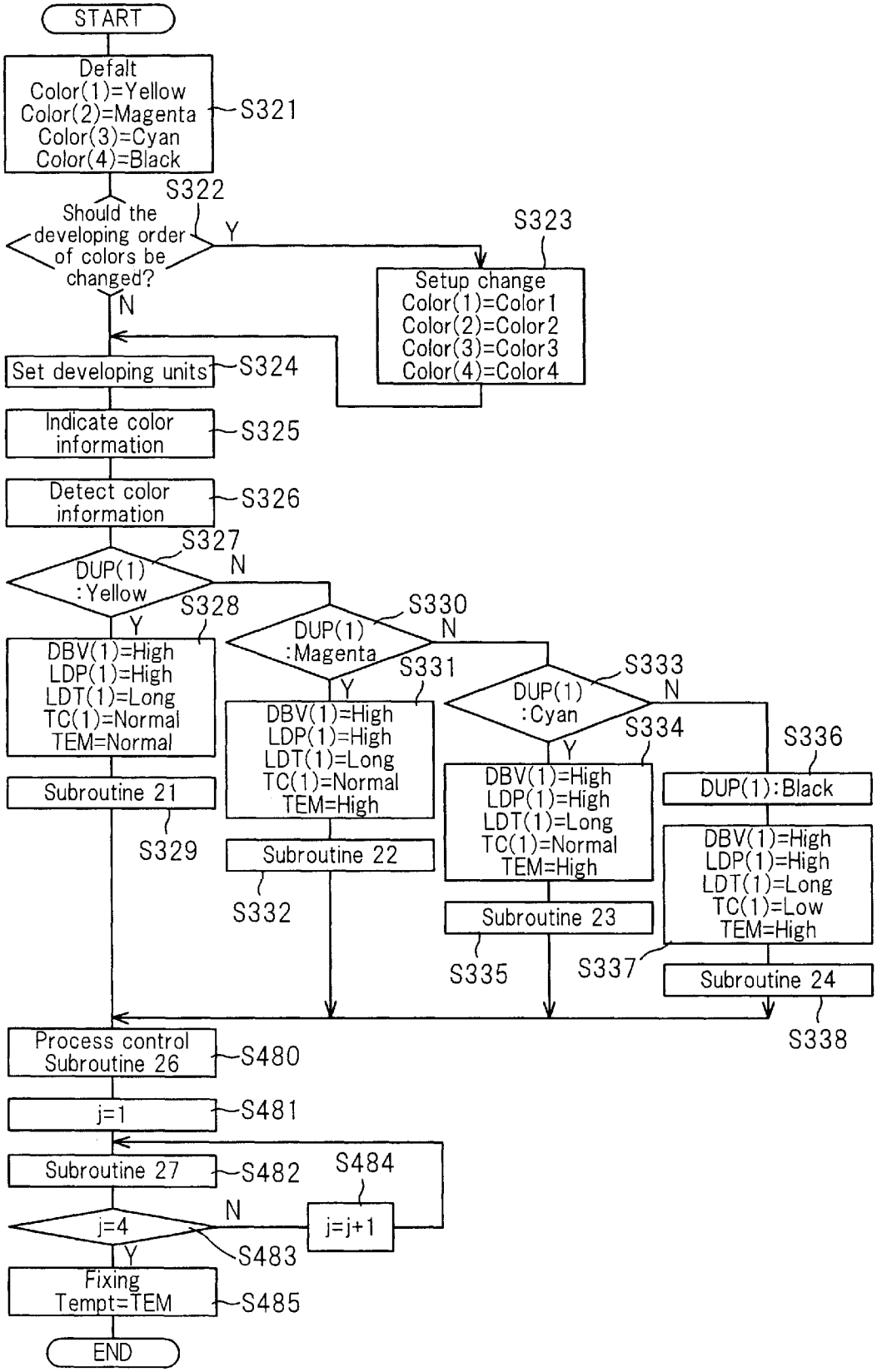
FIG. 62 is a flowchart showing the control steps of the controller of the sixth embodiment.
Figure 63:
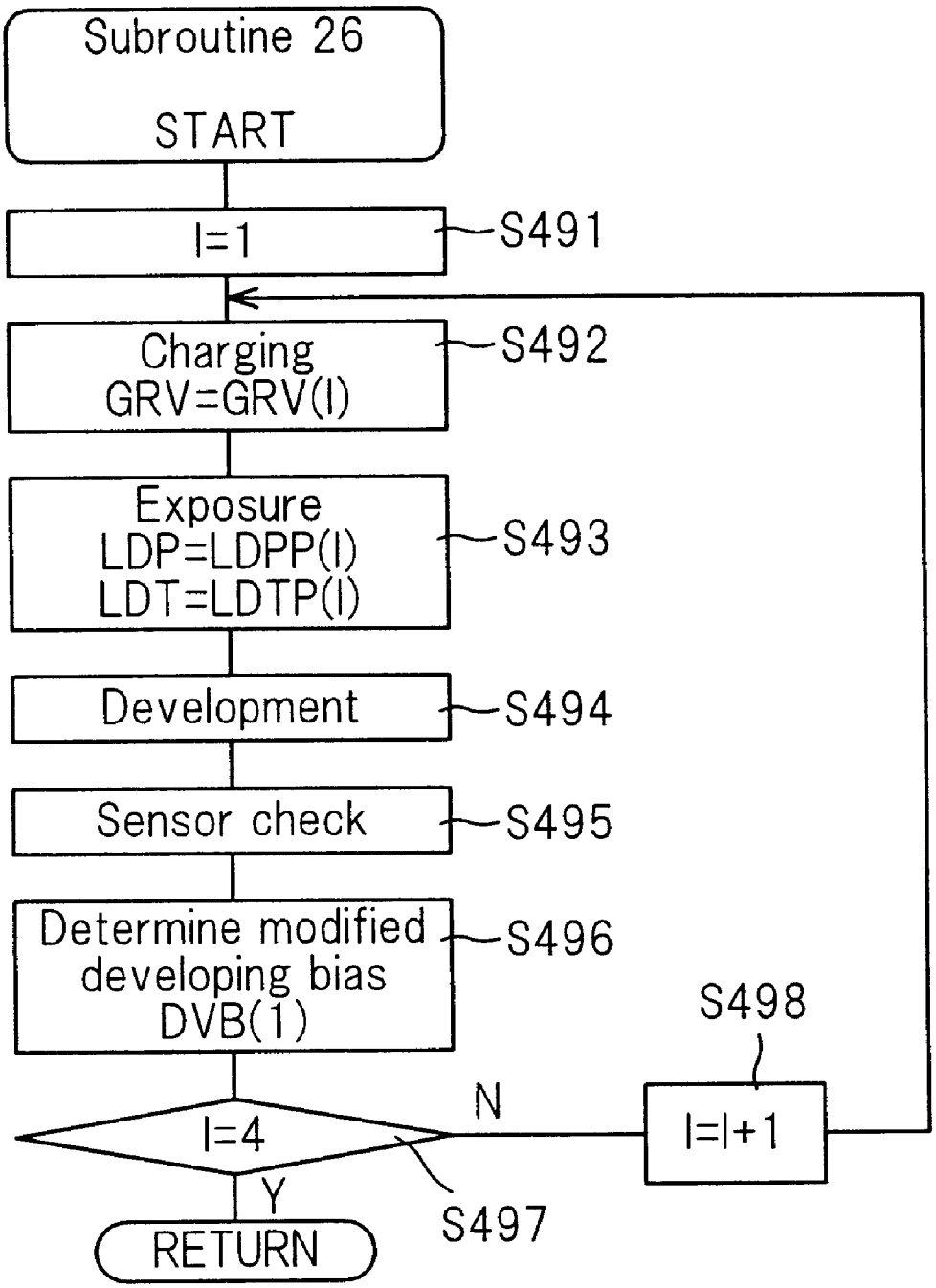
FIG. 63 is a flowchart showing subroutine 26.
Figure 64:
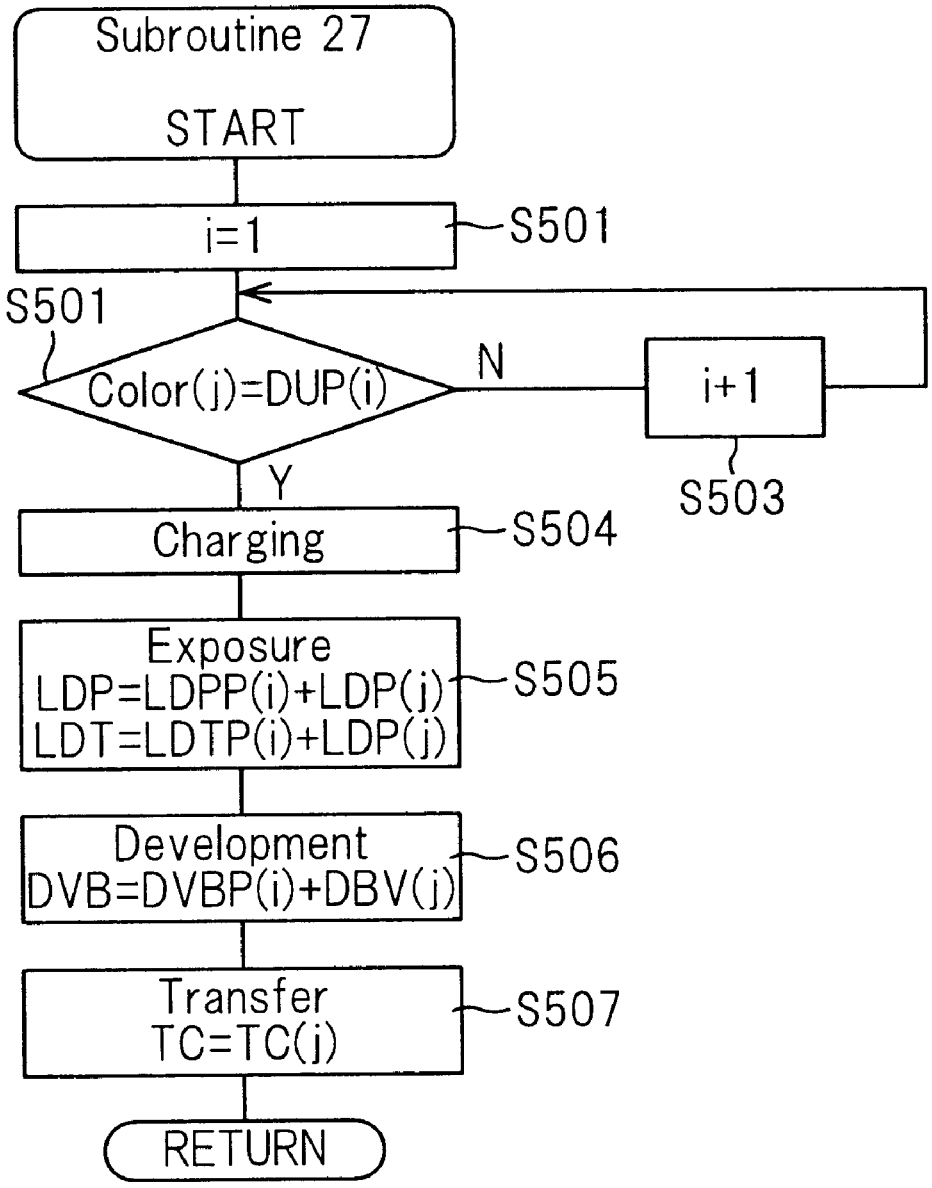
FIG. 64 is a flowchart showing subroutine 27.

FIG. 62 is a flowchart showing the control steps in this image formation. FIG. 63 is a flowchart showing subroutine 26, and FIG. 64 is a flowchart showing subroutine 27.

FIG. 62 is a flowchart showing the control steps in this image formation. Since this flowchart is basically the same as that of the fifth embodiment shown in FIG. 48, the same parts are allotted with the same numerals without description. The difference from the fifth embodiment resides in the sequence of steps S480 to S485. As shown in FIG. 63, since developing units 14*a* to 14*d* are arranged along photosensitive drum 12, the distance (the angle of arrangement) from the charging station to the developing station of each color differs from one to the others, subroutine 26 at step S480 in the process control sets up modified image forming conditions, taking the above fact into account and also determines the image forming conditions based on the detected result from process control sensor 19.

First, the sequential order is set equal to 1 (I=1) at S491, then the image forming conditions of developing unit 14*a* located at DUP(1) are set up. The grid voltage GRV(1) of charger 18 is determined so as to charge photosensitive drum 12 uniformly (S492). Next, modified exposure power LDPP (L) and modified exposure time LDTP(1) of LSU 11 are set again(S493). Development is effected by developing unit 14*a* under these conditions(S494), then the resulting developed state is checked by process control sensor 19 (S495). Based on the detection result of sensor 19, CPU 34 determines modified developing bias DVBP(1) (S496). At S497, it is checked whether I=4. If not, then I=I+1 (S498), and the operation returns to S492. In this way, the processing steps S492 to S496 are repeated until I=4, to determine grid voltages GRV(2) to GRV(4) of charger 18, exposure power LDPP(2) to LDPP(4) of LSU11, exposure time LDTP(2) to LDTP(4) and modified developing bias voltages DVBP(2) to DVBP(4) of developing units 14*b* to 14*d*.

The image forming conditions in the above subroutine 26 for this arrangement of developing units 14*a* to 14*d* are set up in the same manner as in the second embodiment, so the description is omitted. Development is performed under the thus set forming conditions. Here, the timing for development is the same as in FIGS. 58 to 61 above.

In this way CPU 34 sets up image forming conditions based on the toner colors of developing units 14*a* to 14*d* and the color order, and temporarily stores the conditions into RAM 36. Then CPU 34 performs the image formation described below, based on the thus setup image forming conditions.

First, j is assumed as the number indicating the sequential order of development, and j is set equal to 1 (j=1) at S481 (FIG. 62). Then, the image forming of the first color is carried out through subroutine 27 (FIG. 64) under the image forming conditions stored in RAM 36.

As shown in FIG. 64, CPU 34 sets i equal to 1 in subroutine 27 (S501). Here, i is the number allotted for each of developing unit locations DUP(1) to (4). Then, CPU 34 searches for a DUP which allows the image formation of Color (1), based on the stored information in RAM 36 (S502). If DUP (1) is the wanted one, the operation goes to S504. If DUP (1) is not the one, the CPU increments i(i=i+1) at S503 and repeats the check at S502. In this way, CPU 34 locates the position DUP of the developing unit having Color (1).

Then, photosensitive drum 12 is uniformly charged by charger 18 with its grid set at a grid voltage GRV(i) corresponding to the DUP(i) of the developing unit having Color (1) (S504). LSU 11 exposes photosensitive drum 12 at exposure power LDP for a period of exposure time LDT, forming a static latent image (S505). Here, the exposure conditions, i.e., LDP is the modified exposure power LDPP (i) plus exposure power LDP(1) dependent on the color order and LDT is the modified exposure time LDTP(i) plus exposure time LDT(1) dependent on the color order.

Next, development is carried out with the optimal developing bias DVB which is the modified developing bias DVBP (i) plus developing bias DBV (1) dependent on the color order, using the developing unit located at the DUP(i) corresponding to Color (1) (S506). Then, the image is transferred to intermediate transfer element 15 with the transfer voltage set at TC(1) (S507).

When the first color component image has been formed, it is checked if j=4 (S483(FIG. 62)), then j=j+1 at S484 and the operation returns to S482. This sequence, i.e., S482 or subroutine 27 is repeated up to the fourth color, Color (4). In this way, development is carried out based on the thus determined image forming conditions. There are twenty-four types of development timing for performing development. FIGS. 58 to 61 show the timing charts. When the developed image of the fourth color is completely laid on intermediate transfer element 15, all the layers of toners are transferred at one time to print paper 20 and then the toner is fixed at fixing temperature TEM (S485). The multiple layers of color toners are formed on print paper 20, from the top to the bottom, in the developing order.

Since specific setup of the image forming conditions in accordance with the locations of developing units 14*a* to 14*d* and the developing color order is the same as that in the second embodiment, the description is omitted.

(The Seventh Embodiment)

Since the image forming portion of the seventh embodiment has the same configuration as in the third embodiment (see FIG. 30), the detailed description is omitted. In this embodiment, as in the third embodiment, developing unit holder 13 rotates about its cylindrical axis and has a rotary configuration so as to move and set each developing unit for a color to be developed to the predetermined position of photosensitive drum 12. The toner is transferred to print paper 20 from photosensitive drum 12. The difference from the third embodiment resides in that the user can freely select the order of colors to be developed.

Figure 65:
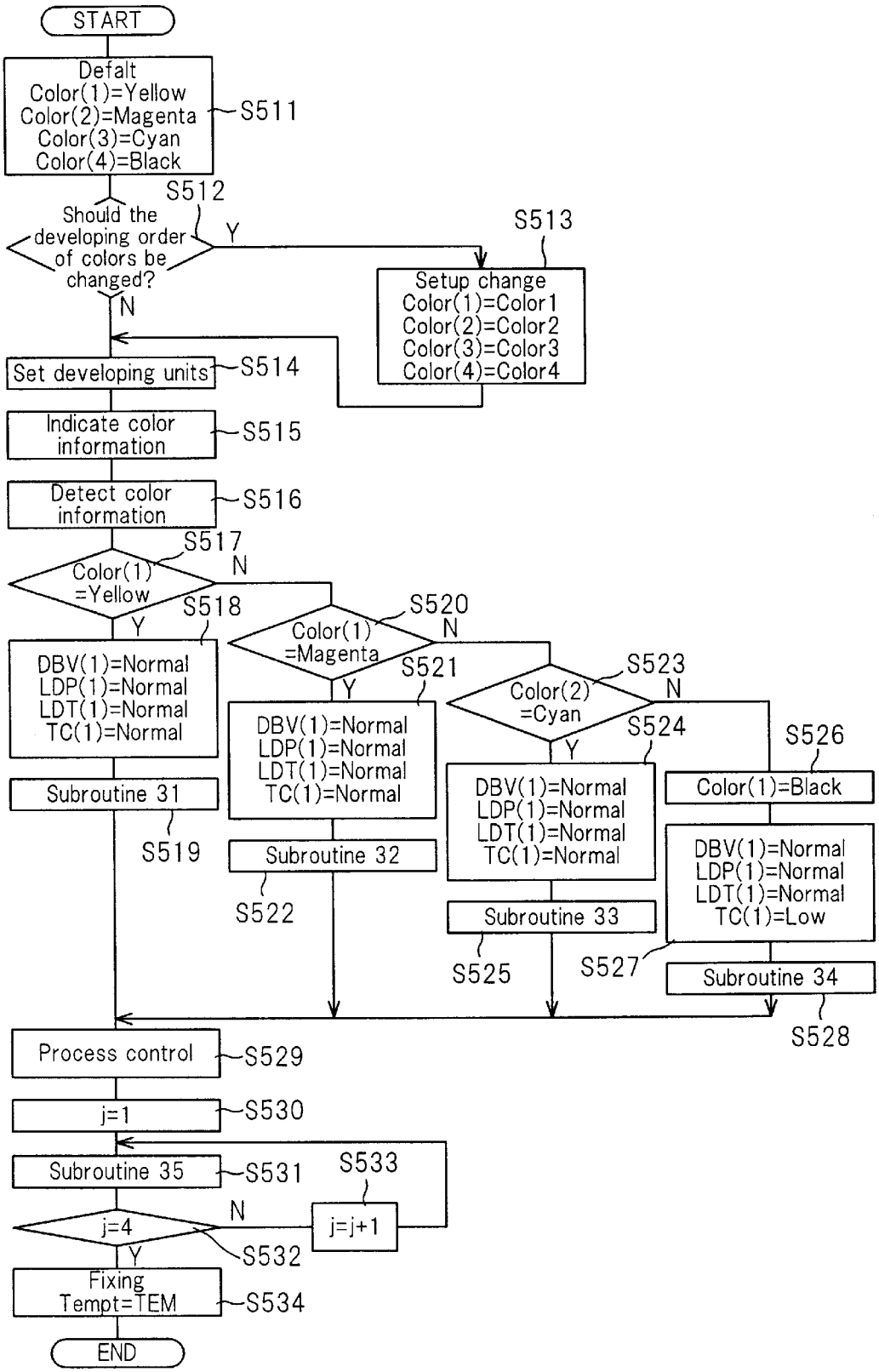
FIG. 65 is a flowchart showing the control steps of the controller of the seventh embodiment.

FIG. 65 is a flowchart showing the control steps during image forming. When all developing units 14*a* to 14*d* are set to accommodation sockets (holders) 13*a* to 13*d*, the color information of each color information indicating means 31 is detected by color information detecting means 32 located at the associated position and the obtained information is output to CPU 34. CPU 34, based on the color information, recognizes the colors of developing units 14*a* to 14*d* having been mounted in developing unit sockets (holders) 13 of image forming portion 70 and stores color information such as process control target values, etc. of developing units 14*a* to 14*d* into RAM.

First, as the initial setup, Color (1)=yellow, Color (2)=magenta, Color (3)=cyan and Color (4)=black (S511). Here, the numerals (1) through (4) of Color indicate the order of development of colors. Since the user is allowed to set the order of colors to be developed, CPU 34 asks whether the order of colors to be developed should be changed (S512). If the setup needs to be changed, the user performs a setup change process as shown in S513. Colors 1 through 4 indicate any of yellow, magenta, cyan and black, and these can be set arbitrarily. CPU 34 stores the set up of the color order of development into RAM 36.

After the order of development has been designated, developing units 14*a* to 14*d* are set to developing unit holder 13 (S514). The color information indicating means 31 attached to each of developing units 14*a* to 14*d* presents color information (S515). This color information is detected by color information detecting means 32 located at the associated position (S516) and the obtained information is output to CPU 34. CPU 34 temporarily stores the color information into RAM 36. CPU 34, based on the color information, recognizes the colors of developing units 14*a* to 14*d* having been mounted in developing unit sockets (holders) 13*a* to 13*d* of image forming portion 10. The mount positions of developing unit sockets (holders) 13*a* to 13*d* are called DUP(1) to DUP(4). The color information stored includes the process control target values, etc. of developing units 14*a* to 14*d*, based on which conditions for the various elements during image forming are set up, to form images of a good quality.

CPU 34 checks at steps S517, S520, S523, S526, which color is set as Color (1), the first color, based on the information of the developing order stored in RAM 36. At steps S518, S521, S524 and S527, developing bias voltage DBV, exposure power LDP, exposure time LDT, transfer voltage TC from photosensitive member 12 to intermediate transfer element 15 and fixing temperature TEM and the fixing speed are set up based on the first color.

If the first color, namely Color (1) is yellow (S517), the image forming conditions for each of the second to fourth colors are determined through subroutine 31 (S519). In a similar manner, the image forming conditions for each of the second to fourth colors are set up through subroutine 32 (S522) if the first color, Color (1) is magenta (S520), subroutine 33 (S525) if the first color, Color (1) is cyan (S523) and subroutine 34 (S528) if the first color, Color (1) is black (S526).

Figure 66:
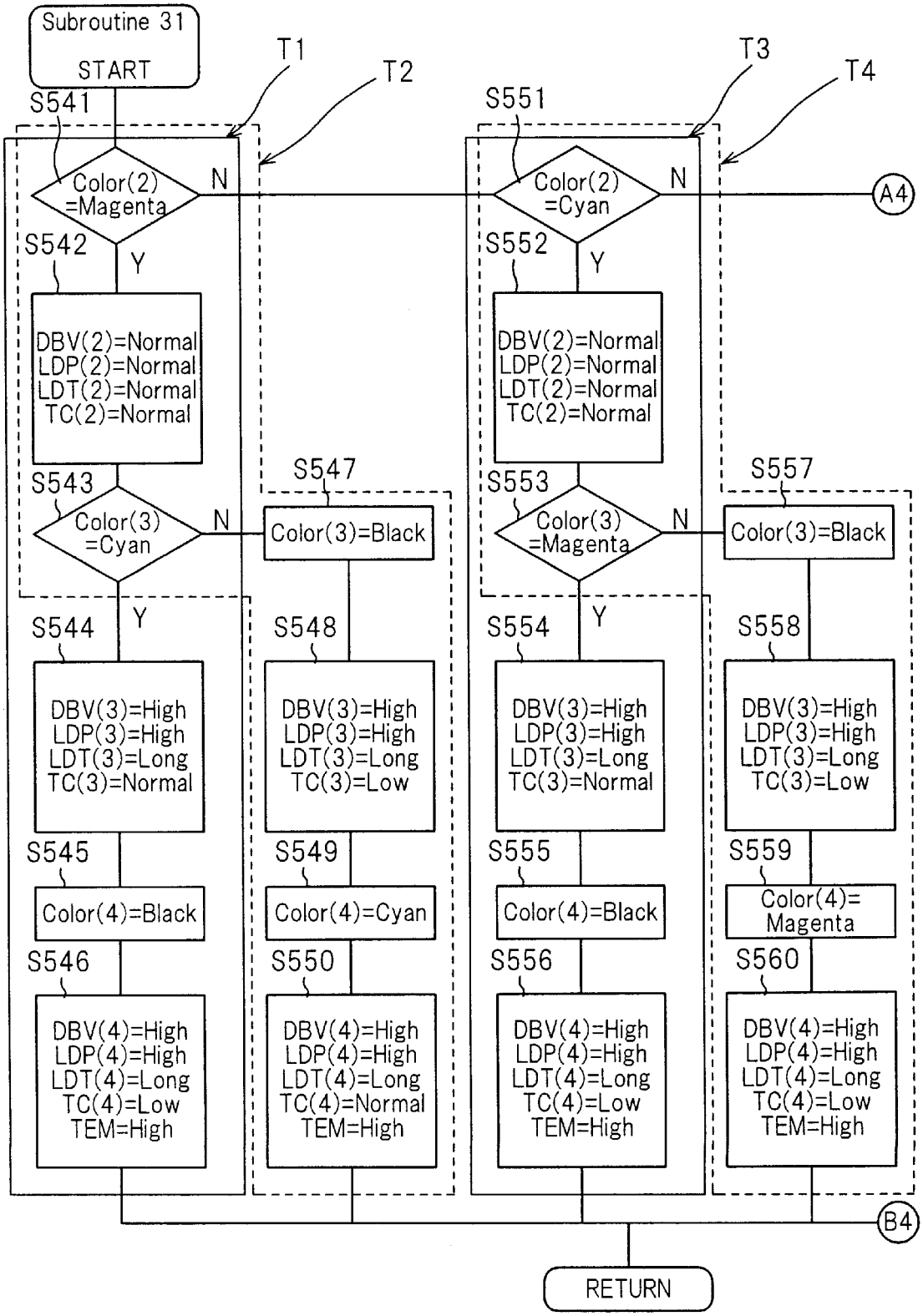
FIG. 66 is a flowchart showing subroutine 31.
Figure 67:
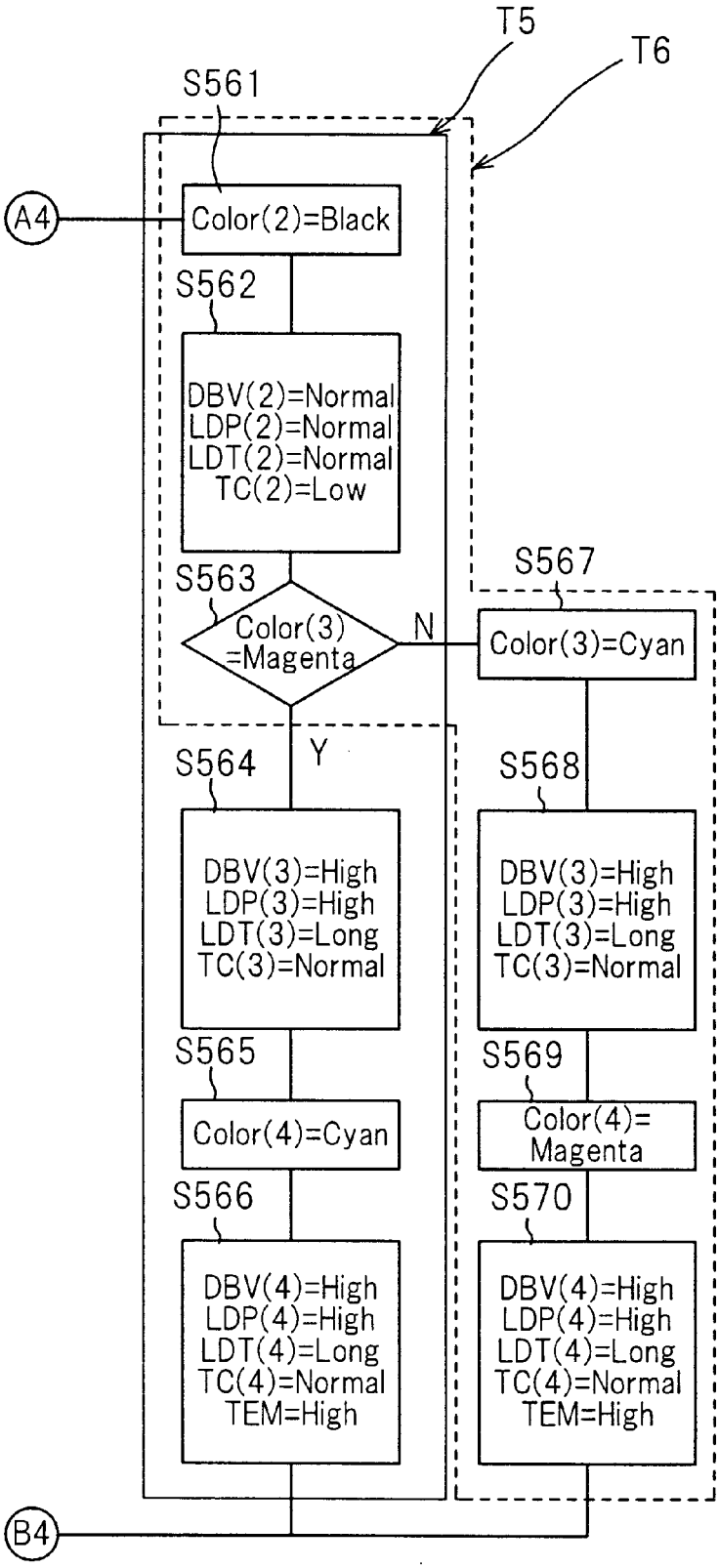
FIG. 67 is a flowchart showing the continuation of subroutine 31 following FIG. 66.

As shown in FIGS. 66 and 67, in subroutine 31 where the first color, Color (1) is yellow, the second color, Color (2) (S541, S551, S561), the third color, Color (3) (S543, S547, S553, S557, S563, S567), and the fourth color, Color (4) (S545, S549, S555, S559, S565, S569) are successively checked and confirmed. In FIGS. 66 and 67, each color confirmation flow is indicated by corresponding number (No. T1 to No. T6) in Table 1. For each color, the image forming conditions are set up (S542, S544, S546, S548, S550, S552, S554, S556, S558, S560, S562, S564, S566, S568, S570). When the conditions for the development color of Color (4) are confirmed, the fixing temperature TEM and fixing speed as the forming conditions are set (S546, S550, S556, S560, S566, S570). Here, only the fixing temperature is mentioned in the flowchart.

Figure 68:
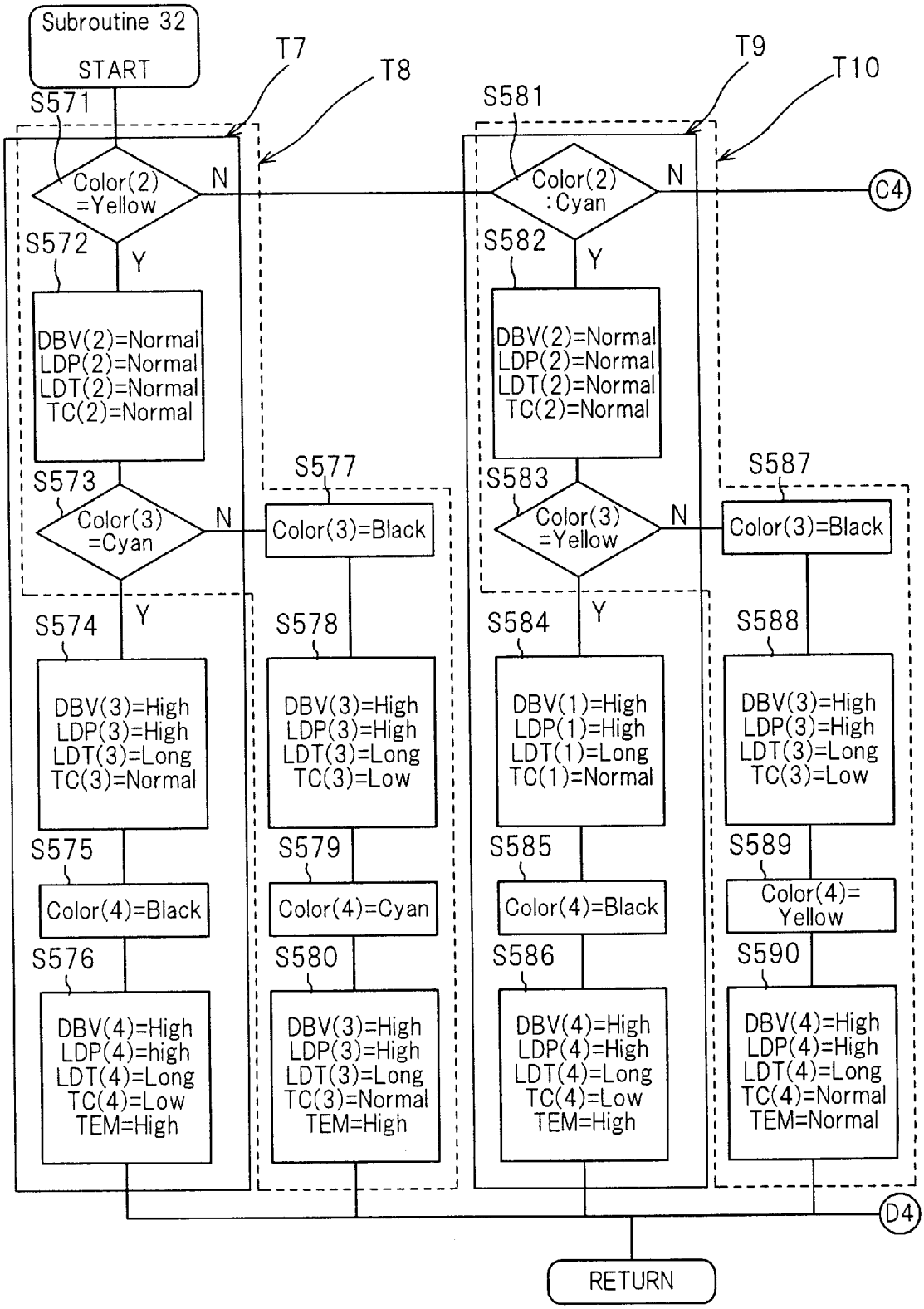
FIG. 68 is a flowchart showing subroutine 32.
Figure 69:
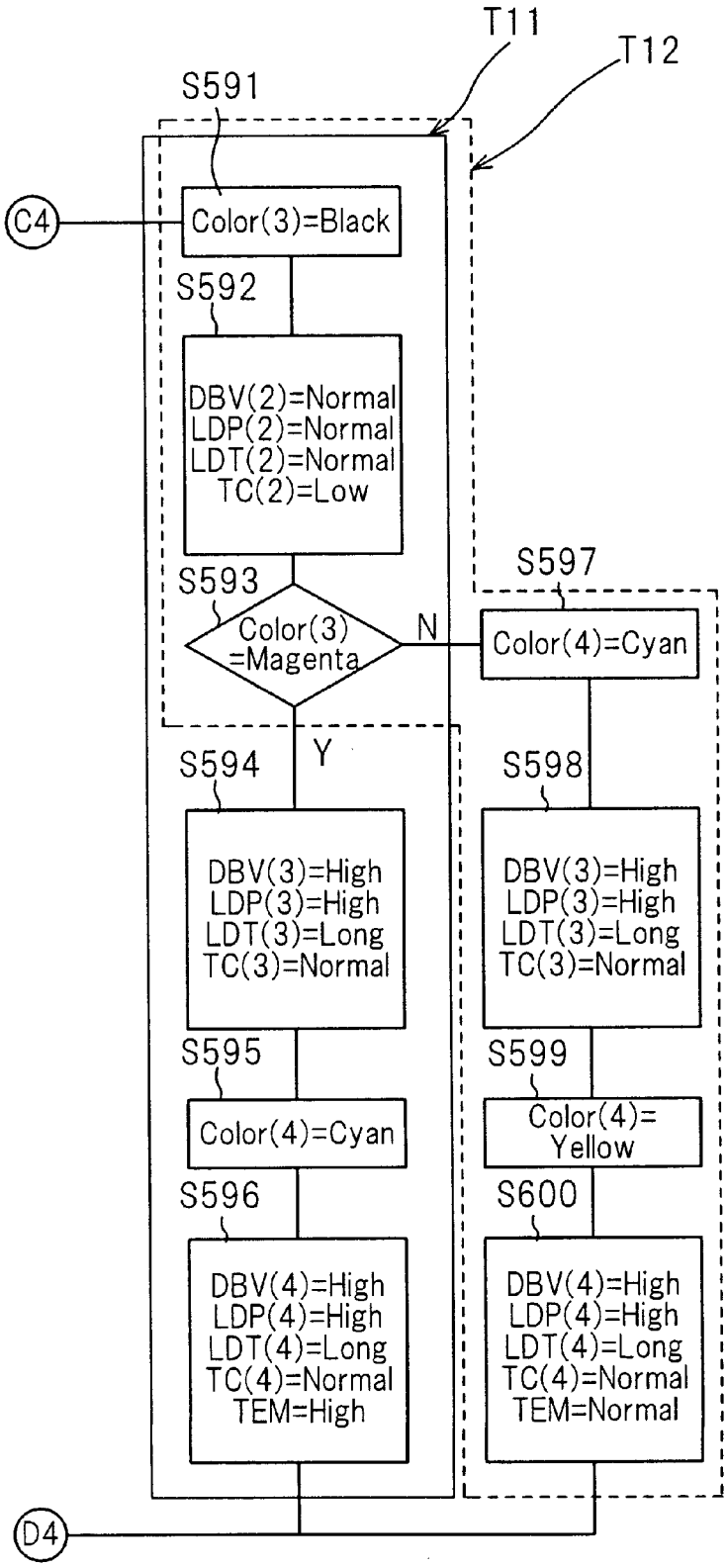
FIG. 69 is a flowchart showing the continuation of subroutine 32 following FIG. 68.

As shown in FIGS. 68 and 69, in subroutine 32 where the first color, Color (1) is magenta, the second color, Color (2) (S571, S581, S591), the third color, Color (3) (S573, S577, S583, S587, S593, S597), and the fourth color, Color (4) (S575, S579, S585, S589, S595, S599) are successively checked and confirmed. In FIGS. 68 and 69, each color confirmation flow is indicated by corresponding number (No. T7 to No. T12) in Table 1. For each color, the image forming conditions are set up (S572, S574, S576, S578, S580, S582, S584, S586, S588, S590, S592, S594, S596, S598, S600). When the conditions for the development color of Color (4) are confirmed, the fixing temperature TEM and fixing speed as the forming conditions are set (S576, S580, S586, S590, S596, S600). Here, only the fixing temperature is mentioned in the flowchart.

Figure 70:
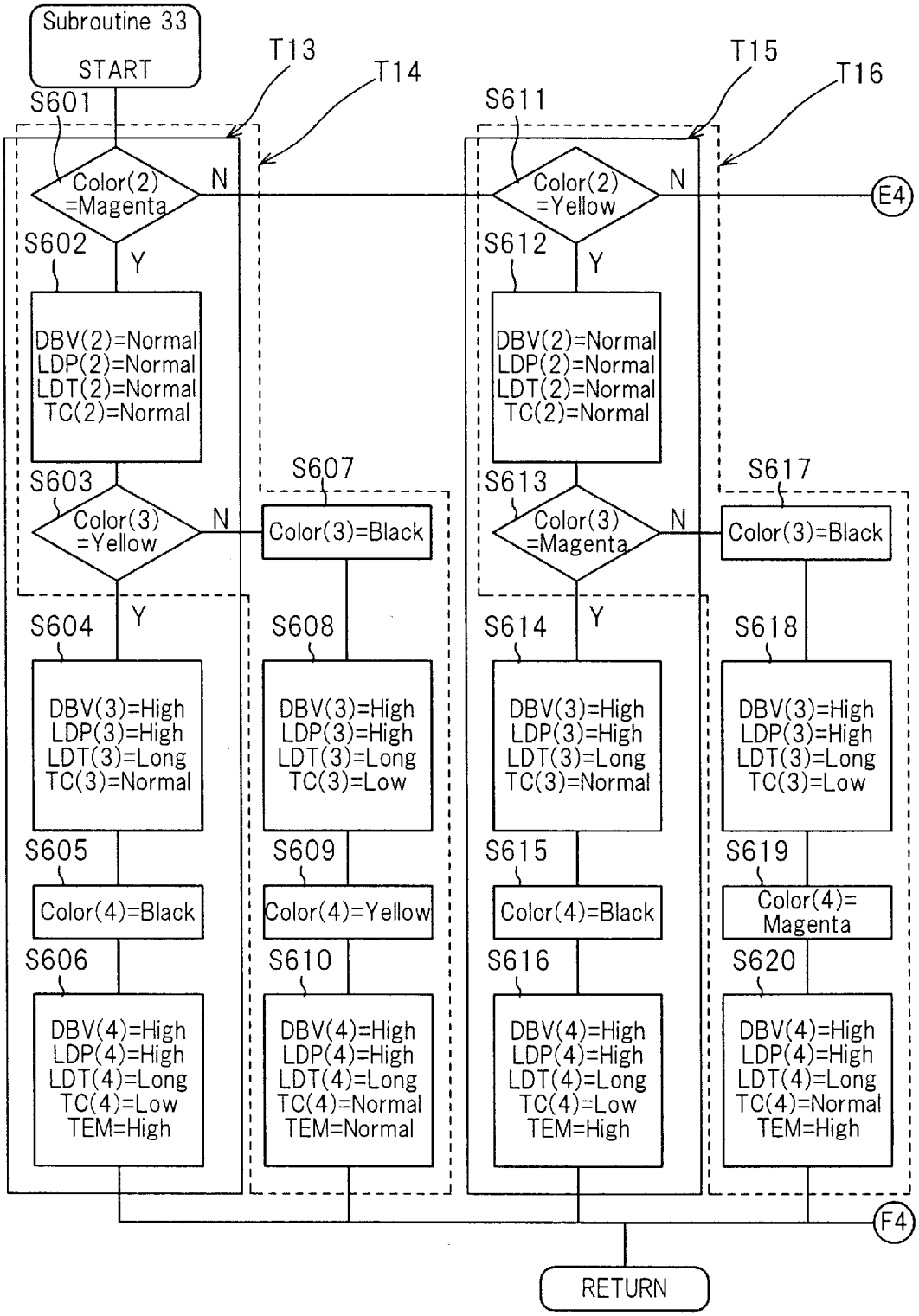
FIG. 70 is a flowchart showing subroutine 33.
Figure 71:
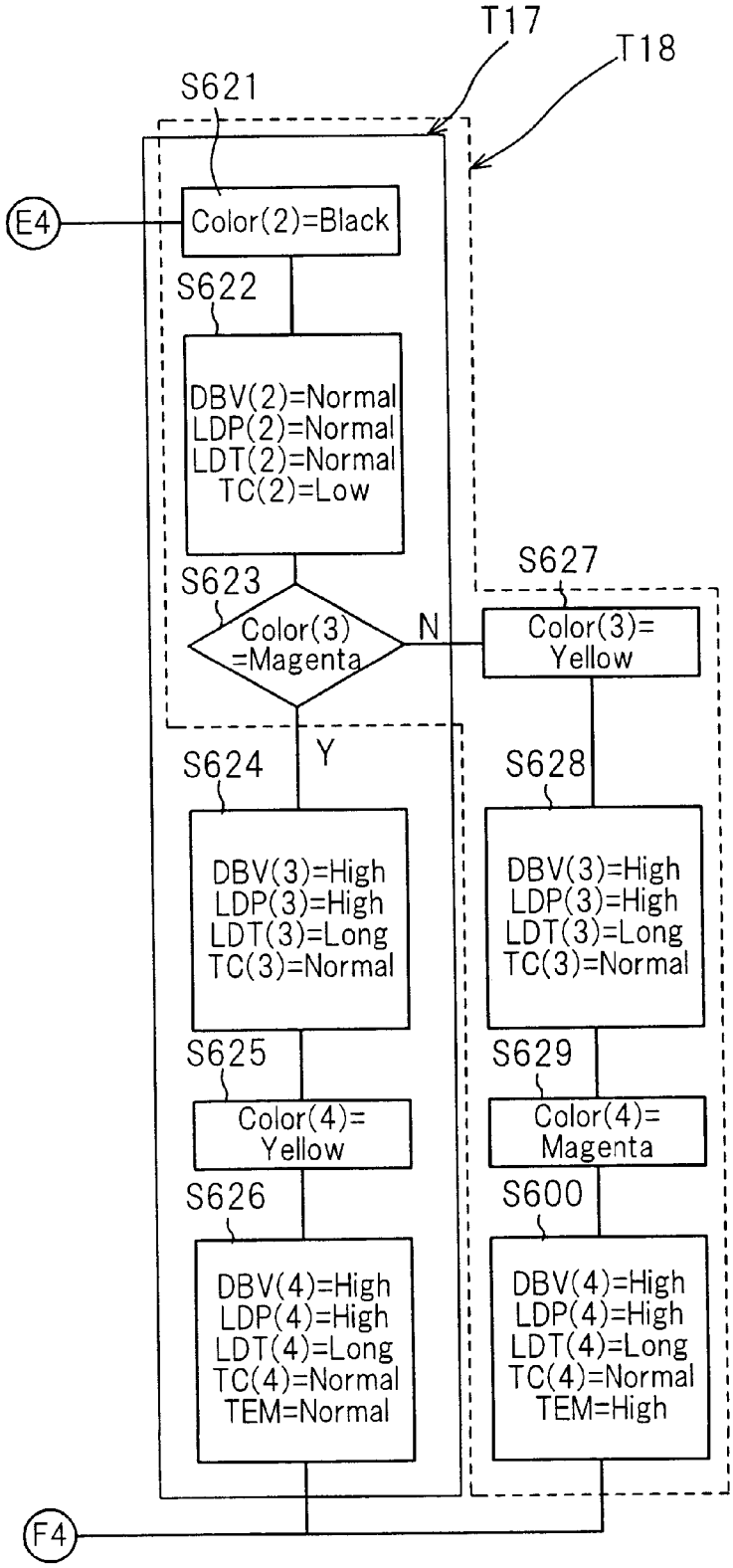
FIG. 71 is a flowchart showing the continuation of subroutine 33 following FIG. 70.

As shown in FIGS. 70 and 71, in subroutine 33 where the first color, Color (1) is cyan, the second color, Color (2) (S601, S611, S621), the third color, Color (3) (S603, S607, S613, S617, S623, S627), and the fourth color, Color (4) (S605, S609, S615, S619, S625, S629) are successively checked and confirmed. In FIGS. 70 and 71, each color confirmation flow is indicated by corresponding number (No. T13 to No. T18) in Table 1. For each color, the image forming conditions are set up (S602, S604, S606, S608, S610, S612, S614, S616, S618, S620, S622, S624, S626, S628, S630). When the conditions for the development color of Color (4) are confirmed, the fixing temperature TEM and fixing speed as the forming conditions are set (S606, S610, S616, S620, S626, S630). Here, only the fixing temperature is mentioned in the flowchart.

Figure 72:
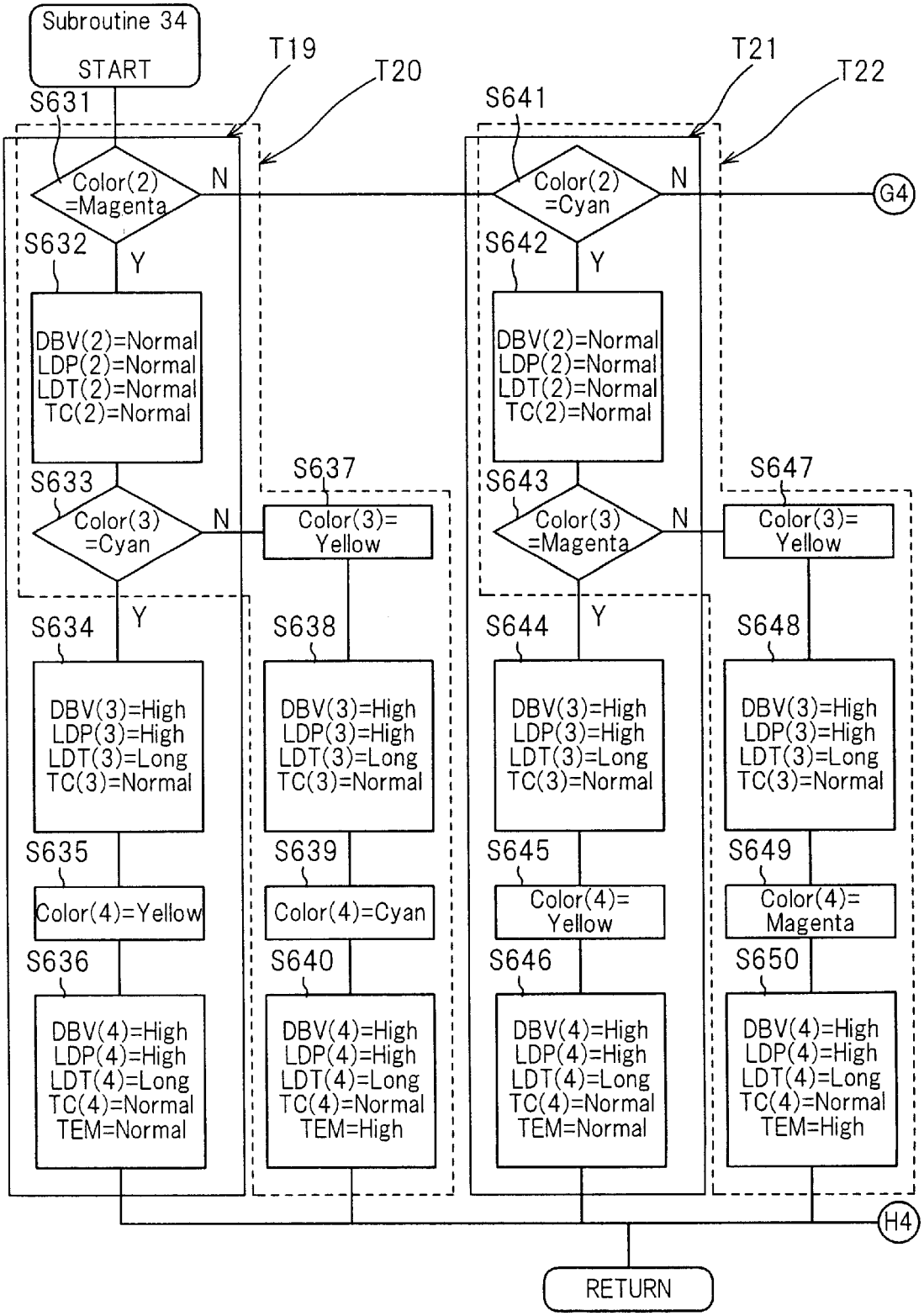
FIG. 72 is a flowchart showing subroutine 34.
Figure 73:
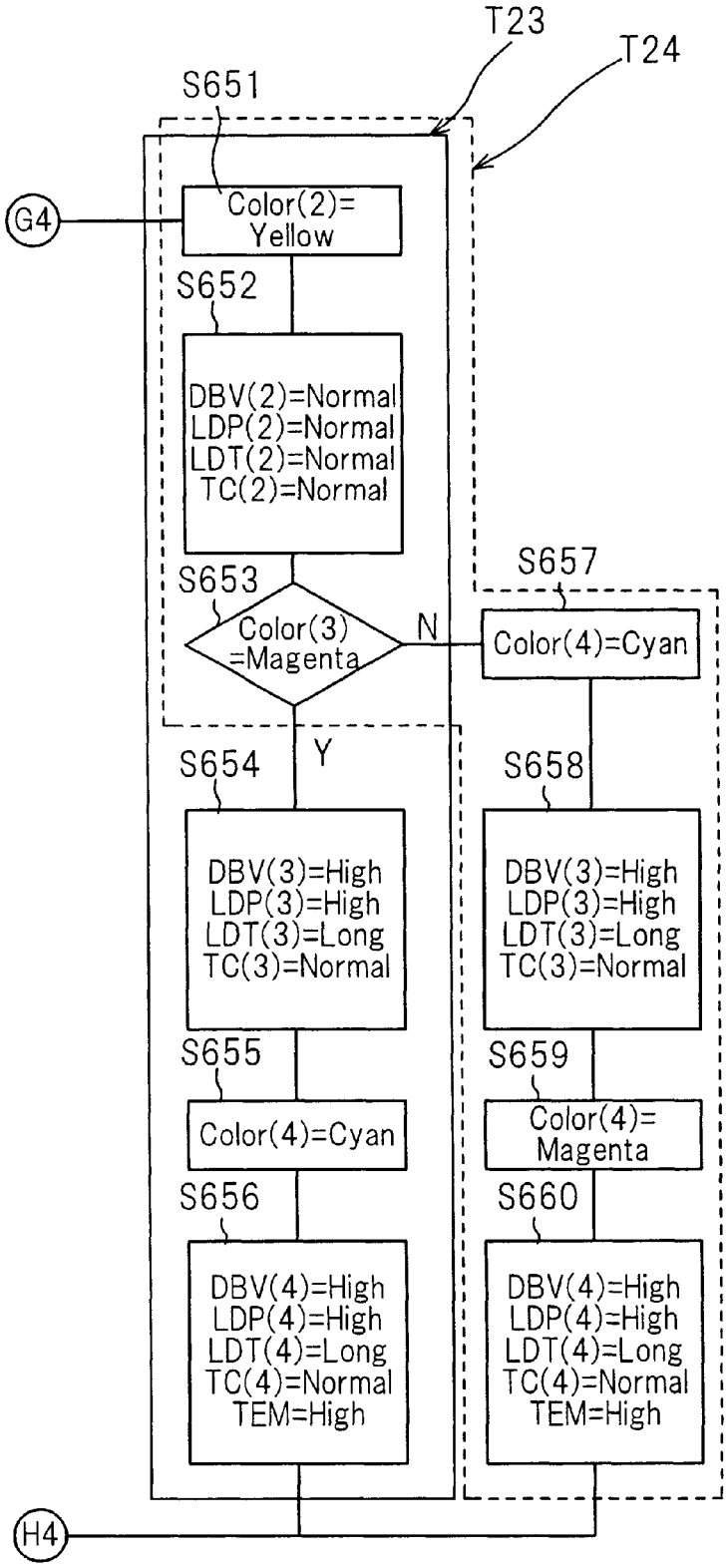
FIG. 73 is a flowchart showing the continuation of subroutine 34 following FIG. 72.

As shown in FIGS. 72 and 73, in subroutine 34 where the first color, Color (1) is black, the second color, Color (2) (S631, S641, S651), the third color, Color (3) (S633, S637, S643, S647, S653, S657), and the fourth color, Color (4) (S635, S639, S645, S649, S655, S659) are successively checked and confirmed. In FIGS. 72 and 73, each color confirmation flow is indicated by corresponding number (No. T19 to No. T24) in Table 1. For each color, the image forming conditions are set up (S632, S634, S636, S638, S640, S642, S644, S646, S648, S650, S652, S654, S656, S658, S660). When the conditions for the development color of Color (4) are confirmed, the fixing temperature TEM and fixing speed as the forming conditions are set (S636, S640, S646, S650, S656, S660). Here, only the fixing temperature is mentioned in the flowchart.

There are twenty-four types of development timing for performing development following the thus setup image forming conditions. FIGS. 58 to 61 show the timing charts. CPU 34 selects one of the timing charts shown in FIGS. 58 to 61, based on the color order, Color (1) to Color (4) with respect to the locations DUP(1) to DUP(4) of developing units 14*a* to 14*d*. CPU 34 sets up image forming conditions based on the toner colors of developing units 14*a* to 14*d* and the color order, Color (1) to Color (4) in which image forming is performed and temporarily stores the conditions into RAM 36. Then CPU 34 performs the image formation described below, based on the thus setup image forming conditions.

Figure 74:
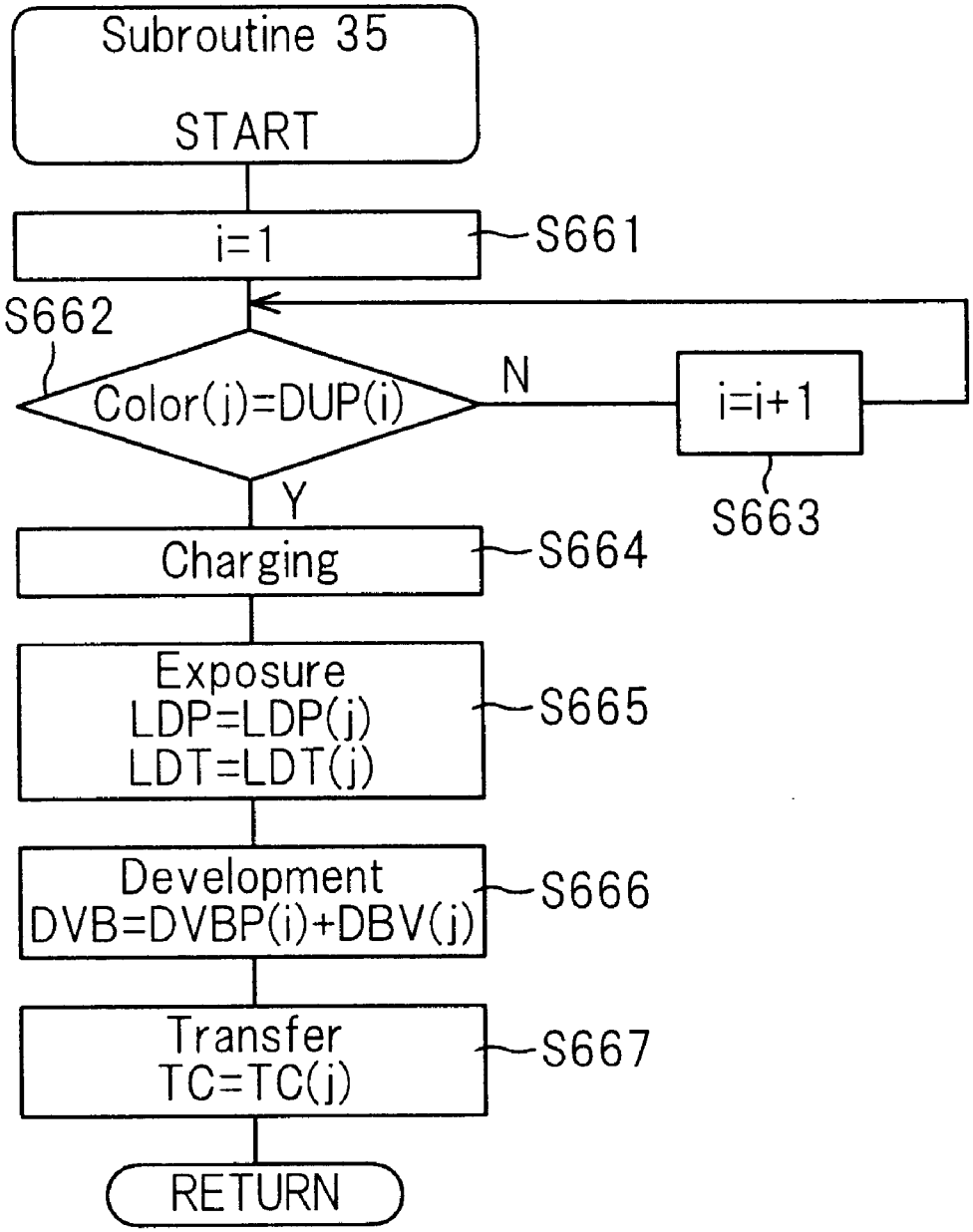
FIG. 74 is a flowchart showing subroutine 35.

After the completion of process control, developing bias DVBP for each layer is set (S529(FIG. 65)). Then, j is assumed as the number indicating the sequential order of development, and j is set equal to 1 (j=1) at S530. Then, the image forming of the first color is carried out through subroutine 35 under the image forming conditions stored in RAM 36 (FIG. 74).

CPU 34 sets i equal to 1 in subroutine 35 (FIG. 74) at S661. Here, i is the number allotted for each of developing unit locations DUP(1) to (4). Then, CPU 34 searches for a DUP which allows the image formation of Color (1), based on the stored information in RAM 36 (S662). If DUP (1) is not the wanted one, the CPU increments i(i=i+1) and repeats the check at S662. In this way, CPU 34 locates the position DUP of the developing unit having Color (1).

Then, the image forming begins with uniform charging of photosensitive drum 12 by charger 18 (S664). LSU 11 exposes photosensitive drum 12 at exposure power LDP (1) for a period of exposure time LDT (1), which are the exposure conditions, to thereby form a static latent image (S665). Next, development is carried out with the optimal developing bias DVB which is the modified developing bias DVBP (1) plus developing bias DBV (1), using the developing unit located at the DUP corresponding to Color (1) (S666). Then, the image is transferred to intermediate transfer element 15 with the transfer voltage set at TC(1) (S667).

When the first color component image has been formed, it is checked if j=4 (S532), then j=j+1 at S533 and the operation returns to S661. This sequence, i.e., S531 or subroutine 35 (FIG. 65) is repeated up to the fourth color, Color (4). In this way, development is carried out based on the thus determined image forming conditions. There are twenty-four types of development timing for performing development. FIGS. 58 to 61 show the timing charts. When the developed image of the fourth color is completely laid on intermediate transfer element 15, all the layers of toners are transferred at one time to print paper 20 and then the toner is fixed at fixing temperature TEM (S534). The multiple layers of color toners are formed on print paper 20, from the top to the bottom, in the order opposite to the developing order.

Since specific setup of the image forming conditions in accordance with the locations of developing units 14*a* to 14*d* and the developing color order is the same as that in the third embodiment, the description is omitted.

(The Eighth Embodiment)

The image forming portion of the eighth embodiment has the same configuration as in the fourth embodiment (see FIGS. 44 and 45), so that the detailed description is omitted. In this embodiment, as in the second embodiment, developing units 14*a* to 14*d* are arranged along the photosensitive drum 12 surface, and developing units 14*a* to 14*d* are fixed and will not move. The difference from the second embodiment resides in that the user can freely select the order of colors to be developed. The difference from the seventh embodiment is that print paper 20 is made to directly pass through and between photosensitive drum 12 and intermediate transfer element 15 so that the image is directly transferred from photosensitive drum 12 to print paper 20. Accordingly there is no transfer member 16.

Figure 75:
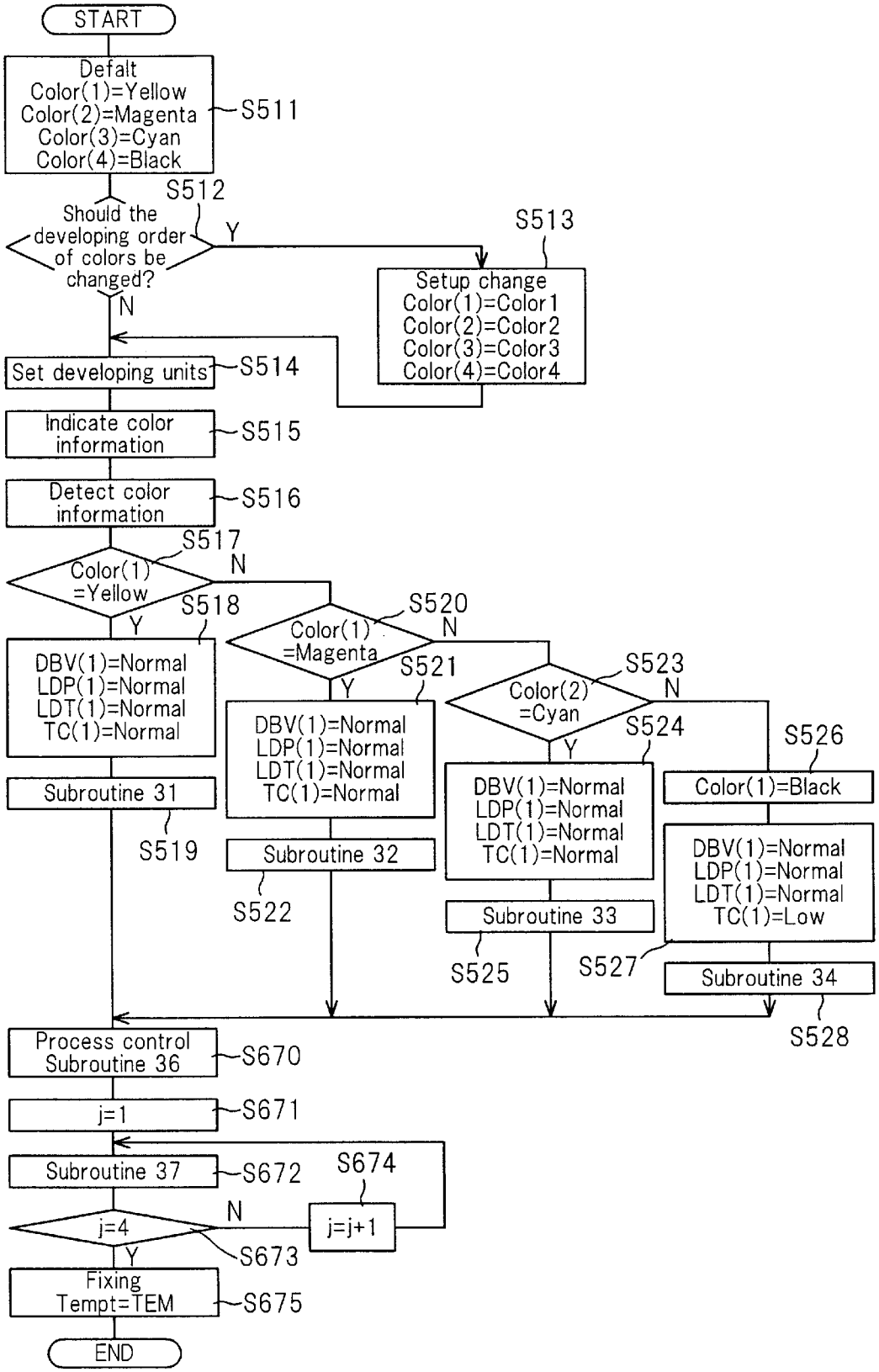
FIG. 75 is a flowchart showing the control steps of the controller of the eighth embodiment.
Figure 76:
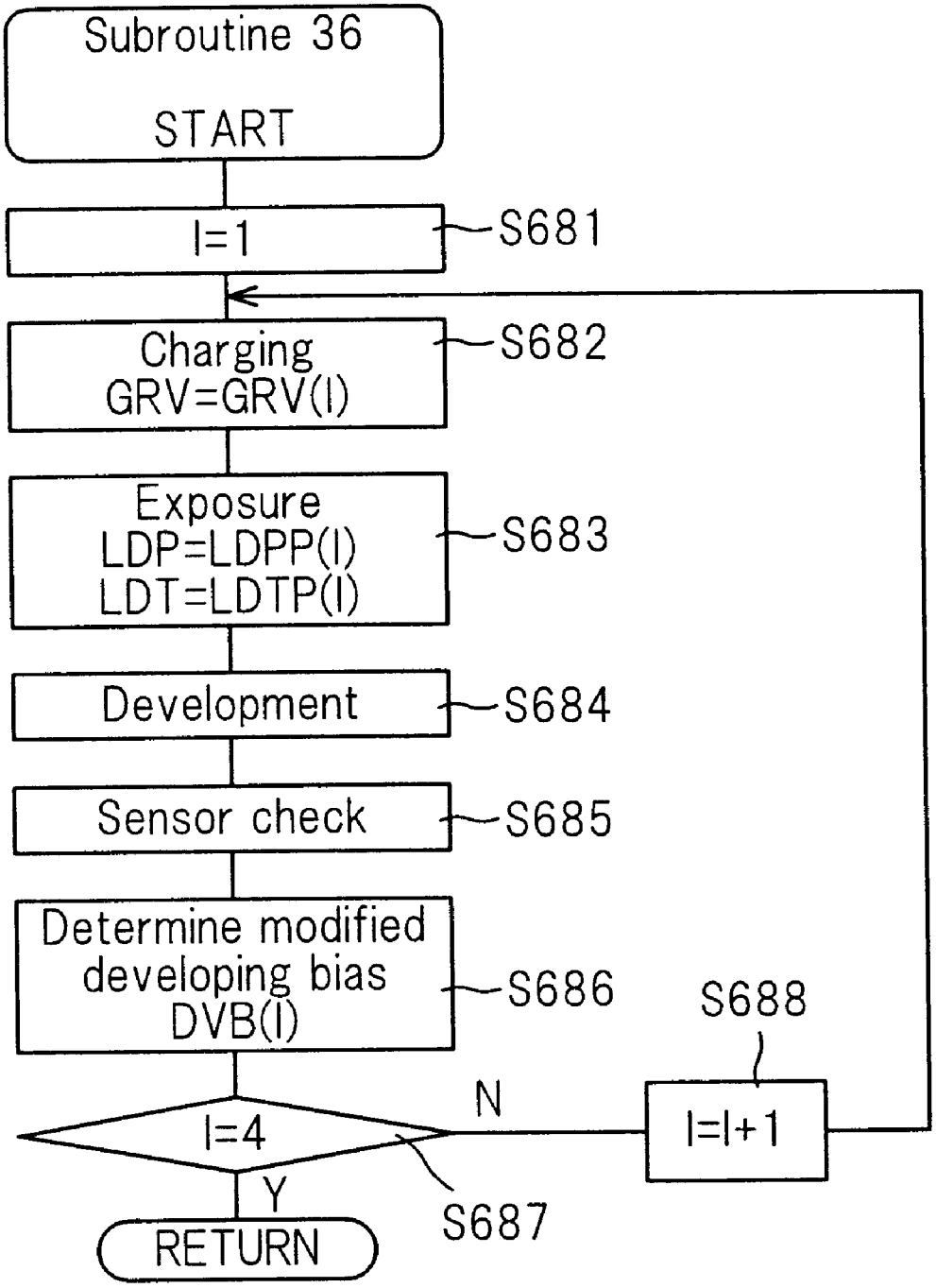
FIG. 76 is a flowchart showing subroutine 36.

FIG. 75 is a flowchart showing the control steps in this image formation. Since this flowchart is basically the same as that of the seventh embodiment shown in FIG. 65, the same parts are allotted with the same numerals without description. The difference from FIG. 65 is the sequence of steps S670 to S675. As shown in FIG. 76, since developing units 14*a* to 14*d* are arranged along photosensitive drum 12, the distance (the angle of arrangement) from charger 18 to the developing station of each color differs from one to the others, subroutine 36 at step S670 in the process control sets up modified image forming conditions, taking the above fact into account and also determines the image forming conditions based on the detected result from process control sensor 19. Subroutine 36 is shown in detail in FIG. 76.

First, the sequential order is set equal to 1 (I=1) at S681, then the image forming conditions of developing unit 14*a* located at DUP(1) are set up. The grid voltage GRV(1) of charger 18 is determined so as to charge photosensitive drum 12 uniformly (S682). Next, modified exposure power LDPP (1) and modified exposure time LDTP(1) of LSU 11 are set again (S683). Development is effected by developing unit 14*a* (S684) under these conditions, then the resulting developed state is checked by process control sensor 19 (S685). Based on the detection result of sensor 19, CPU 34 determines modified developing bias DVBP(1). At S687, it is checked whether I=4. If not, then I=I+1 and the operation returns to S682. In this way, the processing steps S682 to S686 are repeated until I=4, to determine grid voltages GRV(2) to GRV(4) of charger 18, optimal exposure power LDPP(2) to LDPP(4) of LSU11, modified exposure time LDTP(2) to LDTP(4) and modified developing bias voltages DVBP(2) to DVBP(4) of developing units 14*b* to 14*d*.

The image forming conditions in the above subroutine 36 for this arrangement of the developing units are set up in the same manner as in the fourth embodiment, so the description is omitted. Development is performed under the thus set forming conditions. Here, the timing for development is the same as in FIGS. 58 to 61 above.

In this way CPU 34 sets up image forming conditions based on the toner colors of developing units 14*a* to 14*d* and the color order, and temporarily stores the conditions into RAM 36. Then CPU 34 performs the image formation described below, based on the thus setup image forming conditions.

First, j is assumed as the number indicating the sequential order of development, and j is set equal to 1 (j=1) at S671 (FIG. 75). Then, the image forming of the first color is carried out through subroutine 37 (FIG. 64) under the image forming conditions stored in RAM 36.

Figure 77:
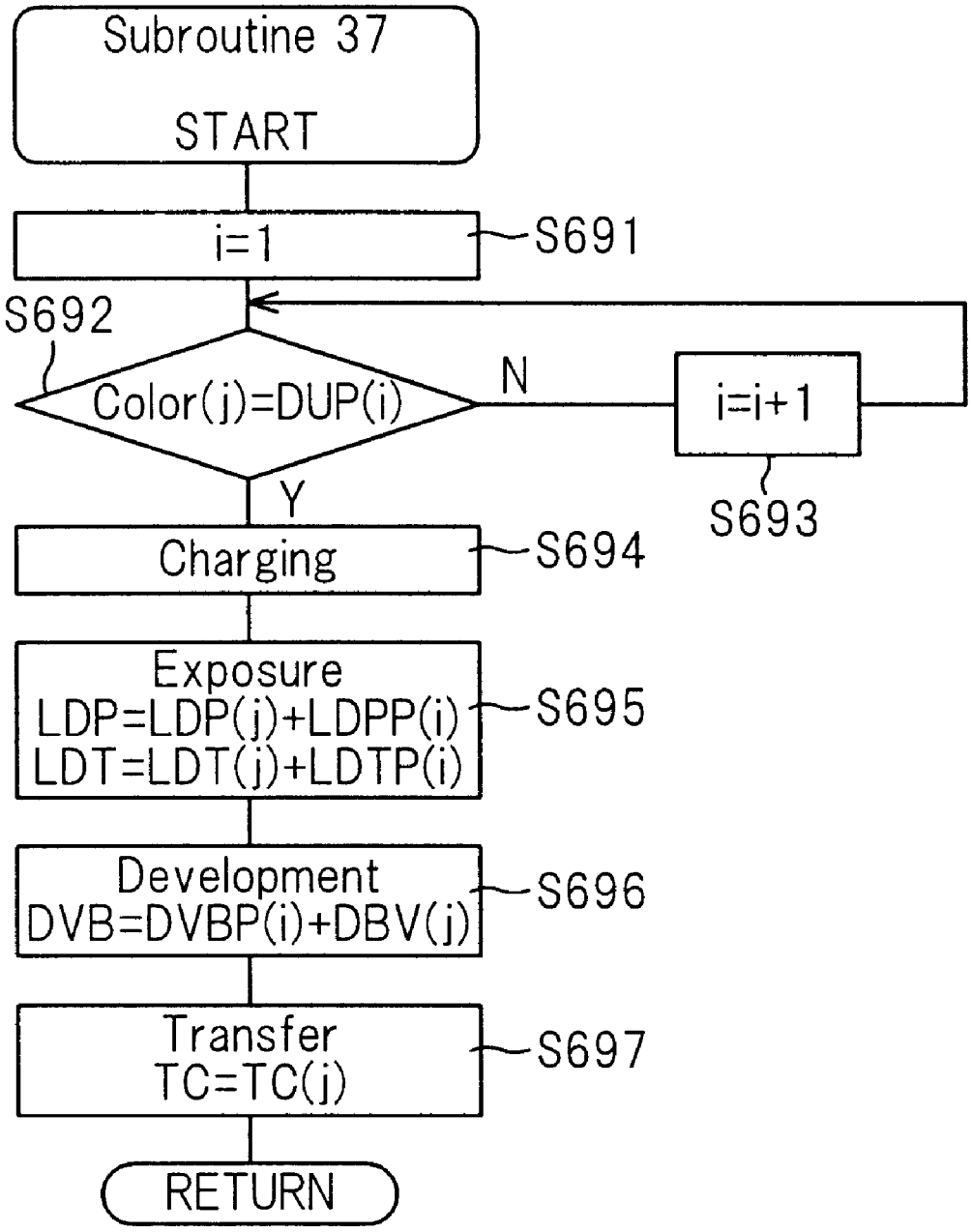
FIG. 77 is a flowchart showing subroutine 37.

As shown in FIG. 77, CPU 34 sets i equal to 1 in subroutine 37 (S691). Here, i is the number allotted for each of developing unit locations DUP(1) to (4). Then, CPU 34 searches for a DUP which allows the image formation of Color (1), based on the stored information in RAM 36 (S692). If DUP (1) is the wanted one, the operation goes to S694. If DUP (1) is not the one, the CPU increments i(i=i+l) at S693 and repeats the check at S692. In this way, CPU 34 locates the position DUP of the developing unit having Color (1).

Then, photosensitive drum 12 is uniformly charged by charger 18 with its grid set at a grid voltage GRV(i) corresponding to the developer's position DUP(i)(S694). LSU 11 exposes photosensitive drum 12 at exposure power LDP for a period of exposure time LDT, forming a static latent image (S695). Here, the exposure conditions, i.e., LDP is the modified exposure power LDPP(i) plus exposure power LDP(1) dependent on the color order and LDT is the modified exposure time LDTP(i) plus exposure time LDT(1) dependent on the color order.

Next, development is carried out with the optimal developing bias DVB which is the modified developing bias DVBP (i) plus developing bias DBV (1) dependent on the color order, using the developing unit located at the DUP(i) corresponding to Color (1) (S696). Then, the image is transferred to intermediate transfer element 15 with the transfer voltage set at TC(1) (S697).

When the first color component image has been formed, it is checked if j=4 (S673(FIG. 75)), then j=j+1 at S674 and the operation returns to S672. This sequence, i.e., S672 or subroutine 37 is repeated up to the fourth color, Color (4). In this way, development is carried out based on the thus determined image forming conditions. There are twenty-four types of development timing for performing development. FIGS. 58 to 61 show the timing charts. When the developed image of the fourth color is completely laid on intermediate transfer element 15, all the layers of toners are transferred at one time to print paper 20 and then the toner is fixed at fixing temperature TEM (S675). The multiple layers of color toners are formed on print paper 20, from the top to the bottom, in the developing order.

Since specific setup of the image forming conditions in accordance with the locations of developing units 14*a* to 114*d* and the developing color order is the same as that in the fourth embodiment, the description is omitted.

(The Ninth Embodiment)

Figure 78:
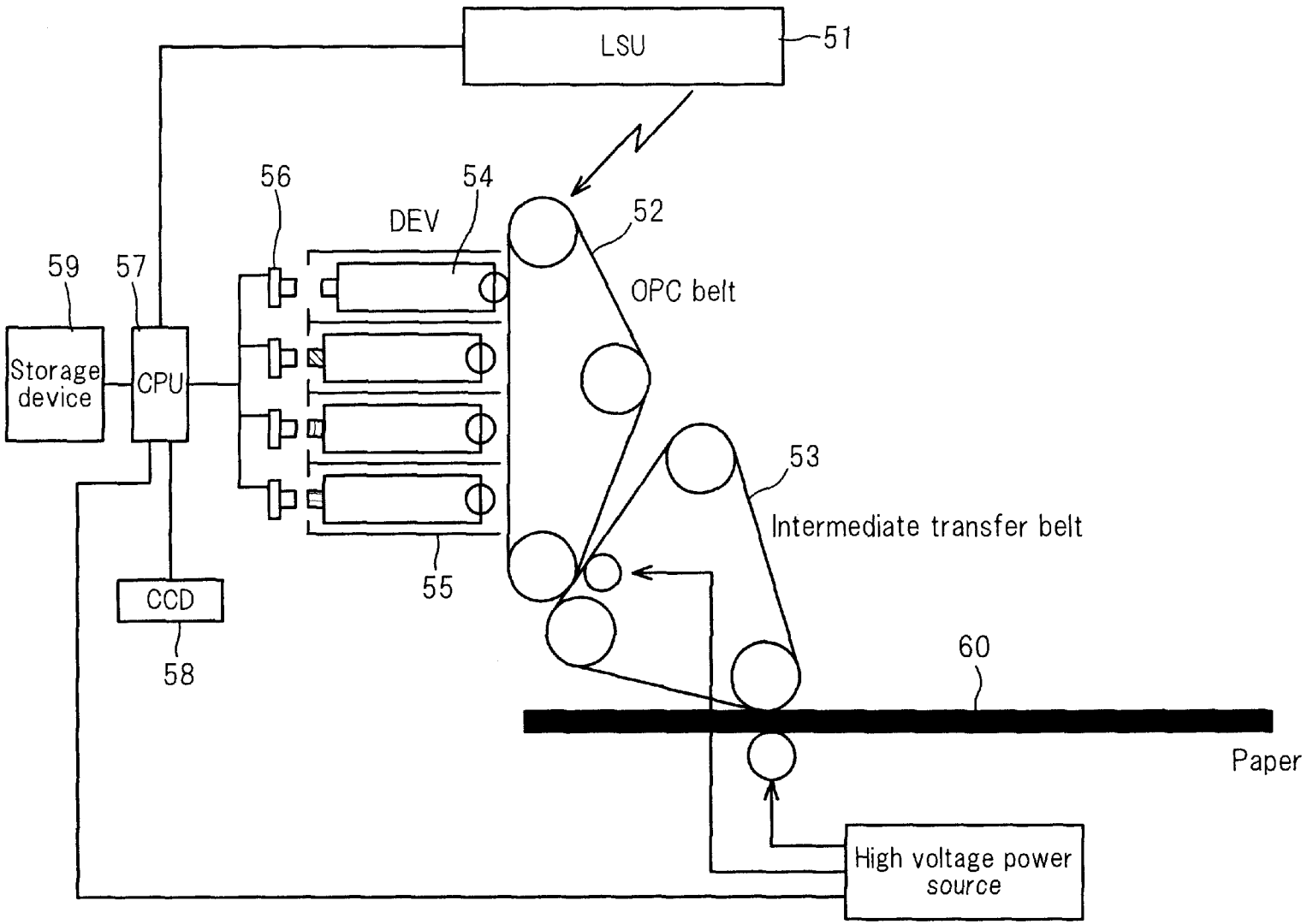
FIG. 78 is an overall schematic view showing the sixth embodiment of the image forming portion in an image forming apparatus according to the present invention.

FIG. 78 is an overall schematic view showing the night embodiment of an image forming apparatus according to the present invention.

This image forming apparatus includes a LSU 51, an OPC (organic photoconductor) belt 52, an intermediate transfer belt 53, four developing units 54, a developing unit holder 55, color information detecting means 56, a CPU 57, a CCD 58 and a storage device 59.

Four developing units 54 store yellow, magenta, cyan and black toners, all are of an identical configuration and accommodated in developing unit holder 55. With this configuration, all the developing units can be attached and removed in the same manner so that replacement of the developing units can be simplified. Each color information detecting means 56 detects the color of the developer held in associated developing unit 54 set in developing unit holder 55. CPU 57 controls its data output so that the image data corresponding to the developer color will be output. Therefore, if the developing units are set in an order different from that in which the developing units were arranged previously, there is no need to re-mount and hence the image forming operation can be started instantly.

Resultantly, the operator's burden can be reduced, which leads to improvement in operativity, safety and other handling performance. Further, since the image forming apparatus can be used as soon as developing units 54 are mounted, the operating efficiency of the apparatus improves. Further, since all developing units 54 have the same configuration, it is possible to reduce the number of parts for developing unit 54 and use the same parts in common, leading to a reasonable design configuration.

The image data read from an original by CCD 58 is temporarily stored into storage device 59 by way of CPU 57. CPU 57, based on the image data, causes LSU 51 to illuminate OPC belt 52. Each developing unit 54 develops its individual color and the developed image is transferred to the intermediate transfer belt. Thus, the four colors of images are developed and transferred to the intermediate transfer belt forming a multi-color image, which in turn is transferred to a sheet of print paper 60 at one time and fixed thereto.

In the above configuration, the color information of the developer stored in each developing unit is automatically read by the apparatus side so as to eliminate the operator's necessity to identify the color of each developing unit. However, it is possible to provide a simple configuration having no color information indicating means and no color information detecting means, in which the operator should input the relationship between colors of developing units 54 and the positions of the image forming portions through the control panel or the like.

By this configuration, the operator's burden during replacement of the developing units can be reduced, and hence hazards and accidents due to erroneous insertion and damage to the parts can be prevented, which leads to improving the apparatus in operativity, handling performance, safety and the like.

Figure 79:
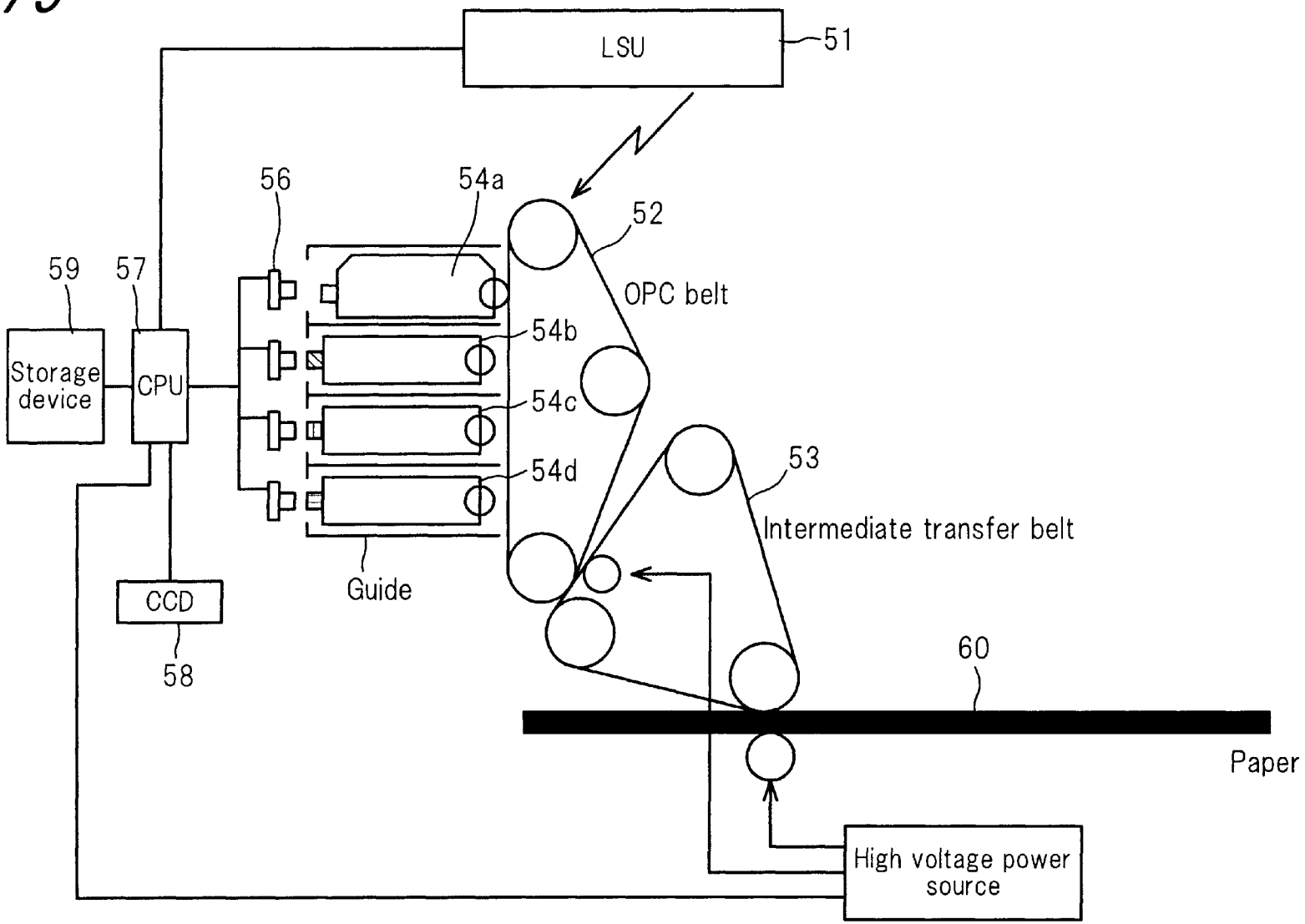
FIG. 79 is an overall schematic view showing a variation of the sixth embodiment.

In the image forming apparatus shown in FIG. 79, among the four developing units holding the developers of yellow, magenta, cyan and black colors, only developing unit 54*a* of black, which consumes the greatest amount of toner, has a different outlook configuration from that of the others. In this way, enlargement of a holder 55 for the black developing unit can reduce the supply frequency of the black developer.

Also in this configuration, when developing units of other three colors are formed with an identical configuration and all the developing units inclusive of black one have an identical configuration of an engaging structure between holder 55 and developing unit 54, the same effects as above can be obtained even if one of the developing units has a different outlook.

Figure 80:
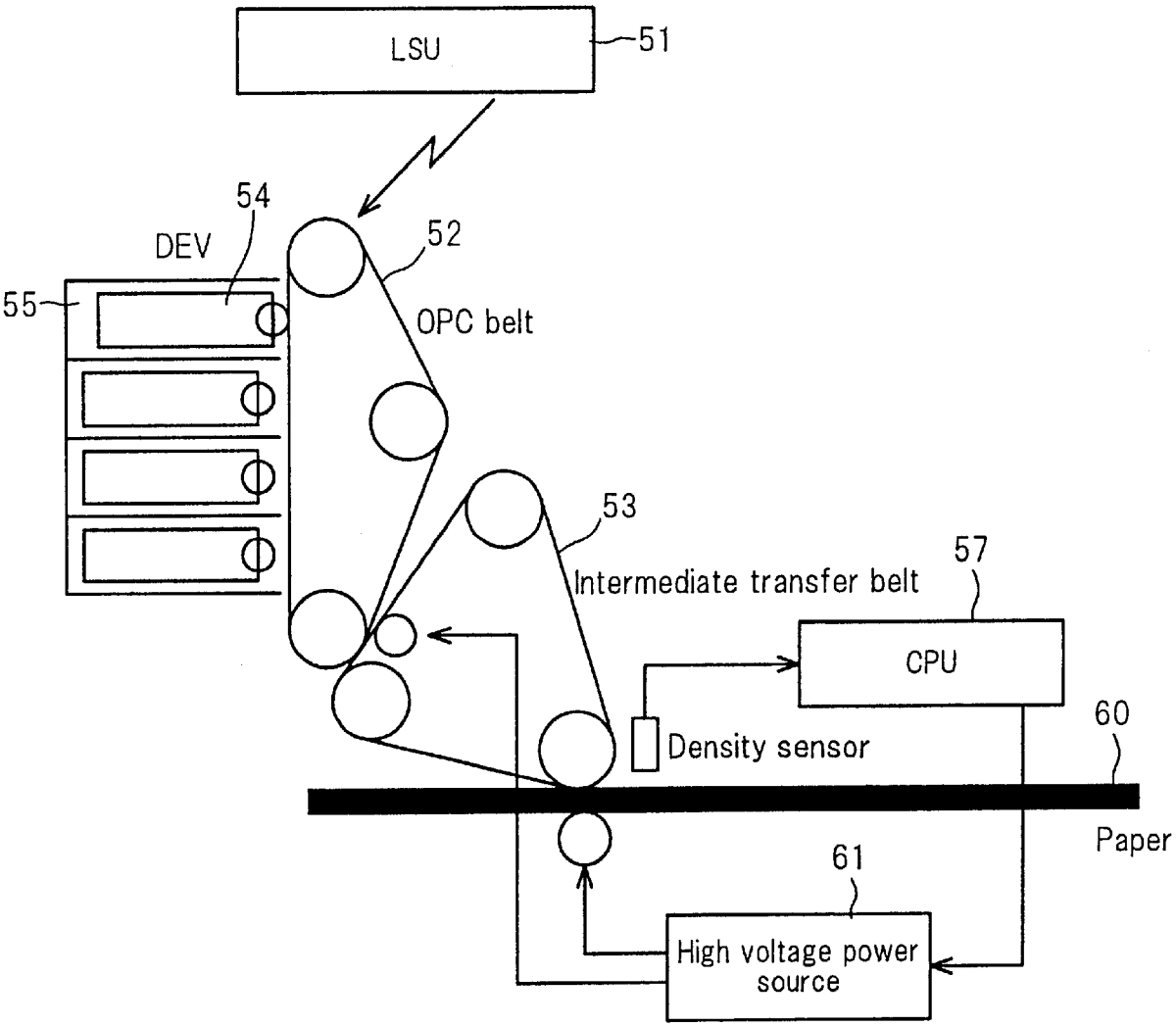
FIG. 80 is an overall schematic view showing another variation of the sixth embodiment.

The image forming apparatus shown in FIG. 80 adopts a different configuration for detecting and confirming color information of developing unit from that in the image forming apparatus in FIGS. 78 and 79.

In this case, when replacement of the developing units is completed, CPU 57 drives the first to fourth developing units 54 so as to form a patch of image of a predetermined shape on the OPC belt (photosensitive support) and read it by a patch image reading means (density sensor) arranged at a predetermined position to thereby detect the color. This reading means is configured of a photosensor, which discriminates the colors based on the difference in the amount of light reflection.

Since this configuration permits elimination of the color information indicating means on the developing unit side, it is possible to reduce the number of components and simply the apparatus configuration. Further, since the patch of image is once transferred to the conveyance and transfer belt etc., it is possible to discriminate the colors of all developing units with a common single sensor. Accordingly, the number of sensors on the apparatus side can be cut down, enabling further reduction of parts in number and further simplification of the apparatus configuration.

The description of the embodiments up to here has been described referring to the apparatus in which a single photosensitive element such as a photosensitive drum or photoconductive belt is used in common by a multiple number of developing units. However, the invention can be applied to an image forming apparatus in which each developing unit has its own photosensitive element. The control means for such an apparatus will be described next.

(The Tenth Embodiment)

Figure 81:
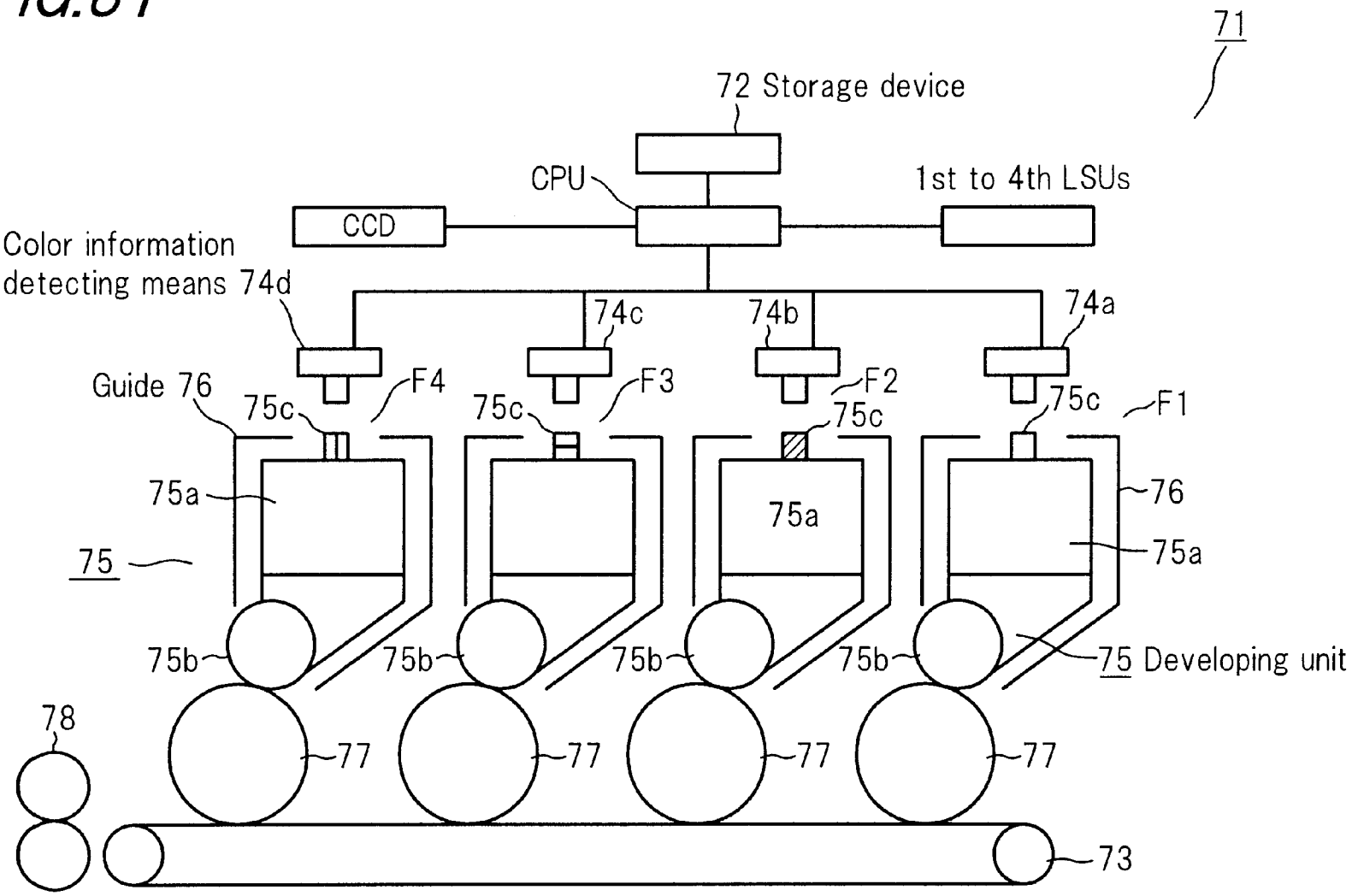
FIG. 81 is an illustrative view sectionally showing the overall configuration of a color image forming apparatus according to the seventh embodiment.
Figure 82:
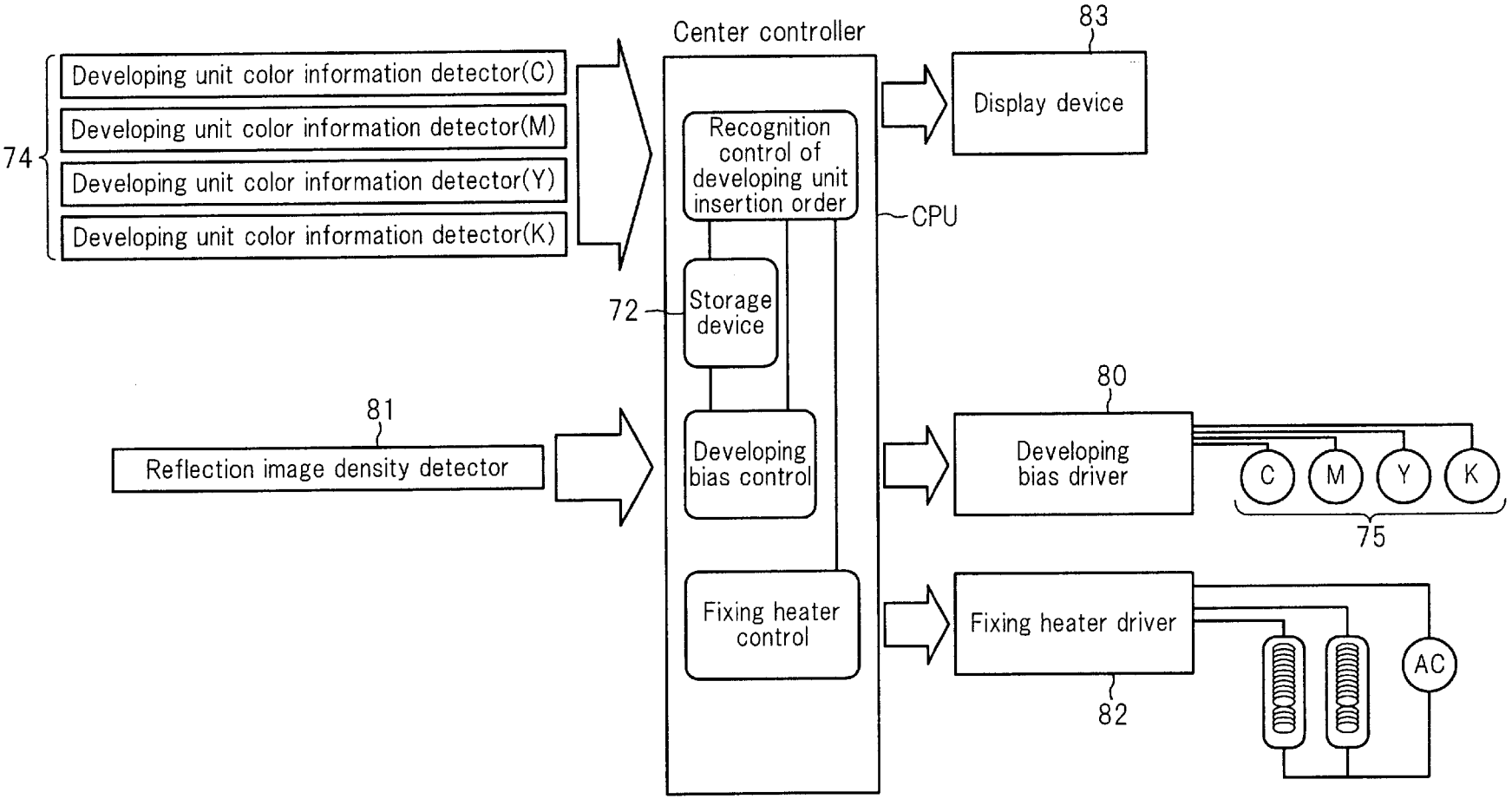
FIG. 82 is a block diagram showing a control system of a color image forming apparatus according to the seventh embodiment.

FIG. 81 is an illustrative view sectionally showing the overall configuration of a color image forming apparatus 71. FIG. 82 is a block diagram showing a control system of the color image forming apparatus.

Color image forming apparatus 71 includes: a central processing unit (CPU) governing the whole apparatus control; an imaging element CCD which photoelectrically converts the data picked up by an unillustrated image reader; first to fourth laser scanner units LSU for individual colors as the exposing means of after mentioned image forming portions; image forming portions F1 to F4 for individual colors; a storage device 72 for storing the information of the developing units in image forming portions F1 to F4; a conveyance belt 73 arranged below image forming portions F1 to F4 for conveying the paper; color information detecting means 74*a* to 74*d* for detecting identification marks 75*c* which give the information of developing units 75 set in image forming portions F1 to F4 and a fixing roller 78 as a heat roller disposed opposing the downstream side of conveyance belt 73.

Each of image forming portions F1 to F4 for individual colors includes a developing unit 75 which holds an associated color of developer and allows itself to be drawn out from apparatus body 71; a guide 76; and a photosensitive drum 77.

All the image forming portions F1 to F4 have the same configuration except those relating the color of the developer (also referred to as toner). In this embodiment, negatively charged toner is used as the developer. However, positively charged toner also may be used.

Developing unit 75 includes: a developing container 75*a* for storing the developer; a developing roller 75*b* arranged in the lower part of developing container 75*a* and bears the developer thereon so as to convey the developer to photosensitive drum 77; an identification mark 75*c* for discrimination of the color of the developer being stored in developing container 75*a*.

Developing container 75*a* holds yellow, magenta, cyan or black developer and supports developing roller 75*b* in its lower part so as to be rotatable.

Developing roller 75*b* is a conductive elastic roller made up of conductive urethane and bears a developer layer thereon and rotates whilst bringing the developing layer into contact with photosensitive drum 77. Developing roller has a developing bias voltage of e.g., −450 V applied via an stainless shaft from an unillustrated bias voltage source.

Identification mark 75*c* as the color information indicating means is formed at a predetermined position of a bar code of color information or a mark directly representing a color. This color information indicating means may be a transparent window for allowing the developer in developing unit 75 to be seen.

Identification mark 75*c* is arranged in the developing unit at a position opposing color information detecting means 74*a* to 74*d* for detecting and identifying the color information so as to be read thereby when developing unit 75 is set into guide 76 and mounted in place.

Color information detecting means 74*a* to 74*d* is a bar code reader for reading bar code information when identification mark 75*c* is of a bar code while it may be a photosensor for identifying the color by the amount of light reflection when the identification mark is of a window for allowing the color of the developer in the developing unit to be seen or of a color mark.

Guide 76 is a holding element which allows developing unit 75 to be inserted or pulled out with respect to apparatus 71.

Therefore, for replacement of a developing unit 75, the operator may and should remove the developing unit 75 of a color in the same fashion and attach the fresh developing unit 75 of a color in the same fashion.

Negatively charged photosensitive drum 77 is formed with a conductive substrate and its surface is charged at a voltage of −550 V, for example. During image forming, photosensitive drum 77 is illuminated by laser scanner unit LSU, so a static latent image in accordance with the image data is formed on the drum surface. This static latent image is developed with the toner of developing roller 75*b* by virtue of the potential difference between developing roller 75*b* and photosensitive drum 77. The thus formed toner image is transferred to the paper which is being conveyed by conveyance and transfer belt 73.

Next, the operation of color image developing unit 1 will be described.

When all developing units 75 are set to associated guides 76, color information detecting means 74*a* to 74*d* detect the color information of identification marks 75*c* as the color information indicating means and output it to the CPU.

The CPU, based on the color information, recognizes the colors of developing units 75 having been mounted in guides 76 of image forming portions F1 to F4 and stores the color information of developing units 75 being mounted in image forming portions F1 to F4 into storage device 72.

When an image forming operation is instructed to start via an unillustrated control means such as a control panel, keyboard or the like, the CPU outputs color components of image data which have been generated by subjecting the image data output from the original reader such as CCD etc., to the predetermined image process through an unillustrated image processor, to the first to fourth laser scanner units LSU of image forming portions F1 to F4 of associated colors.

Each photosensitive drum 77 in the figure is illuminated with the laser beam output from each scanner unit LSU and followed by the developing stage.

In the developing stage, development and transfer is performed from the upstream side with respect to the advancing direction of conveyance and transfer belt 73.

As is understood from the above, the order of insertion of developing units 75 into apparatus body 71 determines the order of transfer and superimposition of the toner layers. That is, the color toner of the developing unit 75 located on the most downstream side in the transfer and superimposition stage adheres to the topmost surface of the paper, which is most affected by heat from the heat roller surface of fixing unit 78. Resultantly, changing the order of insertion of developing units 75, or the order of superimposition of the color toners will cause variations in hue in the resulting color print image.

To deal with this situation, in the present embodiment, the amount of toner adherence of each toner is controlled based on the patterns of arrangement of color developing units 75 in image forming portions F1 to F4.

Figure 83:
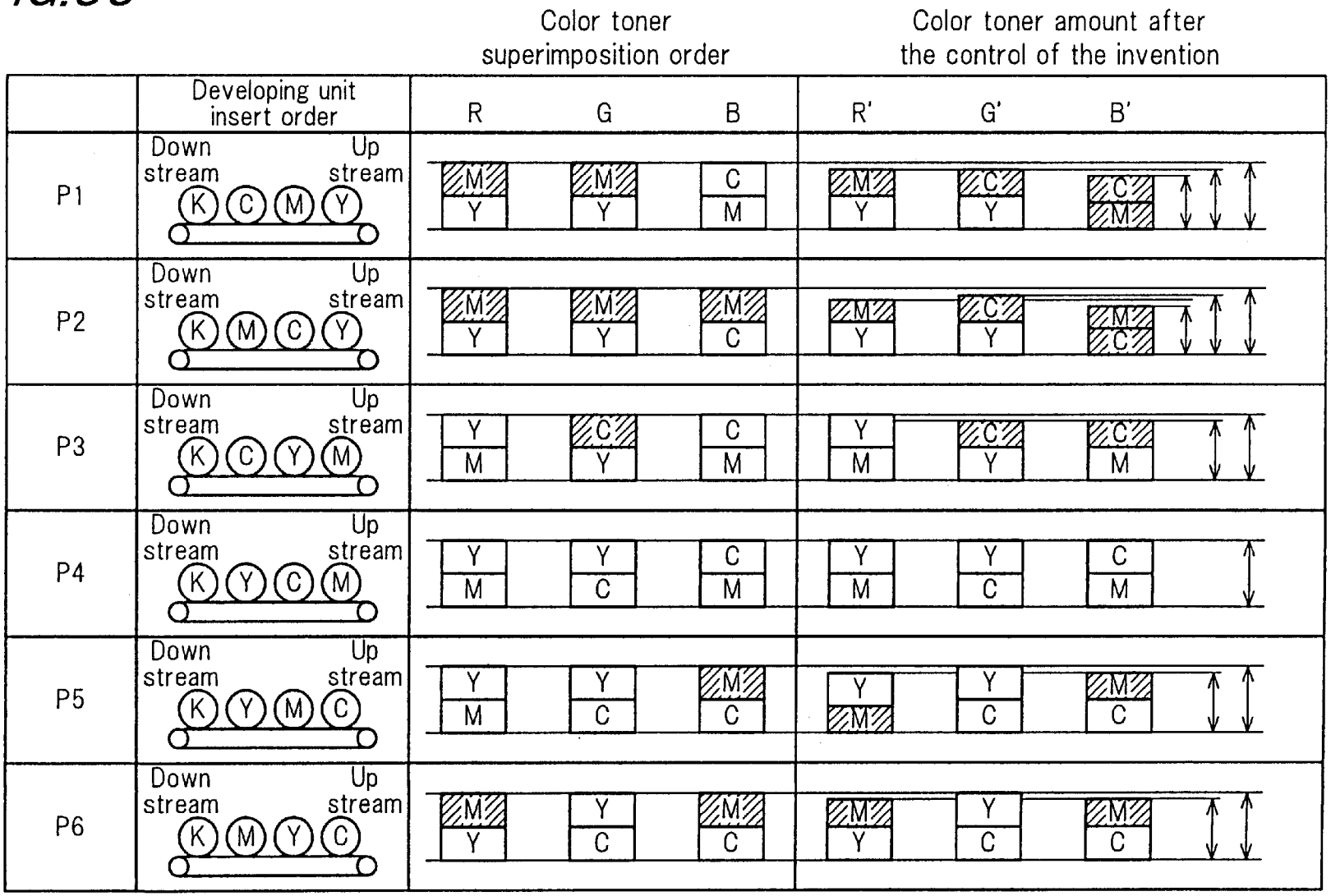
FIG. 83 is an illustrative view showing the orders of superimposition of color toners when red(R), green(G) and blue(B) are reproduced in the cases where individual color developing containers 75*a* according to seventh embodiment are set in different orders P1 to P6 and also showing the amounts of color toners per unit area depending upon the order of arrangement of developing containers 75*a;*
Figure 85A:
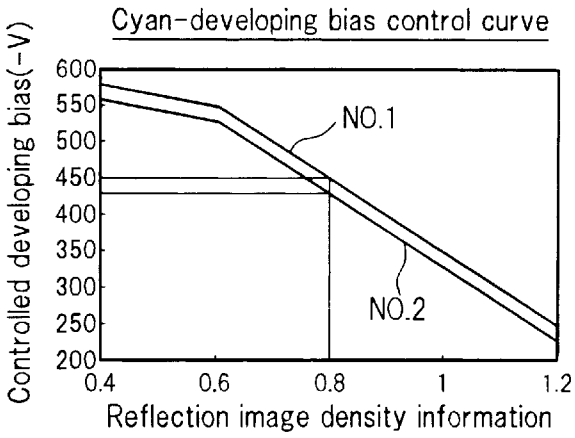
FIG. 85 is an illustrative charts showing developing bias control curves Nos.1 to 3 for each of color developing containers 75*a* to realize the amounts of adherence Nos.1 to 3 shown in FIG. 84, where the axis of abscissa represents the reflected image density value defining the image density and the axis of ordinate represents the controlled developing bias (−V) applied to developing roller 75*b;*
Figure 85B:
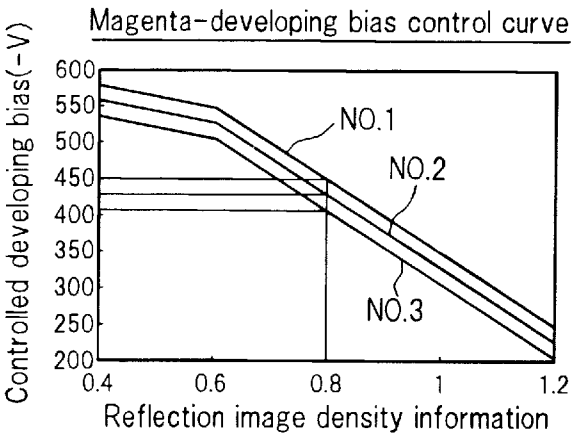
Figure 85C:
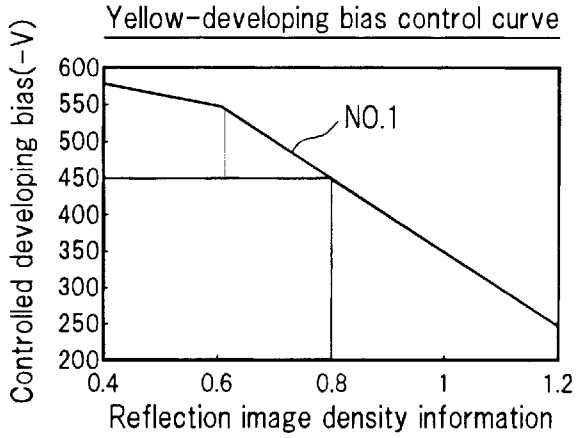
Figure 85D:
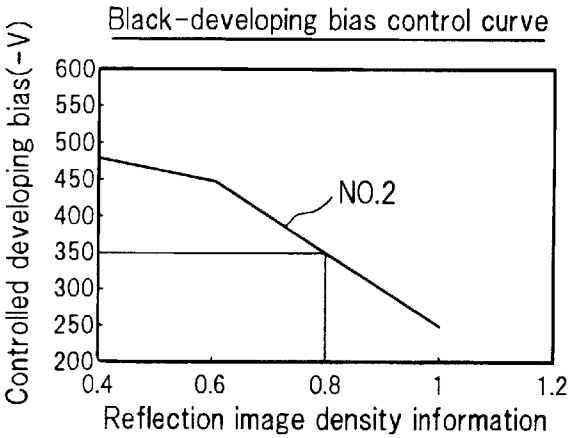

FIG. 83 shows the orders of superimposition of color toners when red(R), green(G) and blue(B) are reproduced in the cases where yellow(Y), magenta(M), cyan(C) and black (B) developing containers 75*a* are set in different orders P1 to P6 and also shows the amounts of superimposed color toners per unit area depending upon the order of arrangement of developing containers 75*a*.

FIG. 84 shows the amounts of superimposed color toners classed into three grades Nos.1 to 3 when yellow(Y), magenta(M), cyan(C) and black(B) developing containers 75*a* are set in different orders P1 to P6. Here, No.1 represents the normal amount of adherence, No.2 represents the second to the least amount of adherence and No.3 represents the least amount of adherence.

FIG. 85 shows charts showing developing bias control curves Nos. 1 to 3 for each of yellow(Y), magenta(M), cyan(C) and black(B) developing containers 75*a* to realize the amounts of adherence Nos.1 to 3 shown in FIG. 84, where the axis of abscissa represents the reflected image density value defining the image density and the axis of ordinate represents the controlled developing bias (−V) applied to developing roller 75*b*. Based on developing bias control curves Nos.1 to 3 in these charts, the developing bias voltage for each case is determined, and the CPU controls a developing bias driver 80(FIG. 82) so as to regulate the developing bias voltages applied to developing rollers 75*b* of colors.

The reflected image density information can be determined by detecting the reflection density of each color toner image, on the associated photosensitive drum 77 surface after development, or on the paper (print medium) surface or conveyance and transfer belt 73 surface after development and transfer.

Figure 86:
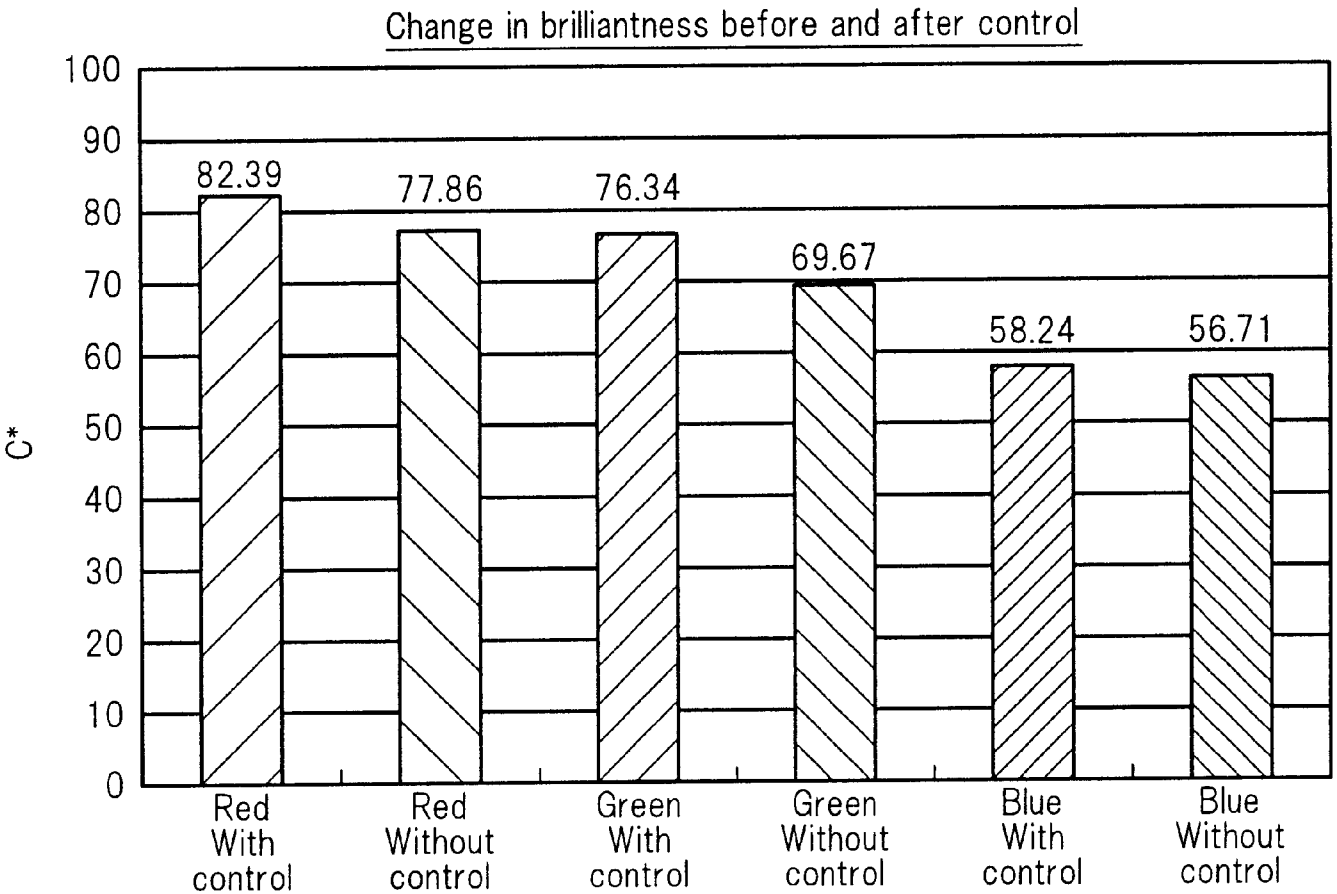
FIG. 86 is an illustrative chart showing the change in brilliantness of individual colors, red(R), green(G) and blue (B) between where each developing bias is not controlled and where it is controlled in association with the mounted orders P1 to P6 of the individual colors of developing containers 75*a* according to seventh embodiment.

FIG. 86 is a chart showing the change in brilliantness of individual colors, red(R), green(G) and blue(B) between where each developing bias is not controlled and where it is controlled in association with the mounted orders P1 to P6 of developing containers 75*a*.

The desired developing bias voltage control curves are selected as shown below. The arrangement of developing units 75 are recognized based on the signals output from developing unit color information detecting means 74*a* to 74*d* shown in FIG. 81 or 74 in FIG. 82. The resultant recognition is stored in storage device 72. The desired developing bias voltage control curves are selected on the basis of the knowledge of the arrangement of developing units 75 stored in storage device 72.

Determination of the developing bias voltages for color toner development is carried out beforehand when the machine is booted. That is, the reflected image density of each color toner image after development or after transfer is detected by a reflection density information detecting means 81(FIG. 82), and based on the reflection density information and the selected control curve as above, the developing bias during development of each color toner is determined.

Developing bias driver 80 performs output control so as to apply the determined developing bias voltages to associated developing units 75 at appropriate processing timings. So, the amounts of adherence of individual toners shown in FIG. 83 are effected, thus making it is possible to provide brilliant color reproducibility as shown in FIG. 86 using existing apparatus body 71 with image forming processes, which are not remarkably modified.

Specifically, when developing containers 75*a* are set in the P1 order or YMCK from the upstream side, the amounts of adherence of magenta(M) and cyan(C) should be set to be fewer than that of yellow(Y). In this case, the amounts of cyan(C) and magenta(M) should be adjusted at grade No.2 while the amounts of yellow(Y) and black(K) should be adjusted at grade NO.1. So, the associated control developing bias voltages are applied to corresponding developing rollers 75*b* under the control of CPU and developing bias driver 80, to thereby effect development of individual colors.

Similarly, when developing containers 75*a* are set in the P2 order or YCMK from the upstream side, the amounts of adherence should be increased in the order of magenta(M), cyan(C) and yellow(Y). In this case, the amount of cyan(C) should be adjusted at grade No.2, the amount of magenta(M) should be adjusted at grade No.3, and the amounts of yellow(Y) and black(K) should be adjusted at grade NO.1. So, the associated control developing bias voltages are applied to corresponding developing rollers 75*b* under the same control, to thereby effect development of individual colors.

Further, when developing containers 75*a* are set in the P3 order or MYCK from the upstream side, the amount of adherence of cyan(C) should be set to be fewer than that of magenta(M) and yellow(Y). In this case, the amount of cyan(C) should be adjusted at grade No.2, the amounts of magenta(M), yellow(Y) and black(K) should be adjusted at grade NO.1. So, the associated control developing bias voltages are applied to corresponding developing rollers 75*b* under the same control, to thereby effect development of individual colors.

When developing containers 75*a* are set in the P4 order or MCYK from the upstream side, the amounts of adherence of magenta(M), cyan(C) and yellow(Y) should be adjusted to be equal to each other. In this case, the amounts of adherence of all the colors should be adjusted at grade No.1. So, the associated control developing bias voltages are applied to corresponding developing rollers 75*b* under the same control, to thereby effect development of individual colors.

Next, when developing containers 75*a* are set in the P5 order or CMYK from the upstream side, the amount of adherence of magenta(M) should be set to be fewer than that of cyan(C) and yellow(Y). In this case, the amount of adherence of magenta(M) should be adjusted at grade No.2 while the amounts of cyan(C), yellow(Y) and black(K) should be adjusted at grade No.1. So, the associated control developing bias voltages are applied to corresponding developing rollers 75*b* under the same control, to thereby effect development of individual colors.

Finally, when developing containers 75*a* are set in the P6 order or CYMK from the upstream side, the amount of adherence of magenta(M) should be set to be fewer than that of cyan(C) and yellow(Y). In this case, the amount of adherence of magenta(M) should be adjusted at grade No.2 while the amounts of cyan(C), yellow(Y) and black(K) should be adjusted at grade No.1. So, the associated control developing bias voltages are applied from developing bias driver 10 to corresponding developing rollers 75*b* under the same control, to thereby effect development of individual colors.

Figure 87A:
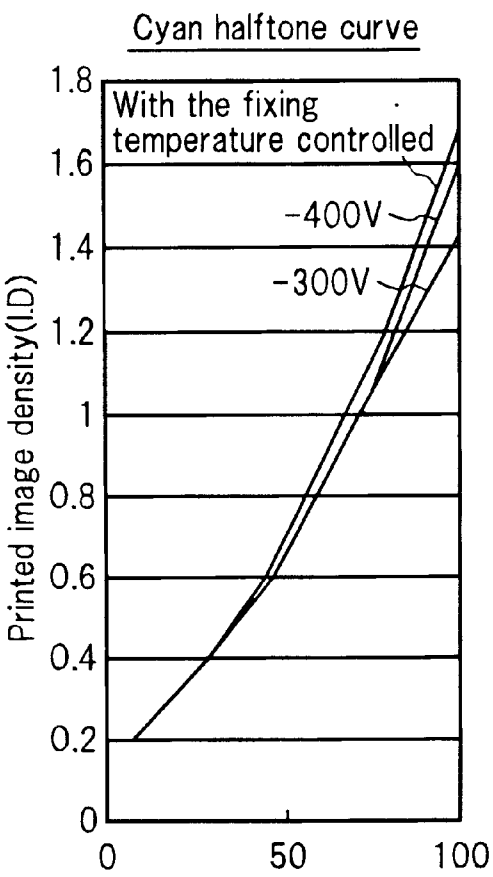
FIG. 87 shows charts presenting reproducible density curves for halftone images of individual colors with the developing bias voltage set at −400 V and −300 V, wherein the axis of abscissa represents image input data and the axis ordinate represents printed image density.
Figure 87B:
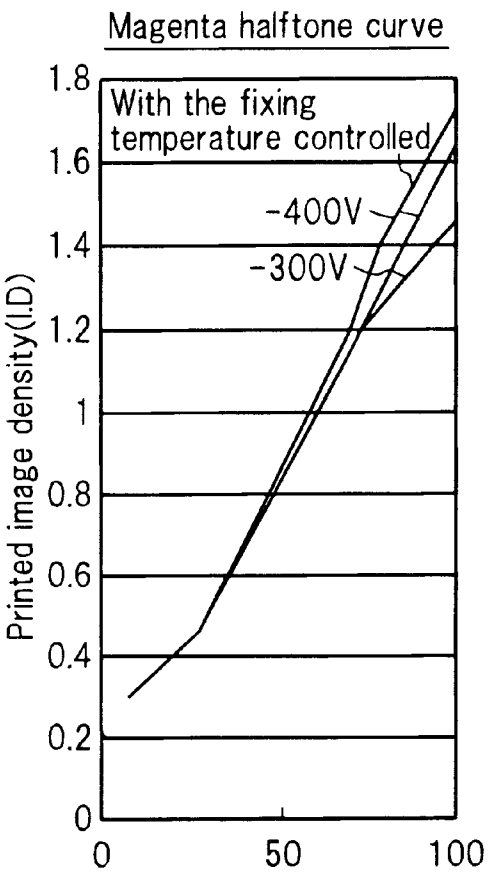
Figure 87C:
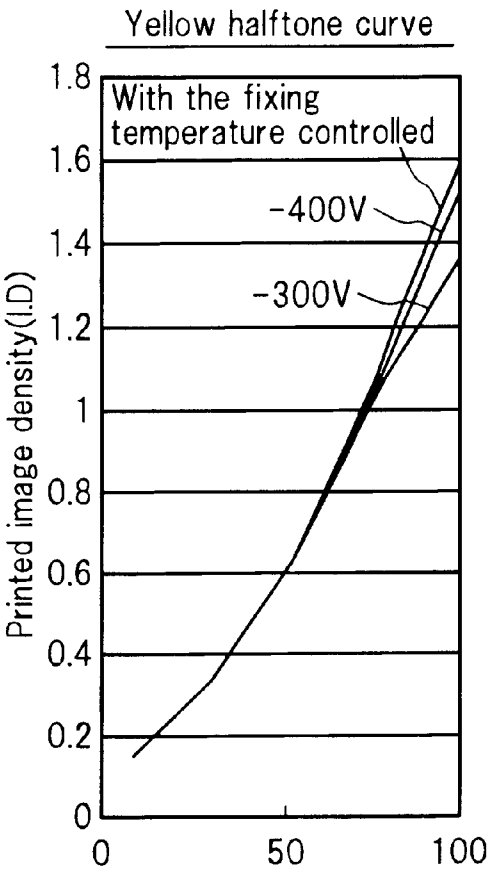

Referring next to FIGS. 82, 87 and 88, another configuration will be described, which can provide better color image quality even if color developing units 75 present insufficient developing functions and if it is difficult to make up for the deficiency by regulating the developing bias voltages to control the amounts of adherence of the color toners appropriately. That is, this configuration provides better color image quality by changing the set temperature of the heat roller of fixing unit 78.

FIG. 87 shows charts presenting reproducible density curves for halftone images of individual colors with the developing bias voltage set at −400 V and −300 V, wherein the axis of abscissa represents image input data and the axis ordinate represents printed image density (I.D).

In a typical dual component developing system, development performance is usually tried to be controlled by regulating the developing bias voltage. However, the developing bias regulation will change only the saturation density as shown in FIG. 87, causing imbalance in reproducing halftones. This causes deviation from the originally intended halftone characteristics, presenting unpreferred color image quality.

This halftone imbalance occurs because the electric field becomes concentrated at the image periphery or edged of a static latent image of dots due to electric field effect therearound, whereby the strong electric field attracts more toner during development.

In contrast, there is no concentration of electric field around the image periphery, in the saturation density range, so that development in proportion to the developing bias voltage will be obtained.

In order to solve the above problem, whilst development performance of the developing units is controlled by regulating the developing bias voltages, the setup temperature of the fixing roller is changed between plural levels, e.g., High and Low levels, dependent on the mounted orders P1 to P6 of developing containers 75*a*, as shown in FIG. 88. Specifically, when the developing containers are mounted in the P4 order, the fixing temperature of the fixing heater driver (designated at 82 in FIG. 82) of fixing unit 78 is set at the Low-level, whereas the fixing temperature of fixing heater driver 82 is set at the High level when the developing containers are mounted in any of the P1, P2, P3, P5 and P6 orders.

As a result, a good color image reproducibility was obtained throughout the entire halftone range, without degradation of the saturation density as seen in FIG. 87.

Since this fixing temperature adjustment is effected only for a particular combination of developer colors as shown in FIG. 88, this configuration will not consume any unnecessary energy. It is also possible to configure a system in which the operator will be recommended to change the arrangement of the developing units into the optimal order by displaying it on a display device 83.

In accordance with the first feature of the present invention, the image forming conditions can be set up in conformity with the developing order of the developing units and the colors of the developers held in the developing units. Therefore, it is possible to provide an image forming apparatus which can reduce the operator's burden during replacement of the developing units and leads to improvement in operativity, handling performance, safety and other performances. Further, since the image forming operation can be started as soon as the replacement is completed, the operating efficiency of the whole apparatus can also be improved.

In accordance with the second feature of the present invention, where each movable developing unit develops the static latent image support at the fixed position, suitable image forming conditions are set up in accordance with the order of color development, designated beforehand. Therefore, the operator etc., can determine the order of color development, and this configuration can also provide uniform stable images even when the developing units are set at arbitrary holding positions.

In accordance with the third feature of the present invention, the developing bias voltage for each color of developer is set to be higher in the order in which the developers are to be transferred later, so that the amount of each developer to be transferred to the recording medium will be equal to the others. Therefore, it is possible to prevent lowering of reproducibility in hue due to reduction of the transfer efficiency of the final color of the multi-color transfer, and hence it is possible to provide uniform stable images even if the developing units are set at arbitrary positions.

In accordance with the fourth feature of the present invention, the exposure power for the developers which are transferred later is set to be higher than that for the developers which are transferred earlier so that the amount of each developer to be transferred to the recording medium will be equal to the others. Therefore, it is possible to prevent lowering of reproducibility in hue due to reduction of the transfer efficiency of the final color of the multi-color transfer, and hence it is possible to provide uniform stable images even if the developing units are set at arbitrary positions.

In accordance with the fifth feature of the present invention, the exposure time for the developers which are transferred later is set to be longer than that for the developers which are transferred earlier so that the amount of each developer to be transferred to the recording medium will be equal to the others. Therefore, it is possible to prevent lowering of reproducibility in hue due to reduction of the transfer efficiency of the final color of the multi-color transfer, and hence it is possible to provide uniform stable images even if the developing units are set at arbitrary positions.

In accordance with the sixth feature of the present invention, since the transfer output voltage for the black developer is set to be lower than that for the chromatic color developers, this control enables black printing, which has a lower optimal transfer voltage than that of the chromatic color toners, to present uniform and stable images, and even if the developing units are arranged arbitrarily, it is possible to provide uniform and stable images.

In accordance with the seventh feature of the present invention, upon fixing, if a low chromatic color developer is located on the recording medium in the upper layer than a high chromatic color developer is, the fixing temperature is set to be higher. This control enhances the chroma and broadens the range of hues.

In accordance with the eighth feature of the present invention, upon fixing, if a low chromatic color developer is located on the recording medium in the upper layer than a high chromatic color developer is, the speed of fixing is set to be lower. This control enhances the chroma and broadens the range of hues.

In accordance with the ninth feature of the present invention, the voltage applied to the charger is varied dependent on each developing unit so that the static latent image support will have a constant surface potential at its developing position. Therefore, even when the position of each developing unit relative to the charger for charging the static latent image support differs from that of the others, time-dependent attenuation of the surface potential on the static latent image support due to discharge can be compensated, thus making it possible to eliminate edge effects, rear end voids, fogging and other deficiencies.

In accordance with the tenth feature of the present invention, the exposure power is varied dependent on the position of each developing unit so that the static latent image support will have a constant surface potential after exposure at its developing position. Therefore, even when the position of each developing unit relative to the exposing device differs from that of the others, time-dependent attenuation of the surf ace potential after exposure on the static latent image support due to influence of the charge-transfer speed in the static latent image support can be compensated, thus making it possible to eliminate density failure, low reproducibility in hue and other deficiencies.

In accordance with the eleventh feature of the present invention, the exposure time is varied dependent on the position of each developing unit so that the static latent image support will have a constant surface potential after exposure at its developing position. Therefore, even when the position of each developing unit relative to the exposing device differs from that of the others, time-dependent attenuation of the surface potential after exposure on the static latent image support due to influence of the charge-transfer speed in the static latent image support can be compensated, thus making it possible to eliminate density failure, low reproducibility in hue and other deficiencies.

In accordance with the twelfth and thirteenth features of the present invention, it is possible to provide an image developing device which can minimize deviation of hues in the final multi-color printed image regardless of the order of arrangement of the developing units.

In accordance with the fourteenth feature of the present invention, it is possible to provide an image developing device which can provide better color image quality even if the color developing units present insufficient developing functions and if it is difficult to make up for the deficiency by regulating the developing bias voltages to control the a mounts of adherence of the color toners appropriately.

In accordance with the fifteenth feature of the present invention, since all the developing units are of an identical configuration, the developer units can be used in common regardless of the developer colors. As a result, it is possible to reduce the number of parts of the developing units and the image forming apparatus and use the same parts in common, leading to a reasonable design configuration.

In accordance with the sixteenth feature of the present invention, all the developing units have an identical engaging structure and the developing unit holding a developer which is consumed most is designed to be larger in size. Therefore, the frequency of supply of the developer which is consumed most can be reduced, thus making it possible to improve the maintenance performance, though the number of parts increases as compared to the configuration where all the developing units are identical.

In accordance with the seventeenth and nineteenth features of the present invention, the color of the developer stored in the developer storage portion of each developing unit is automatically recognized by the color information detection portion, and the controller performs control based on the recognition. Therefore, there is no need for the operator to check the color of each developing unit being mounted when each developing unit is set to the image forming apparatus.

As a result, since there is no need to check the color of each developing unit, the operator's burden can be reduced, and hence the operativity and safety are improved. Also, the image forming apparatus can be used as soon as the developing units are attached, so that the operating efficiency of the apparatus improves.

In accordance with the eighteenth feature of the present invention, a patch image is formed on the static latent image support using the developer held in each developing unit and the color information detecting portion detects the amount of light reflected on the patch image so as to recognize the color of the developer held in each developing unit. Therefore, no color information indicator is needed on the developer side, hence it is possible to reduce the number of parts and simplify the apparatus configuration.

In accordance with the twentieth and twenty-first features of the present invention, it is possible to provide an image developing device which can minimize deviation of hues in the final multi-color printed image, regardless of the order of arrangement of the developing units.

In accordance with the twenty-second feature of the present invention, it is possible to provide an image developing device which can provide better color image quality even if the color developing units present insufficient developing functions and if it is difficult to make up for the deficiency by regulating the developing bias voltages to control the amounts of adherence of the color toners appropriately.

What is claimed is:

1. An image forming apparatus comprising a static latent image support, a charging device for charging the surface of the static latent image support, an exposing device for forming a static latent image on the static latent image support, and a plurality of developing units, each developing the formed static latent image with a developer held therein to produce a visual image, wherein the developed images are transferred and superimposed one over another to a recording medium and fixed thereto, the image forming apparatus further comprising:

a developing unit holding portion having as many holders for accommodating the developing units and allowing the developing units to be detachably attached and set in an arbitrary order; and a controller for regulating the image forming conditions of each developer under which image is formed, depending on the order of development determined by the arrangement in which the developing units are set in the developing unit holding portion and depending on the colors of the developers held in the developing units.

2. The image forming apparatus according to claim 1, wherein the controller arbitrarily sets up the order of development of the plurality of developing units, when the colors of developers are designated.

3. The image forming apparatus according to claim 1 or 2, wherein, upon the control of the image forming conditions by the controller, the developing bias voltage for each color of developer is set to be higher in the order in which the developers are to be located closer to the top surface, so that the amount of each developer per unit area to be transferred to the recording medium will be equal to the others.

4. The image forming apparatus according to claim 1 or 2, wherein, upon the control of the image forming conditions by the controller, the exposure power of the exposing device for each color of developer is set to be higher in the order in which the developers are to be located closer to the top surface, so that the amount of each developer per unit area to be transferred to the recording medium will be equal to the others.

5. The image forming apparatus according to claim 1 or 2, wherein, upon the control of the image forming conditions by the controller, the exposure time of the exposing device for each color of developer is set to be longer in the order in which the developers are to be located closer to the top surface, so that the amount of each developer per unit area to be transferred to the recording medium will be equal to the others.

6. The image forming apparatus according to claim 1 or 2, wherein the controller controls the image forming conditions in such a manner that, when the developed images are transferred from the static latent image support, the transfer output voltage for the black developer is set to be lower than that for the chromatic color developers.

7. The image forming apparatus according to claim 1 or 2, wherein the controller controls the image forming conditions in such a manner that, when, upon fixing, any low chromatic color developer is located in a layer higher than a high chromatic color developer on the recording medium, the fixing temperature is set to be higher.

8. The image forming apparatus according to claim 1 or 2, wherein the controller controls the image forming conditions in such a manner that, when, upon fixing, any low chromatic color developer is located in a layer higher than a high chromatic color developer on the recording medium, the speed of fixing is set to be lower.

9. The image forming apparatus according to claim 1 or 2, wherein the developing units are arranged at fixed positions around the static latent image support, and upon the control of the image forming conditions by the controller, the voltage applied to the charger is varied dependent on each developing unit so that the static latent image support will have a constant surface potential at the developing position of the associated developing unit.

10. The image forming apparatus according to claim 1 or 2, wherein the developing units are arranged at fixed positions around the static latent image support, and upon the control of the image forming conditions by the controller, the exposure power of the exposing device is varied dependent on the position of each developing unit so that the static latent image support will have a constant surface potential after exposure at the developing position of the associated developing unit.

11. The image forming apparatus according to claim 1 or 2, wherein the developing units are arranged at fixed positions around the static latent image support, and upon the control of the image forming conditions by the controller, the exposure time of the exposing device is varied dependent on the position of each developing unit so that the static latent image support will have a constant surface potential after exposure at the developing position of the associated developing unit.

12. The image forming apparatus according to claim 1 or 2, wherein the controller controls the image forming conditions so that the amount of developer per unit area to be supplied for development by each developing unit is controlled to modify dependent upon a predetermined developer amount of the developing unit or a developer amount based on the predetermined rule.

13. The image forming apparatus according to claim 12, wherein the modification control is carried out by controlling the developing bias voltage of each developing unit.

14. The image forming apparatus according to claim 12, further comprising a fixing unit for fixing the multi-color image formed on the recording medium to the recording medium by heating, wherein the fixing temperature of the fixing unit is controlled to modify based on the order of development.

15. The image forming apparatus according to claim 1 or 2, wherein all the developing units are of an identical configuration.

16. The image forming apparatus according to claim 1 or 2, wherein all the developing units are accommodated in, and engaged with, the developer holder, and of all the developing units the developing unit from which a greatest amount of developer is used is designed to be larger in size than the developing units of other developers, but the larger one also has the same engaging structure as that of the others.

17. The image forming apparatus according to claim 1 or 2, further comprising color information detecting portion for detecting color information of the developer colors, wherein the controller determines the colors of the developers held in developing units based on the detected result from the color detecting portion.

18. The image forming apparatus according to claim 17, wherein a patch image is formed on the static latent image support using the developer held in each developing unit and the color information detecting portion detects the amount of light reflected on the patch image so as to recognize the color of the developer held in each developing unit.

19. The image forming apparatus according to claim 1 or 2, wherein each developing units has a color information indicator presenting the color information of the developer held therein; the apparatus main body includes color information detectors for detecting the color information presented by the color information indicators; and the controller determines the colors of the developers held in developing units based on the detected result from the color information detectors.

20. An image forming apparatus comprising:

a plurality of image forming portions provided for different colors, each having a static latent image support, an exposing portion for forming a static latent image on the static latent image support and a developing unit for developing the formed static latent image into a visual image with a developer held therein;

a developing unit holder which permits the plurality of developing units in the image forming portions to be attached and removed with respect to the apparatus main body and also permits each developing unit to be accommodated and arranged into any holding position;

a developing unit arrangement detecting portion for detecting the order of arrangement of the developing units set in the holding positions; and a developer amount controller which controls the amount of developer per unit area to be supplied for development by each developing unit so as to adjust it to the predetermined amount of developer for the associated developing unit or based on the predetermined rule.

21. The image forming apparatus according to claim 20, wherein the developer amount controller comprises a developing bias controller for controlling the developing bias voltage of each developing unit.

22. The image forming apparatus according to claim 20 or 21, further comprising a fixing unit for fixing the developer image formed on the recording medium to the recording medium by heating, wherein the fixing temperature of the fixing unit is modified based on the order of arrangement of the developing units detected by the developer unit arrangement detecting portion.

* * * * *